US012662908B2

(12) United States Patent
Cho et al.

(10) Patent No.: US 12,662,908 B2
(45) Date of Patent: Jun. 23, 2026

(54) MULTILATERAL JUNCTION ASSEMBLY EMPLOYING DEGRADABLE MATERIAL

(71) Applicant: Halliburton Energy Services, Inc., Houston, TX (US)

(72) Inventors: Brian Williams Cho, Spring, TX (US); Jamie Revelle Weber, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/897,872

(22) Filed: Sep. 26, 2024

(65) Prior Publication Data

US 2025/0109661 A1 Apr. 3, 2025

Related U.S. Application Data

(60) Provisional application No. 63/586,002, filed on Dec. 5, 2023, provisional application No. 63/586,018, filed
(Continued)

(51) Int. Cl.
*E21B 41/00* (2006.01)

(52) U.S. Cl.
CPC ..... *E21B 41/0035* (2013.01); *E21B 41/0042* (2013.01); *E21B 2200/05* (2020.05); *E21B 2200/08* (2020.05)

(58) Field of Classification Search
CPC ..... E21B 41/0035; E21B 7/061; E21B 10/26; E21B 17/04; E21B 23/01; E21B 29/02; E21B 33/12; E21B 34/06; E21B 41/0042; E21B 43/162; E21B 2200/05; E21B 2200/08
See application file for complete search history.

(56) References Cited

U.S. PATENT DOCUMENTS 5,720,349 A 2/1998 Pleasants et al.
5,826,651 A 10/1998 Lee et al.
(Continued)

FOREIGN PATENT DOCUMENTS

AU 2019429892 A1 6/2021
BR 112013013148 A2 8/2016
(Continued)

OTHER PUBLICATIONS

WO2025072807-PCT-ISR (Year: 2025).*
(Continued)

*Primary Examiner* — Steven A Macdonald
(74) *Attorney, Agent, or Firm* — Scott Richardson; Parker Justiss, P.C.

(57) ABSTRACT

Provided is a multilateral junction assembly, a well system, and a method. The multilateral junction assembly, in one aspect, includes a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore, and degradable material positioned on a radial surface of the transition sleeve body covering the sidewall opening, the degradable material configured to degrade over time and uncover the sidewall opening.

21 Claims, 97 Drawing Sheets

Related U.S. Application Data on Dec. 5, 2023, provisional application No. 63/586,012, filed on Sep. 28, 2023, provisional application No. 63/586,022, filed on Sep. 28, 2023.

(56) References Cited

U.S. PATENT DOCUMENTS 5,878,818 A * 3/1999 Hebert ..... E21B 7/061 175/81
6,012,526 A 1/2000 Jennings et al.
6,076,602 A 6/2000 Gano et al.
6,145,593 A 11/2000 Hennig
6,419,026 B1 7/2002 MacKenzie et al.
6,752,211 B2 6/2004 Dewey et al.
6,883,611 B2 4/2005 Smith et al.
6,997,272 B2 2/2006 Eppink
7,168,606 B2 1/2007 Badrak
7,207,401 B2 4/2007 Dewey et al.
7,213,652 B2 5/2007 Hepburn et al.
7,225,875 B2 6/2007 Steele et al.
7,240,738 B2 * 7/2007 Pendleton ..... E21B 23/02 166/255.2
7,584,795 B2 9/2009 Hepburn et al.
7,831,133 B2 11/2010 Vinegar et al.
7,984,762 B2 7/2011 Renshaw et al.
8,171,995 B2 5/2012 Renshaw et al.
9,010,416 B2 4/2015 Xu et al.
9,303,485 B2 4/2016 Hecker et al.
9,523,268 B2 12/2016 Potapenko et al.
9,926,766 B2 3/2018 Xu et al.
10,385,654 B2 8/2019 Gibb
10,435,992 B2 10/2019 Carmody et al.
10,619,438 B2 4/2020 Fripp et al.
10,704,328 B2 7/2020 Korf et al.
10,724,319 B2 7/2020 Hulsewe
11,448,042 B1 9/2022 Glaesman et al.
11,634,962 B1 4/2023 Glaesman et al.
12,252,952 B2 3/2025 Least et al.
12,320,226 B2 6/2025 Moses et al.
2002/0050358 A1 5/2002 Algeroy et al.
2002/0079102 A1 * 6/2002 Dewey ..... E21B 43/305 166/50
2003/0070811 A1 * 4/2003 Robison ..... E21B 43/116 166/298
2003/0178196 A1 * 9/2003 Smith ..... E21B 41/0042 166/117.6
2004/0092404 A1 * 5/2004 Murray ..... E21B 29/06 507/100
2004/0168829 A1 9/2004 Hess et al.
2005/0167109 A1 8/2005 Hepburn et al.
2006/0266531 A1 11/2006 Hepburn et al.
2007/0125550 A1 6/2007 Campbell et al.
2007/0277979 A1 12/2007 Todd et al.
2008/0023205 A1 1/2008 Craster et al.
2008/0105438 A1 5/2008 Jordan et al.
2009/0151950 A1 6/2009 Patel
2010/0101786 A1 4/2010 Lovell et al.
2010/0147537 A1 * 6/2010 Docherty ..... E21B 33/1208 166/387
2010/0175895 A1 * 7/2010 Metcalfe ..... E21B 43/08 166/243
2011/0024121 A1 2/2011 Skeates et al.
2011/0036576 A1 2/2011 Schultz et al.
2011/0094742 A1 4/2011 Badalamenti et al.
2012/0175112 A1 7/2012 Atkinson et al.
2013/0020084 A1 1/2013 Goodson
2013/0020088 A1 1/2013 Dyer et al.
2013/0168151 A1 7/2013 Grigor et al.
2014/0238701 A1 8/2014 Rosas et al.
2015/0041154 A1 2/2015 Hallundbaek et al.
2015/0053421 A1 2/2015 Tips
2015/0068756 A1 * 3/2015 Pendleton ..... E21B 41/0035 166/50
2015/0260012 A1 9/2015 Themig
2016/0145956 A1 * 5/2016 Dahl ..... E21B 23/12 166/117.6
2016/0312584 A1 10/2016 Hazel
2016/0326818 A1 * 11/2016 Lajesic ..... E21B 23/01
2016/0341010 A1 * 11/2016 Hepburn ..... E21B 43/14
2016/0341011 A1 * 11/2016 Steele ..... E21B 41/0042
2017/0051574 A1 2/2017 Hughes et al.
2018/0112497 A1 4/2018 Pendleton et al.
2018/0171736 A1 6/2018 Xu et al.
2018/0209232 A1 7/2018 Hulsewe
2018/0274300 A1 9/2018 Vemuri et al.
2018/0328148 A1 11/2018 Glaser
2019/0040719 A1 2/2019 Rodriguez et al.
2019/0234163 A1 8/2019 Glaser et al.
2020/0011134 A1 1/2020 Nevlud et al.
2020/0018135 A1 1/2020 Zeng
2020/0173238 A1 6/2020 Hepburn et al.
2020/0190949 A1 * 6/2020 Hales ..... E21B 43/10
2020/0240235 A1 * 7/2020 Fripp ..... E21B 33/10
2020/0270970 A1 8/2020 Hepburn et al.
2020/0325749 A1 * 10/2020 Fripp ..... E21B 33/10
2020/0362656 A1 11/2020 Fripp et al.
2021/0017835 A1 1/2021 Pelto et al.
2021/0040810 A1 * 2/2021 Evers ..... E21B 43/123
2021/0054708 A1 2/2021 Al-Mousa et al.
2021/0123310 A1 4/2021 Fripp et al.
2021/0140276 A1 * 5/2021 Steele, Jr. ..... E21B 17/0283
2021/0156227 A1 5/2021 Al-Quwaisim et al.
2021/0189817 A1 6/2021 Fripp et al.
2021/0222509 A1 7/2021 Fripp et al.
2021/0277747 A1 9/2021 Al Naimi et al.
2021/0317705 A1 10/2021 Gregurek et al.
2021/0332659 A1 10/2021 Fripp et al.
2021/0332673 A1 10/2021 Fripp et al.
2021/0348478 A1 11/2021 Novelen et al.
2021/0355787 A1 11/2021 Fripp et al.
2022/0003067 A1 1/2022 Glaesman
2022/0074276 A1 3/2022 Webber et al.
2022/0173543 A1 6/2022 Steele et al.
2022/0178211 A1 6/2022 Steele et al.
2022/0186562 A1 6/2022 Stokes
2022/0186575 A1 6/2022 Fripp et al.
2022/0186579 A1 6/2022 Pelto et al.
2022/0205341 A1 6/2022 Asthana et al.
2022/0282590 A1 9/2022 Fripp et al.
2022/0389795 A1 12/2022 Steele
2023/0265718 A1 8/2023 Lajesic
2023/0265719 A1 8/2023 Lajesic
2024/0360737 A1 10/2024 Least et al.
2024/0392646 A1 11/2024 Gutterres

FOREIGN PATENT DOCUMENTS

CA 2425058 A1 10/2003
CA 3057621 A1 9/2018
CA 3119178 8/2020
CN 103104213 A 5/2013
CN 104895559 A 9/2015
CN 204782914 U 11/2015
CN 103883291 B 3/2016
CN 105443061 A 3/2016
CN 205297420 U 6/2016
CN 105971556 A 9/2016
CN 106121644 A 11/2016
CN 206129175 U 4/2017
CN 107313749 A 11/2017
CN 206668213 U 11/2017
CN 107939332 A 4/2018
CN 108645296 A 10/2018
CN 20829448 U 12/2018
CN 110043190 A 7/2019
CN 209586349 U 11/2019
DE 102010025256 A1 2/2014
GB 2593614 B 7/2022
KR 20160093580 A 8/2016
NO 20210729 A1 6/2021
RU 2012138282 A 3/2014
RU 2608454 C1 1/2017
RU 2610452 C2 2/2017

(56) References Cited

FOREIGN PATENT DOCUMENTS

| | | | |
|---|---|---|---|
| RU | 2638667 | C2 | 12/2017 |
| RU | 178974 | U1 | 4/2018 |
| WO | 0026501 | A1 | 5/2000 |
| WO | 2015069463 | A1 | 5/2015 |
| WO | 2016195720 | A1 | 12/2016 |
| WO | 2018140143 | A1 | 8/2018 |
| WO | 2022115629 | A1 | 6/2022 |
| WO | 2022146419 | A1 | 7/2022 |
| WO | 2022146425 | A1 | 7/2022 |
| WO | 2022191825 | A1 | 9/2022 |
| WO | 2022231579 | A1 | 11/2022 |
| WO | 2023158518 | A1 | 8/2023 |

OTHER PUBLICATIONS

WO2025072807-PCT-WO (Year: 2025).*
Bruton, G., et al., "Whipstock Options for Sidetracking," Oilfield Review, No. 1, Spring 2014, 10 pages.

* cited by examiner

400

500

MULTILATERAL JUNCTION ASSEMBLY EMPLOYING DEGRADABLE MATERIAL

CROSS-REFERENCE TO RELATED APPLICATION

This application claims the benefit of U.S. Provisional Application Ser. No. 63/586,002, filed on Dec. 5, 2023, entitled "MULTILATERAL JUNCTION CONSTRUCTION USING EXPANDING METALLIC ALLOY," U.S. Provisional Application Ser. No. 63/586,012, filed on Sep. 28, 2023, entitled "V1 INTELLIGENT MULTILATERAL WELL CONSTRUCTION USING EXPANDING METALLIC ALLOY," U.S. Provisional Application Ser. No. 63/586,018, filed on Dec. 5, 2023, entitled "V2 INTELLIGENT MULTILATERAL USING EXPANDING METALLIC ALLOY," and U.S. Provisional Application Ser. No. 63/586,022, filed on Sep. 28, 2023, entitled "TELESCOPING LEAD MILL," all of which are commonly assigned with this application and incorporated herein by reference in their entirety.

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which.

Figure 1:
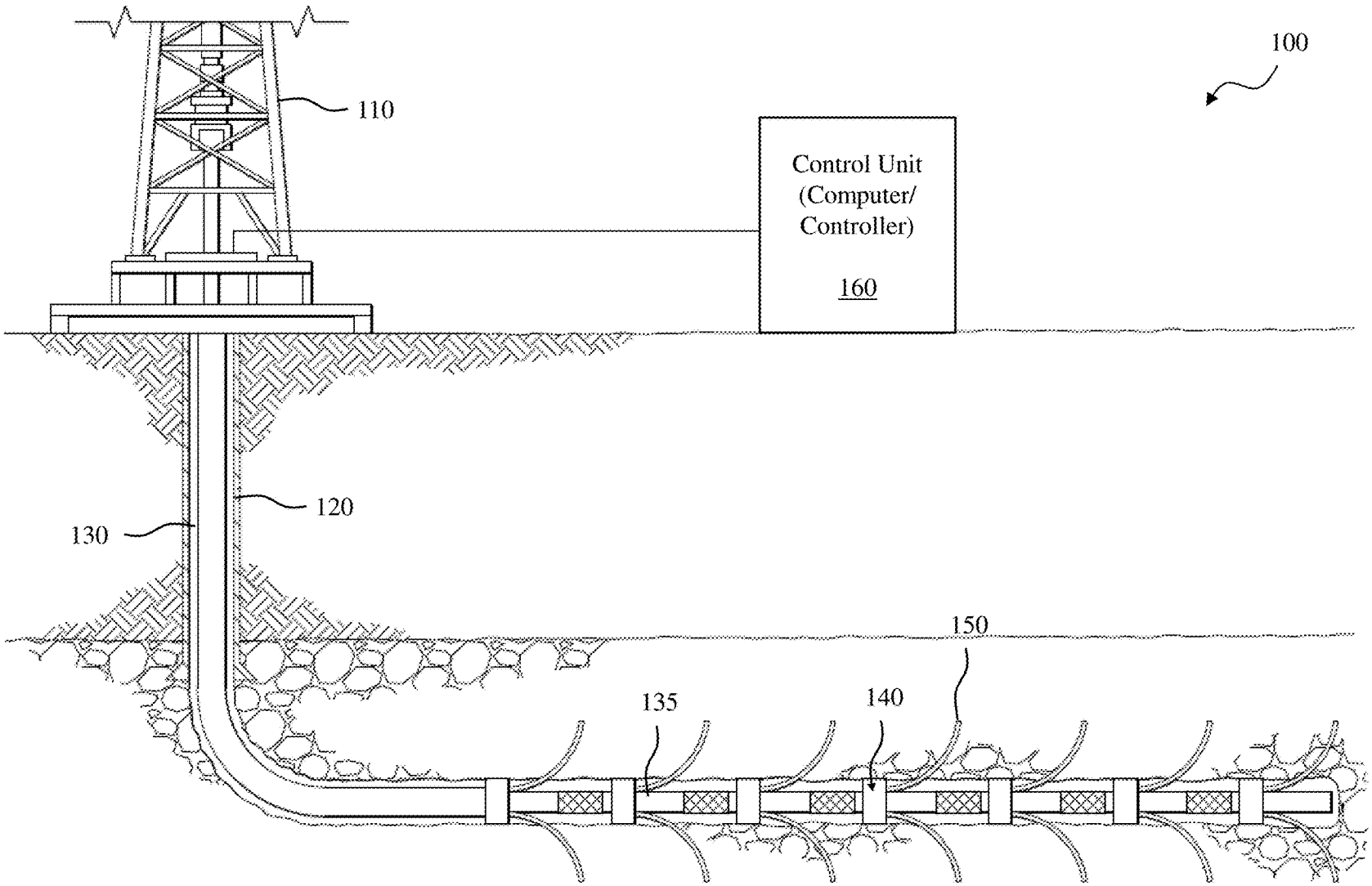
FIG. 1 illustrates a multilateral well system designed, manufactured, and operated according to one or more embodiments of the disclosure, and including an expandable metal and/or degradable material designed, manufactured and or operated according to one or more embodiments of the disclosure.

FIGS. 34 through 51 illustrate a method for forming a well system at various different stages of manufacture, the well system employing one or more of the features disclosed above with respect to FIGS. 2 through 16F; and FIGS. 52 through 71 illustrate a method for forming a well system at various different stages of manufacture, the well system employing one or more of the features disclosed above with respect to FIGS. 2 through 16F.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Various values and/or ranges may be explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The present disclosure, for the first time, has recognized that expandable materials (e.g., expandable metals (EM) and/or swellable elastomers) and/or degradable materials (DM) may be used alone or in combination with one another to design, manufacture and/or operate a multilateral wellbore and the devices and/or features used therewith.

The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or housing diameter due to variations in temperature and/or pressure. Nevertheless, other embodiments may exist wherein no residual unreacted metal exists in the expanded metal. In at least one embodiment, the residual unreacted metal exists when the expandable metal has expanded into contact with another feature, such as another wellbore tubular, prior to all of the expandable metal reacting into expanded metal. In at least one other embodiment, the residual unreacted metal exists when the expandable metal has expanded to fill a volume, such as a volume within a wellbore, prior to all of the expandable metal reacting into expanded metal. Once the expanded metal has sealed against a surface or filled the volume, the reactive fluid may no longer reach the expandable metal, and the hydrolysis essentially ends, in some instances leaving the residual unreacted metal.

The expandable metal, in some embodiments, may be described as expanding to a cement like material, and thereby forming the required seal. In other words, the expandable metal goes from metal to micron-scale particles and then these larger micron-scale particles lock together to, in essence, seal two or more surfaces together. The reaction may, in certain embodiments, occur in less than 2 days in a reactive fluid and in certain temperatures. Nevertheless, the time of reaction may vary depending on the reactive fluid, the expandable metal used, the downhole temperature, the surface-area-to-volume ratio (SA:V) of the expandable metal, etc.

In some embodiments, the reactive fluid may be a brine solution such as may be produced during well completion activities, and in other embodiments, the reactive fluid may be one of the additional solutions discussed herein (e.g., water-based mud). The expandable metal is electrically conductive in certain embodiments. The expandable metal, in certain embodiments, has a yield strength greater than about 8,000 psi, e.g., 8,000 psi+/−50%. The expandable metal, in at least one embodiment, has a minimum dimension greater than about 1.25 mm (e.g., approximately 0.05 inches).

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

It should be noted that the starting expandable metal, unless otherwise indicated, is not a metal oxide (e.g., an insulator). In contrast, the starting expandable metal has, in certain embodiments, the properties of traditional metals: 1) highly conductive to both electricity and heat (e.g., greater than 1,000,000 siemens per meter); 2) contains a metallic bond (e.g., the outermost electron shell of each of the metal atoms overlaps with a large number of neighboring atoms), and as a consequence, the valence electrons are allowed to move from one atom to another and are not associated with any specific pair of atoms, which gives metals their conductive nature; 3) malleable and ductile, for example deforming under stress without cleaving; and 4) tends to be shiny and lustrous with high density. In contrast, metal oxides are ceramics, and are dull, insulating, fragile, brittle and are not conductive metals.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al + 3H_2O \rightarrow Al(OH)_3 + 3/2H_2.$$

$$Al + 2H_2O \text{ -> } AlO(OH) + 3/2H_2$$

$$Al + 3/2H_2O \text{ -> } 1/2Al_2O_3 + 3/2H_2$$

Magnesium hydroxide is considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

It is to be understood, that the chosen expandable metal is to be selected such that the expanded metal does not degrade into the brine. As such, the use of metals or metal alloys for the expandable metal that form relatively water-insoluble hydration products may be chosen. For example, magnesium hydroxide and calcium hydroxide have low solubility in water. Alternatively, or in addition to, the sealing element may be positioned such that degradation into the brine is constrained due to the geometry of the area in which the expandable metal is disposed and thus resulting in reduced exposure of the expandable metal and/or expanded metal. For example, the volume of the area in which the expandable metal is disposed may be less than the expansion volume of the expandable metal. In some examples, the volume of the area is less than as much as 50% of the expansion volume. Alternatively, the volume of the area in which the expandable metal may be disposed may be less than 90% of the expansion volume, less than 80% of the expansion volume, less than 70% of the expansion volume, or less than 60% of the expansion volume.

In at least one embodiment, the expandable metal is a non-graphene based expandable metal. By non-graphene based material, it is meant that is does not contain graphene, graphite, graphene oxide, graphite oxide, graphite intercalation, or in certain embodiments, compounds and their derivatized forms to include a function group, e.g., including carboxy, epoxy, ether, ketone, amine, hydroxy, alkoxy, alkyl, aryl, aralkyl, alkaryl, lactone, functionalized polymeric or oligomeric groups, or a combination comprising at least one of the forgoing functional groups. In at least one other embodiment, the expandable metal does not include a matrix material or an exfoliatable graphene-based material. By not being exfoliatable, it means that the expandable metal is not able to undergo an exfoliation process. Exfoliation as used herein refers to the creation of individual sheets, planes, layers, laminae, etc. (generally, "layers") of a graphene-based material; the delamination of the layers; or the enlargement of a planar gap between adjacent ones of the layers, which in at least one embodiment the expandable metal is not capable of.

In yet another embodiment, the expandable metal does not include graphite intercalation compounds, wherein the graphite intercalation compounds include intercalating agents such as, for example, an acid, metal, binary alloy of an alkali metal with mercury or thallium, binary compound of an alkali metal with a Group V element (e.g., P, As, Sb, and Bi), metal chalcogenide (including metal oxides such as, for example, chromium trioxide, $PbO_2$, $MnO_2$, metal sulfides, and metal selenides), metal peroxide, metal hyperoxide, metal hydride, metal hydroxide, metals coordinated by nitrogenous compounds, aromatic hydrocarbons (benzene, toluene), aliphatic hydrocarbons (methane, ethane, ethylene, acetylene, n-hexane) and their oxygen derivatives, halogen, fluoride, metal halide, nitrogenous compound, inorganic compound (e.g., trithiazyl trichloride, thionyl chloride), organometallic compound, oxidizing compound (e.g., peroxide, permanganate ion, chlorite ion, chlorate ion, perchlorate ion, hypochlorite ion, $As_2O_5$, $N_2O_5$, $CH_{3D}lO_4$, $(NH_4)_2S_2O_8$, chromate ion, dichromate ion), solvent, or a combination comprising at least one of the foregoing. Thus, in at least one embodiment, the expandable metal is a structural solid expanded metal, which means that it is a metal that does not exfoliate and it does not intercalate. In yet another embodiment, the expandable metal does not swell by sorption.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate. Based upon the present disclosure, those skilled in the art would understand the ratios that might be necessary of the expandable metal to the alloy.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. Alternatively, the starting expandable metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expandable metal is formed in a serpentinite reaction, a hydration and metamorphic reaction. In one variation, the resultant material resembles a mafic material. Additional ions can be added to the reaction, including silicate, sulfate, aluminate, and phosphate. The expandable metal can be alloyed to increase the reactivity or to control the formation of oxides.

The expandable metal can be configured in many different fashions, as long as an adequate volume of material is available for achieving the necessary seal and/or anchor. For example, the expandable metal may be formed into a single long member, multiple short members, rings, among others. In another embodiment, the expandable metal may be formed into a long wire of expandable metal, which can in turn be wound around a housing as a sleeve, or placed within a seal groove (e.g., thereby forming a continuous wire of expandable metal). The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent, but held in place using one or more different techniques, including an enclosure (e.g., an enclosure that could be crushed to expose the individual separate chunks to the reactive fluid), a cage, etc.

Additionally, a delay coating or protective layer may be applied to one or more portions of the expandable metal to delay the expanding reactions. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. The delay coating or protective layer may be applied to any of the different expandable metal configurations disclosed above.

The term degradable material is intended to encompass all materials that degrade over time to otherwise go away or release one element from another element. Those skilled in the art understand the myriads of different materials that could function as the degradable material. In at least one embodiment, the degradable material is a polymer based degradable material. Polymer-based biodegradable materials employ synthetic polymers such as Polyglycolic Acid (PGA), Poly(lactic-co-glycolic acid) (PLGA), and Polyvinyl Alcohol (PVA). These materials offer excellent mechanical strength, chemical resistance, and controlled degradation characteristics. PGA degradable materials are known for their high strength and rapid degradation, making them suitable for short-term isolation requirements. PLGA biodegradable materials strike a balance between strength and degradation rate, allowing for customized performance. PVA dissolvable biodegradable materials possess high dissolvability in water-based fluids and are often used in low-temperature applications.

In yet another embodiment, composite degradable materials are used. Composite degradable materials combine different materials to harness their collective advantages. Fiber-reinforced composites, such as carbon fiber-reinforced polymers (CFRP), offer exceptional strength-to-weight ratios and resistance to chemical degradation. These degradable materials are highly customizable and can be tailored for specific wellbore conditions. Ceramic matrix composites (CMC) provide excellent resistance to thermal and chemical stresses, making them suitable for extreme environments. CMC degradable materials exhibit controlled dissolution properties, ensuring effective isolation during fracturing operations.

In yet another embodiment, metallic degradable materials may be used. Metallic degradable materials are constructed using metals such as magnesium alloys, zinc alloys, and iron-based materials. These degradable materials offer robust mechanical properties and high resistance to wellbore conditions. Magnesium alloy degradable materials excel in high-temperature environments, as they exhibit excellent corrosion resistance and controlled dissolution rates. Zinc alloy degradable materials provide reliable dissolvability and are often favored for their cost-effectiveness. Iron-based degradable materials offer superior mechanical strength and can withstand harsh wellbore conditions, making them suitable for demanding applications. In at least one embodiment, the metallic degradable material is an expandable metal (e.g., as discussed above) that is not appropriately bound by another feature, and thus ultimately turns to a degradable material over time. For example, in those embodiments wherein an expandable metal is used as the degradable material, and the volume of the area in which the expandable metal is placed is greater than the expansion volume of the expandable metal, the expanded metal in the exposed regions will ultimately be a degradable material and dissolve. Thus, in certain embodiments, the expandable metal may be positioned such that a portion of the expandable metal expands to form an anchor or seal (e.g., that portion that is bound by another feature and/or in a smaller volume area that is less than the expansion volume) and another portion of the expandable metal degrades to form an opening (e.g., that portion that is not bound by another feature and/or in a larger volume area that is greater than the expansion volume).

In essence, different expandable metals have different amounts of volumetric expansion that they may achieve. Accordingly, if the volume of space that the expandable metal is located is small enough such that the expandable metal expands into contact with the one or more surfaces upon undergoing hydrolysis, while volumetrically expanding no more than its total achievable volumetric expansion, then the resulting expanded metal will function as an anchor and/or seal. However, if the volume of space were so large that the expandable metal volumetrically expands its full achievable volumetric expansion upon undergoing hydrolysis without yet expanding into contact with the one or more surfaces, then it would degrade/dissolve and go away.

For example, as discussed above, calcium oxide (CaO) in one embodiment has a total achievable volumetric expansion of about approximately 260%. Accordingly, if the volume of space is small enough such that the calcium oxide (CaO) expands into contact with the one or more surfaces upon undergoing hydrolysis, while volumetrically expanding less than 260%, then the resulting expanded metal will function as an anchor and/or seal. However, if the volume of space were so large that the calcium oxide (CaO) volumetrically expanded the full 260% upon undergoing hydrolysis without yet expanding into contact with the one or more surfaces, then it would degrade/dissolve and go away. Other expandable metals have different total achievable expansion amounts, but one skilled in the art would be able to apply the principles taught herein to those other materials, while dictating whether the expandable metal will ultimately form an anchor and/or seal, or degrade/dissolve and go away.

Given the foregoing, situations may be designed wherein a single unitary layer or chunk of expandable metal may be deployed such that it forms an anchor and/or seal in one region and degrades/dissolves and goes away in another region. The present disclosure, in one or more embodiments, is relying upon this theory to take advantage of the dual benefits of the expandable metal.

Turning to FIG. 1, illustrated is a multilateral well system 100 designed, manufactured, and operated according to one or more embodiments of the disclosure, and including an expandable metal and/or degradable material designed, manufactured and or operated according to one or more embodiments of the disclosure. The multilateral well system 100, according to certain example embodiments, is for hydrocarbon reservoir production. The multilateral well system 100, in one or more embodiments, includes a pumping station 110, a main wellbore 120, tubing 130, 135, which may have differing tubular diameters, and a plurality of multilateral junctions 140, and lateral wellbores 150 with additional tubing integrated with a main bore of the tubing 130, 135. One or more features of the multilateral well system 100, including one or more features in the main wellbore 120 (e.g., multilateral milling assemblies, two part milling and running tools, multilateral whipstock assemblies, multilateral fluid loss devices, multilateral mainbore completions, multilateral junction sleeves, multilateral downhole assemblies, etc.) or lateral wellbores 150 (e.g., multilateral lateral bore completions, multilateral lateral bore transitions joints, etc.) may include the expandable metal and/or degradable materials disclosed herein. The multilateral well system 100 may additionally include a control unit 160. The control unit 160, in this embodiment, is operable to provide control to and/or from the features of the main wellbore 120 or lateral wellbores 150.

Figure 2:
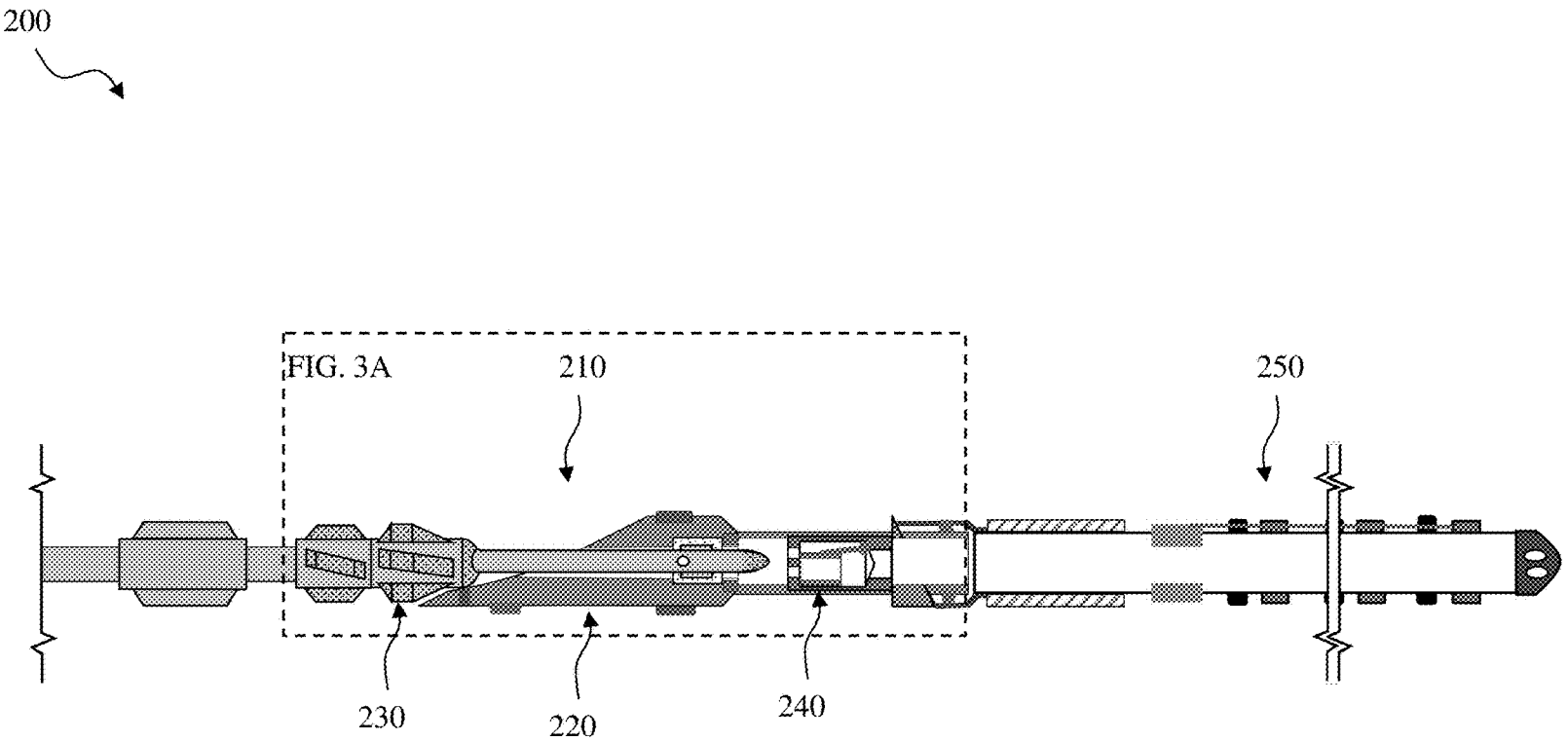
FIG. 2 illustrates a multilateral downhole device designed, manufactured and/or operated according to one or more embodiments of the disclosure.

Turning to FIG. 2, illustrated is a multilateral downhole device 200 designed, manufactured and/or operated according to one or more embodiments of the disclosure. The multilateral downhole device 200, in the illustrated embodiment, includes one or more of a multilateral milling assembly 210, which in at least one embodiment includes a multilateral whipstock assembly 220, a two part milling and running tool 230, a multilateral fluid loss device 240, and a multilateral mainbore completion 250, all of which may include various different versions and/or positioning of the expandable metal and/or degradable material designed, manufactured and/or operated according to one or more embodiments of the disclosure.

Figure 3A:
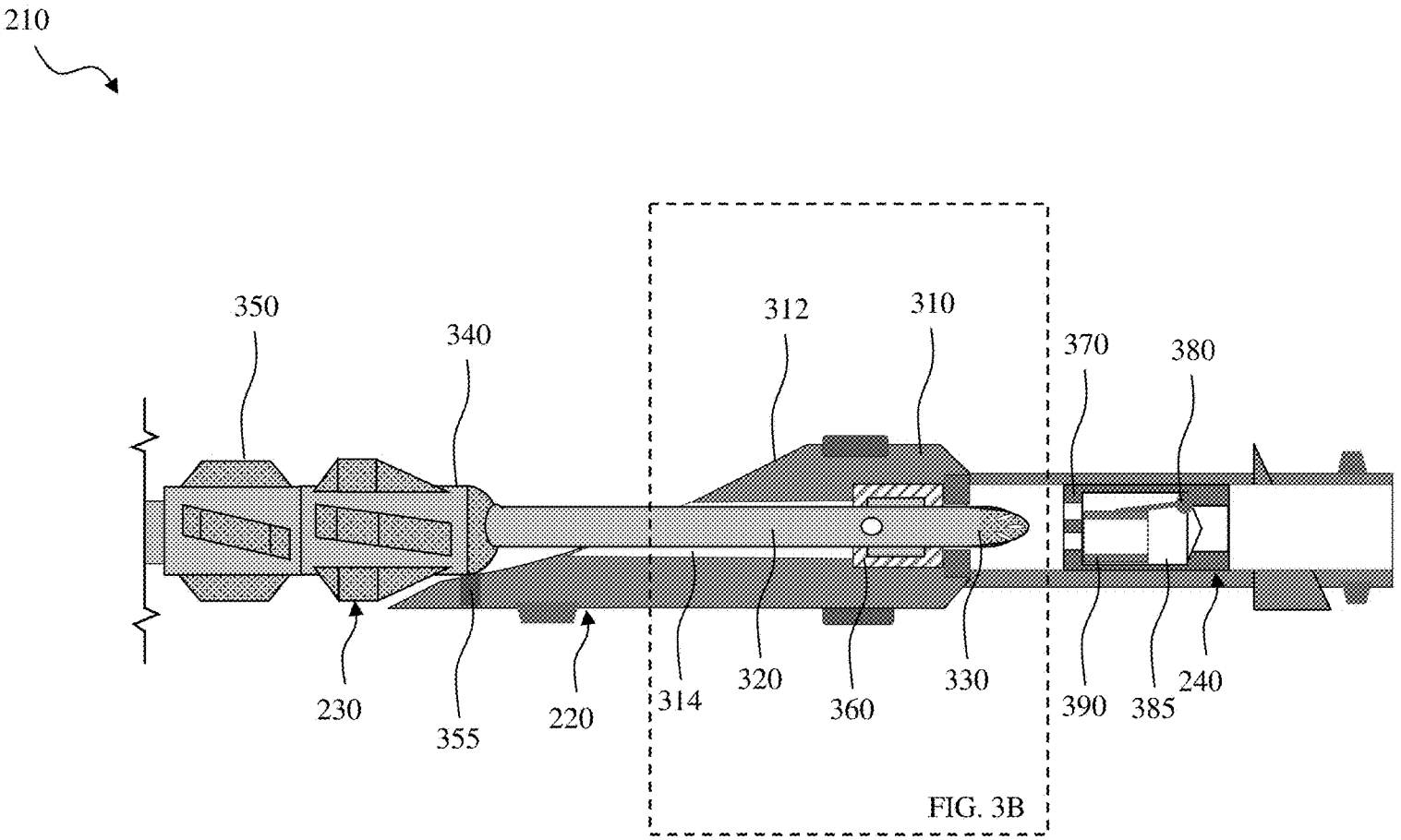
FIG. 3A illustrates an enlarged view of the multilateral milling assembly illustrated in FIG. 2.

Turning to FIG. 3A, illustrated is an enlarged view of the multilateral milling assembly 210 illustrated in FIG. 2. Similar to above, the multilateral milling assembly 210 includes the multilateral whipstock assembly 220, the two part milling and running tool 230, and the multilateral fluid loss device 240. In the illustrated embodiment, the multilateral whipstock assembly 220 includes a whipstock body 310, the whipstock body 310 having a whipface 312 and an opening 314 extending therethrough.

In the illustrated embodiment, the two part milling and running tool 230 is coupled to the multilateral whipstock assembly 220. In at least this one embodiment, the two part milling and running tool 230 includes a conveyance 320, a smaller assembly 330 coupled to an end of the conveyance 320, and a larger bit assembly 340. Further to this embodiment, the two part milling and running tool 230 may include a watermelon bit 350. In the illustrated embodiment, the larger bit assembly 340 is slidably coupled to the conveyance 320, and furthermore the smaller assembly 330 and larger bit assembly 340 are configured to slidingly engage one another downhole to form a combined bit assembly (e.g., not shown in FIG. 3A). Further to the embodiment of FIG. 3A, the larger bit assembly 340 is removably coupled to the whipface 312 of the whipstock body 310 using a coupling mechanism 355, such as a shear feature.

In the illustrated embodiment of FIG. 3A, degradable material 360 axially fixes the smaller assembly 330 relative to the whipface 312. For example, in this embodiment, the degradable material 360 is configured to degrade over time and allow the smaller assembly 330 to release from the whipface 312 and axially slide relative to the larger bit assembly 340 to form the combined bit assembly. The degradable material 360 may be any degradable material known in the art, including the degradable materials discussed above.

In the illustrated embodiment of FIG. 3A, the multilateral milling assembly 210 additionally includes the multilateral fluid loss device 240. The multilateral fluid loss device 240, in the illustrated embodiment, includes a fluid loss device body 370, as well as a plug member 380 located in a fluid passageway 385 of the fluid loss device body 370. In the illustrated embodiment, the plug member 380 is configured to move between a first position allowing fluid to traverse the fluid passageway 385 as it travels from a first end to a second end and a second position preventing the fluid from traversing the fluid passageway 385 as it travels from the first end to the second end. The multilateral fluid loss device 240 of FIG. 3A additionally includes degradable material 390 located within the fluid passageway 385 and engaged with the plug member 380. In at least this one embodiment, the degradable material 390 prevents the plug member 380 from moving to the second position, the degradable material 390 configured to degrade over time and allow the plug member 380 to move from the first position to the second position to prevent the fluid from traversing the fluid passageway as it travels from the first end to the second end.

Figure 3B:
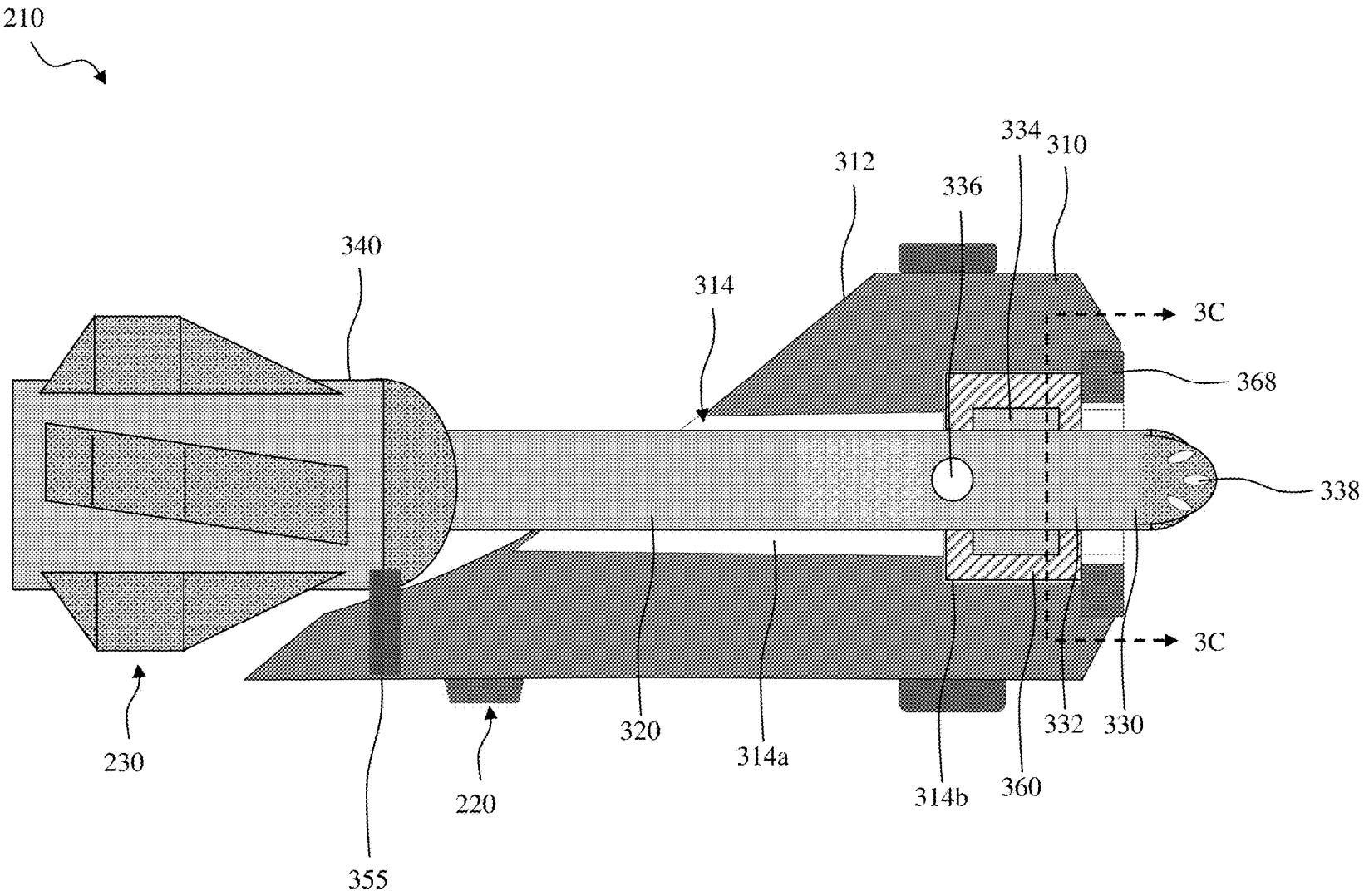
FIGS. 3B and 3C illustrate an enlarged view of a portion of the multilateral milling assembly of FIG. 3A, as well as a cross-sectional view of the multilateral whipstock assembly and the two part milling and running tool taken through the line 3C-3C of FIG. 3B, respectively.
Figure 3C:
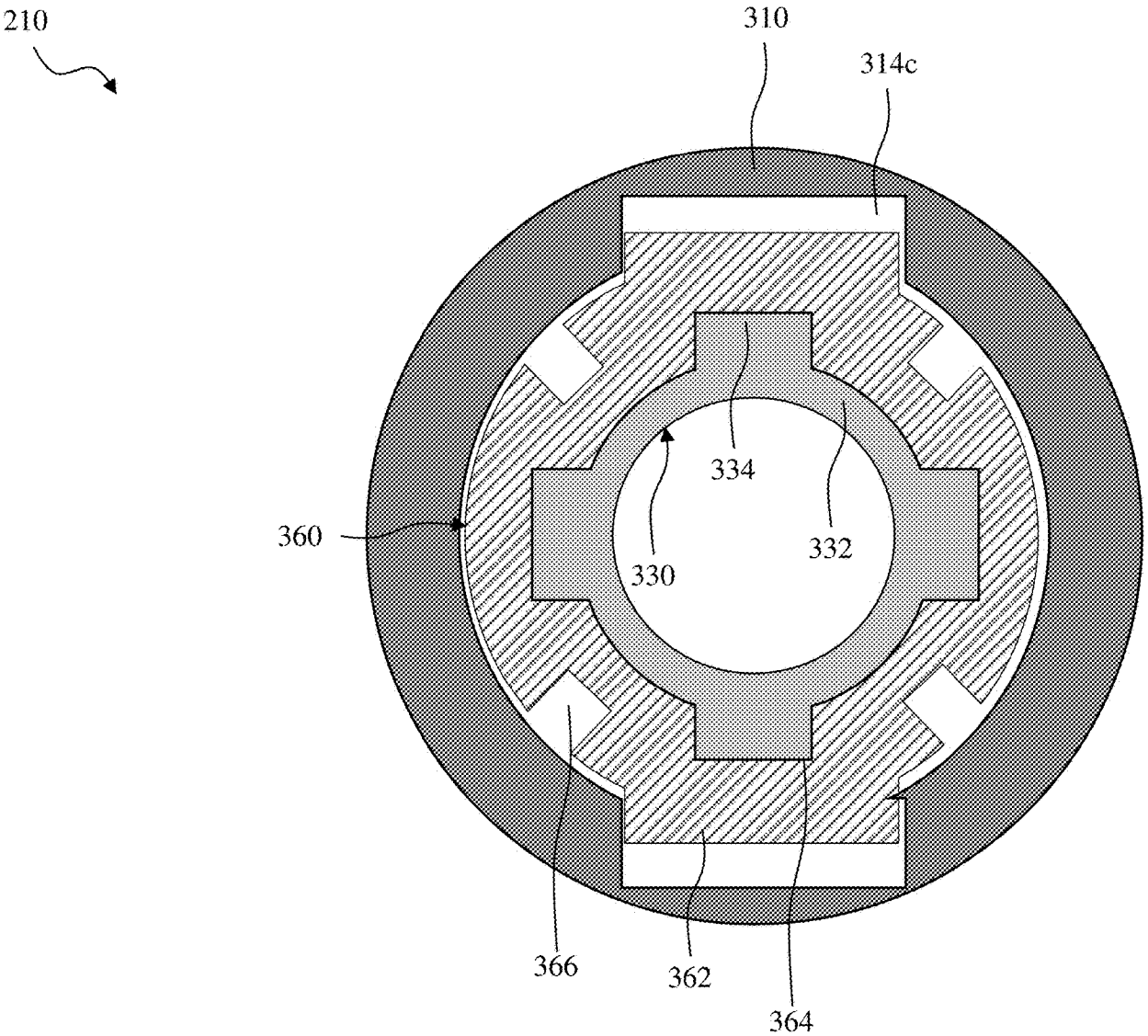

Turning to FIGS. 3B and 3C, illustrated is an enlarged view of a portion of the multilateral milling assembly 210 of FIG. 3A, as well as a cross-sectional view of the multilateral whipstock assembly 220 and the two part milling and running tool 230 taken through the line 3C-3C of FIG. 3B, respectively. As is illustrated, in one or more embodiments the opening 314 in the multilateral whipstock assembly 220 may include a first smaller width opening 314*a* and a second larger width opening 314*b*. In the illustrated embodiment of FIGS. 3A through 3C, the degradable material 360 is located in the second larger width opening 314*b* to fix the smaller assembly 330 relative to the whipstock body 310.

As further shown in the embodiment of FIGS. 3A through 3C, the smaller assembly 330 may include a main portion 332 and a smaller assembly clutch ring portion 334. In accordance with this one embodiment, the smaller assembly clutch ring portion 334 may be located in the second larger width opening 314*b*, and surrounded by the degradable material 360 to axially and rotationally fix the smaller assembly 330 relative to the degradable material 360. Further to the embodiment of FIGS. 3A through 3C, the degradable material 360 may include one or more degradable material outer diameter clutch ring portions 362, the one or more degradable material outer diameter clutch ring portions 362 configured to engage with one or more slots 314*c* in the second larger width opening 314*b* to rotationally couple the degradable material 360 to the whipstock body 310. Further to the embodiment of FIGS. 3A through 3C, the degradable material 360 may include one or more degradable material inner diameter slots 364, the one or more degradable material inner diameter slots 364 configured to engage with the one or more smaller assembly clutch ring portions 334 of the smaller assembly 330 to rotationally fix the smaller assembly 330 relative to the degradable material 360. As shown, in one or more embodiments the degradable material 360 may additionally have one or more circulation flutes 366 extending along a length thereof, the one or more circulation flutes 366 configured to permit reactive fluid to circulate past the degradable material 360 to permit the degradable material 360 to degrade over time and allow the smaller assembly 330 to release from the whipstock body 310.

The degradable material 360 may comprise any degradable material known in the art, including any of the degradable materials disclosed above. Nevertheless, in the illustrated embodiment of FIGS. 3A through 3C, the degradable material 360 is a metal based degradable material. For example, the metal based degradable material may be an expandable metal configured to expand in response to hydrolysis and then degrade to allow the smaller assembly 330 to release from the whipstock body 310. In one or more embodiments, the expandable metal is configured to expand in response to hydrolysis and after the hydrolysis has completed then degrade to allow the smaller assembly 330 to release from the whipstock body 310. Notwithstanding, in yet another embodiment, the degradable material 360 is a polymer based degradable material, among others.

In the embodiment of FIGS. 3A through 3C, the multilateral milling assembly 210 includes a lock ring 368 retaining the degradable material 360 within the second larger width opening 314*b*. Any type of lock ring may be used and remain within the scope of the disclosure. The lock ring 368 may also comprise many different materials and remain within the scope of the disclosure.

In the embodiment of FIGS. 3A through 3C, the smaller assembly 330 may also include one or more flow ports therein. For example, the smaller assembly 330 may include one or more primary flow ports 336. The one or more primary flow ports 336, in at least one embodiment, are located uphole of the smaller assembly clutch ring portion 334. The smaller assembly 330, in at least one embodiment, may further include one or more secondary flow ports 338 in the smaller assembly 330. In at least this one embodiment, the one or more secondary flow ports 338 are located downhole of the smaller assembly clutch ring portion 334.

Figure 4A:
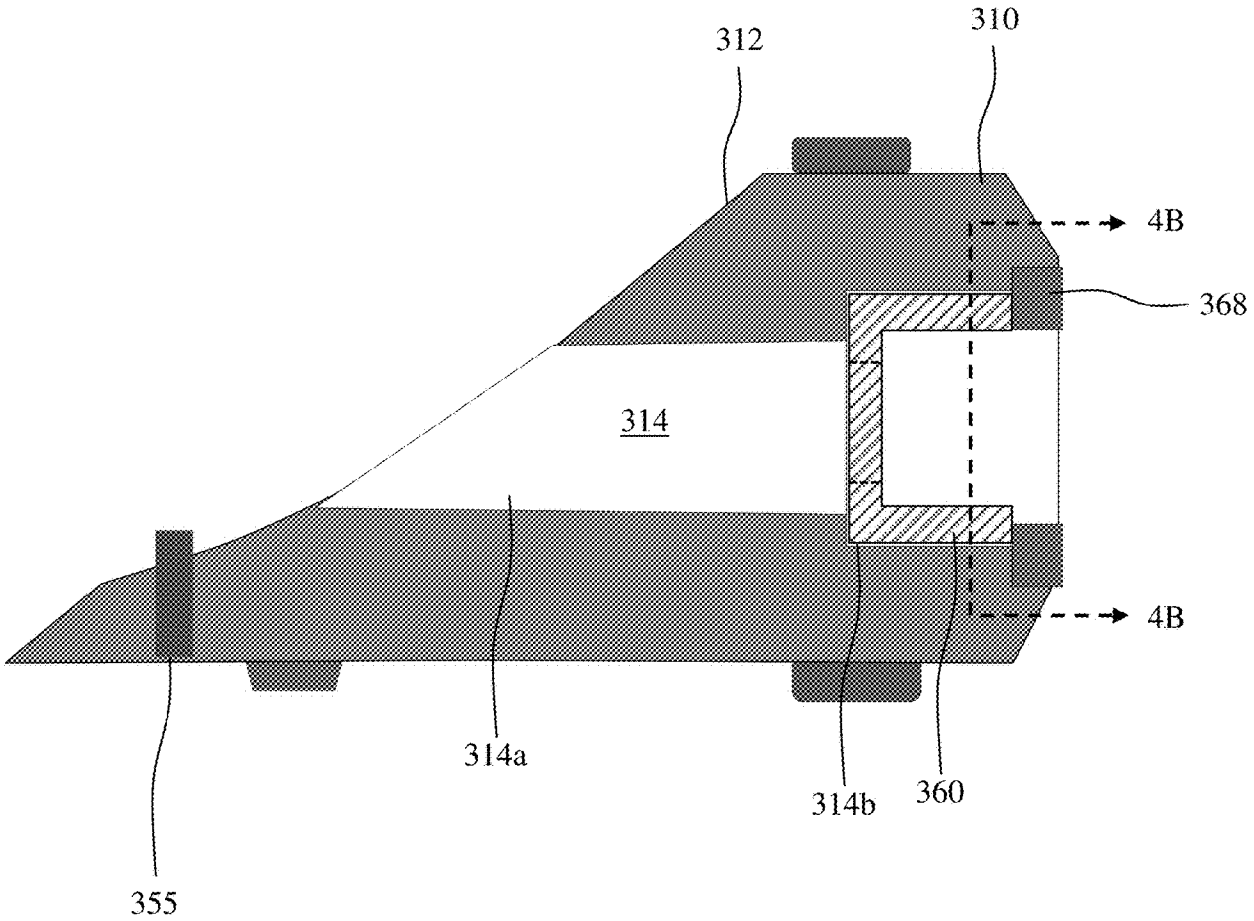
FIGS. 4A and 4B illustrate an enlarged view of a multilateral whipstock assembly, as well as a cross-sectional view of the multilateral whipstock assembly taken through the line 4B-4B of FIG. 4A, respectively, designed, manufactured and/or operated according to one or more embodiments of the disclosure.
Figure 4B:
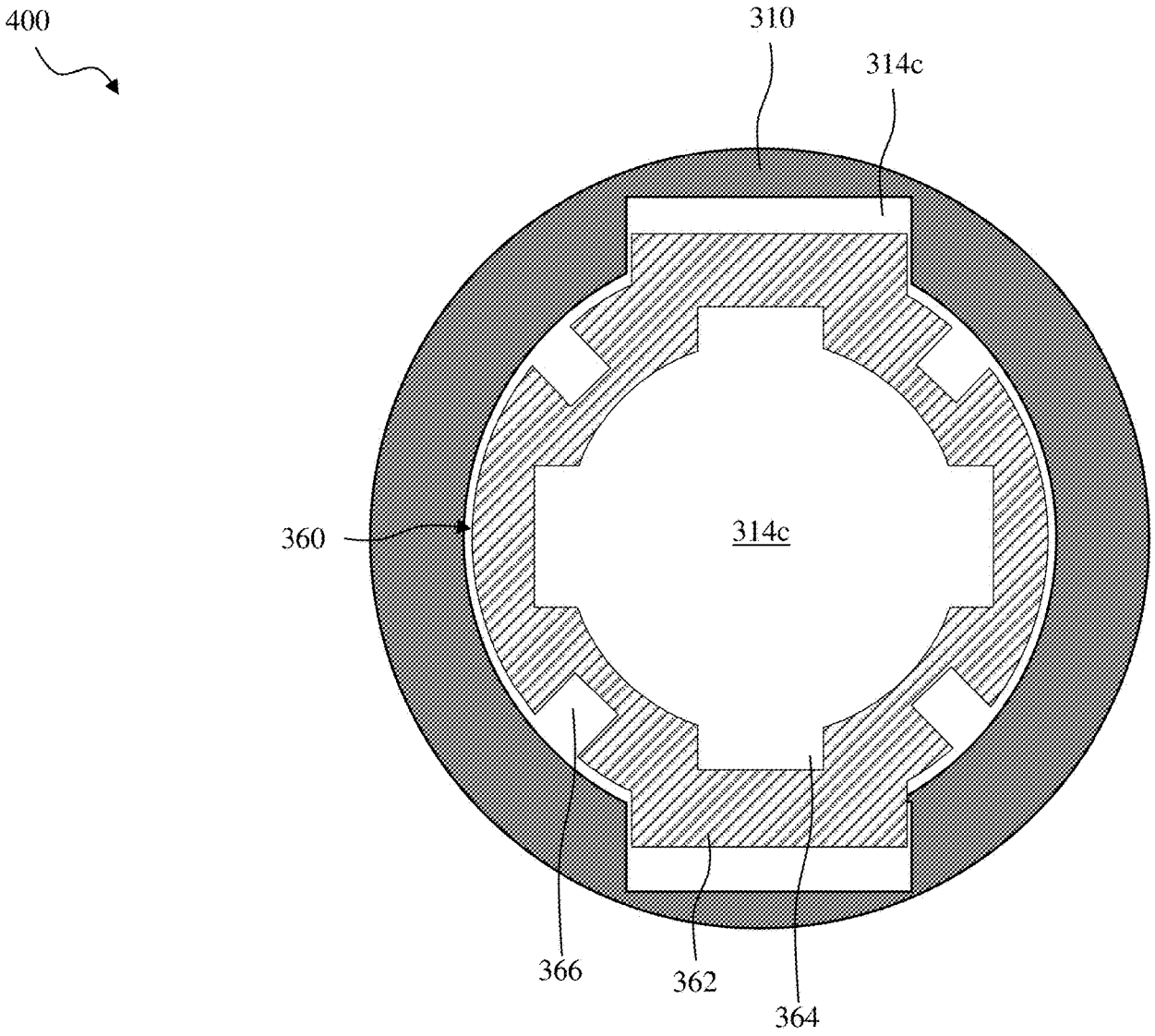

Turning to FIGS. 4A and 4B, illustrated is an enlarged view of a multilateral whipstock assembly 400, as well as a cross-sectional view of the multilateral whipstock assembly 400 taken through the line 4B-4B of FIG. 4A, respectively, designed, manufactured and/or operated according to one or more embodiments of the disclosure. The multilateral whipstock assembly 400 is similar in many respects to the multilateral whipstock assembly 220 illustrated in FIGS. 3A through 3C. Accordingly, like reference numbers have been used to indicate similar, if not identical, features.

In at least the embodiment of FIGS. 4A and 4B, the multilateral whipstock assembly 400 includes a whipstock body 310, the whipstock body 310 having a whipface 312 and an opening 314 extending therethrough. The multilateral whipstock assembly 400, in at least this one embodiment, further includes degradable material 360 located in the opening 314, the degradable material 360 configured to axially fix a smaller assembly of a two part milling and running tool relative to the whipstock body 310. In at least this one embodiment, the degradable material 360 is configured to degrade over time and allow the smaller assembly to release from the whipstock body 310 and axially slide (e.g., to the left in the disclosed embodiment) relative to a larger bit assembly of the two part milling and running tool to form a combined bit assembly. In one or more embodiments, as is shown, the opening 314 includes a first smaller width opening 314*a* and a second larger width opening 314*b*, and in this embodiment the degradable material 360 is located in the second larger width opening 314*b*. Further to the embodiment of FIGS. 4A and 4B, a lock ring 368 may be used to retain the degradable material 360 within the second larger width opening 314*b*.

In the illustrated embodiment of FIGS. 4A and 4B, the degradable material 360 includes one or more degradable material outer diameter clutch ring portions 362. In this embodiment, the one or more degradable material outer diameter clutch ring portions 362 are configured to engage with one or more slots 314*c* in the second larger width opening 314*b* to rotationally couple the degradable material 360 to the whipstock body 310. Similarly, in the embodiment of FIGS. 4A and 4B, the degradable material 360 includes one or more degradable material inner diameter slots 364. In at least this one embodiment, the one or more degradable material inner diameter slots 364 are configured to engage with one or more smaller assembly clutch ring portions of a smaller assembly to rotationally fix the smaller assembly relative to the degradable material 360. As further illustrated in the embodiment of FIGS. 4A and 4B, the degradable material 360 has one or more circulation flutes 366 extending along a length thereof, the one or more circulation flutes 366 configured to permit reactive fluid to circulate past the degradable material 360 to permit the degradable material 360 to degrade over time and allow the smaller assembly to release from the whipstock body 310. While the one or more circulation flutes 366 are illustrated on a radial outer surface of the degradable material 360, they could also be located on a radial inner surface of the degradable material 360.

As discussed above, the degradable material 360 may comprise many different materials and remain within the scope of the disclosure. In one or more embodiments, the degradable material 360 is a polymer based degradable material, or other material disclosed above. Nevertheless, in at least the embodiment of FIGS. 3A and 3B, the degradable material 360 is a metal based degradable material. For example, the metal based degradable material may be an expandable metal configured to expand in response to hydrolysis and then degrade to allow the smaller assembly to release from the whipstock body 310. In at least one embodiment, the expandable metal is configured to expand in response to hydrolysis and after the hydrolysis has completed then degrade to allow the smaller assembly to release from the whipstock body 310. As indicated above, the volume of the degradable material 360, as well as the volume of the space that the degradable material 360 is located, could be tailored such that the degradable material 360 volumetrically expands its full achievable volumetric expansion prior to filling the volume of space, such that it will degrade as opposed to form a seal/anchor.

Figure 5A:
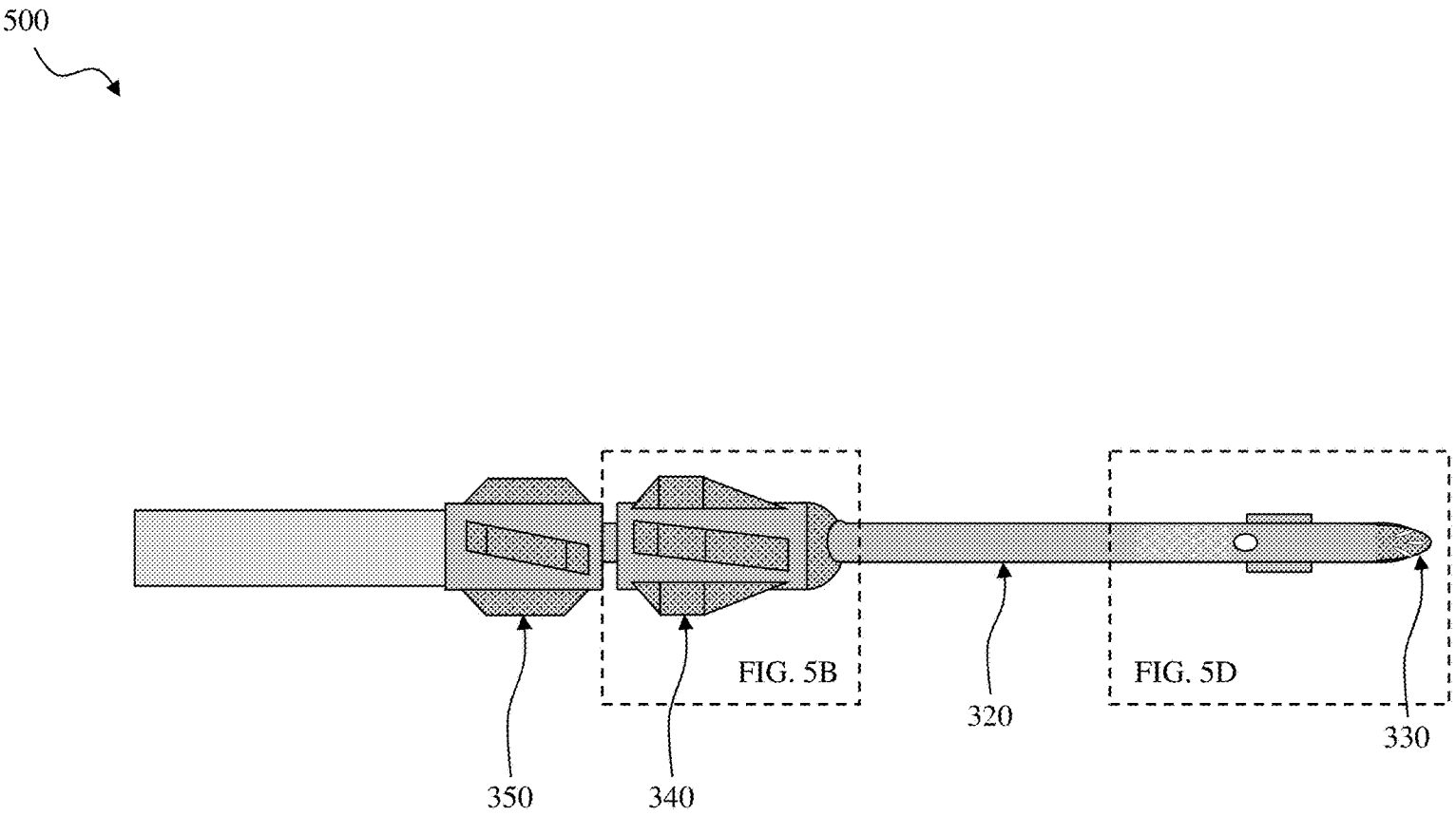
FIGS. 5A through 5G illustrate various different views of a two part milling and running tool designed, manufactured and/or operated according to one or more embodiments of the disclosure.
Figure 5B:
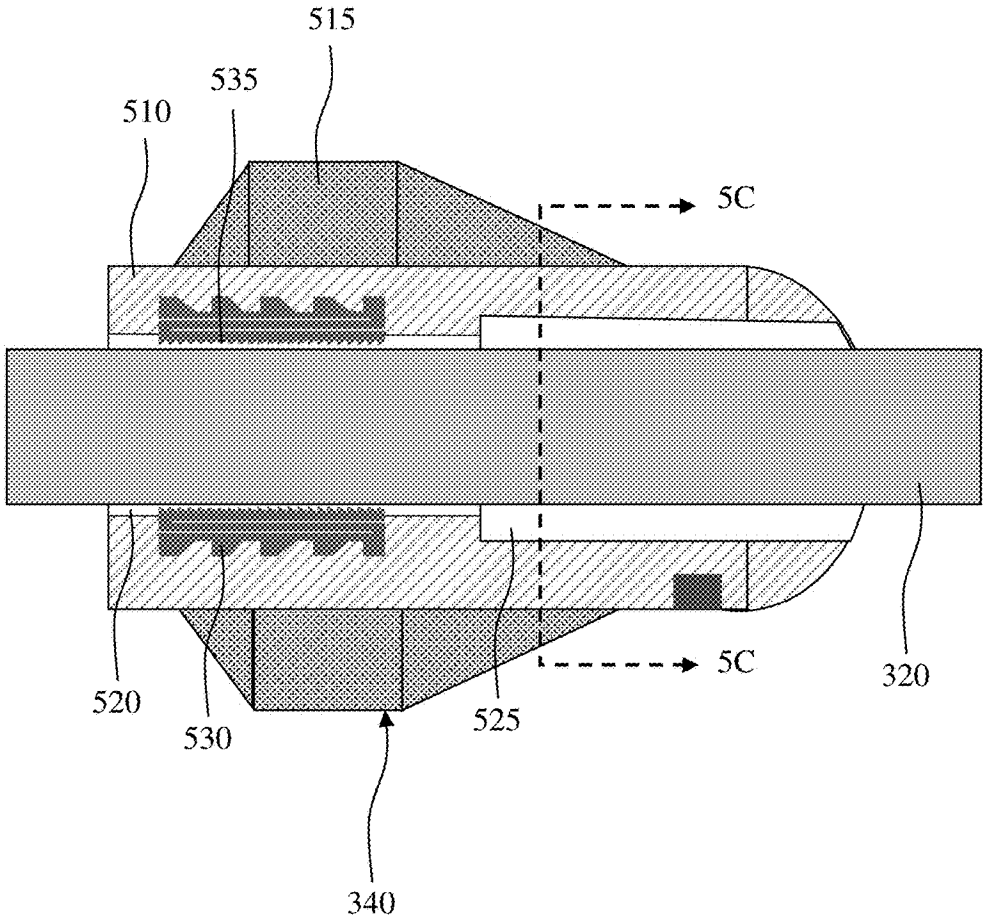
Figure 5C:
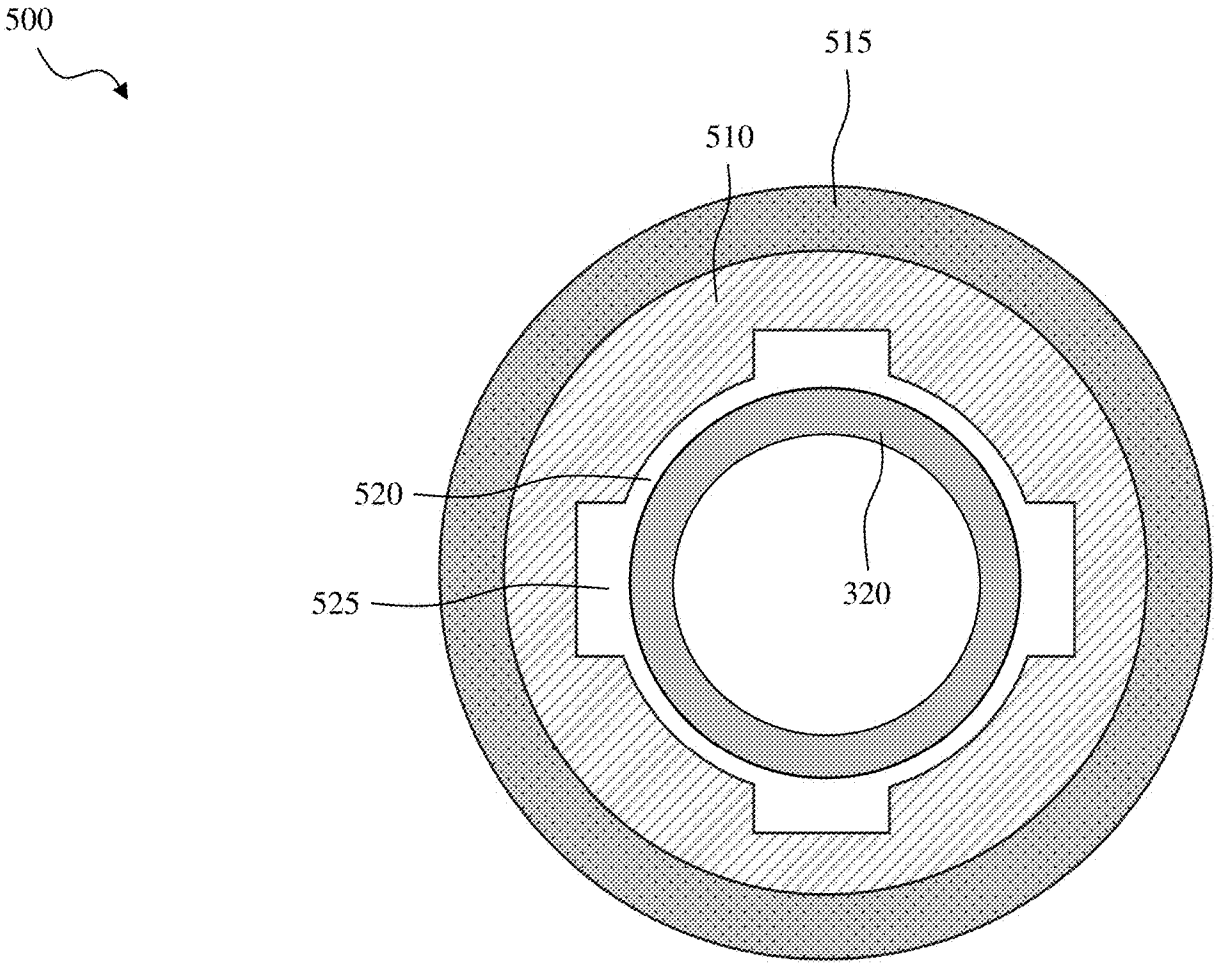
Figure 5D:
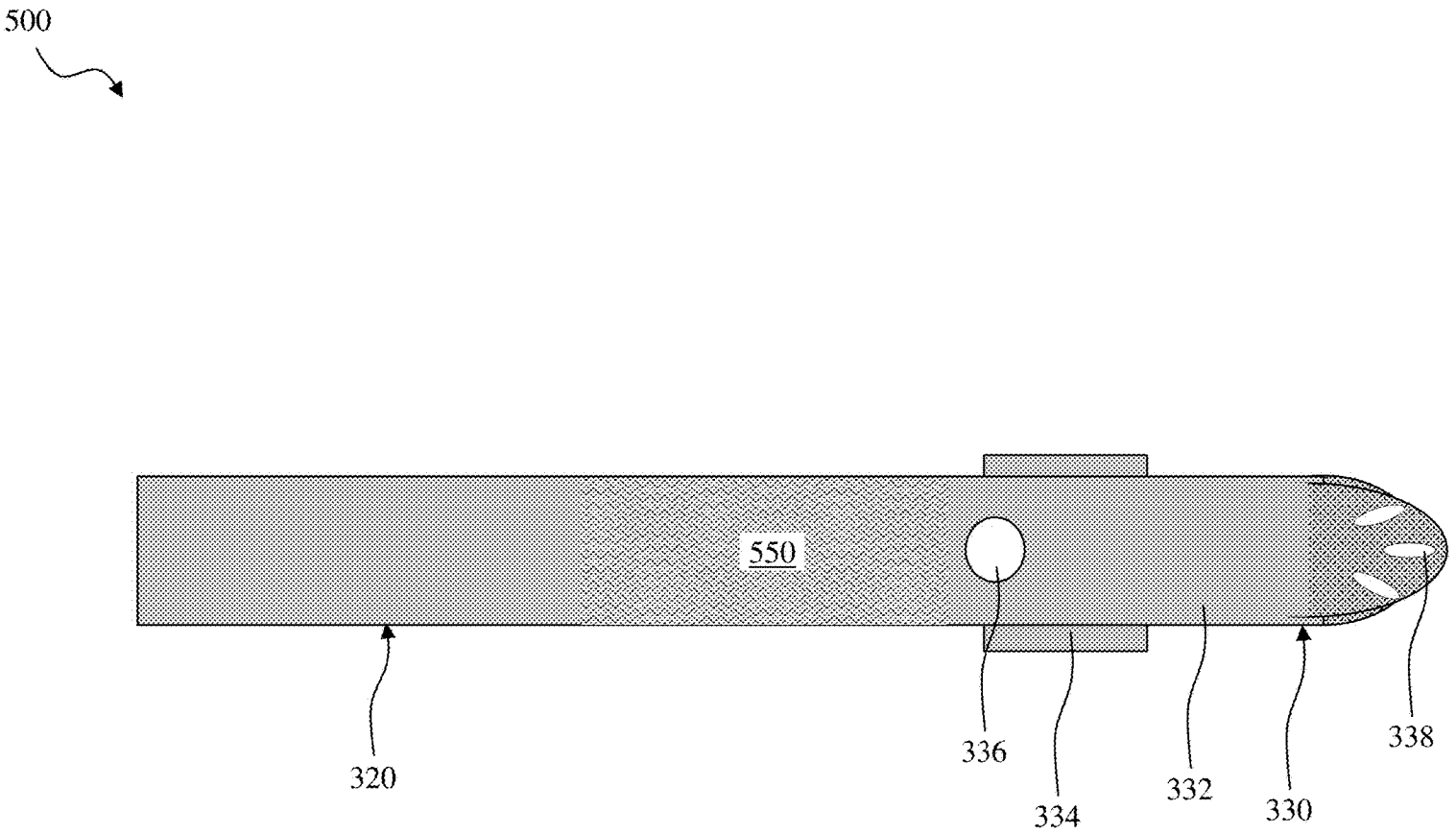
Figure 5E:
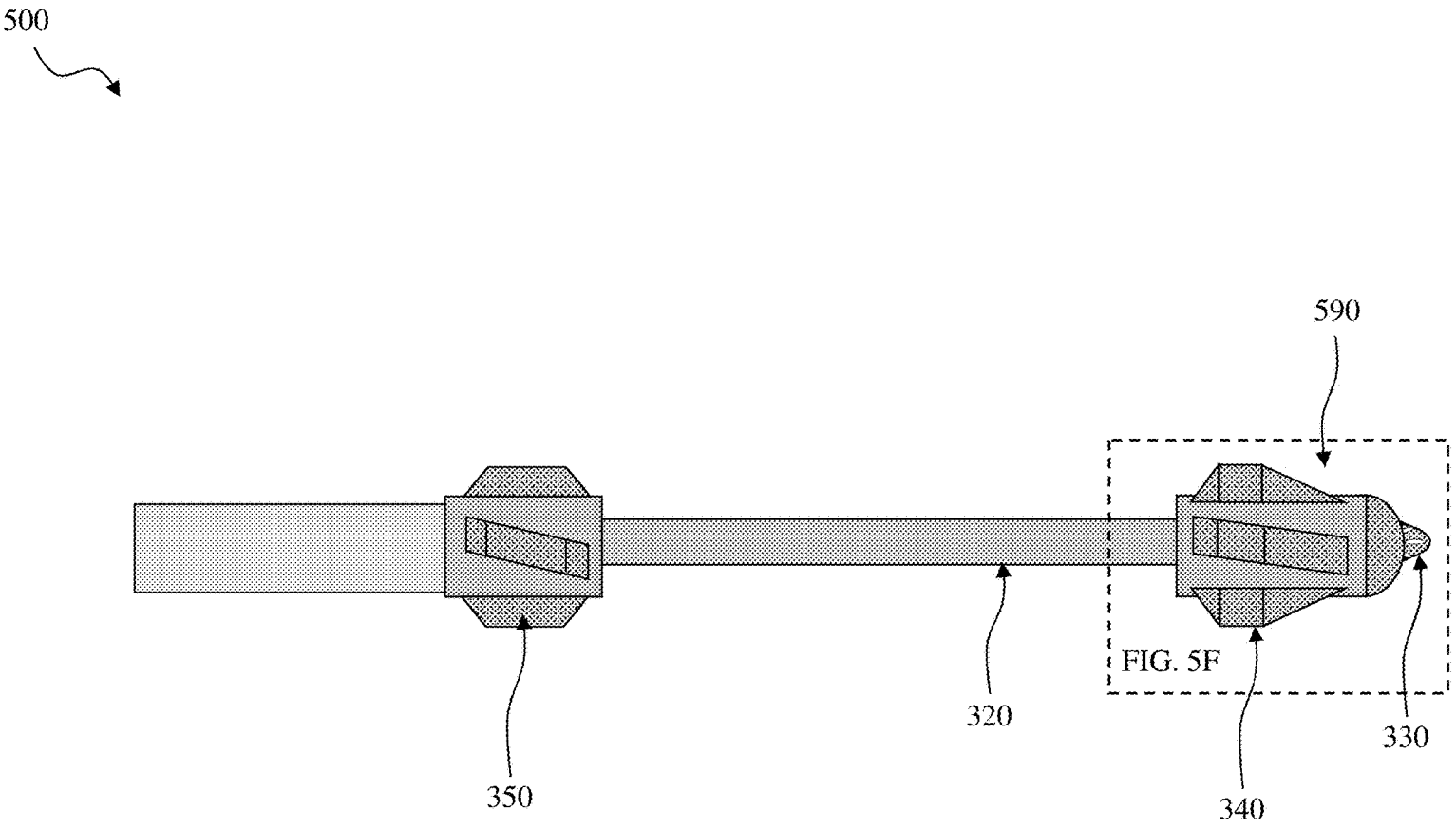
Figure 5F:
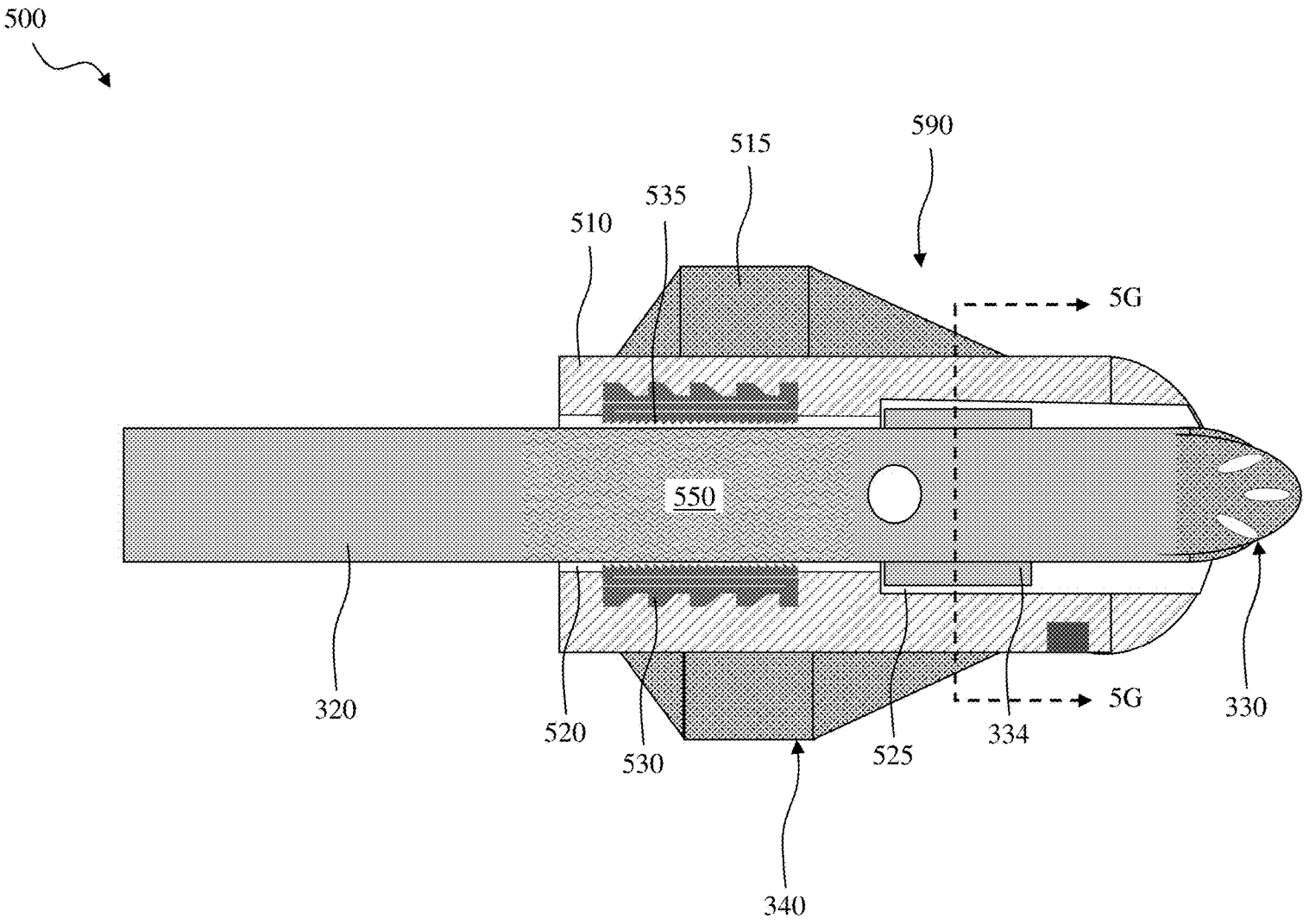
Figure 5G:
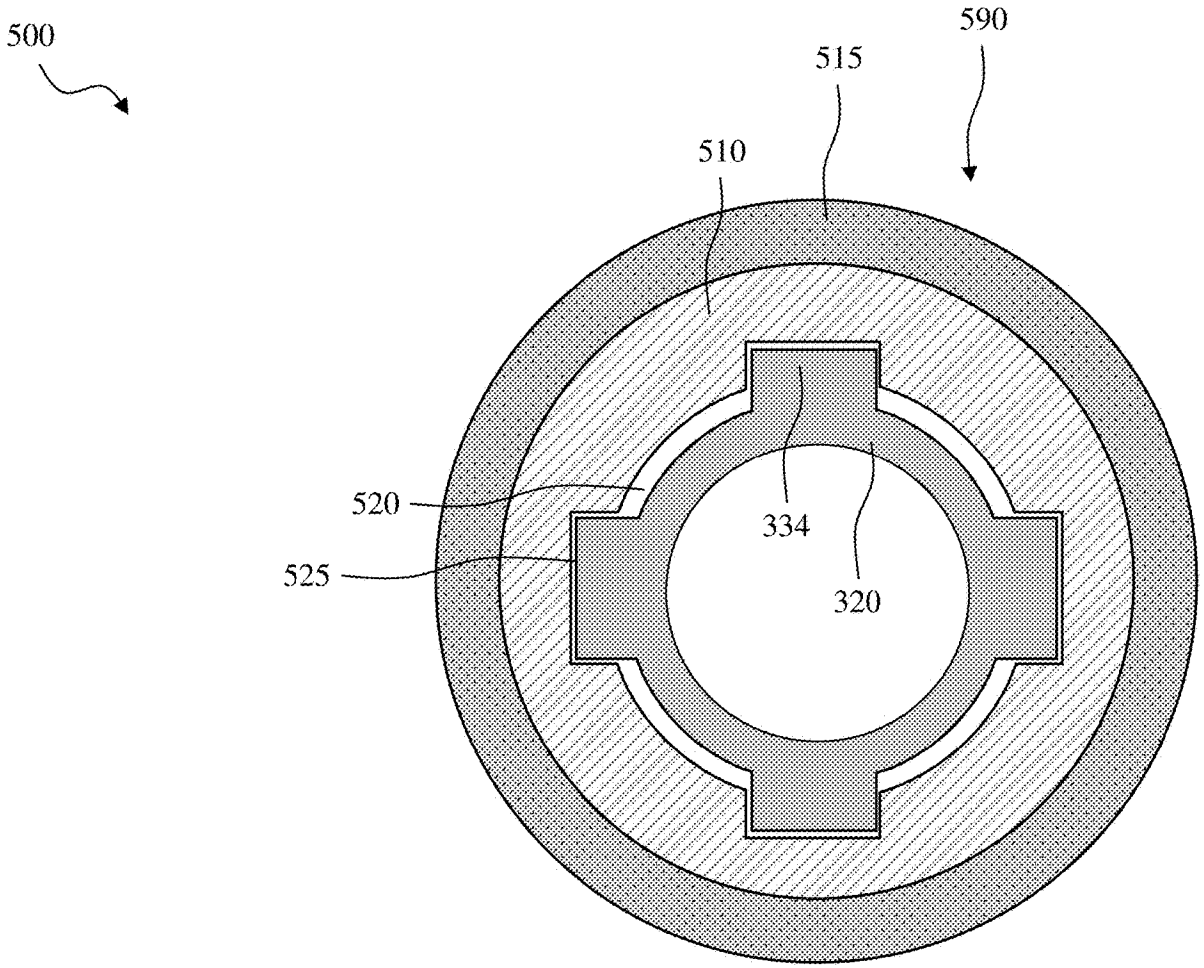

Turning now to FIGS. 5A through 5G, illustrated are various different views of a two part milling and running tool 500 designed, manufactured and/or operated according to one or more embodiments of the disclosure. FIGS. 5A through 5D illustrate various different views of the two part milling and running tool 500 in the run-in-hole state, whereas FIGS. 5E through 5G illustrate various different views of the two part milling and running tool 500 in the activated state, and thus achieving the combined bit assembly 590. The two part milling and running tool 500 is similar in many respects to the two part milling and running tool 230 illustrated and described with respect to FIGS. 3A through 3C above. Accordingly, like reference numbers have been used to indicate similar, if not identical, features.

With initial reference to FIGS. 5A through 5D, the two part milling and running tool 500 includes a conveyance 320. The two part milling and running tool 500, in the illustrated embodiment, additionally includes a smaller assembly 330 coupled to an end of the conveyance 320. The two part milling and running tool 500, in the illustrated embodiment, additionally includes a larger bit assembly 340 slidably coupled to the conveyance 320. In the illustrated embodiment, the smaller assembly 330 and larger bit assembly 340 are configured to slidingly engage one another downhole to form a combined bit assembly (e.g., combined bit assembly 590 of FIGS. 5E through 5G). While not required, the two part milling and running tool 500, in the illustrated embodiment, additionally includes a watermelon bit 350.

In accordance with one or more embodiments, the larger bit assembly 340 may include a larger bit assembly body 510, as well as one or more larger bit assembly cutters 515 extending from the larger bit assembly body 510. The larger bit assembly body 510, in one or more embodiments, may have a larger bit assembly body opening 520 extending along a length thereof, the larger bit assembly body opening 520 configured to surround and slide upon the conveyance 320. The larger bit assembly body opening 520, in one or more embodiments, includes one or more slots 525. The one or more slots 525, in at least one embodiment, are configured to engage with a smaller assembly clutch ring portion (e.g., smaller assembly clutch ring portion 334) of the smaller assembly 330, and thus when engaged, prevent the smaller assembly 330 and larger bit assembly 340 from rotating relative to one another.

In at least one embodiment, the larger bit assembly 340 includes a body lock ring 530 in an interior thereof. In at least one embodiment, the body lock ring 530 is configured to allow the smaller assembly 330 to slide toward the larger bit assembly 340 but prevent the smaller assembly 330 from sliding away from the larger bit assembly 340. In the illustrated embodiment, the body lock ring 530 include body lock ring teeth 535 configured to engage with the conveyance 320. In at least one embodiment, the body lock ring teeth 535 are angled to allow the smaller assembly 330 to slide toward the larger bit assembly 340 but prevent the smaller assembly 330 from sliding away from the larger bit assembly 340.

In accordance with one or more embodiments, the smaller assembly 330 may include a main portion 332 and a smaller assembly clutch ring portion 334. As indicated above, it is the smaller assembly clutch ring portion 334 that is configured to engage with the one or more slots 525 of the larger bit assembly 340, for example to prevent the smaller assembly 330 and larger bit assembly 340 from rotating relative to one another when in the combined bit assembly state. In one or more embodiments, the smaller assembly 330 may also include one or more flow ports therein. For example, the smaller assembly 330 may additionally include one or more primary flow ports 336. The one or more primary flow ports 336, in at least one embodiment, are located uphole of the smaller assembly clutch ring portion 334. The smaller assembly 330, in at least one embodiment, may further include one or more secondary flow ports 338 in the smaller assembly 330. In at least this one embodiment, the one or more secondary flow ports 338 are located downhole of the smaller assembly clutch ring portion 334.

In at least one or more embodiments, the smaller assembly 330 may include a roughened surface 550. Further to the illustrated embodiment, the roughened surface 550 is configured to engage with the body lock ring 530 of the larger bit assembly 340, and thus allow the smaller assembly 330 to slide toward the larger bit assembly 340 but prevent the smaller assembly 330 from sliding away from the larger bit assembly 340. In one or more embodiments, such as that shown, the roughened surface 550 is a serrated surface. Nevertheless, any roughened surface 550 may be used and remain within the scope of the disclosure. In at least one embodiment, the roughened surface 550 is configured such that less than 10 percent of its length extends outside of the larger bit assembly 340 when the smaller assembly 330 and larger bit assembly 340 engage one another downhole to form the combined bit assembly. In accordance with this embodiment, the smaller assembly 330 and larger bit assembly 340 may freely slide back and forth relative to one another until the body lock ring 530 and roughened surface 550 engage one another when forming the combined bit assembly. In yet another embodiment, none of the roughened surface 550 extends outside of the larger bit assembly 340 when the smaller assembly 330 and larger bit assembly 340 engage one another downhole to form the combined bit assembly. In at least one other embodiment, the smaller assembly 330 includes a body lock ring, and the larger bit assembly 340 includes the roughened surface 550.

Turning briefly to FIGS. 5E through 5F, illustrated is the two part milling and running tool 500 when the smaller assembly 330 and larger bit assembly 340 have slid together to form the combined bit assembly 590. As shown, a collection of the body lock ring 530 and the roughened surface 550 prevent the smaller assembly 330 and the larger bit assembly 340 from axially sliding relative to one another. Similarly, a combination of the smaller assembly clutch ring portion 334 and the one or more slots 525 prevent the smaller assembly 330 and the larger bit assembly 340 from rotating relative to one another.

Figure 6A:
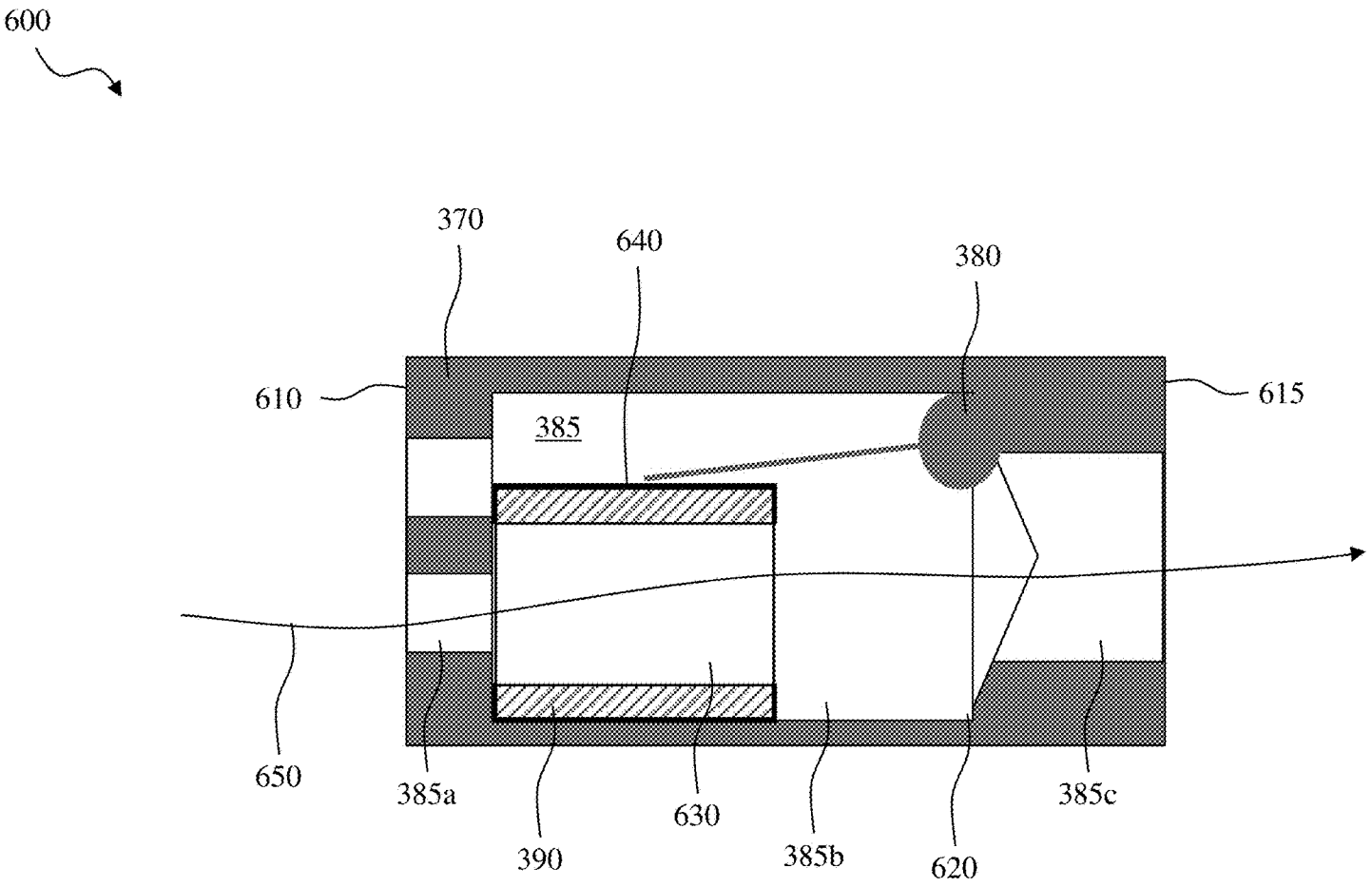
FIGS. 6A and 6B illustrate various different views of a multilateral fluid loss device designed and manufactured at different stages of operation in accordance with an embodiment of the disclosure.
Figure 6B:
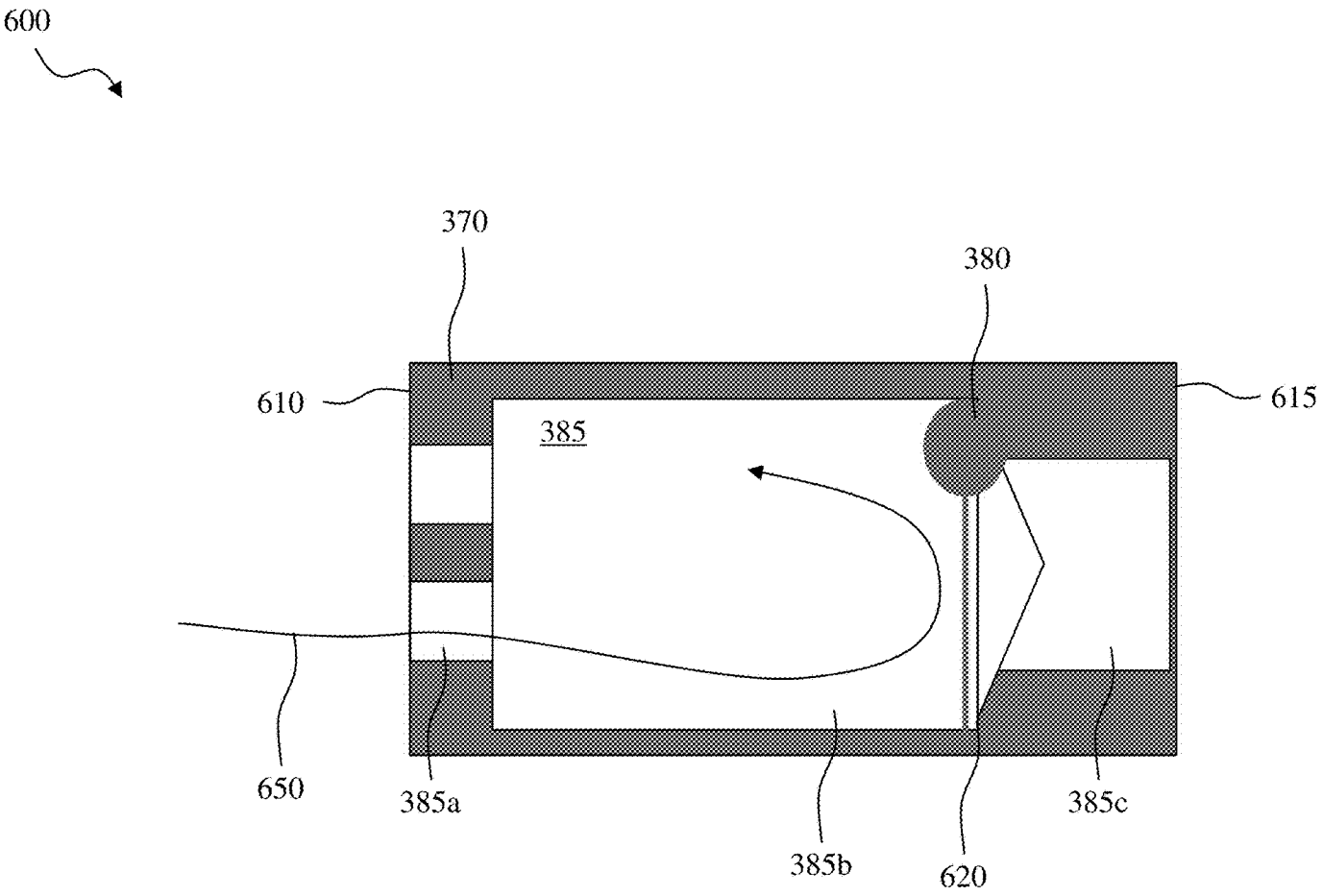

Turning to FIGS. 6A and 6B, illustrated are various different views of a multilateral fluid loss device 600 designed and manufactured at different stages of operation in accordance with an embodiment of the disclosure. For example, FIG. 6A illustrates the multilateral fluid loss device 600 in the run-in-hole state, whereas FIG. 6B illustrates the multilateral fluid loss device 600 in an activated state. The multilateral fluid loss device 600 is similar in many respects to the multilateral fluid loss device 240 illustrated and described with respect to FIG. 3A. Accordingly, like reference numbers have been used to indicate similar, if not identical, features.

The multilateral fluid loss device 600, in the illustrated embodiment, includes a fluid loss device body 370, as well as a plug member 380 located in a fluid passageway 385 of the fluid loss device body 370. In the illustrated embodiment, the plug member 380 is configured to move between a first position allowing fluid to traverse the fluid passageway 385 as it travels from a first end 610 to a second end 615 (e.g., as shown in FIG. 6A) and a second position preventing the fluid from traversing the fluid passageway 385 as it travels from the first end 610 to the second end 615 (e.g., as shown in FIG. 6B). The plug member 380 may comprise a variety of different features and remain within the scope of the disclosure. Nevertheless, in at least the embodiment of FIGS. 6A and 6B, the plug member 380 is a flapper valve. In this one embodiment, the flapper valve is configured to move to the second position and engage with a flapper valve seat 620 after the degradable material 390 had degraded, to prevent the fluid from traversing the fluid passageway 385 as it travels from the first end 610 to the second end 615. In at least one embodiment, the fluid passageway 385 has uphole and downhole diameter portions 385*a*, 385*c*, separated by a larger middle diameter portion 385*b*. In at least this one embodiment, the plug member 380 is located in the larger middle diameter portion 385*b*.

The multilateral fluid loss device 600 of FIG. 6A additionally includes the degradable material 390 located within the fluid passageway 385 and engaged with the plug member 380. In at least this one embodiment, the degradable material 390 prevents the plug member 380 from moving to the second position, the degradable material 390 configured to degrade over time and allow the plug member 380 to move from the first position to the second position to prevent the fluid from traversing the fluid passageway 385 as it travels from the first end 610 to the second end 615. In at least one embodiment, the degradable material 390 has one or more openings 630 located therein, the one or more openings 630 allowing fluid to pass through the degradable material 390 as the degradable material 390 prevents the plug member 380 from moving to the second position. In one or more embodiments, a delay coating 640 may surround the degradable material 390. In at least this one embodiment, the delay coating 640 is configured to increase the time needed for the degradable material 390 to degrade. As discussed above, the delay coating material and/or thickness may be chosen to specifically set the time needed for the degradable material 390 to degrade.

The degradable material 390 may comprise any degradable material known in the art, including any of the degradable materials disclosed above. Nevertheless, in the illustrated embodiment of FIGS. 6A and 6B, the degradable material 390 is a metal based degradable material. For example, the metal based degradable material may be an expandable metal configured to expand in response to hydrolysis and then degrade to allow the plug member 380 to move from the first position to the second position. In one or more embodiments, the expandable metal is configured to expand in response to hydrolysis and after the hydrolysis has completed then degrade to allow the plug member 380 to move from the first position to the second position. Notwithstanding, in yet another embodiment, the degradable material 390 is a polymer based degradable material, among others.

As shown in FIG. 6A, degradable material 390 is located within the fluid passageway 385 and engaged with the plug member 380, and thus the degradable material 390 is preventing the plug member 380 from moving to the second position, thereby allowing fluid 650 to traverse the fluid passageway 385 as it travels from the first end 610 to the second end 615. In contrast, as shown in FIG. 6B, the degradable material 390 has degraded, and thus it is no longer located within the fluid passageway 385 and engaged with the plug member 380, and thus the plug member 380 is allowed to move from the first position (e.g., of FIG. 6A) to the second position (e.g., of FIG. 6B), thereby preventing the fluid 650 from traversing the fluid passageway 385 as it travels from the first end 610 to the second end 615.

Figure 7A:
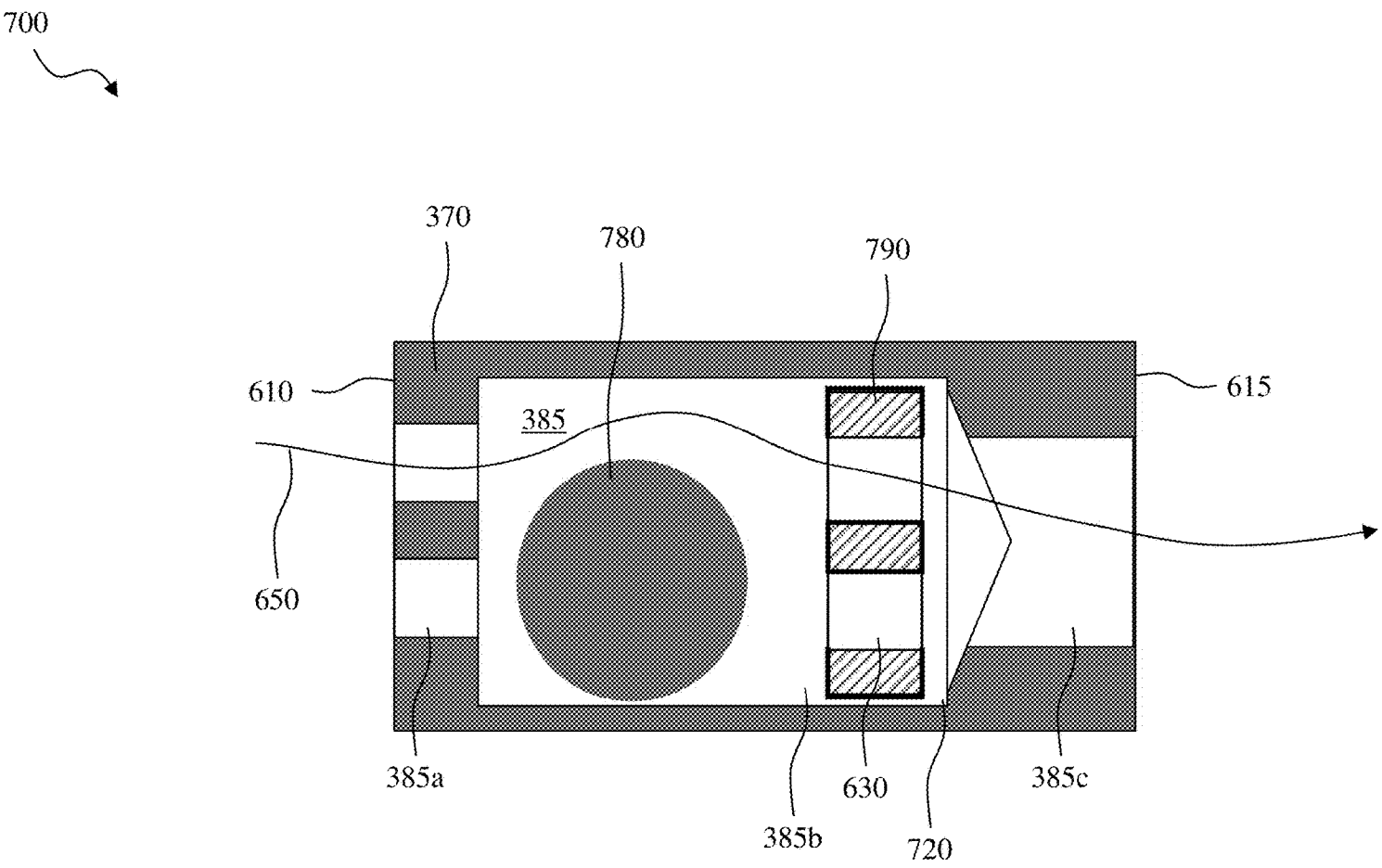
FIGS. 7A and 7B illustrate various different views of a multilateral fluid loss device designed and manufactured at different stages of operation in accordance with an alternative embodiment of the disclosure.
Figure 7B:
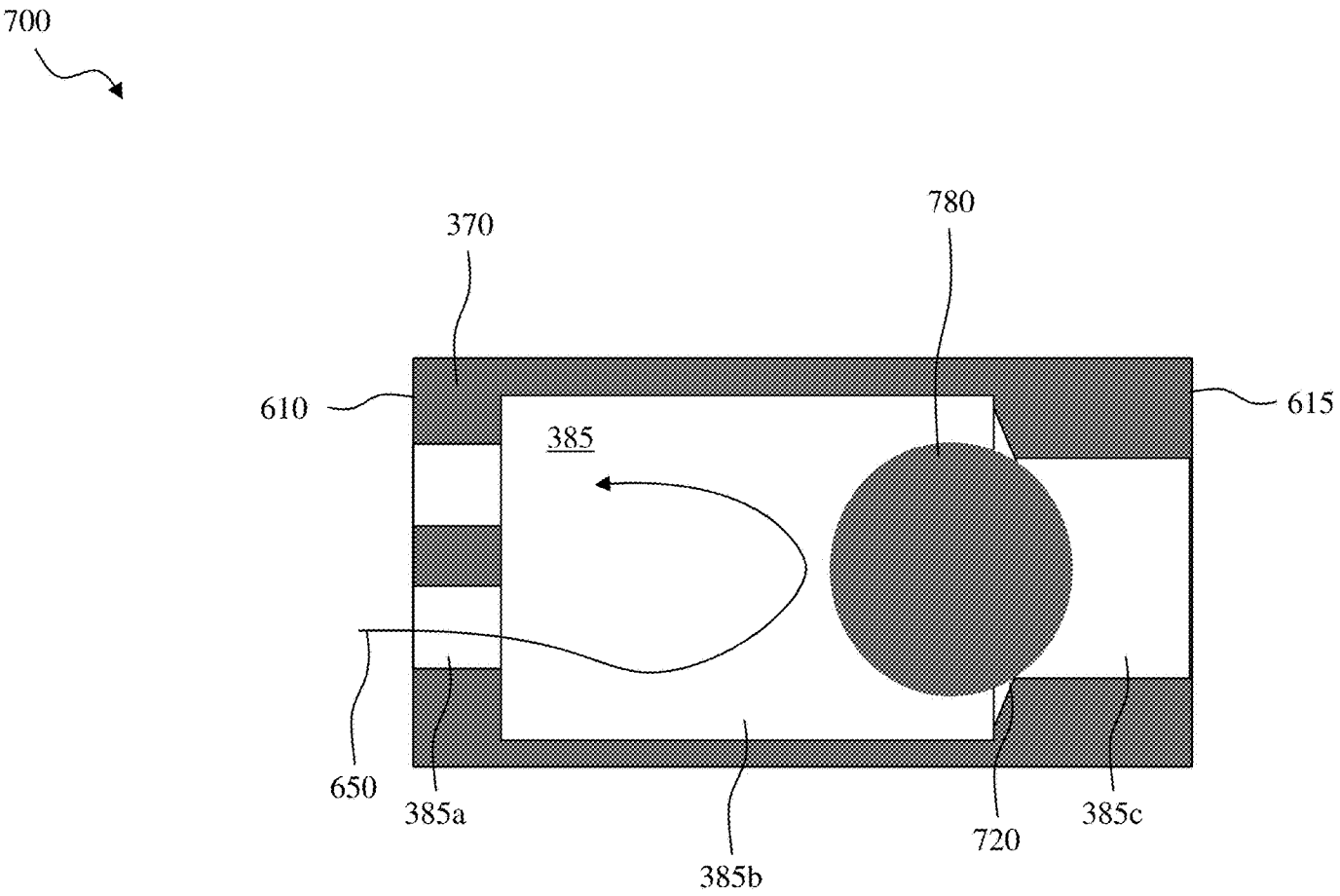

Turning to FIGS. 7A and 7B, illustrated are various different views of a multilateral fluid loss device 700 designed and manufactured at different stages of operation in accordance with an alternative embodiment of the disclosure. The multilateral fluid loss device 700 of FIGS. 7A and 7B is similar in many respects to the multilateral fluid loss device 600 of FIGS. 6A and 6B. Accordingly, like reference numbers have been used to indicate similar, if not identical, features. The multilateral fluid loss device 700 differs, for the most part, from the multilateral fluid loss device 600, in that the plug member 780 is a ball. In at least this one embodiment, the ball is held in a first position by the degradable material 790, and thus the ball allows fluid 650 to traverse the fluid passageway 385 as it travels from the first end 610 to the second end 615. However, after the degradable material 790 had degraded, the ball is allowed to move to the second position and engage with a ball seat 720, thus preventing the fluid 650 from traversing the fluid passageway 385 as it travels from the first end 610 to the second end 615. The multilateral fluid loss device 700 also differs from the multilateral fluid loss device 600, in that the degradable material 790 is a cage of degradable material 790, and may or may not include the delay coating.

Figure 8:
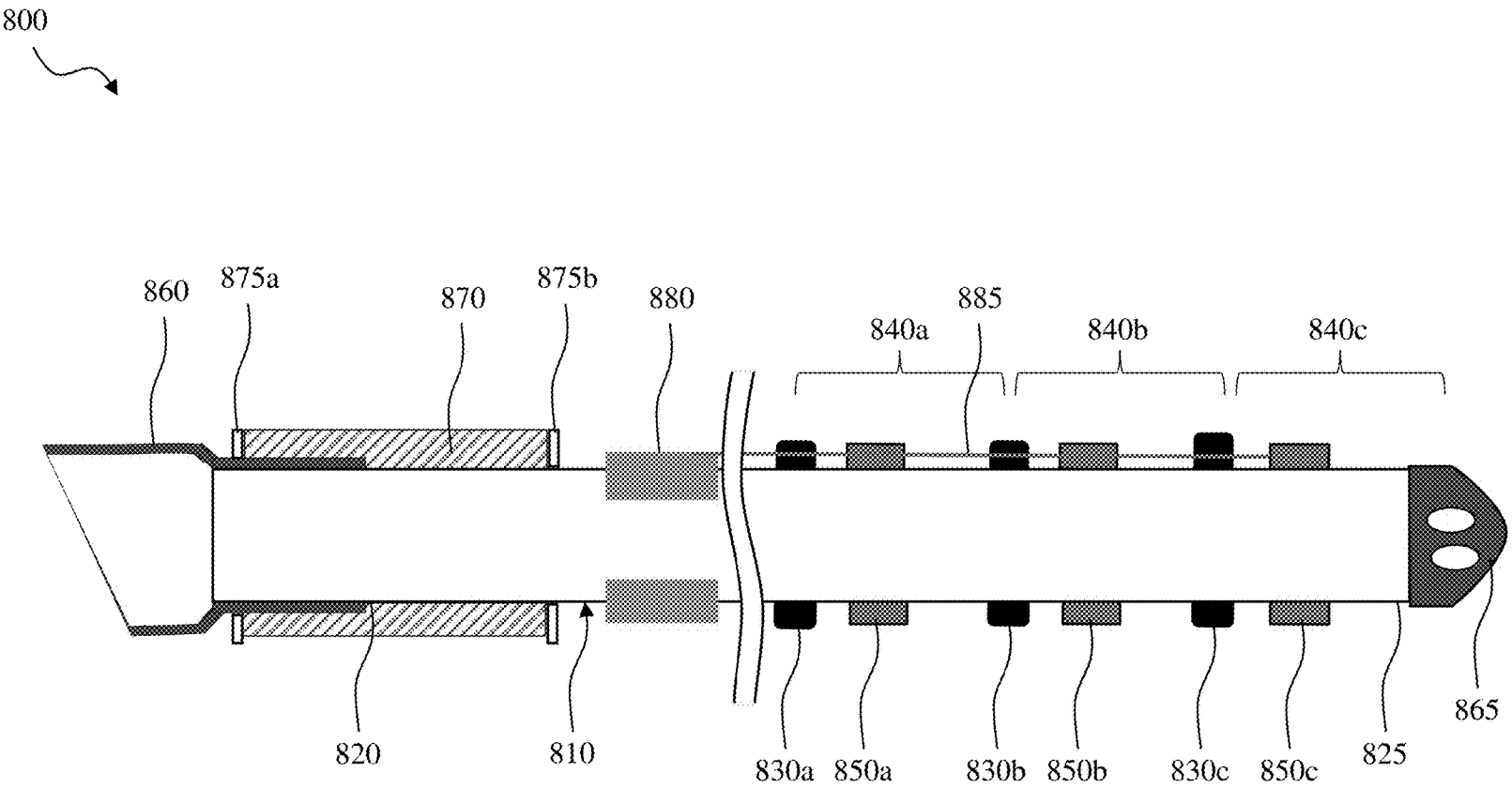
FIG. 8 illustrates a multilateral mainbore completion designed, manufactured and/or operated according to one or more embodiments of the disclosure.

Turning to FIG. 8, illustrated is a multilateral mainbore completion 800 designed, manufactured and/or operated according to one or more embodiments of the disclosure. The multilateral mainbore completion 800, in one or more embodiments, includes a tubular 810 having a first end 820 (e.g., uphole end) and a second end 825 (e.g., downhole end). The tubular 810, in one or more embodiments, is configured to extend through one or more subterranean formations, including in certain embodiments through one or more open hole subterranean formations.

The multilateral mainbore completion 800, in one or more embodiments, further includes first and second packers 830*a*, 830*b* located on a radial exterior surface of the tubular 810. In one or more embodiments, the first and second packers 830*a*, 830*b* are configured to move from a radially retracted state to a radially extended state to engage with a wellbore tubular (e.g., including without limitation an open hole wellbore, a cased wellbore, production tubing located within a wellbore, etc.) and separate the tubular 810 into first and second production zones 840*a*, 840*b*. In the embodiment of FIG. 8, the multilateral mainbore completion 800 includes a third packer 830*c* that separates the tubular into a third production zone 840*c*. Notwithstanding, any number of packers may be used and remain within the scope of the disclosure.

The multilateral mainbore completion 800, in one or more embodiments, further includes a first interval control valve 850*a* located in the tubular 810 in the first production zone 840*a* and a second interval control valve 850*b* located in the tubular 810 in the second production zone 840*b*. Any type of interval control valve may be used for the first and second interval control valves 850*a*, 850*b*, including an electronic interval control device (eICD), an autonomous interval control device (aICD), etc. and remain within the scope of the disclosure. In the embodiment of FIG. 8, the multilateral mainbore completion 800 includes a third interval control valve 850*c*. Notwithstanding, any number of interval control valves may be used and remain within the scope of the disclosure.

The multilateral mainbore completion 800, in one or more embodiments, further includes an orientation device 860 coupled to the first end 820 of the tubular 810. In at least one embodiment, the orientation device 860 is configured to engage with a separate uphole device to rotationally orient the separate uphole device within the wellbore tubular. In at least one embodiment, the orientation device 860 is a muleshoe or scoop type orientation device configured to rotationally orient a multilateral whipstock assembly or multilateral junction sleeve assembly, among others. Nevertheless, the present disclosure should not be limited to any specific type of orientation device. In the illustrated embodiment of FIG. 8, the multilateral mainbore completion 800, may additionally include a float shoe 865 located at the second end 825 of the tubular 810.

The multilateral mainbore completion 800, in one or more embodiments, further includes an expandable metal anchor 870 positioned on the radial exterior surface of the tubular 810. In at least one embodiment, the expandable metal anchor 870 includes a metal configured to expand in response to hydrolysis to axially and rotationally fix the tubular 810 with respect to the wellbore tubular. For example, upon subjecting the expandable metal anchor 870 to reactive fluid, the expandable metal goes from metal to micron-scale particles that are larger and lock together to form an expanded metal anchor that anchors and/or seals the multilateral mainbore completion 800 within the wellbore tubular. Those skilled in the art understand that for the expandable metal anchor 870 to work as intended (e.g., turn into an expanded metal anchor), the volume of space that the expandable metal is located should be small enough such that the expandable metal expands into contact with the one or more surfaces upon undergoing hydrolysis, while volumetrically expanding no more than its total achievable volumetric expansion.

In at least one embodiment, the expandable metal anchor 870 is positioned between the first packer 830*a* and the orientation device 860. For example, in at least one embodiment, the expandable metal anchor 870 is placed within 100 m of the orientation device 860. In yet another embodiment, the expandable metal anchor 870 is placed within 20 m of the orientation device 860. In even yet another embodiment, the expandable metal anchor 870 is placed within 5 m, if not 3 m, if not 1 m of the orientation device 860. In at least one embodiment, the expandable metal anchor 870 spans at least a portion of the tubular 810 and the orientation device 860, and thus ultimately anchors the tubular 810 and the orientation device 860. Further to the embodiment, of FIG. 8, first and second end rings 875*a*, 875*b* may be located on opposing ends of the expandable metal anchor 870.

The multilateral mainbore completion 800, in one or more embodiments, further includes a control line coupler 880 located on the tubular 810. In one or more embodiments, the control line coupler 880 is located between the first packer 830*a* and the expandable metal anchor 870. While a variety of different control line couplers may be used, in at least one embodiment the control line coupler is an inductive coupler or wet mate coupler.

The multilateral mainbore completion 800, in one or more embodiments, further includes a control line 885 that extends downhole from the control line coupler 880. For example, in at least one embodiment, the first packer 830*a* is a first feedthrough packer, and the control line 885 extends from the control line coupler 880 through the first feedthrough packer to the first interval control valve 850*a*. In yet another embodiment, the second packer 830*b* is also a second feedthrough packer, and the control line 885 extends from the control line coupler 880 through the first feedthrough packer and the second feedthrough packer to the second interval control valve 850*b*. The same theory could hold true if the multilateral mainbore completion 800 were to comprise three or more feedthrough packers.

Figure 9A:
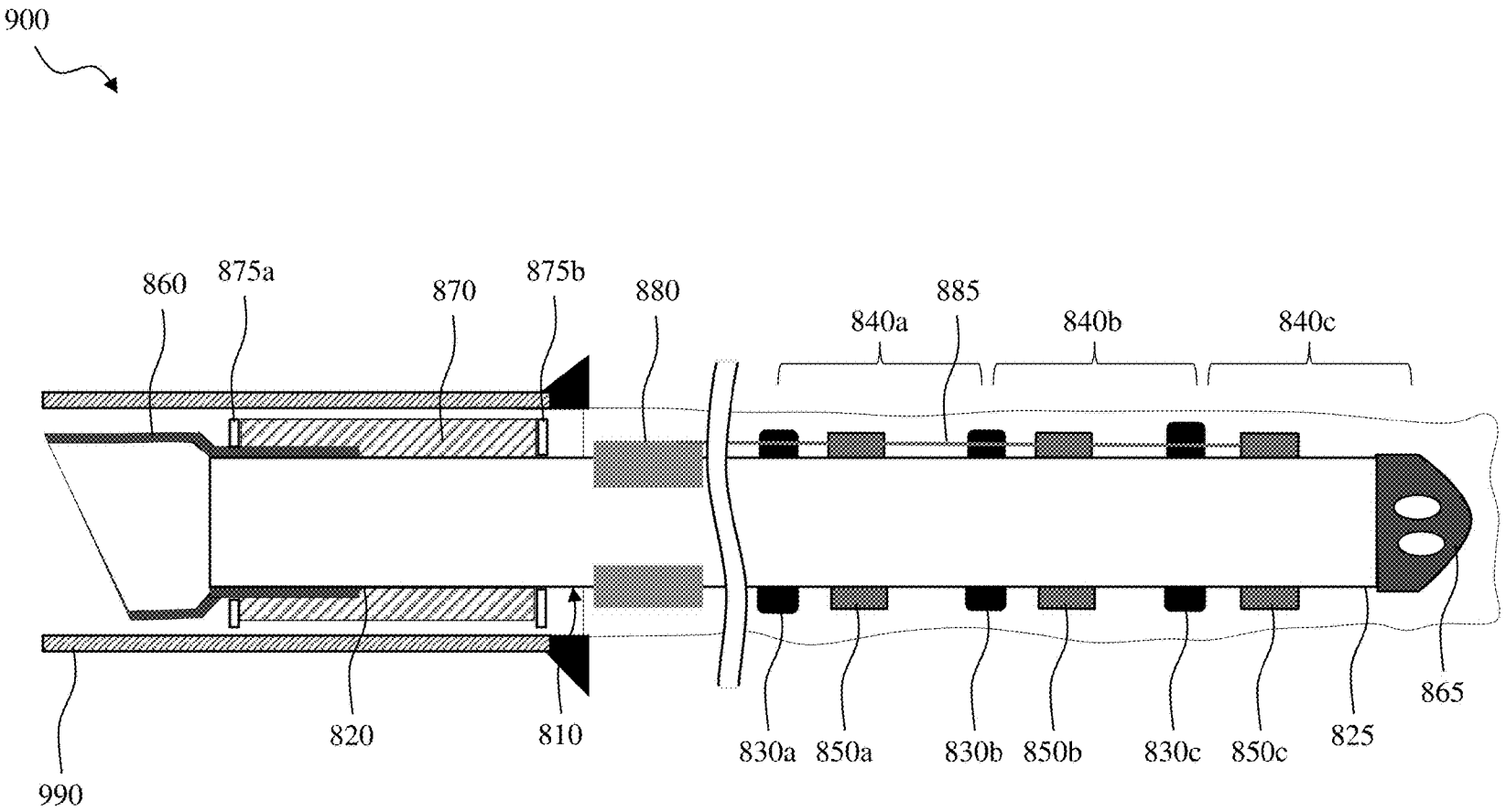
FIGS. 9A through 9C illustrate various different manufacturing states for a multilateral mainbore completion designed, manufactured and/or operated according to the disclosure, and placed within a wellbore tubular.
Figure 9B:
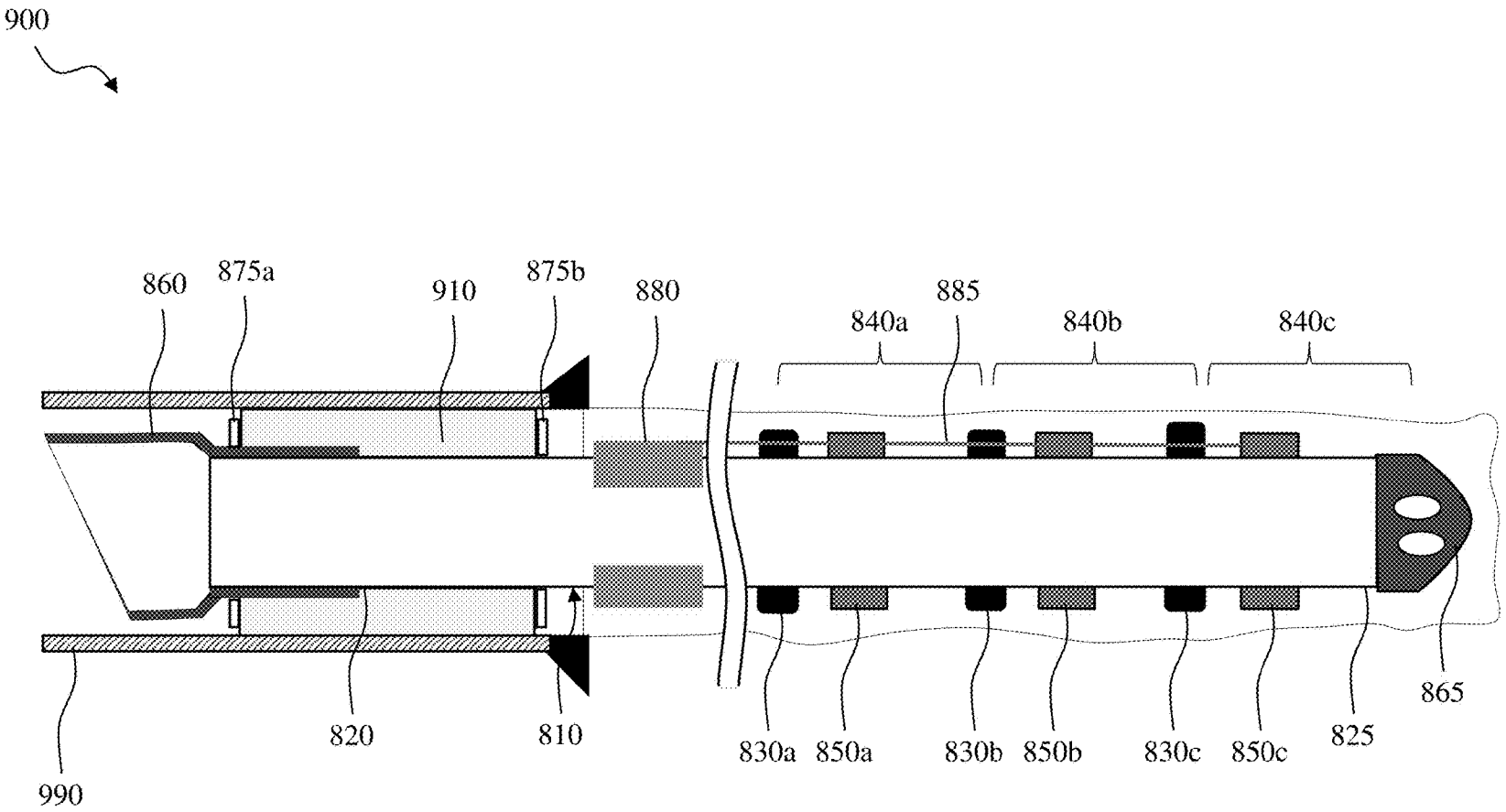
Figure 9C:
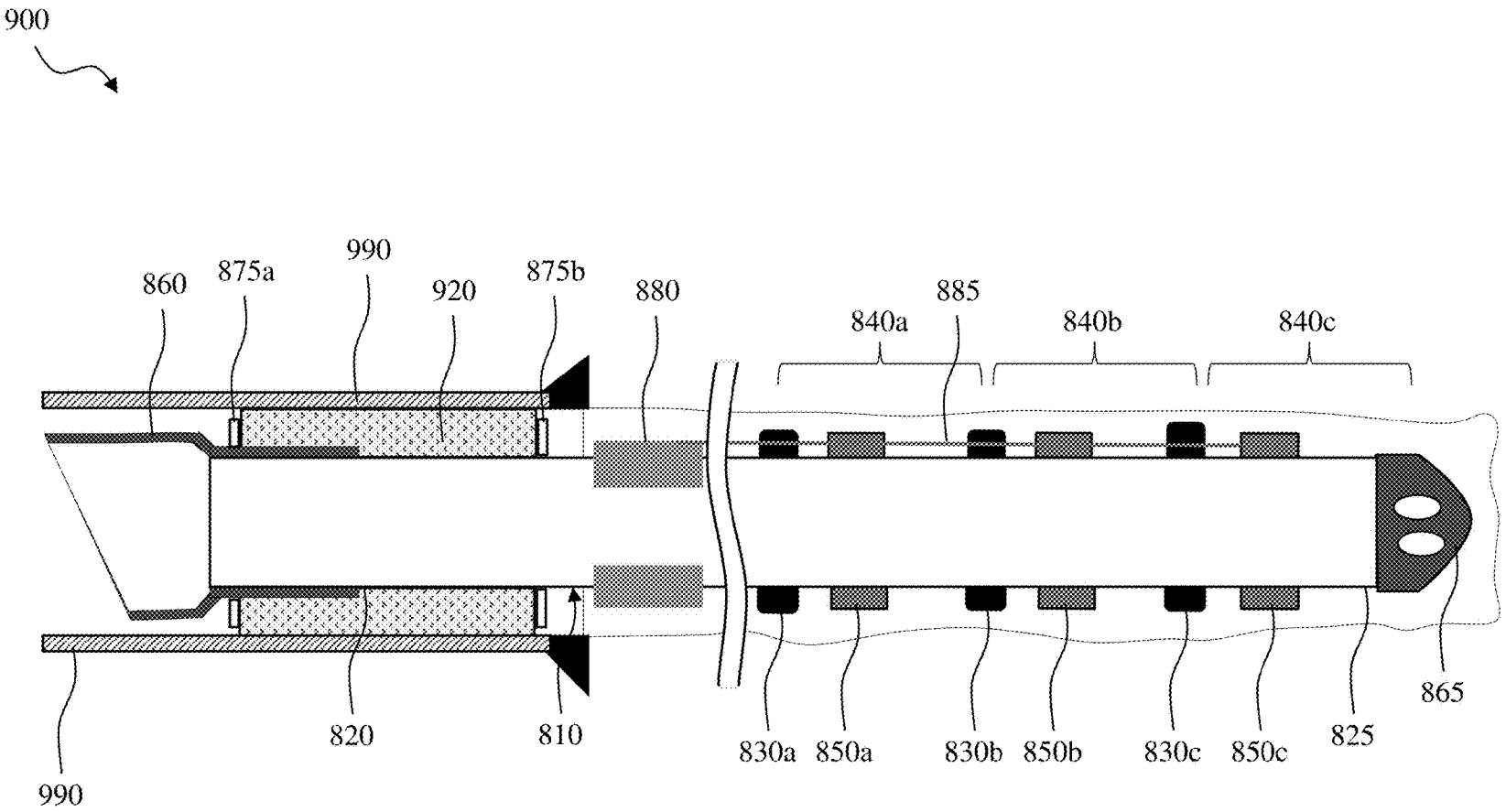

Turning to FIGS. 9A through 9C, depicted are various different manufacturing states for a multilateral mainbore completion 900 designed, manufactured and/or operated according to the disclosure, and placed within a wellbore tubular 990. The multilateral mainbore completion 900 of FIGS. 9A through 9C is similar in many respects to the multilateral mainbore completion 800 of FIG. 8. Accordingly, like reference numbers have been used to indicate similar, if not identical, features.

With reference to FIG. 9A, the expandable metal anchor 870 is positioned about the tubular 810 and between the tubular 810 and the wellbore tubular 990. The expandable metal anchor 870, in accordance with one or more embodiments of the disclosure, comprises a metal configured to expand in response to hydrolysis. The expandable metal anchor 870, in the illustrated embodiment, may comprise any of the expandable metals discussed above, or any combination of the same. The expandable metal anchor 870 may have a variety of different lengths and thicknesses, for example depending on the amount of anchoring force that is needed, as well as whether it is desired for the expandable metal anchor 870 to function as a seal when subjected to reactive fluid, and remain within the scope of the disclosure.

With reference to FIG. 9B, illustrated is the expandable metal anchor 870 illustrated in FIG. 9A after subjecting it to a reactive fluid to expand the metal in the space, and thereby form an expanded metal anchor 910. In the illustrated embodiment, the expanded metal anchor 910 generally fills the space. Notwithstanding the foregoing, the expanded metal anchor 910 may have a variety of different volumes and remain within the scope of the disclosure. Such volumes, as expected, are a function of the size of the space, the volume of the expandable metal anchor 870, and the composition of the expandable metal anchor 870, among other factors.

With reference to FIG. 9C, illustrated is the expandable metal anchor 870 illustrated in FIG. 9A after subjecting it to a reactive fluid to expand the metal in the space, and thereby form an expanded metal anchor 920 including residual unreacted expandable metal therein. In one embodiment, expanded metal anchor 920 includes at least 1% residual unreacted expandable metal therein. In yet another embodiment, the expanded metal anchor 920 includes at least 3% residual unreacted expandable metal therein. In even yet another embodiment, the expanded metal anchor 920 includes at least 10% residual unreacted expandable metal therein, and in certain embodiments at least 20% residual unreacted expandable metal therein.

Figure 10A:
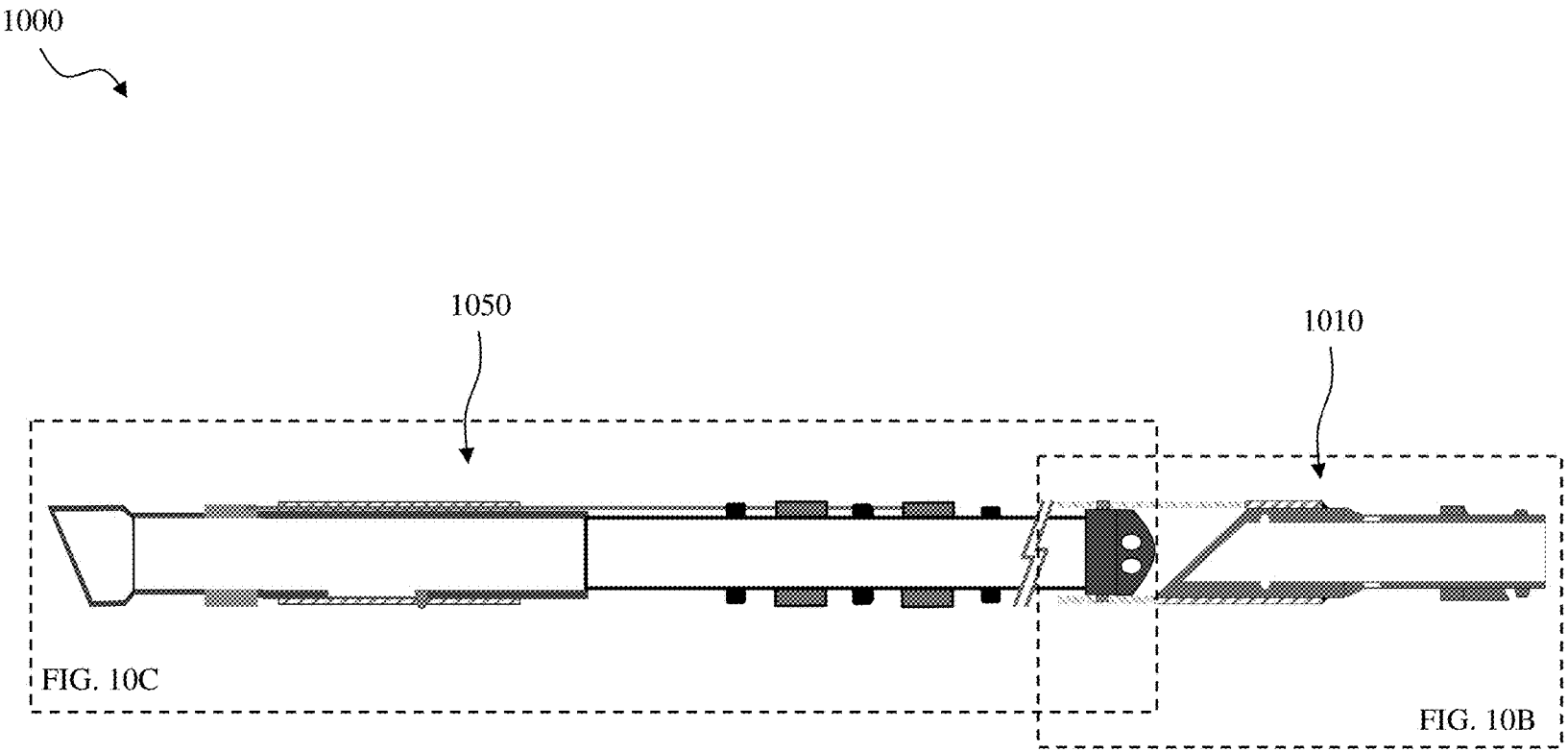
FIG. 10A illustrates is multilateral downhole assembly designed, manufactured and/or operated according to one or more embodiments of the disclosure.

Turning to FIG. 10A, illustrated is multilateral downhole assembly 1000 designed, manufactured and/or operated according to one or more embodiments of the disclosure. The multilateral downhole assembly 1000, in one or more embodiments, includes a multilateral deflector assembly 1010 coupled to a running tool, in this embodiment the running tool being a multilateral junction assembly 1050.

Figure 10B:
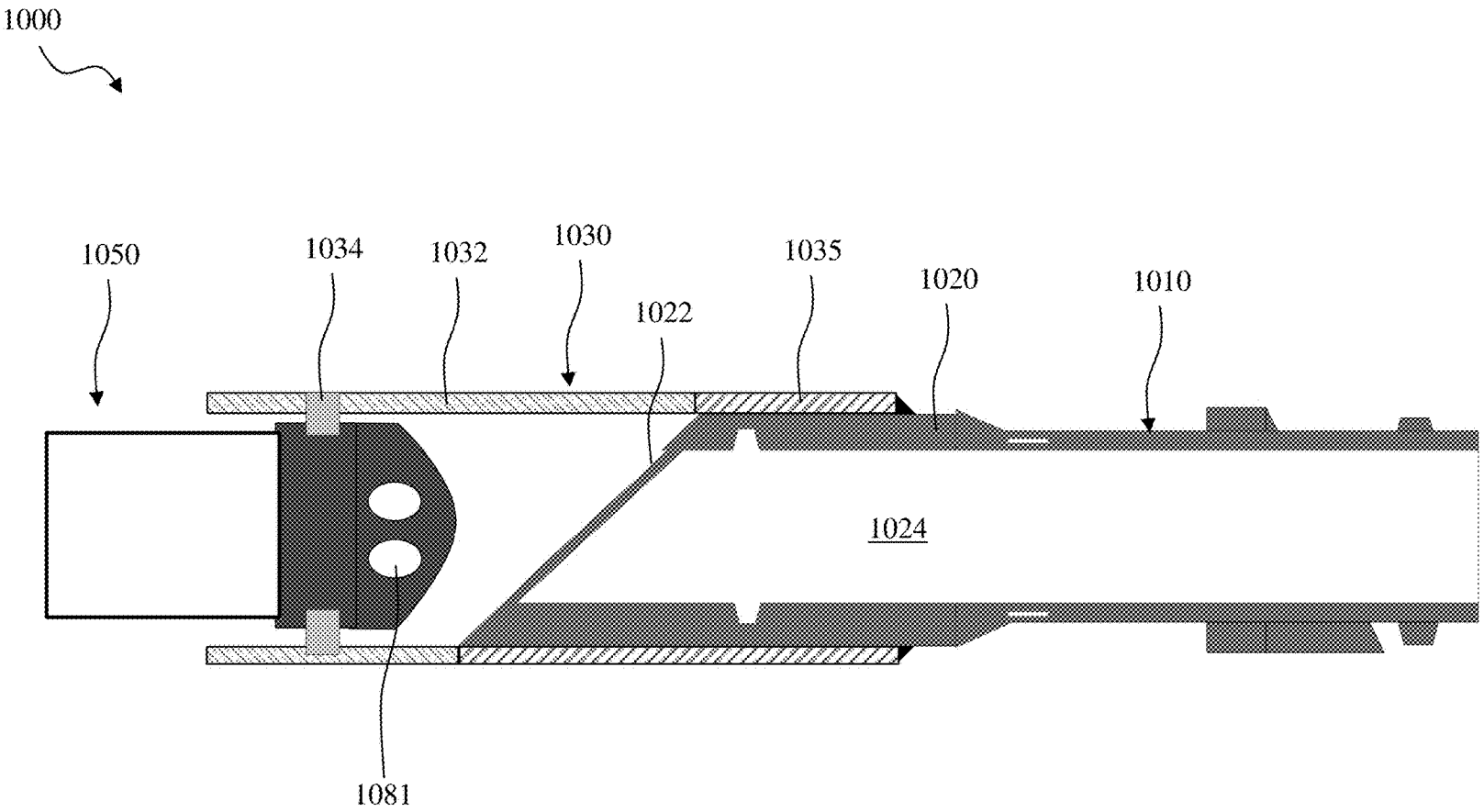
FIG. 10B illustrates an enlarged view of the multilateral deflector assembly of FIG. 10A coupled to an end of the multilateral junction assembly.

Turning to FIG. 10B, illustrated is an enlarged view of the multilateral deflector assembly 1010 of FIG. 10A coupled to an end of the multilateral junction assembly 1050. In at least one embodiment, the multilateral deflector assembly 1010 includes a deflector body 1020 having a deflector face 1022 and an opening 1024 extending therethrough. In one or more embodiments, the multilateral junction assembly 1050 (e.g., running tool) is coupled to the multilateral deflector assembly 1010 using a degradable material coupling mechanism 1030. In at least one embodiment, the degradable material coupling mechanism 1030 is configured to degrade over time and allow the multilateral junction assembly 1050 (e.g., running tool) to release from the multilateral deflector assembly 1010, for example after the multilateral deflector assembly 1010 is axially and rotationally fixed within the wellbore.

The multilateral deflector assembly 1010 of FIG. 10B additionally includes an expandable metal anchor 1035 positioned on a radial exterior surface of the deflector body 1020. In one or more embodiments, the expandable metal anchor 1035 includes a metal configured to expand in response to hydrolysis to axially and rotationally fix the multilateral deflector assembly 1010 within a wellbore tubular. In at least one such embodiment, the degradable material coupling mechanism 1030 is a metal based degradable material coupling mechanism. For example, in at least one embodiment, the metal based degradable material coupling mechanism is an expandable metal coupling mechanism configured to expand in response to hydrolysis and then degrade to allow the multilateral junction assembly 1050 (e.g., running tool) to release from the multilateral deflector assembly 1010. For example, the expandable metal coupling mechanism is configured to expand in response to hydrolysis and after the hydrolysis has completed then degrade to allow the multilateral junction assembly 1050 (e.g., running tool) to release from the multilateral deflector assembly 1010.

In one example embodiment, the degradable material coupling mechanism 1030 and the expandable metal anchor 1035 are a single unitary layer of expandable metal including the metal configured to expand in response to hydrolysis. In this embodiment, the single unitary layer of expandable metal is configured to degrade to allow the multilateral junction assembly 1050 (e.g., running tool) to release from the multilateral deflector assembly 1010 while forming an expanded metal anchor to axially and rotationally fix the multilateral deflector assembly 1010 within a wellbore tubular. For example, in one embodiment, the expanded metal anchor is configured to not extend uphole of the deflector face 1022, even though it originated as a single unitary layer of expandable metal.

While the above has been discussed as employing expandable metal for the degradable material, in yet another embodiment the degradable material is a polymer based degradable material, or another known material, while the expandable metal anchor 1035 still employs a metal configured to expand in response to hydrolysis. In the illustrated embodiment, the degradable material coupling mechanism 1030 includes a first sleeve portion 1032 coupled to the multilateral deflector assembly 1010 and a second post portion 1034 coupling the multilateral junction assembly 1050 (e.g., running tool) with the first sleeve portion 1032. Furthermore, in at least one embodiment, the multilateral junction assembly 1050 (e.g., running tool) includes one or more flow ports 1081 configured to provide reactive fluid to the degradable material coupling mechanism 1030.

Figure 10C:
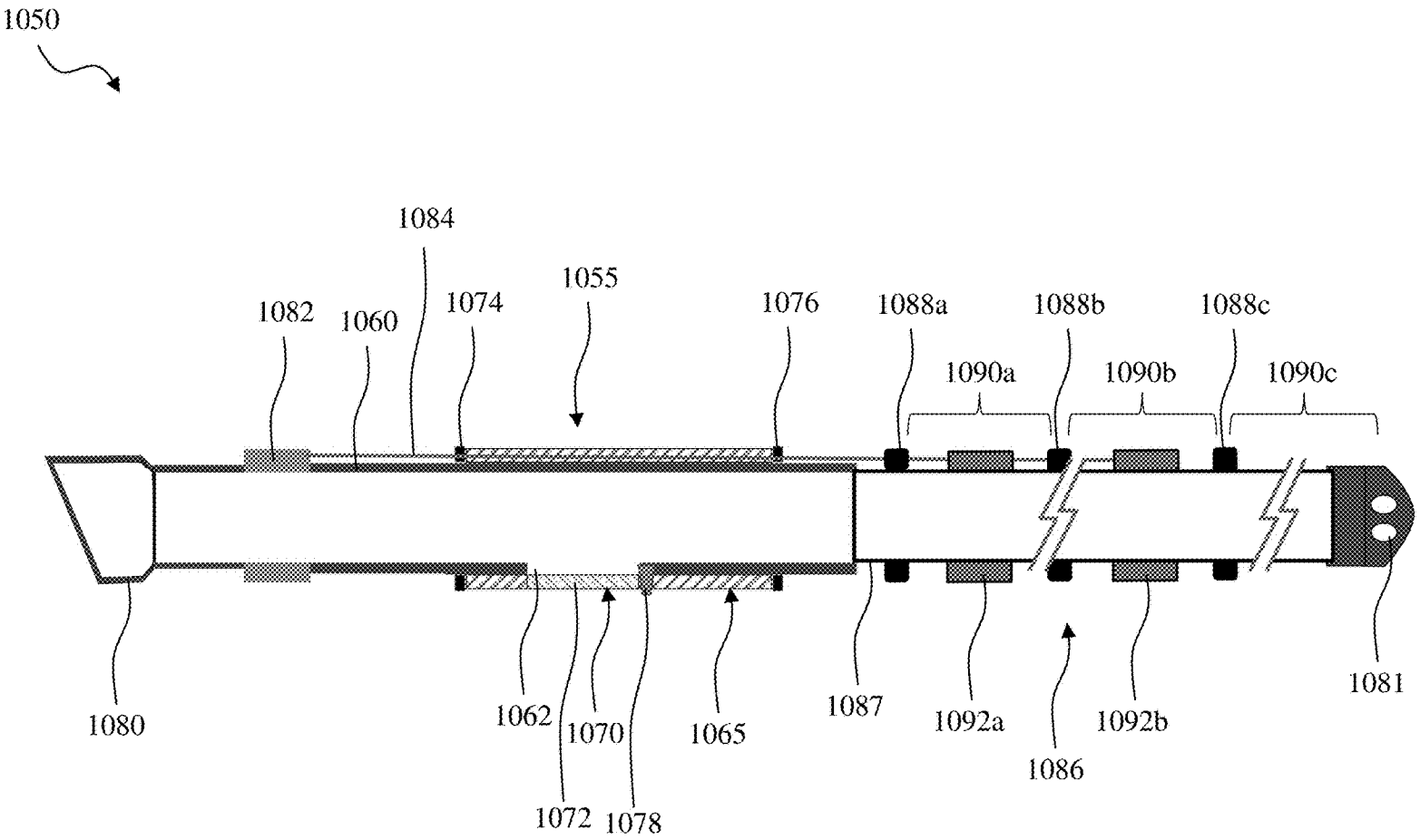
FIGS. 10C and 10D illustrate enlarged views of the multilateral junction assembly of FIG. 10A.
Figure 10D:
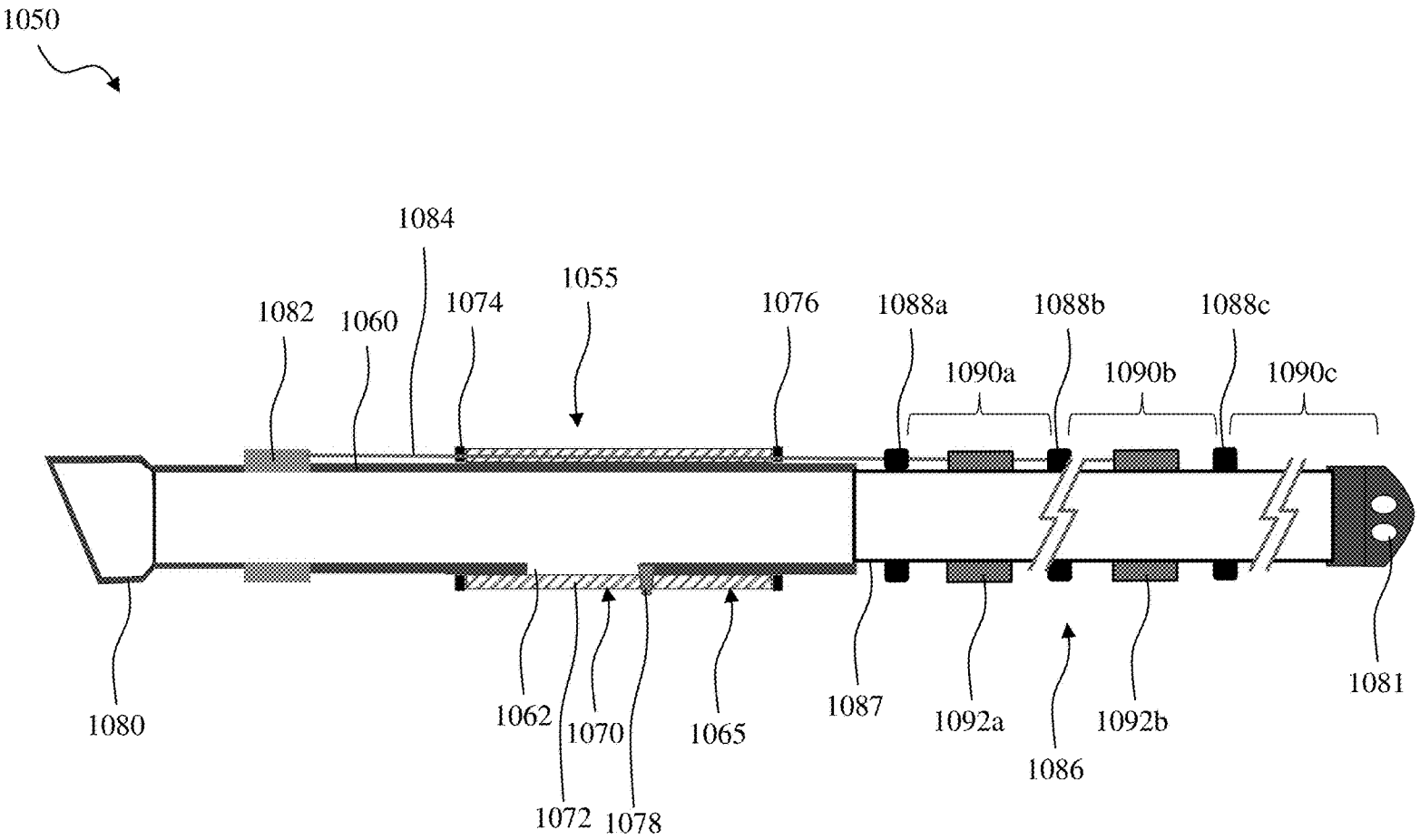

Turning to FIGS. 10C and 10D, illustrated are enlarged views of the multilateral junction assembly 1050 of FIG. 10A. The multilateral junction assembly 1050, in the illustrated embodiment, includes a transition sleeve assembly 1055, and a multilateral lateral bore completion 1086 coupled to a downhole end of the transition sleeve assembly 1055. The transition sleeve assembly 1055, in one embodiment, includes a transition sleeve body 1060 having a sidewall opening 1062 in a sidewall thereof. In at least this one embodiment, the sidewall opening 1062 is configured to align with a main wellbore when the transition sleeve assembly 1055 is at least partially insert within a lateral wellbore.

The transition sleeve assembly 1055, in the illustrated embodiment, further includes an expandable metal anchor 1065 positioned on a radial exterior surface of the transition sleeve body 1060, and degradable material 1070 positioned on a radial surface (e.g., radial exterior surface) of the transition sleeve body 1060 covering the sidewall opening 1062. In one or more embodiments, the expandable metal anchor 1065 includes a metal configured to expand in response to hydrolysis to axially and rotationally fix the multilateral junction assembly 1050 within a wellbore tubular, for example forming at least a part of a Level-5 junction. In one or more embodiments, such as is illustrated in FIG. 10C, the expandable metal anchor 1065 is positioned on the radial exterior surface of the transition sleeve body 1060 uphole and downhole the sidewall opening 1062, the expandable metal anchor 1065 configured to fix the transition sleeve body 1060 within a wellbore tubular uphole and downhole the sidewall opening 1062. The expandable metal anchor 1065 may comprise any of the expandable metals discussed above, so long as it expands into contact with a wellbore tubular and forms an expanded metal anchor and/or seal.

In the illustrated embodiment of FIG. 10C, the degradable material 1070 is a layer of degradable material 1072 positioned on the radial exterior surface of the transition sleeve body 1060 covering the sidewall opening 1062. The layer of degradable material 1072 may comprise any material known to degrade over time, as well as any of the materials disclosed above. In one or more embodiments, however, the layer of degradable material 1072 is a layer of polymer based degradable material positioned over the sidewall opening 1062. In yet another embodiment, however, the layer of degradable material 1072 is a layer of metal based degradable material. For example, in at least one embodiment, the layer of metal based degradable material is a layer of expandable metal configured to expand in response to hydrolysis and then degrade to uncover the sidewall opening 1062. In this embodiment, the layer of expandable metal is configured to expand in response to hydrolysis and after the hydrolysis has completed then degrade to uncover the sidewall opening 1062.

In accordance with at least one embodiment, for example when the layer of degradable material 1072 comprises a layer of expandable metal configured to expand in response to hydrolysis, the layer of expandable metal and the expandable metal anchor 1065 are a single unitary layer of expandable metal including the metal configured to expand in response to hydrolysis. In at least one embodiment, the single unitary layer of expandable metal is configured to degrade around the sidewall opening 1062 but form an expanded metal anchor outside of the sidewall opening 1062. Accordingly, the single unitary layer of expandable metal has the dual purpose of degrading and forming the expanded metal anchor, and can be located axially and radially below the sidewall opening 1062. Such an embodiment is shown in FIG. 10D. In the illustrated embodiment of FIGS. 10C and 10D, first and second end rings 1074, 1076 are located on opposing ends of the expandable metal anchor 1065 (e.g., on opposing ends of the single unitary layer of expandable metal).

The multilateral junction assembly 1050, in at least one embodiment, may further include an orientation feature 1078 coupled to the transition sleeve body 1060 uphole or downhole of the sidewall opening 1062. In at least one embodiment, the orientation feature 1078 (e.g., a collet finger in one embodiment) is configured to provide proper orientation and space out of the transition sleeve assembly 1055. In one or more embodiments, the orientation feature 1078 is coupled to the transition sleeve body within 5 m uphole or downhole of the sidewall opening 1062, if not 3 m, if not 1 m. Furthermore, while the present disclosure may position the orientation feature 1078 uphole or downhole of the sidewall opening 1062, certain advantages exist in positioning it uphole of the sidewall opening 1062.

The multilateral junction assembly 1050, in at least one embodiment, may further include an orientation device 1080 (e.g., muleshoe) coupled to an uphole end of the transition sleeve body 1060. In at least one embodiment, the orientation device 1080 is configured to engage with a separate uphole device to rotationally orient the separate uphole device within the main wellbore. The multilateral junction assembly 1050, in at least one embodiment, may further include a control line coupler 1082 located on the transition sleeve body 1060 between the orientation device 1080 and the sidewall opening 1062. While a variety of different control line couplers 1082 may be used, in one or more embodiments, the control line coupler 1082 is an inductive coupler or a wet mate coupler. The multilateral junction assembly 1050, in at least one embodiment, may further include a control line 1084 that extends downhole from the control line coupler 1082.

The multilateral junction assembly 1050, and more particularly the multilateral lateral bore completion 1086, in one or more embodiments, further includes a tubular 1087 having a first end and a second end, and further includes first and second packers 1088*a*, 1088*b* located on a radial exterior surface of the tubular 1087. In one or more embodiments, the first and second packers 1088*a*, 1088*b* are configured to move from a radially retracted state to a radially extended state to engage with a wellbore tubular (e.g., including without limitation an open hole wellbore, a cased wellbore, production tubing located within a wellbore, etc.) and separate the multilateral lateral bore completion 1086 into first and second production zones 1090*a*, 1090*b*. In the embodiment of FIGS. 10C and 10D, the multilateral lateral bore completion 1086 includes a third packer 1088*c* that separates the multilateral lateral bore completion 1086 into a third production zone 1090*c*. Notwithstanding, any number of packers may be used and remain within the scope of the disclosure.

The multilateral lateral bore completion 1086, in one or more embodiments, further includes a first interval control valve 1092*a* located in the first production zone 1090*a* and a second interval control valve 1092*b* located in the second production zone 1090*b*. Any type of interval control valve may be used for the first and second interval control valves 1092*a*, 1092*b*, including an electronic interval control device (eICD), an autonomous interval control device (aICD), etc. and remain within the scope of the disclosure. Notwithstanding, any number of interval control valves may be used and remain within the scope of the disclosure.

In at least one embodiment, the control line 1084 extends downhole from the control line coupler 1082 toward the first and second interval control valves 1092*a*, 1092*b*. For example, in at least one embodiment, the first packer 1088*a* is a first feedthrough packer, and the control line 1084 extends from the control line coupler 1082 through the first feedthrough packer to the first interval control valve 1092*a*. In yet another embodiment, the second packer 1088*b* is also a second feedthrough packer, and the control line 1084 extends from the control line coupler 1082 through the first feedthrough packer and the second feedthrough packer to the second interval control valve 1092*b*. The same theory could hold true if the multilateral lateral bore completion 1086 were to comprise three or more feedthrough packers.

Figure 11A:
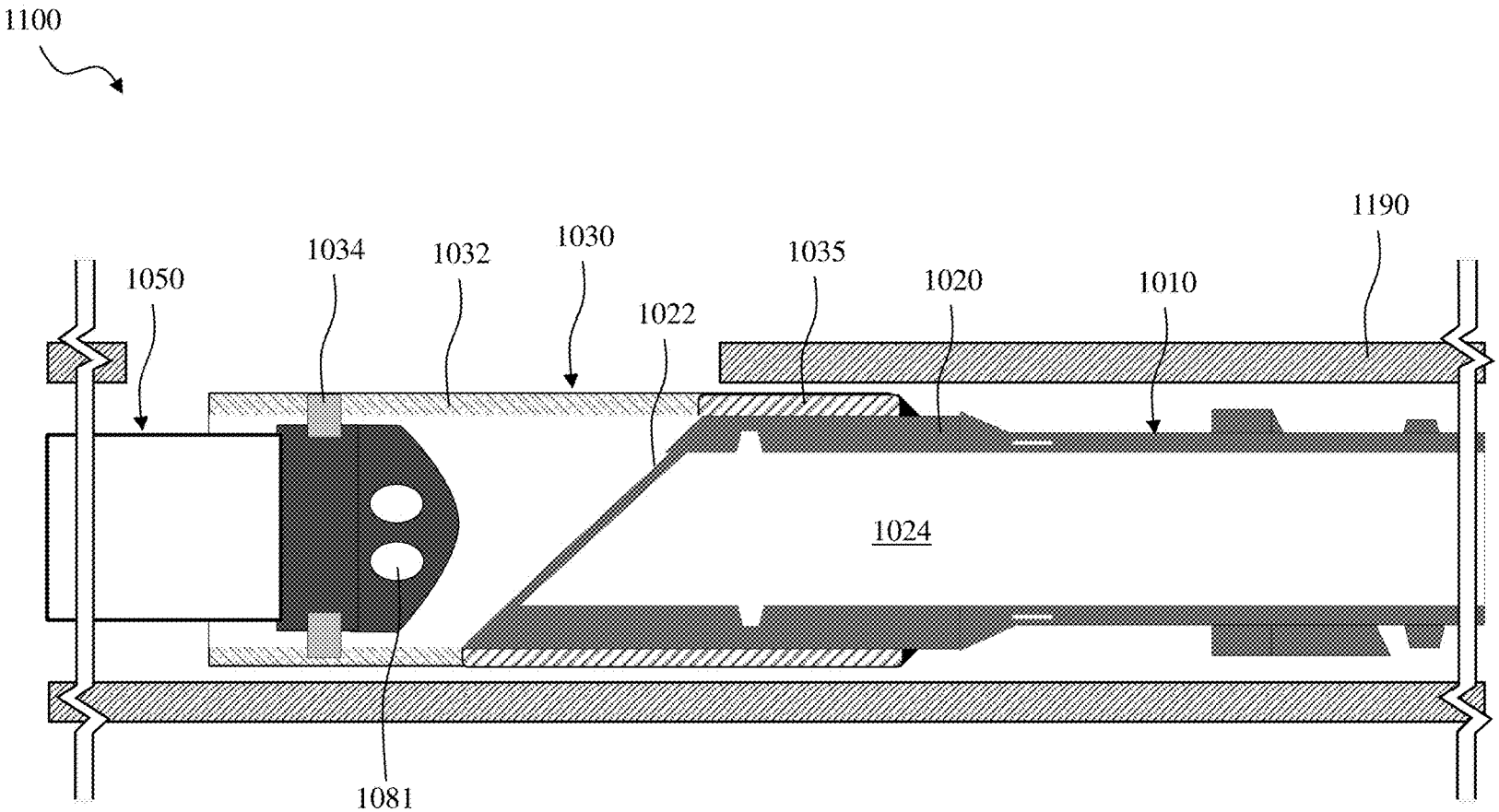
FIGS. 11A through 11C illustrate various different manufacturing states for a multilateral downhole assembly designed, manufactured and/or operated according to the disclosure, and placed within a wellbore tubular.
Figure 11B:
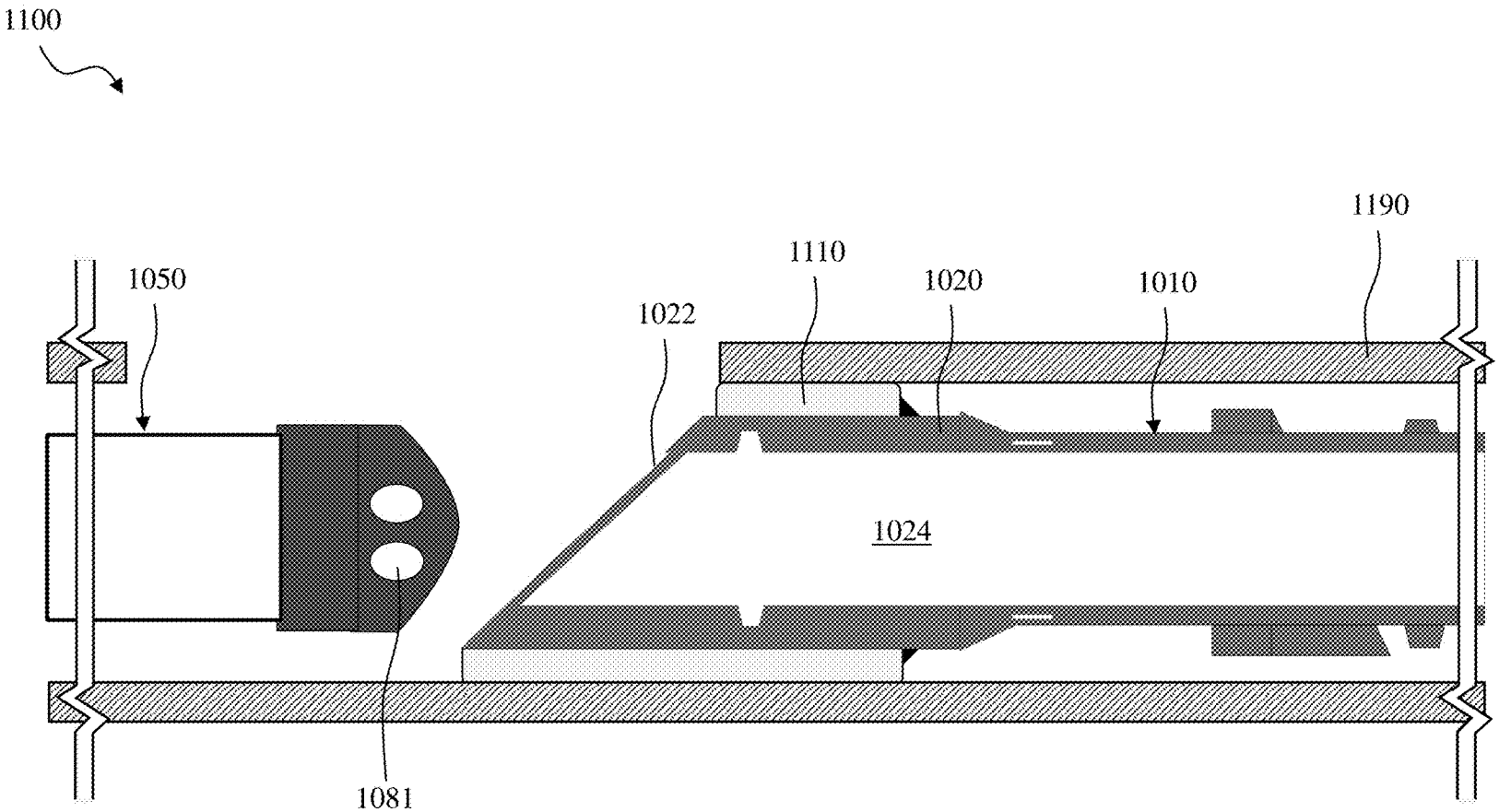
Figure 11C:
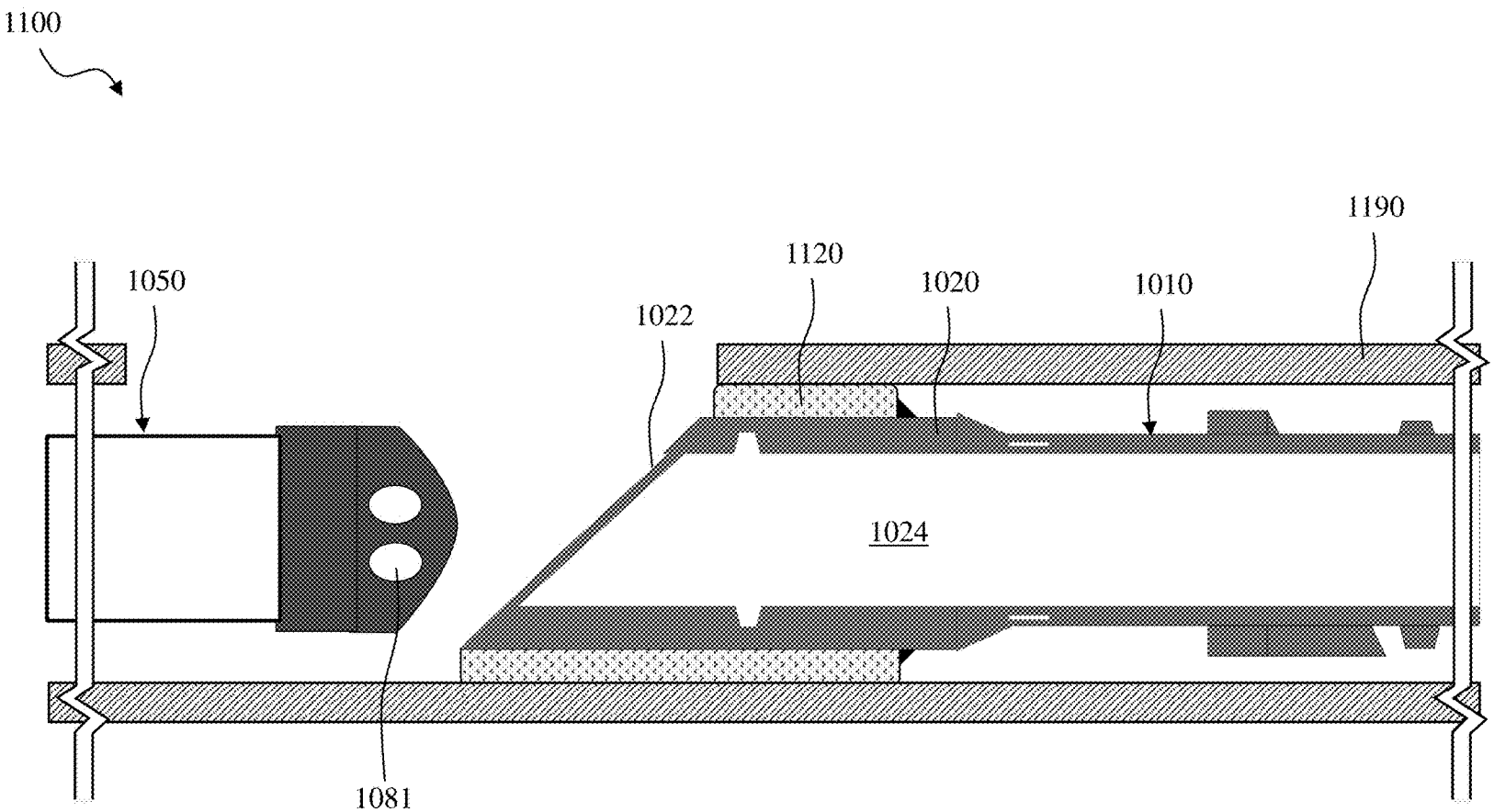

Turning to FIGS. 11A through 11C, depicted are various different manufacturing states for a multilateral downhole assembly 1100 designed, manufactured and/or operated according to the disclosure, and placed within a wellbore tubular 1190. The multilateral downhole assembly 1100 of FIGS. 11A through 11C is similar in many respects to the multilateral downhole assembly 1000 of FIG. 10A. Accordingly, like reference numbers have been used to indicate similar, if not identical, features.

With reference to FIG. 11A, the multilateral downhole assembly 1100, including the multilateral deflector assembly 1010 and the multilateral junction assembly 1050 are located in the wellbore tubular 1190. In the illustrated embodiment, the multilateral junction assembly 1050 has positioned the multilateral deflector assembly 1010 within the wellbore tubular 1190 using the degradable material coupling mechanism 1030. As indicated above, the multilateral deflector assembly 1010 may include a metal configured to expand in response to hydrolysis. The expandable metal anchor 1035, in the illustrated embodiment, may comprise any of the expandable metals discussed above, or any combination of the same. The expandable metal anchor 1035 may have a variety of different lengths and thicknesses, for example depending on the amount of anchoring force that is needed, as well as whether it is desired for the expandable metal anchor 1035 to function as a seal when subjected to reactive fluid, and remain within the scope of the disclosure.

With reference to FIG. 11B, illustrated is the multilateral downhole assembly 1100 illustrated in FIG. 11A after subjecting it to a reactive fluid to expand the metal in the space, and thereby form an expanded metal anchor 1110. In the illustrated embodiment, the expanded metal anchor 1110 generally fills the space. Notwithstanding the foregoing, the expanded metal anchor 1110 may have a variety of different volumes and remain within the scope of the disclosure, and in one embodiment may not extend uphole of the deflector face 1022. Such volumes, as expected, are a function of the size of the space, the volume of the expandable metal anchor 1035, and the composition of the expandable metal anchor 1035, among other factors.

In the illustrated embodiment of FIG. 11B, the degradable material coupling mechanism 1030 also comprises the material configured to expand in response to hydrolysis. However, given the limited volume of the degradable material coupling mechanism 1030 relative to the space surrounding it, the degradable material coupling mechanism 1030 degrades over time and allows the multilateral junction assembly 1050 to release from the multilateral deflector assembly 1010. Accordingly, a single unitary layer of expandable metal may both result in the expanded metal anchor 1110, as well as degrade to release from the multilateral deflector assembly 1010.

With reference to FIG. 11C, illustrated is the multilateral downhole assembly 1100 illustrated in FIG. 11A after subjecting it to a reactive fluid to expand the metal in the space, and thereby form an expanded metal anchor 1120 including residual unreacted expandable metal therein. In one embodiment, expanded metal anchor 1120 includes at least 1% residual unreacted expandable metal therein. In yet another embodiment, the expanded metal anchor 1120 includes at least 3% residual unreacted expandable metal therein. In even yet another embodiment, the expanded metal anchor 1120 includes at least 10% residual unreacted expandable metal therein, and in certain embodiments at least 20% residual unreacted expandable metal therein.

Figure 12:
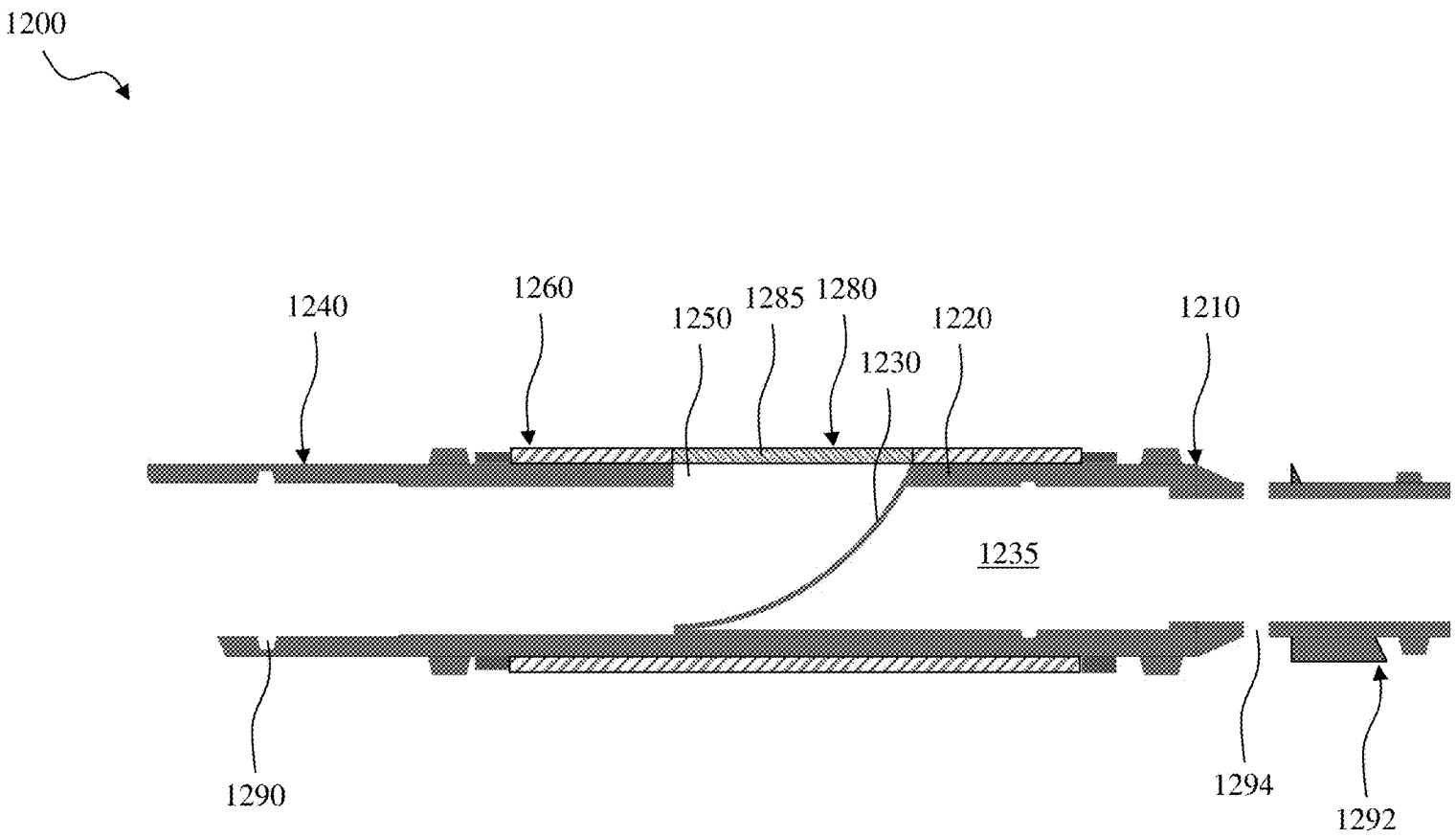
FIG. 12 illustrates a multilateral junction sleeve assembly designed, manufactured and/or operated according to one or more embodiments of the disclosure.

Turning now to FIG. 12, illustrated is a multilateral junction sleeve assembly 1200 designed, manufactured and/or operated according to one or more embodiments of the disclosure. In the illustrated embodiment of FIG. 12, the multilateral junction sleeve assembly includes a multilateral deflector assembly 1210 according to one embodiment. In at least one embodiment, the multilateral deflector assembly 1210 includes a deflector body 1220 having a deflector face 1230 and an opening 1235 extending therethrough. In at least one embodiment, the multilateral deflector assembly 1210 is configured to deflect a downhole tool into a lateral wellbore that is at least partially aligned with the opening 1235.

The multilateral junction sleeve assembly 1200, in the illustrated embodiment, further includes a deflector assembly sleeve 1240 coupled to an uphole end of the deflector body 1220. In at least one embodiment, the deflector assembly sleeve 1240 has a sidewall opening 1250 in a sidewall thereof aligned with the deflector face 1230.

The multilateral junction sleeve assembly 1200, in the illustrated embodiment, further includes one or more of an expandable metal anchor 1260 positioned on a radial exterior surface of the deflector assembly sleeve 1240 and degradable material 1280 positioned on a radial exterior surface of the deflector assembly sleeve 1240 covering the sidewall opening 1250. In one or more embodiments, the expandable metal anchor 1260 includes a metal configured to expand in response to hydrolysis to axially and rotationally fix the multilateral deflector assembly 1210 within a wellbore tubular. In one or more embodiments, such as is illustrated in FIG. 12, the expandable metal anchor 1260 is positioned on the radial exterior surface of the deflector assembly sleeve 1240 uphole and downhole the sidewall opening 1250, the expandable metal anchor configured to fix the multilateral deflector assembly 1210 within a wellbore tubular uphole and downhole the sidewall opening 1250. The expandable metal anchor 1260 may comprise any of the expandable metals discussed above, so long as it expands into contact with a wellbore tubular and forms an expanded metal anchor.

In the illustrated embodiment of FIG. 12, the degradable material 1280 is a layer of degradable material 1285 positioned on the radial exterior surface of the deflector assembly sleeve 1240 covering the sidewall opening 1250. The layer of degradable material 1285 may comprise any material known to degrade over time, as well as any of the materials disclosed above. In one or more embodiments, however, the layer of degradable material 1285 is a layer of polymer based degradable material positioned between open ends of the expandable metal anchor 1260. In yet another embodiment, however, the layer of degradable material 1285 is a layer of metal based degradable material. For example, in at least one embodiment, the layer of metal based degradable material is a layer of expandable metal configured to expand in response to hydrolysis and then degrade to uncover the sidewall opening 1250. In this embodiment, the layer of expandable metal is configured to expand in response to hydrolysis and after the hydrolysis has completed then degrade to uncover the sidewall opening 1250.

In accordance with at least one embodiment, for example when the layer of degradable material 1285 comprises a layer of expandable metal configured to expand in response to hydrolysis, the layer of expandable metal and the expandable metal anchor 1260 are a single unitary layer of expandable metal including the metal configured to expand in response to hydrolysis. In at least one embodiment, the single unitary layer of expandable metal is configured to degrade around the sidewall opening 1250 but form an expanded metal anchor outside of the sidewall opening 1250. Accordingly, the single unitary layer of expandable metal has the dual purpose of degrading and forming the expanded metal anchor, and can be located axially and radially below the sidewall opening 1250.

The multilateral junction sleeve assembly 1200, in at least one embodiment, may further include an uphole orientation feature 1290 coupled to an uphole end of the deflector assembly sleeve 1240, and a downhole orientation feature 1292 coupled to a downhole end of the multilateral deflector assembly 1210. In at least one embodiment, the downhole orientation feature 1292 is both an orientation feature and a latch. The multilateral junction sleeve assembly 1200, and particularly the multilateral deflector assembly 1210, in one or more embodiments, may further include one or more flow ports 1294 located therein between the deflector face 1230 and the downhole orientation feature 1292.

Figure 13:
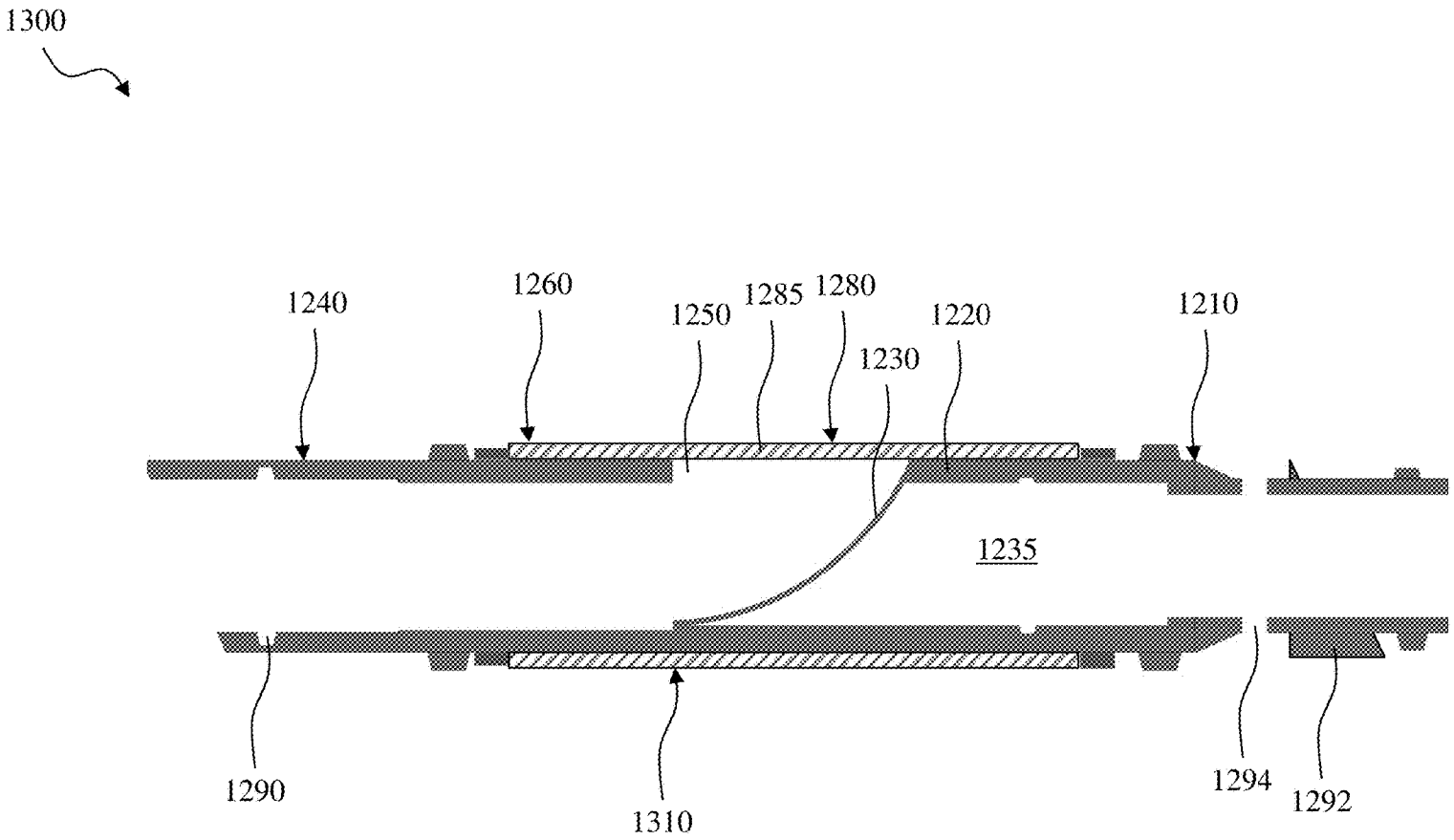
FIG. 13 illustrates a multilateral junction sleeve assembly designed, manufactured and/or operated according to one or more embodiments alternative embodiments of the disclosure.

Turning to FIG. 13, illustrated is a multilateral junction sleeve assembly 1300 designed, manufactured and/or operated according to one or more embodiments alternative embodiments of the disclosure. The multilateral junction sleeve assembly 1300 of FIG. 13 is similar in many respects to the multilateral junction sleeve assembly 1200 of FIG. 12. Accordingly, like reference numbers have been used to indicate similar, if not identical, features. The multilateral junction sleeve assembly 1300 differs, for the most part, from the multilateral junction sleeve assembly 1200, in that the multilateral junction sleeve assembly 1300 employs a single unitary layer of expandable metal 1310 for its expandable metal anchor 1260 and degradable material 1280.

Figure 14A:
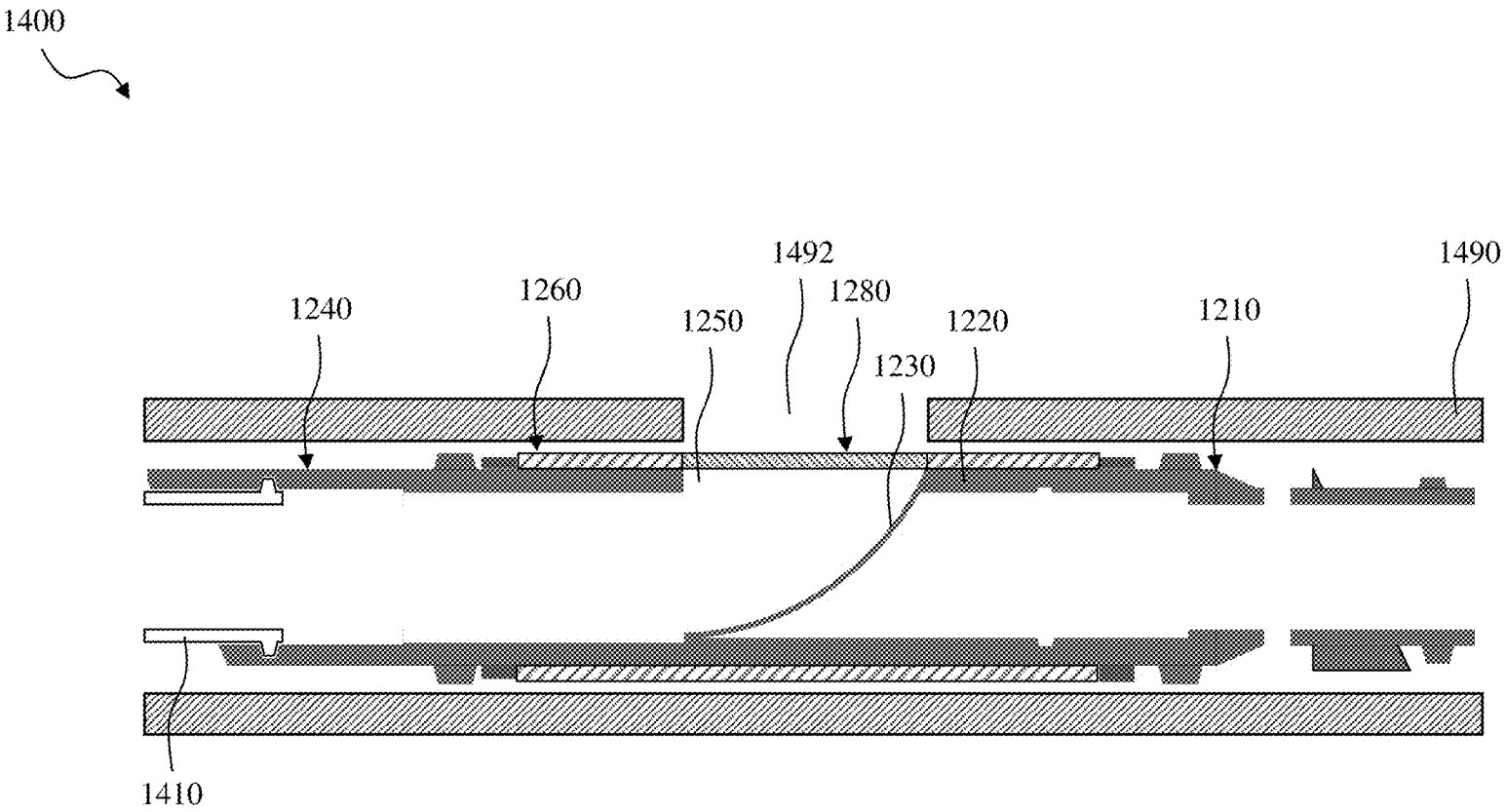
FIGS. 14A through 14C illustrate various different manufacturing states for a multilateral junction sleeve assembly designed, manufactured and/or operated according to the disclosure, and placed within a wellbore tubular.
Figure 14B:
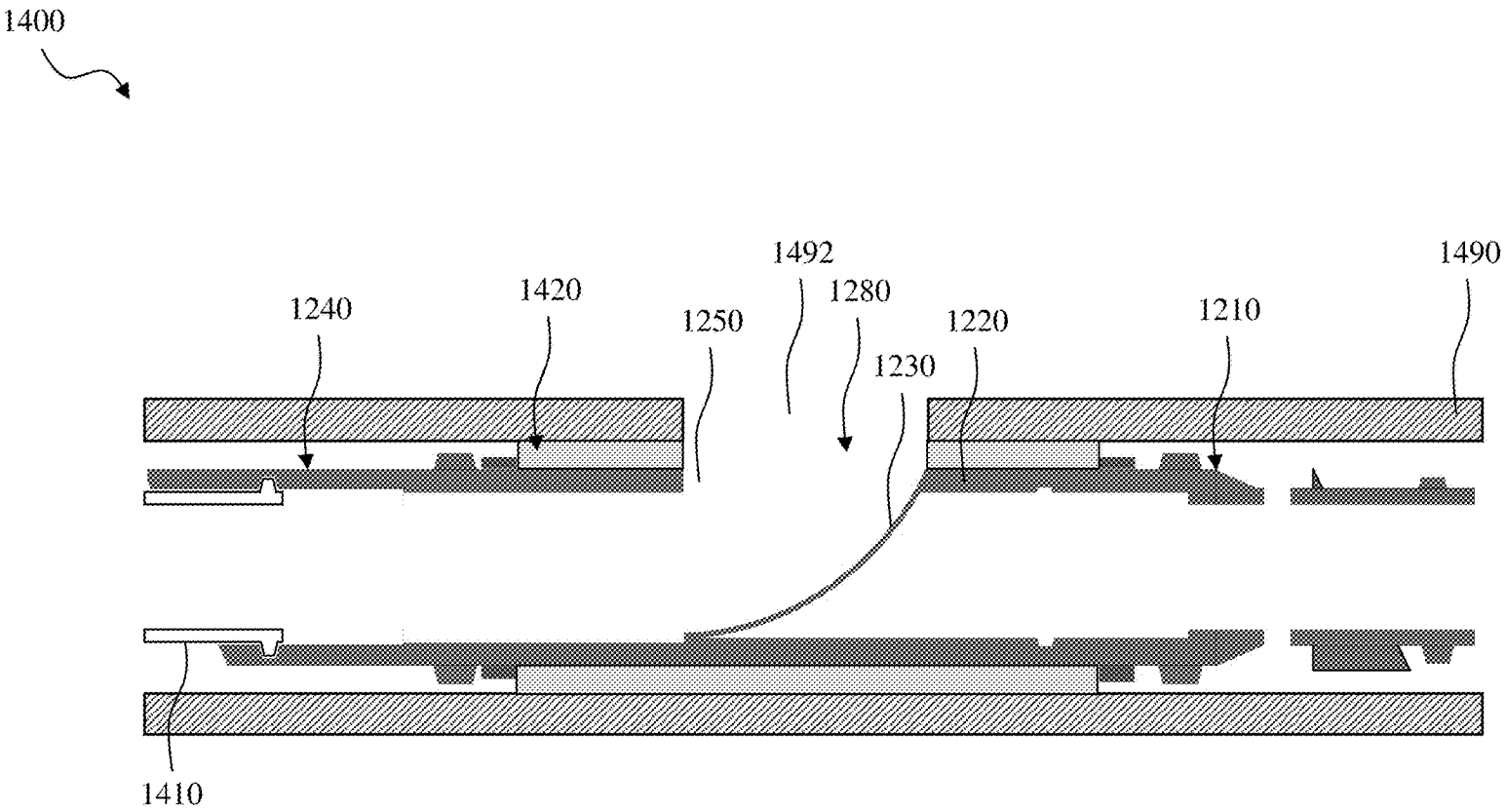
Figure 14C:
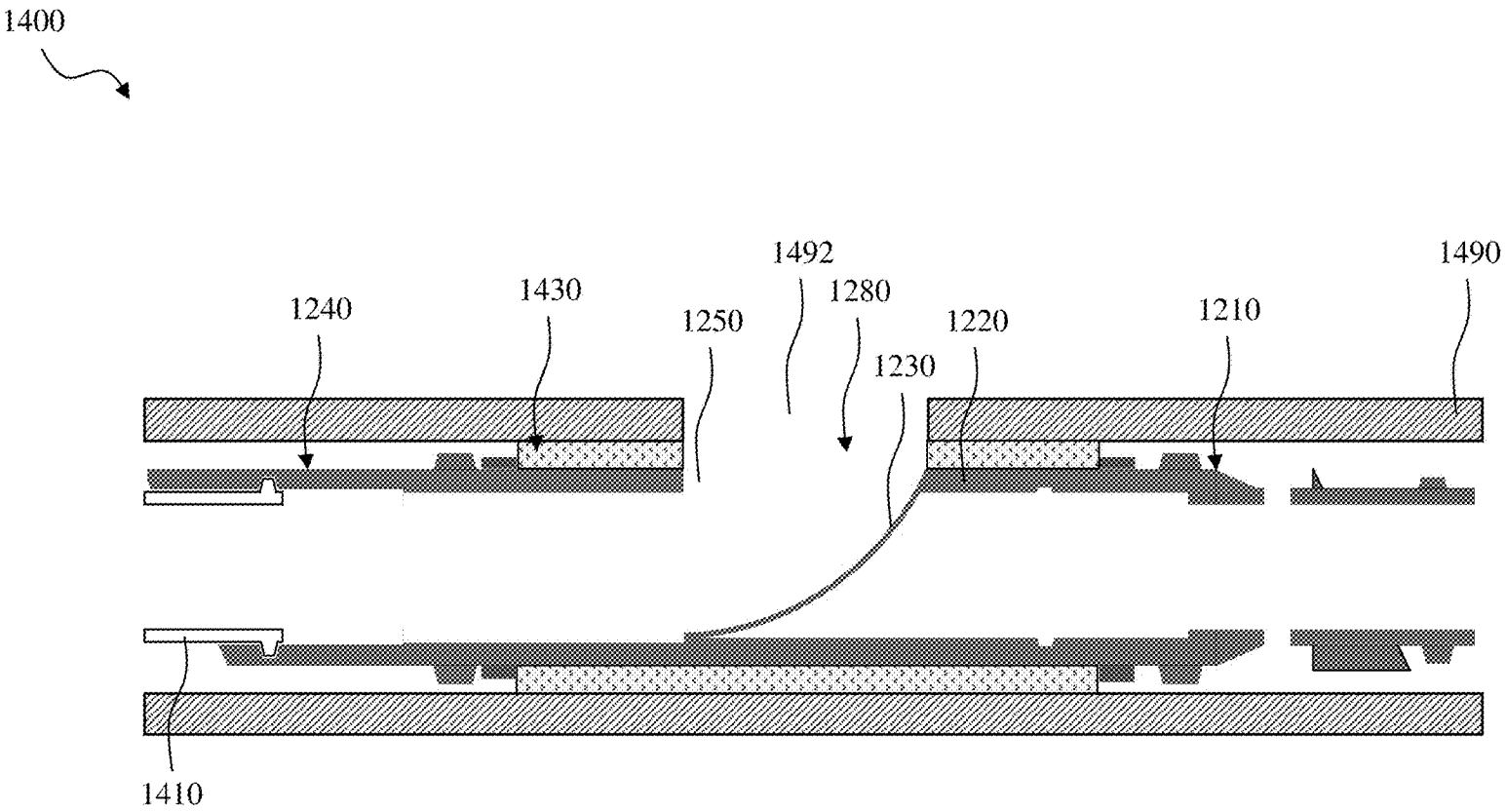

Turning to FIGS. 14A through 14C, depicted are various different manufacturing states for a multilateral junction sleeve assembly 1400 designed, manufactured and/or operated according to the disclosure, and placed within a wellbore tubular 1490. The multilateral junction sleeve assembly 1400 of FIGS. 14A through 14C is similar in many respects to the multilateral junction sleeve assembly 1200 of FIG. 12. Accordingly, like reference numbers have been used to indicate similar, if not identical, features.

With reference to FIG. 14A, the multilateral junction sleeve assembly 1400, including the multilateral deflector assembly 1210, deflector assembly sleeve 1240, expandable metal anchor 1260, and degradable material 1280, are positioned within the wellbore tubular 1490 using a running tool 1410. In the illustrated embodiment, the running tool 1410 has positioned the multilateral junction sleeve assembly 1400 within the wellbore tubular 1490 such that the deflector face 1230 of the multilateral deflector assembly 1210 is at least partially aligned with an opening 1492 in the wellbore tubular (e.g., the opening 1492 located at a junction between a main wellbore and a lateral wellbore). As indicated above, the expandable metal anchor 1260 may comprise a metal configured to expand in response to hydrolysis. As also indicated above, the degradable material 1280 may also comprise many different materials, but in at least one embodiment may also comprise a metal configured to expand in response to hydrolysis.

With reference to FIG. 14B, illustrated is the multilateral junction sleeve assembly 1400 in FIG. 14A after subjecting it to a reactive fluid to expand the metal in the space, and thereby form an expanded metal anchor 1420. In the illustrated embodiment, the expanded metal anchor 1420 generally fills the space. Notwithstanding the foregoing, the expanded metal anchor 1420 may have a variety of different volumes and remain within the scope of the disclosure, and in one embodiment may not extend into the sidewall opening 1250 of the deflector assembly sleeve 1240. Such volumes, as expected, are a function of the size of the space, the volume of the expandable metal anchor 1260, and the composition of the expandable metal anchor 1260, among other factors.

In the illustrated embodiment of FIG. 14B, the degradable material 1280 also comprises the material configured to expand in response to hydrolysis. However, given the lack of wellbore tubular 1490 providing a surface for the degradable material 1280 to expand and lock against, the degradable material 1280 degrades over time and uncovers the sidewall opening 1250 of the deflector assembly sleeve 1240.

With reference to FIG. 14C, illustrated is the multilateral junction sleeve assembly 1400 illustrated in FIG. 14A after subjecting it to a reactive fluid to expand the metal in the space, and thereby form an expanded metal anchor 1430 including residual unreacted expandable metal therein. In one embodiment, expanded metal anchor 1430 includes at least 1% residual unreacted expandable metal therein. In yet another embodiment, the expanded metal anchor 1430 includes at least 3% residual unreacted expandable metal therein. In even yet another embodiment, the expanded metal anchor 1430 includes at least 10% residual unreacted expandable metal therein, and in certain embodiments at least 20% residual unreacted expandable metal therein.

Figure 15:
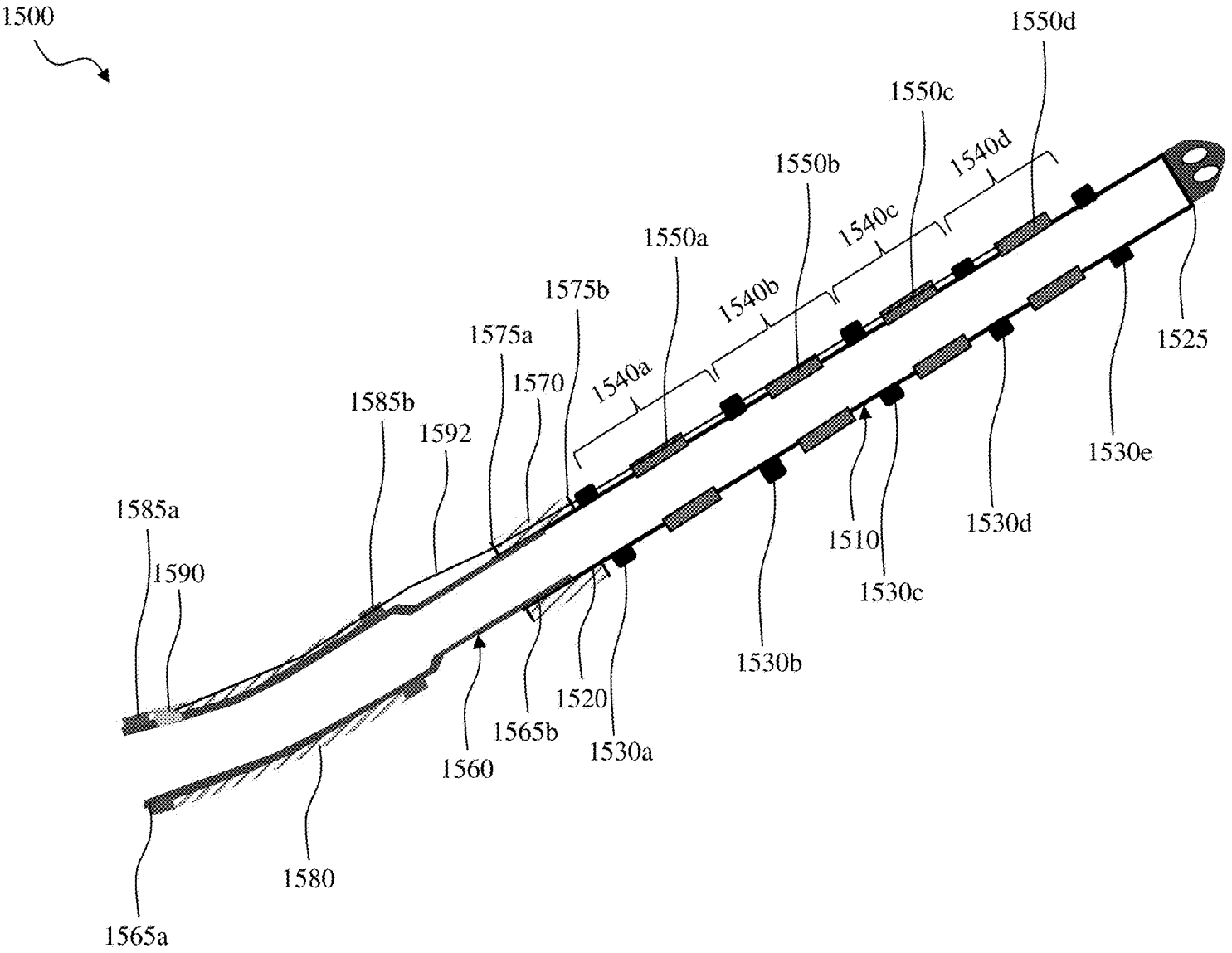
FIG. 15 illustrates a multilateral lateral bore completion designed, manufactured and/or operated according to one or more embodiments of the disclosure.

Turning to FIG. 15, illustrated is a multilateral lateral bore completion 1500 designed, manufactured and/or operated according to one or more embodiments of the disclosure. The multilateral lateral bore completion 1500, in one or more embodiments, includes a tubular 1510 having a first end 1520 (e.g., uphole end) and a second end 1525 (e.g., downhole end). The tubular 1510, in one or more embodiments, is configured to extend through one or more subterranean formations, including in certain embodiments through one or more open hole subterranean formations of a lateral wellbore.

The multilateral lateral bore completion 1500, in one or more embodiments, further includes first and second packers 1530*a*, 1530*b* located on a radial exterior surface of the tubular 1510. In one or more embodiments, the first and second packers 1530*a*, 1530*b* are configured to move from a radially retracted state to a radially extended state to engage with a wellbore tubular (e.g., including without limitation an open hole wellbore, a cased wellbore, production tubing located within a wellbore, etc.) and separate the tubular 1510 into first and second production zones 1540*a*, 1540*b*. In the embodiment of FIG. 15, the multilateral lateral bore completion 1500 includes third, fourth and fifth packers 1530*c*, 1530*d*, 1530*e* that separates the tubular into third and fourth production zone 1540*c*. 1540*d*. Notwithstanding, any number of packers may be used and remain within the scope of the disclosure.

The multilateral lateral bore completion 1500, in one or more embodiments, further includes a first interval control valve 1550*a* located in the tubular 1510 in the first production zone 1540*a* and a second interval control valve 1550*b* located in the tubular 1510 in the second production zone 1540*b*. Any type of interval control valve may be used for the first and second interval control valves 1550*a*, 1550*b*, including an electronic interval control device (eICD), an autonomous interval control device (aICD), etc. and remain within the scope of the disclosure. In the embodiment of FIG. 15, the multilateral lateral bore completion 1500 includes a third and fourth interval control valves 1550*c*, 1550*d*, respectively, located in the tubular 1510 in the third and fourth production zones 1540*c*, 1540*d*, respectively. Notwithstanding, any number of interval control valves may be used and remain within the scope of the disclosure.

The multilateral lateral bore completion 1500, in one or more embodiments, further includes a transition joint 1560 coupled to the first end 1520 of the tubular 1510. In at least one embodiment, the transition joint 1560 includes an uphole end 1565*a* and a downhole end 1565*b* and is configured to extend partially into a main wellbore (e.g., from the lateral wellbore) and ultimately form a portion of the junction (e.g., Level-5 junction) between the lateral wellbore and the main wellbore.

The multilateral lateral bore completion 1500, in one or more embodiments, further includes an expandable metal anchor 1570 positioned on the radial exterior surface of the tubular 1510. In at least one embodiment, the expandable metal anchor 1570 includes a metal configured to expand in response to hydrolysis to axially and rotationally fix the tubular 1510 with respect to the wellbore tubular (e.g., wellbore tubular of a lateral wellbore). For example, upon subjecting the expandable metal anchor 1570 to reactive fluid, the expandable metal goes from metal to micron-scale particles that are larger and lock together to form an expanded metal anchor that anchors and/or seals the multilateral lateral bore completion 1500 within the wellbore tubular. Those skilled in the art understand that for the expandable metal anchor 1570 to work as intended (e.g., turn into an expanded metal anchor), the volume of space that the expandable metal is located should be small enough such that the expandable metal expands into contact with the one or more surfaces upon undergoing hydrolysis, while volumetrically expanding no more than its total achievable volumetric expansion.

In at least one embodiment, the expandable metal anchor 1570 is positioned between the first packer 1530*a* and the first end 1520. For example, in at least one embodiment, the expandable metal anchor 1570 is placed within 100 m of the first end 1520. In yet another embodiment, the expandable metal anchor 1570 is placed within 20 m of the first end 1520. In even yet another embodiment, the expandable metal anchor 1570 is placed within 5 m, if not 3 m, if not 1 m of the first end 1520. In at least one embodiment, the expandable metal anchor 1570 spans at least a portion of the tubular 1510 and the transition joint 1560, and thus ultimately anchors the tubular 1510 and the transition joint 1560. Further to the embodiment, of FIG. 15, first and second end rings 1575*a*, 1575*b* may be located on opposing ends of the expandable metal anchor 1570.

The multilateral lateral bore completion 1500, in one or more embodiments, further includes an expandable metal anchor 1580 positioned on the radial exterior surface of the transition joint 1560. In at least one embodiment, the expandable metal anchor 1580 includes a metal configured to expand in response to hydrolysis to axially and rotationally fix and seal the transition joint 1560 at a junction between the lateral wellbore and the main wellbore. For example, upon subjecting the expandable metal anchor 1580 to reactive fluid, the expandable metal goes from metal to micron-scale particles that are larger and lock together to form an expanded metal anchor that anchors and/or seals the transition joint 1560. Those skilled in the art understand that for the expandable metal anchor 1580 to work as intended (e.g., turn into an expanded metal anchor), the volume of space that the expandable metal is located should be small enough such that the expandable metal expands into contact with the one or more surfaces upon undergoing hydrolysis, while volumetrically expanding no more than its total achievable volumetric expansion.

In at least one embodiment, the expandable metal anchor 1580 is positioned between the uphole end 1565*a* and the downhole end 1565*b*. For example, in at least one embodiment, the expandable metal anchor 1580 is placed within 100 m of the uphole end 1565*a*. In yet another embodiment, the expandable metal anchor 1580 is placed within 20 m of the uphole end 1565*a*. In even yet another embodiment, the expandable metal anchor 1570 is placed within 5 m, if not 3 m, if not 1 m of the uphole end 1565*a*. In at least one embodiment, the transition joint 1560 has a transition joint diameter and the tubular 1510 has a tubular diameter, and further wherein the transition joint diameter is greater than the tubular diameter. For example, in at least one embodiment, the expandable metal anchor 1580 is located about the larger diameter portion of the transition joint 1560. Further to the embodiment of FIG. 15, first and second end rings 1585*a*, 1585*b* may be located on opposing ends of the expandable metal anchor 1580.

The multilateral lateral bore completion 1500 may additionally include a control line coupler 1590 located on the transition joint 1560. In one or more embodiments, the control line coupler 1590 is located proximate (e.g., within 30 m, if not within 10 m) the uphole end 1565*a*. While a variety of different control line couplers may be used, in at least one embodiment the control line coupler is an inductive coupler or wet mate coupler.

The multilateral lateral bore completion 1500, in one or more embodiments, further includes a control line 1592 that extends downhole from the control line coupler 1590. For example, in at least one embodiment, the first packer 1530*a* is a first feedthrough packer, and the control line 1592 extends from the control line coupler 1590 through the first feedthrough packer to the first interval control valve 1550*a*. In yet another embodiment, the second packer 1530*b* is also a second feedthrough packer, and the control line 1592 extends from the control line coupler 1590 through the first feedthrough packer and the second feedthrough packer to the second interval control valve 1550*b*. The same theory could hold true if the multilateral lateral bore completion 1500 were to comprise three or more feedthrough packers.

Figure 16A:
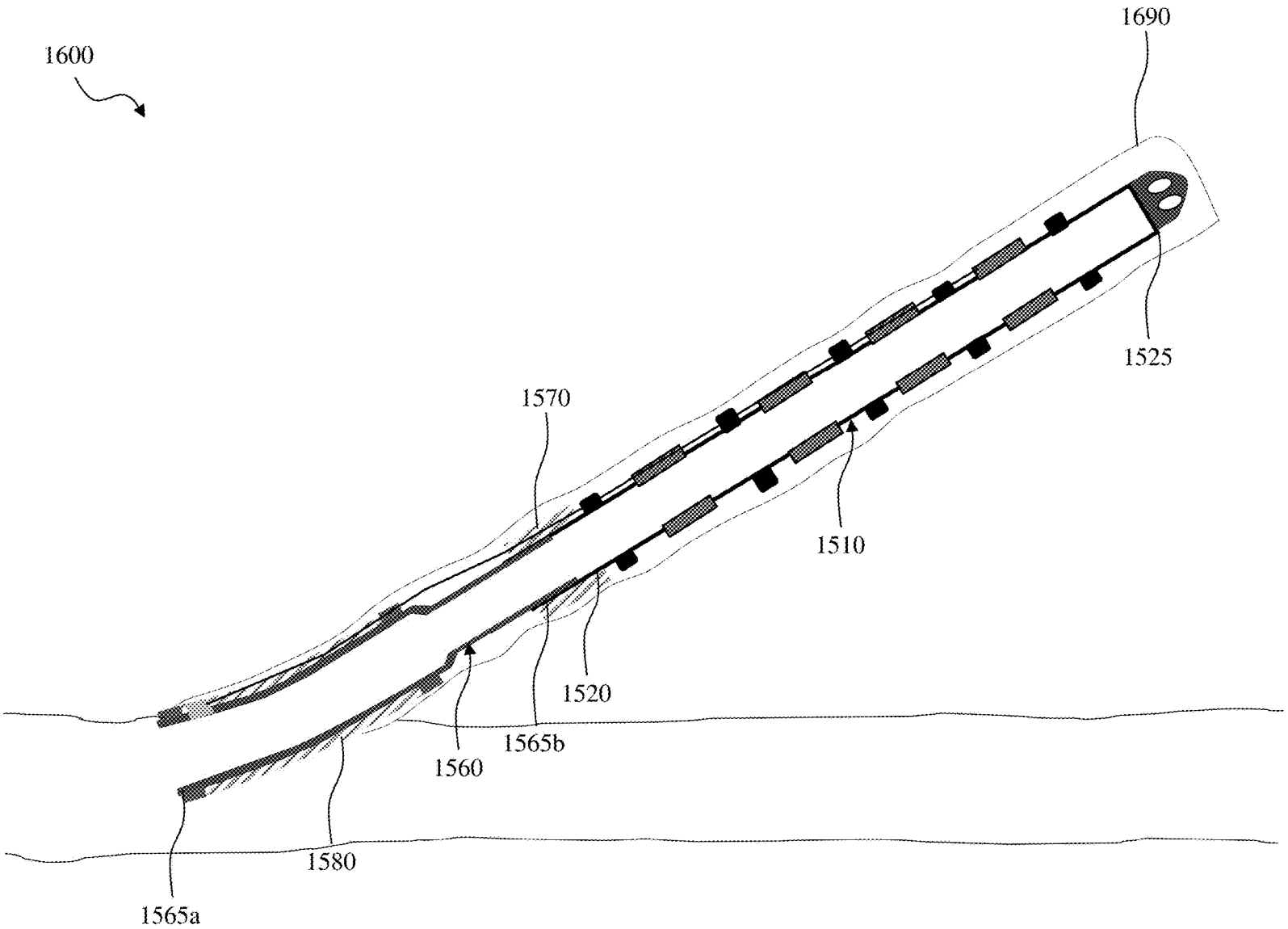
FIG. 16A through 16C illustrate various different manufacturing states for a multilateral lateral bore completion designed, manufactured and/or operated according to the disclosure, and placed within a wellbore tubular (e.g., lateral wellbore tubular)
Figure 16B:
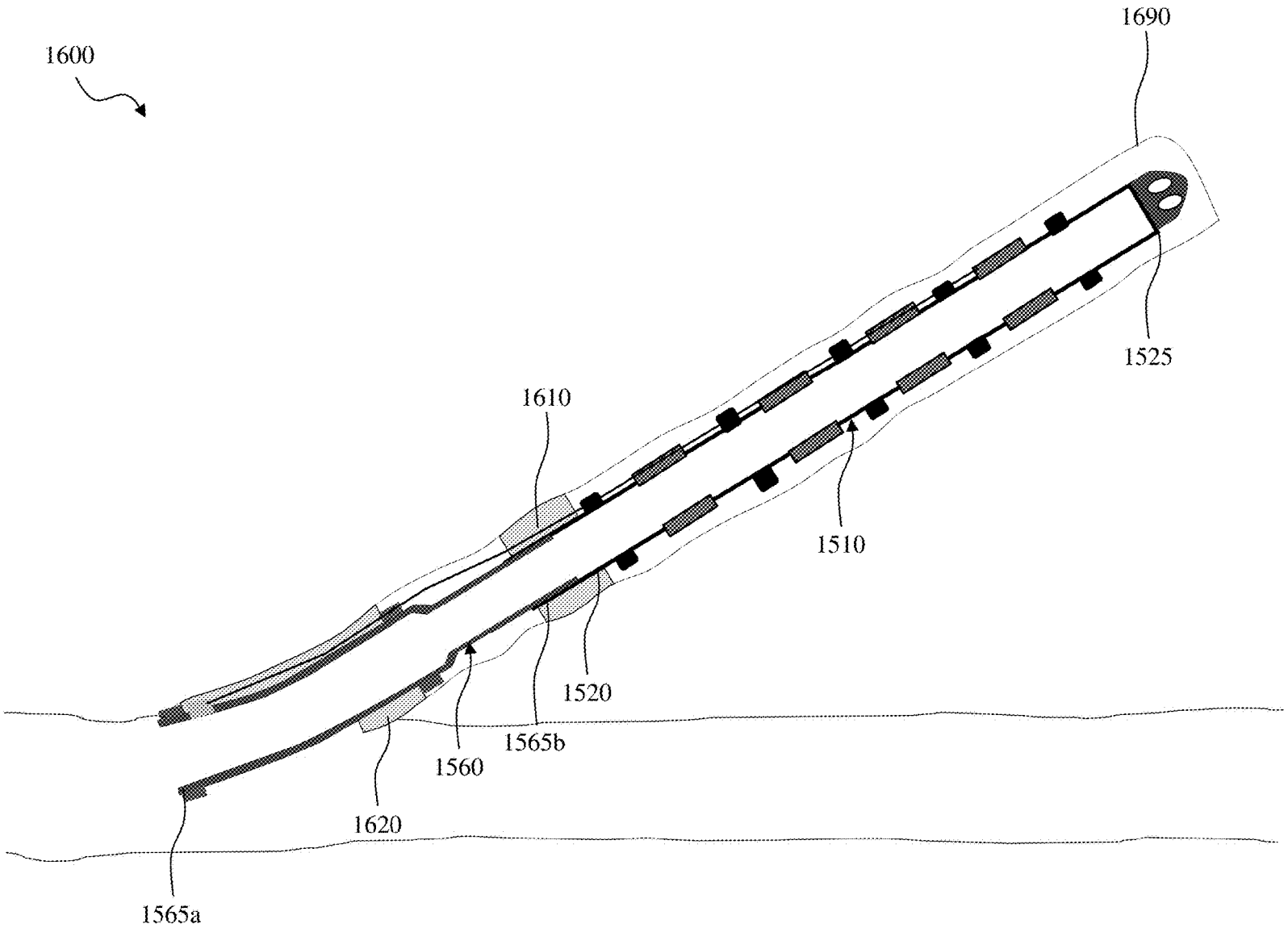
Figure 16C:
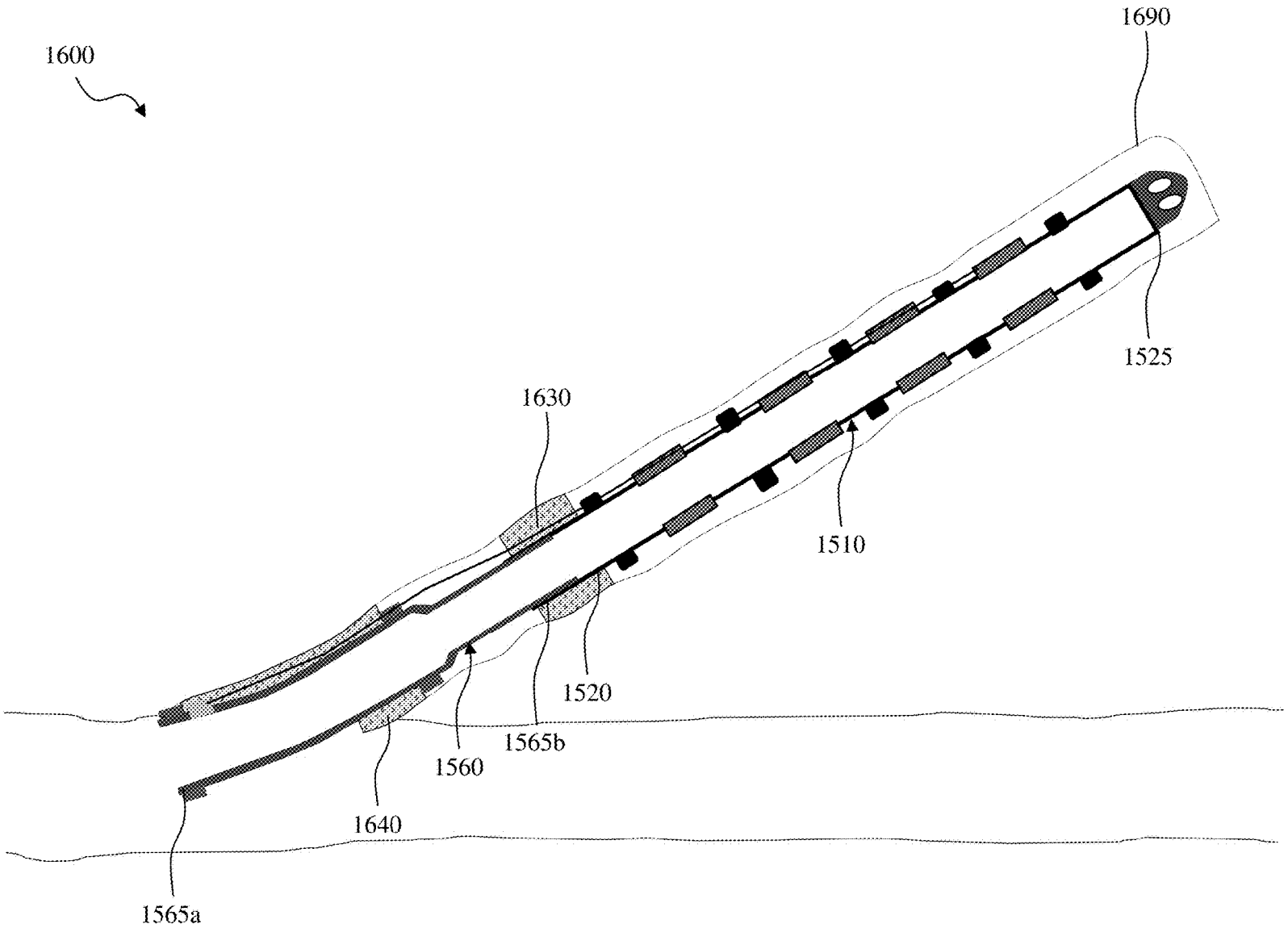

Turning to FIGS. 16A through 16C, depicted are various different manufacturing states for a multilateral lateral bore completion 1600 designed, manufactured and/or operated according to the disclosure, and placed within a wellbore tubular 1690 (e.g., lateral wellbore tubular). The multilateral lateral bore completion 1600 of FIGS. 16A through 16C is similar in many respects to the multilateral lateral bore completion 1500 of FIG. 15. Accordingly, like reference numbers have been used to indicate similar, if not identical, features.

With reference to FIG. 16A, the expandable metal anchor 1570 is positioned about the tubular 1510 and between the tubular 1510 and the wellbore tubular 1690. The expandable metal anchor 1570, in accordance with one or more embodiments of the disclosure, comprises a metal configured to expand in response to hydrolysis. The expandable metal anchor 1570, in the illustrated embodiment, may comprise any of the expandable metals discussed above, or any combination of the same. The expandable metal anchor 1570 may have a variety of different lengths and thicknesses, for example depending on the amount of anchoring force that is needed, as well as whether it is desired for the expandable metal anchor 1570 to function as a seal when subjected to reactive fluid, and remain within the scope of the disclosure.

With further reference to FIG. 16A, the expandable metal anchor 1580 is positioned about the transition joint 1560 and between the transition joint 1560 and the wellbore tubular 1690. The expandable metal anchor 1580, in accordance with one or more embodiments of the disclosure, comprises a metal configured to expand in response to hydrolysis. The expandable metal anchor 1580, in the illustrated embodiment, may comprise any of the expandable metals discussed above, or any combination of the same. The expandable metal anchor 1580 may have a variety of different lengths and thicknesses, for example depending on the amount of anchoring force that is needed, as well as whether it is desired for the expandable metal anchor 1580 to function as a seal when subjected to reactive fluid, and remain within the scope of the disclosure.

With reference to FIG. 16B, illustrated is the expandable metal anchor 1570 and expandable metal anchor 1580 illustrated in FIG. 16A after subjecting them to a reactive fluid to expand the metal in the space, and thereby form an expanded metal anchor 1610 and expanded metal anchor 1620. In the illustrated embodiment, the expanded metal anchors 1610, 1620 generally fill the space. Notwithstanding the foregoing, the expanded metal anchors 1610, 1620 may have a variety of different volumes and remain within the scope of the disclosure. Such volumes, as expected, are a function of the size of the space, the volume of the expandable metal anchors 1570, 1580, and the composition of the expandable metal anchors 1570, 1580, among other factors.

With reference to FIG. 16C, illustrated is the expandable metal anchors 1570, 1580 illustrated in FIG. 15A after subjecting them to a reactive fluid to expand the metal in the space, and thereby form expanded metal anchors 1630, 1640 including residual unreacted expandable metal therein. In one embodiment, expanded metal anchors 1630, 1640 include at least 1% residual unreacted expandable metal therein. In yet another embodiment, the expanded metal anchors 1630, 1640 include at least 3% residual unreacted expandable metal therein. In even yet another embodiment, the expanded metal anchors 1630, 1640 include at least 10% residual unreacted expandable metal therein, and in certain embodiments at least 20% residual unreacted expandable metal therein.

Figure 16D:
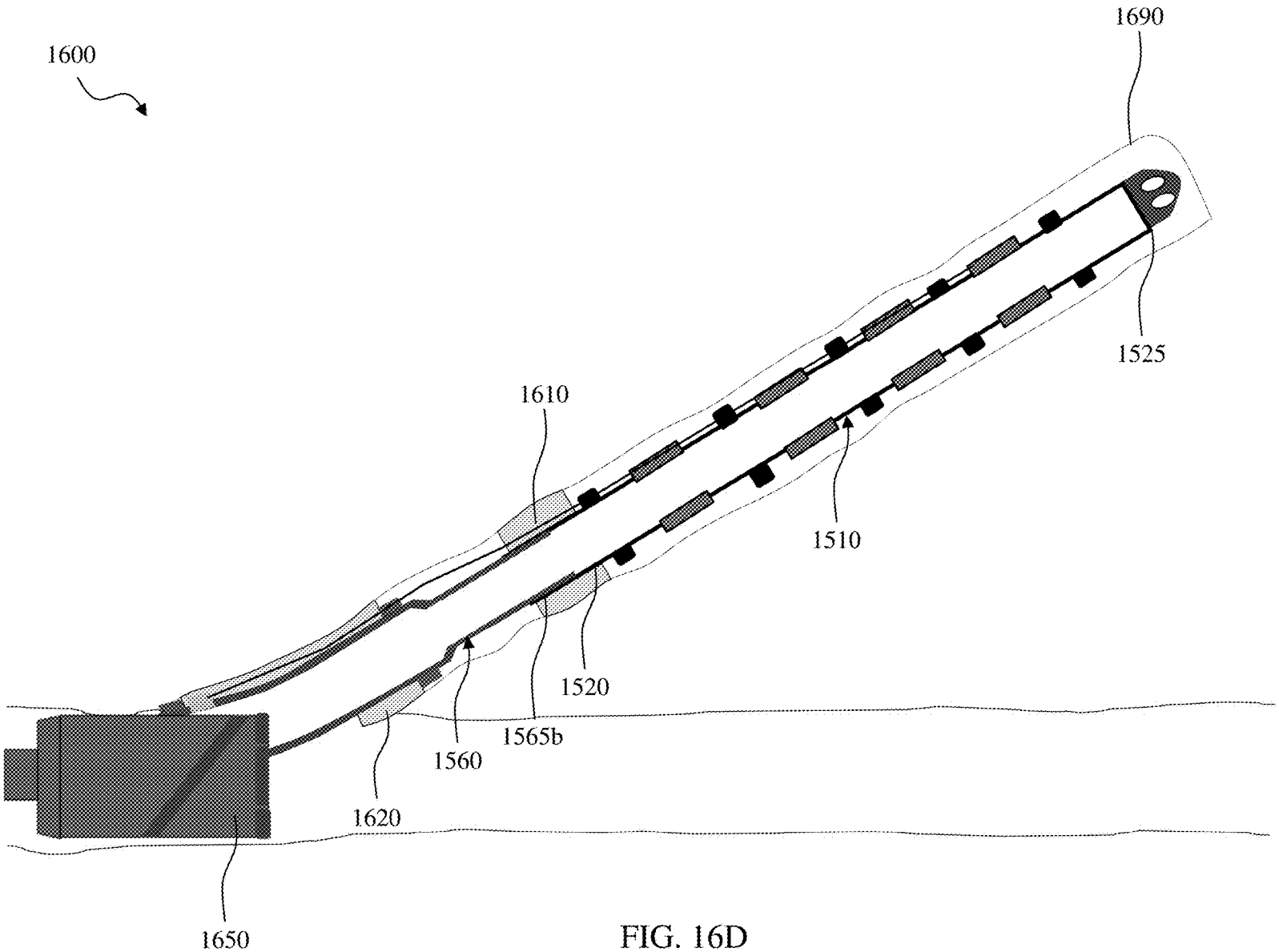
FIGS. 16D and 16E illustrate the multilateral lateral bore completion of FIG. 16B during and after washing over the transition joint with a washover tool, respectively.
Figure 16E:
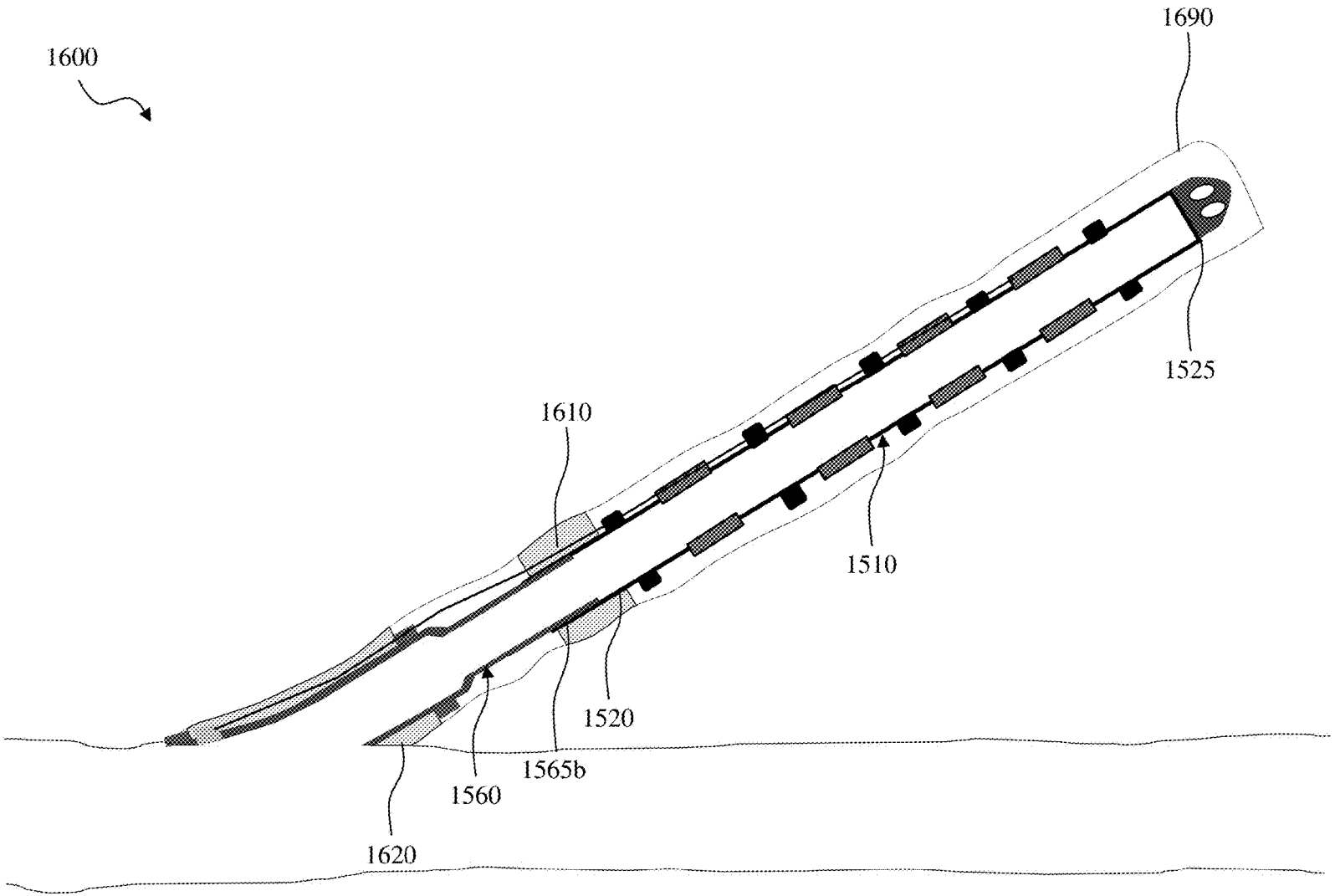

Turning to FIGS. 16D and 16E, illustrated is the multilateral lateral bore completion 1600 of FIG. 16B during and after washing over the transition joint 1560 with a washover tool 1650, respectively.

Figure 16F:
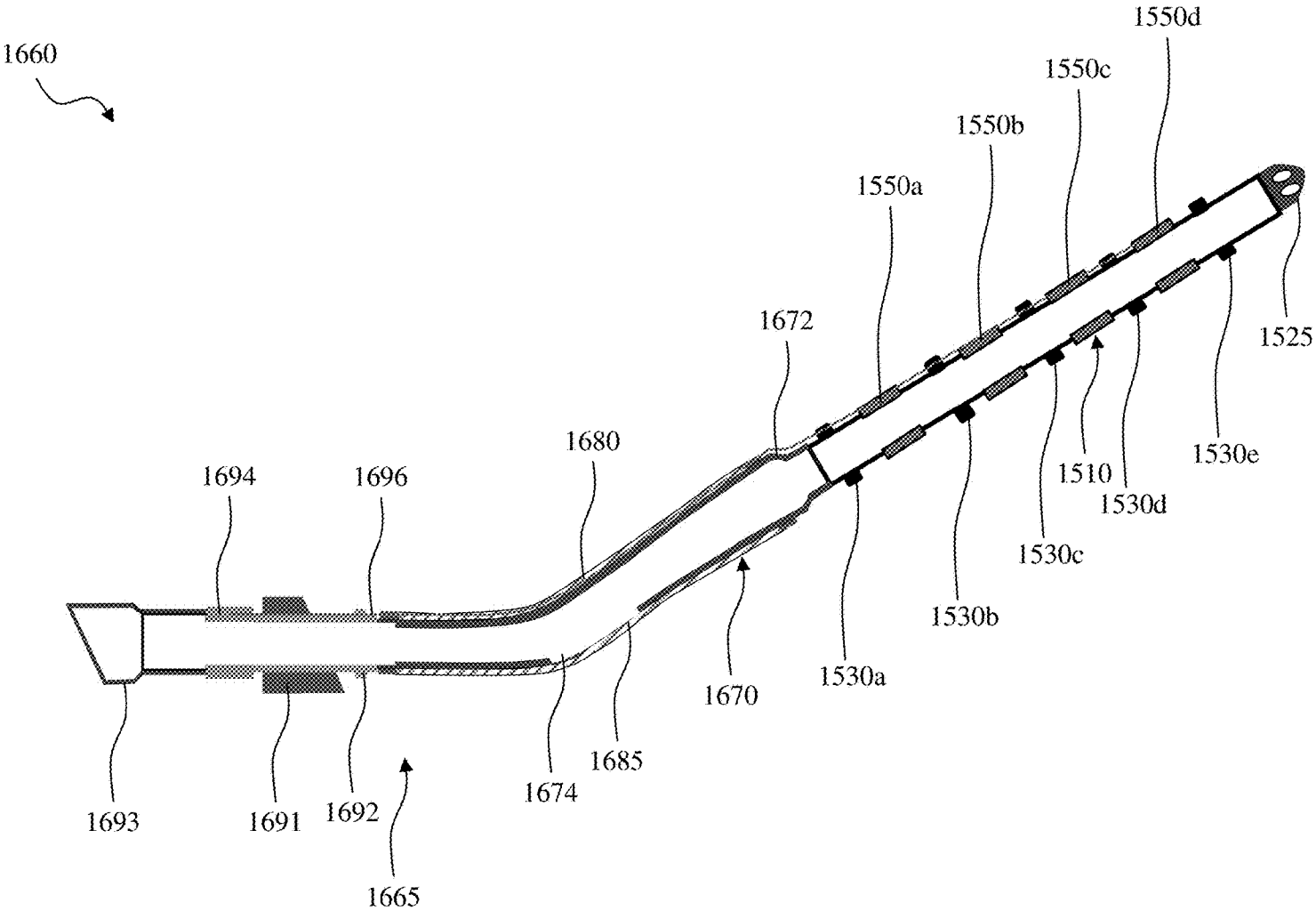
FIG. 16F illustrates a multilateral lateral bore completion designed, manufactured and/or operated according to one or more embodiments of the disclosure.

Turning to FIG. 16F, illustrated is a multilateral lateral bore completion 1660 designed, manufactured and/or operated according to one or more embodiments of the disclosure. The multilateral lateral bore completion 1660 is similar in many respects to the multilateral lateral bore completion 1500 of FIG. 15. Accordingly, like reference numbers have been used to indicate similar, if not identical, features. The multilateral lateral bore completion 1660 differs, for the most part, from the multilateral lateral bore completion 1500, in that the multilateral lateral bore completion 1660 does not include a transition joint 1560, but includes a transition sleeve assembly 1665 including a transition sleeve 1670. The transition sleeve 1670, in one embodiment, includes a transition sleeve body 1672 having a sidewall opening 1674 in a sidewall thereof. In at least this one embodiment, the sidewall opening 1674 is configured to align with a main wellbore when the transition sleeve assembly 1665 is at least partially insert within a lateral wellbore.

The transition sleeve 1670, in the illustrated embodiment, further includes an expandable metal anchor 1680 positioned on a radial exterior surface of the transition sleeve body 1672, and degradable material 1685 positioned on a radial exterior surface of the transition sleeve body 1672 covering the sidewall opening 1674. In one or more embodiments, the expandable metal anchor 1680 includes a metal configured to expand in response to hydrolysis to axially and rotationally fix the multilateral lateral bore completion 1660 within a wellbore tubular. In one or more embodiments, such as is illustrated in FIG. 16F, the expandable metal anchor 1680 is positioned on the radial exterior surface of the transition sleeve body 1672 uphole and downhole the sidewall opening 1674, the expandable metal anchor 1680 configured to fix the multilateral lateral bore completion 1660 within a wellbore tubular uphole and downhole the sidewall opening 1674. The expandable metal anchor 1680 may comprise any of the expandable metals discussed above, so long as it expands into contact with a wellbore tubular and forms an expanded metal anchor and/or seal.

In the illustrated embodiment of FIG. 16F, the degradable material 1685 is a layer of degradable material positioned on the radial exterior surface of the transition sleeve body 1672 covering the sidewall opening 1674. The layer of degradable material may comprise any material known to degrade over time, as well as any of the materials disclosed above. In one or more embodiments, however, the layer of degradable material is a layer of polymer based degradable material positioned over the sidewall opening 1674. In yet another embodiment, however, the layer of degradable material is a layer of metal based degradable material. For example, in at least one embodiment, the layer of metal based degradable material is a layer of expandable metal configured to expand in response to hydrolysis and then degrade to uncover the sidewall opening 1674. In this embodiment, the layer of expandable metal is configured to expand in response to hydrolysis and after the hydrolysis has completed then degrade to uncover the sidewall opening 1674.

In accordance with at least one embodiment, for example when the layer of degradable material comprises a layer of expandable metal configured to expand in response to hydrolysis, the layer of expandable metal and the expandable metal anchor 1680 are a single unitary layer of expandable metal including the metal configured to expand in response to hydrolysis. In at least one embodiment, the single unitary layer of expandable metal is configured to degrade around the sidewall opening 1674 but form an expanded metal anchor outside of the sidewall opening 1674. Accordingly, the single unitary layer of expandable metal has the dual purpose of degrading and forming the expanded metal anchor.

The transition sleeve assembly 1665, in at least one embodiment, may further include an orientation feature 1691 and latch 1692 coupled to the transition sleeve body 1672 uphole or downhole of the sidewall opening 1674. In at least one embodiment, the orientation feature 1691 (e.g., a collet finger in one embodiment) is configured to provide proper orientation and space out of the transition sleeve assembly 1665, and the latch 1692 is configured to temporarily latch the transition sleeve assembly 1665 (e.g., relative to a multilateral deflector assembly). In one or more embodiments, the orientation feature 1691 is coupled to the transition sleeve body 1672 within 5 m uphole or downhole of the sidewall opening 1674, if not 3 m, if not 1 m. Furthermore, while the present disclosure may position the orientation feature 1691 uphole or downhole of the sidewall opening 1674, certain advantages exist in positioning it downhole of the sidewall opening 1674.

The transition sleeve assembly 1665, in at least one embodiment, may further include an orientation device 1693 (e.g., muleshoe) coupled to an uphole end of the transition sleeve body 1672. In at least one embodiment, the orientation device 1693 is configured to engage with a separate uphole device to rotationally orient the separate uphole device within the main wellbore. The transition sleeve assembly 1665, in at least one embodiment, may further include a control line coupler 1694, for example located on the transition sleeve body 1672 between the orientation device 1693 and the sidewall opening 1674. While a variety of different control line couplers 1694 may be used, in one or more embodiments, the control line coupler 1694 is an inductive coupler or a wet mate coupler. The transition sleeve assembly 1665, in at least one embodiment, may further include a control line 1696 that extends downhole from the control line coupler 1694.

Turning to FIGS. 17 through 33, illustrated is a method for forming a well system 1700 at various different stages of manufacture, the well system 1700 employing one or more of the features disclosed above with respect to FIGS. 2 through 16F. As the embodiment of FIGS. 17 through 33 will employ one or more features disclosed with respect to FIGS. 2 through 16F above, like reference numbers may be used to indicate similar, if not identical, features. Furthermore, FIGS. 17 through 33 may be viewed in conjunction with FIGS. 2 through 16F.

Figure 17:
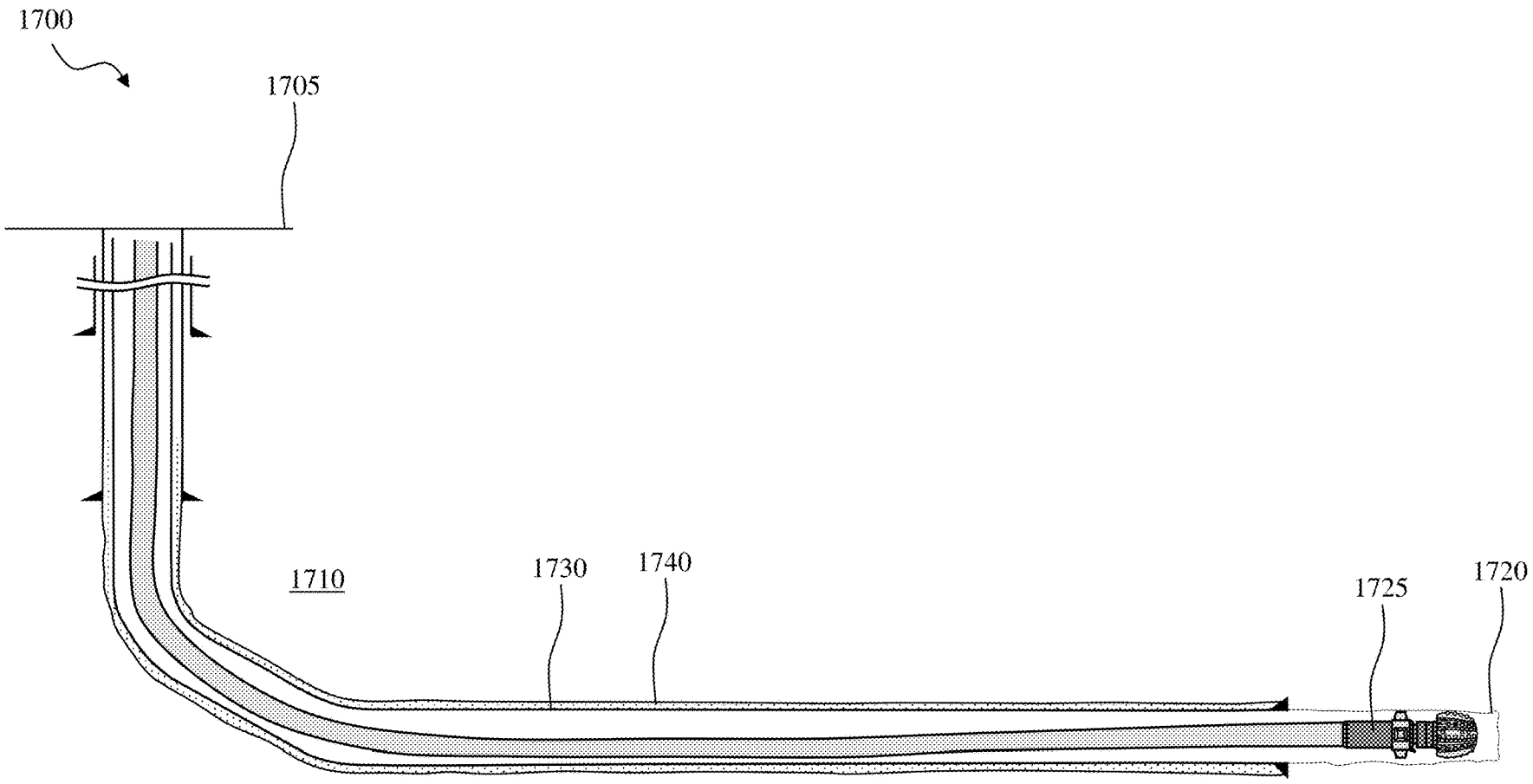
FIGS. 17 through 33 illustrate a method for forming a well system at various different stages of manufacture, the well system employing one or more of the features disclosed above with respect to FIGS. 2 through 16F.

With initial reference to FIG. 17, a main wellbore 1720 has been drilled (e.g., using a drilling assembly 1725) from a terranean surface 1705 through one or more subterranean formations 1710. In the illustrated embodiment, the main wellbore 1720 includes a wellbore tubular 1730 (e.g., wellbore casing, wellbore liner, etc.), as well as cement 1740 positioned between the wellbore tubular 1730 and the main wellbore 1720.

Figure 18:
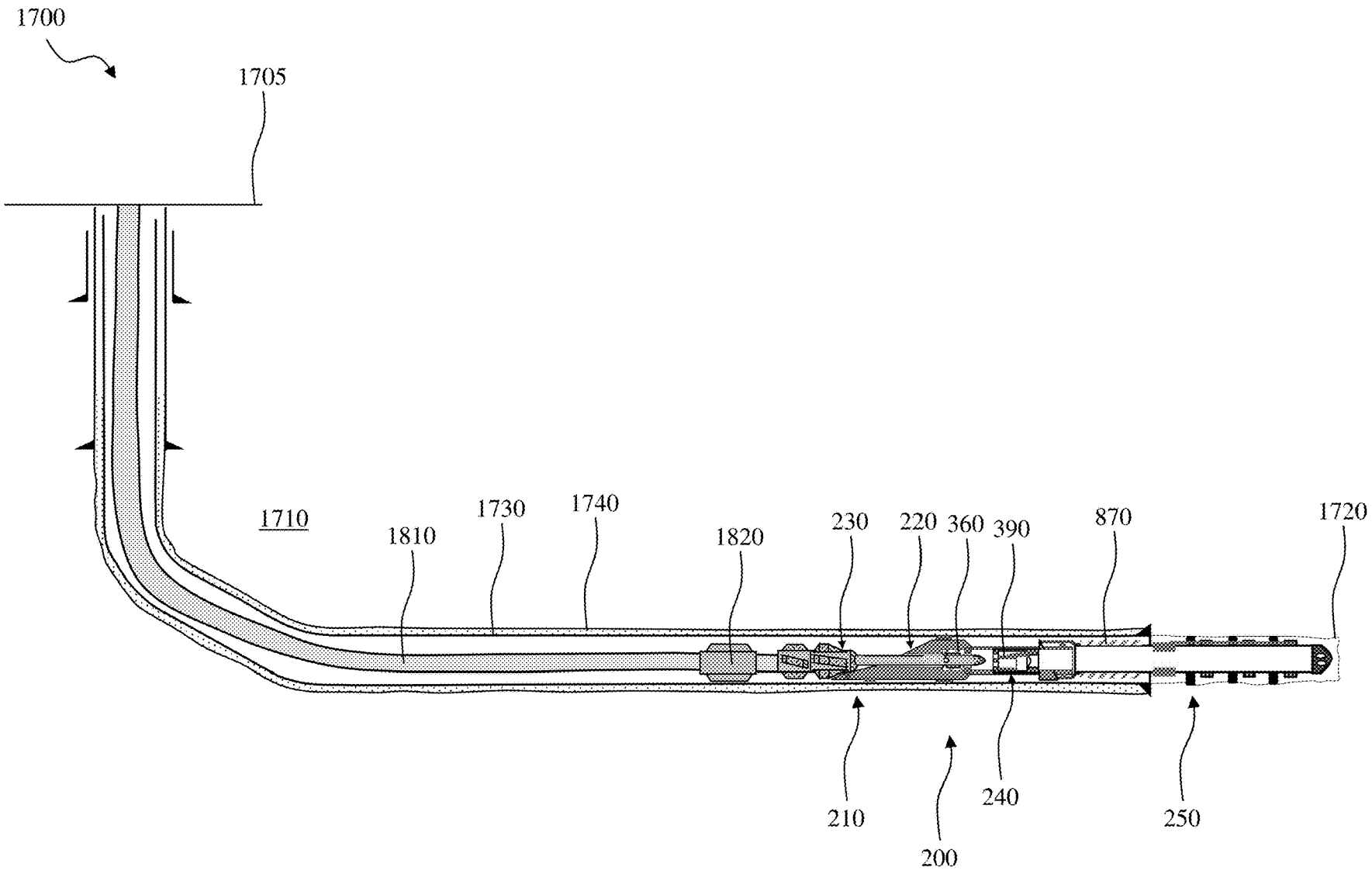

Turning to FIG. 18, illustrated is the well system 1700 of FIG. 17 after employing a running tool 1810 to position a multilateral downhole device 200 designed, manufactured and/or operated according to one or more embodiments of the disclosure within the main wellbore 1720. In at least one embodiment, this could be considered the first multilateral trip downhole. In the illustrated embodiment of FIG. 18, the multilateral downhole device 200 includes one or more of a multilateral milling assembly 210 (e.g., which in at least one embodiment includes a multilateral whipstock assembly 220, a two part milling and running tool 230, and a multilateral fluid loss device 240) and a multilateral mainbore completion 250, all of which may include various different versions and/or positioning of the expandable metal and/or degradable material designed, manufactured and/or operated according to one or more embodiments of the disclosure. In the illustrated embodiment of FIG. 18, the degradable material 360, 390 of the multilateral whipstock assembly 220 and multilateral fluid loss device 240, respectively, remain intact. Additionally, the expandable metal anchor 870 of the multilateral mainbore completion 250 is in the unexpanded state. In the illustrated embodiment of FIG. 18, the running tool 1810, along with a workstring orientation tool (WOT) 1820, has axially and rotationally positioned the multilateral whipstock assembly 220 at a location in the main wellbore 1720 wherein the lateral wellbore is to be formed. Those skilled in the art understand the process for accomplishing such.

Figure 19:
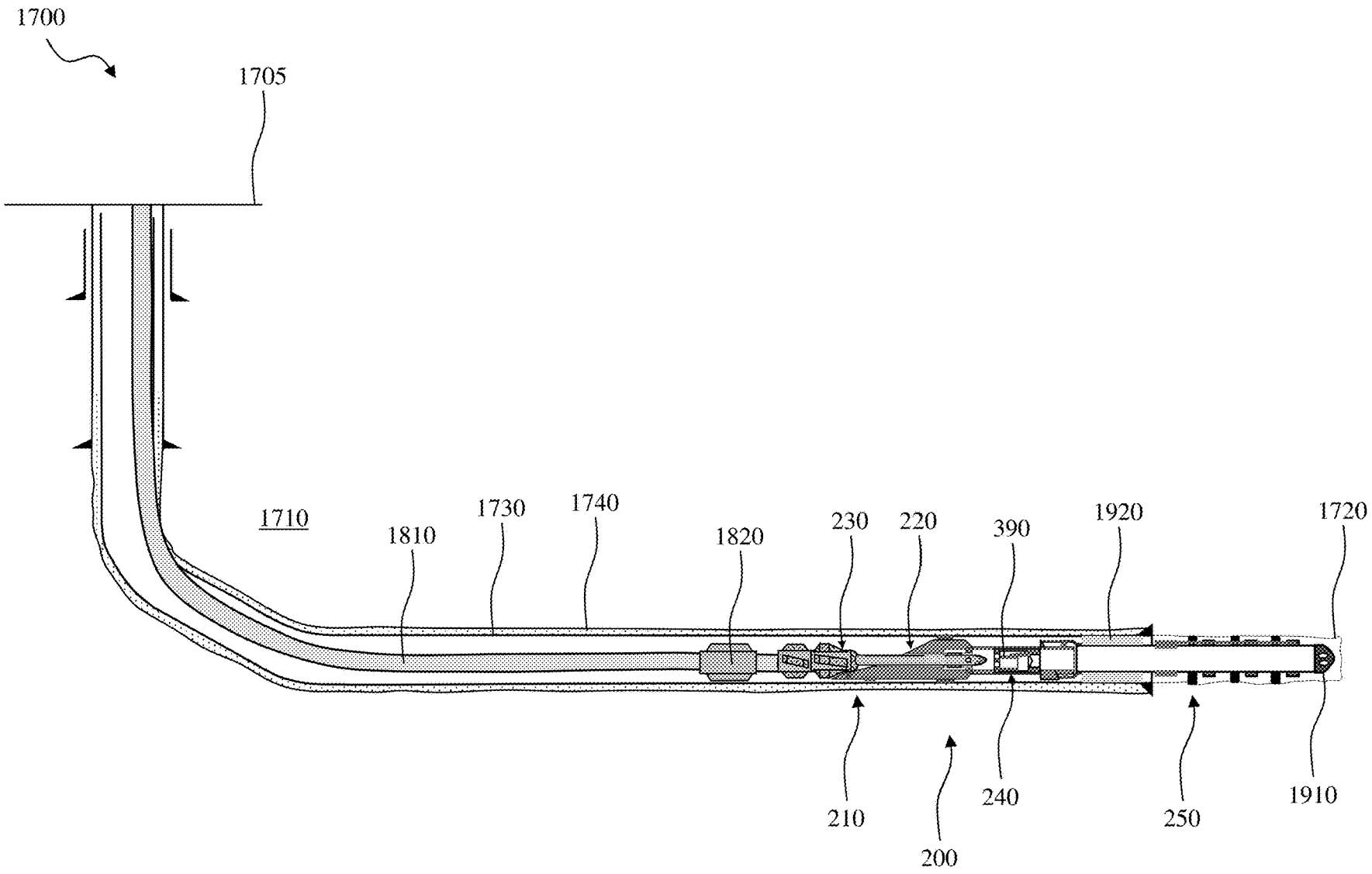

Turning to FIG. 19, illustrated is the well system 1700 of FIG. 18, after subjecting the multilateral downhole device 200 to reactive fluid (e.g., mud with water based completion fluid, brine, etc.). For example, in at least one embodiment, the operator could circulate reactive fluid down through a float shoe 1910 located at the end of the multilateral downhole device 200 to initiate the chemical reaction process for each of the degradable material 360, 390 and the expandable metal anchor 870. In at least one embodiment, the circulation of reactive fluid may cease when the expandable metal anchor 870 of the multilateral mainbore completion 250 and degradable materials 360, 390 of the multilateral whipstock assembly 220 are soaking in reactive fluid.

As shown in FIG. 19, the reactive fluid causes the expandable metal anchor 870 to turn to an expanded metal anchor 1920, as discussed above. Additionally, the reactive fluid causes the degradable material 360 to degrade or otherwise dissolve away, for example allowing the two part milling and running tool 230 the ability to decouple from the multilateral whipstock assembly 220. In at least this one embodiment, the degradable material 390 of the multilateral fluid loss device 240 includes a delay coating thereon, and thus the degradable material 390 remains in the multilateral fluid loss device 240 at this point in time.

Figure 20:
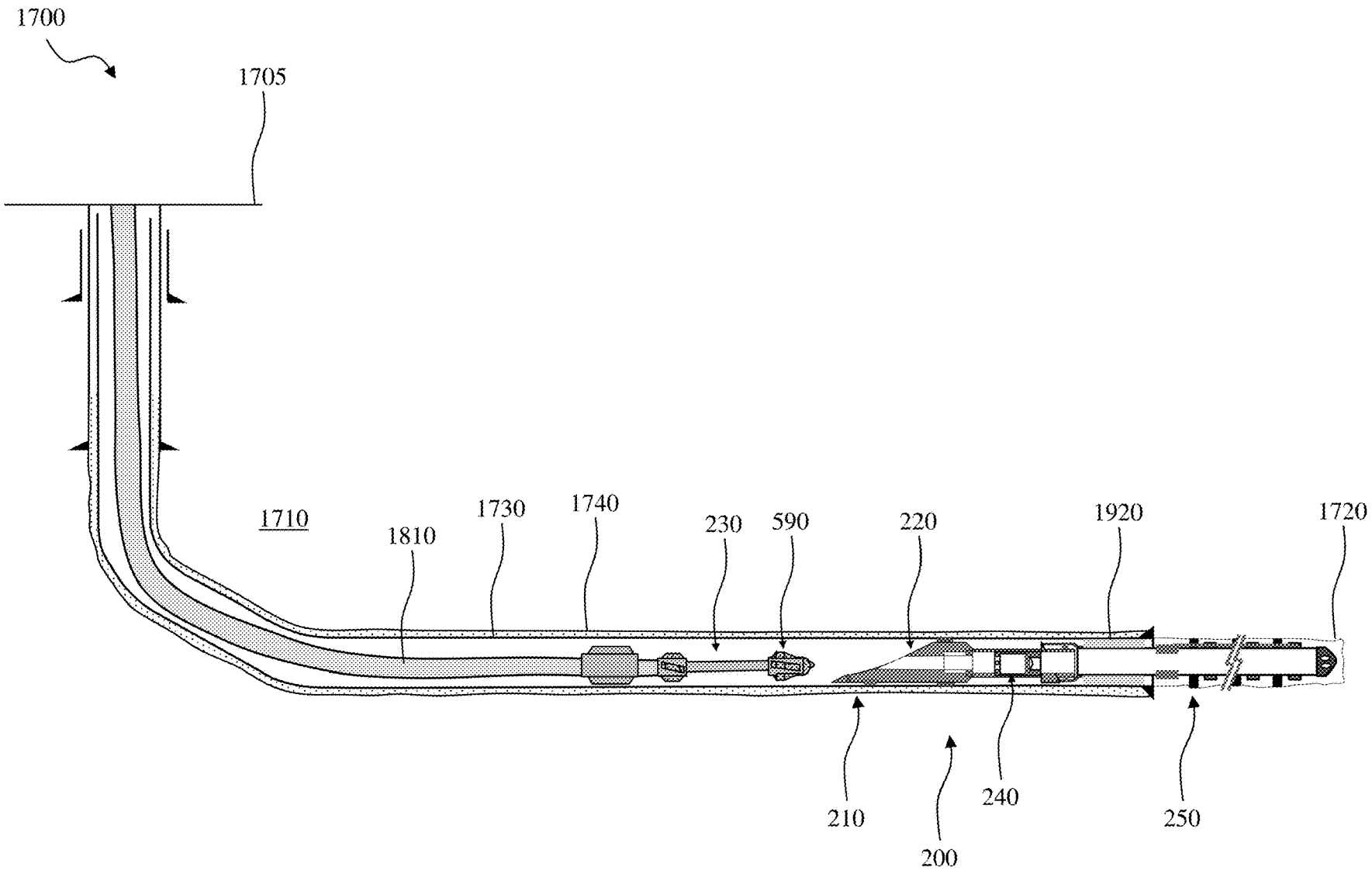

Turning to FIG. 20, illustrated is the well system of FIG. 19 after the degradable material 360 axially fixing the two part milling and running tool 230 to the multilateral whipstock assembly 220 has fully degraded, and thus the two part milling and running tool 230 is free to slide relative to the multilateral whipstock assembly 220. For example, the smaller assembly 330 could first slide relative to the larger bit assembly 340 to form the combined bit assembly 590 (e.g., in at least one embodiment, the body lock ring 530 of the larger bit assembly 340 would axially fix the smaller assembly 330 to the larger bit assembly 340). Thereafter, the combined bit assembly 590 would continue to be pulled uphole, thereby shearing the coupling mechanism 355 located between the larger bit assembly 340 and the multilateral downhole device 200, resulting in the two part milling and running tool 230 being in the position shown in FIG. 20.

Further to the embodiment of FIG. 20, the degradable material 390 within the multilateral fluid loss device 240 has now fully degraded or otherwise dissolved, thereby allowing the plug member 380 to move to the second position, preventing fluid from traversing the fluid passageway 385 thereof.

Figure 21:
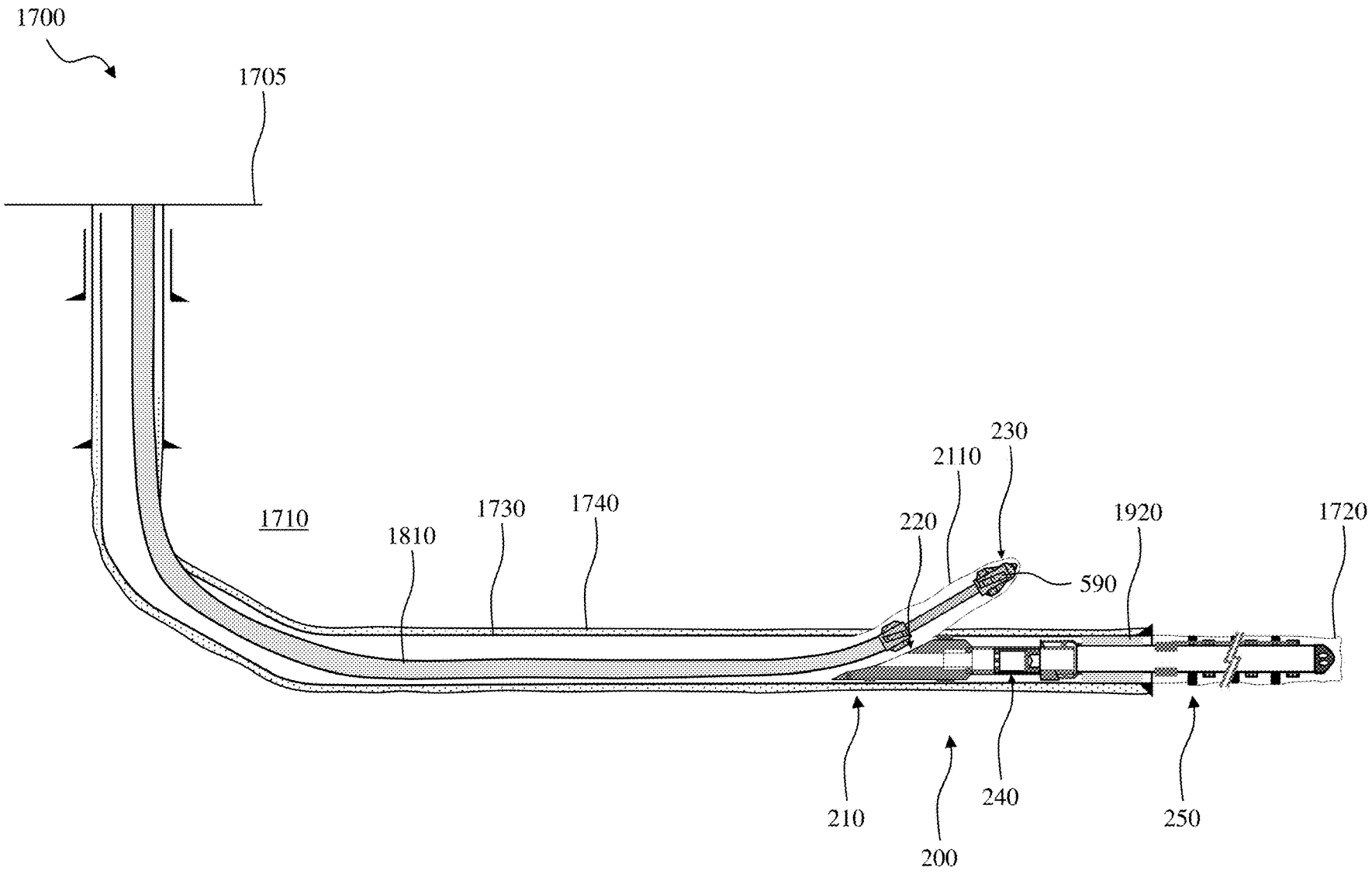

Turning to FIG. 21, illustrated is the well system 1700 of FIG. 20, after using the combined bit assembly 590 of the two part milling and running tool 230 to mill the wellbore tubular 1730 and drill a full window pocket 2110 in the subterranean formation 1710. In certain embodiments, the full window pocket 2110 is between 5 m and 15 m long, and in certain other embodiments about 13.5 m long. Thereafter, a circulate and clean process could occur, and then the two part milling and running tool 230 may be pulled out of hole.

Figure 22:
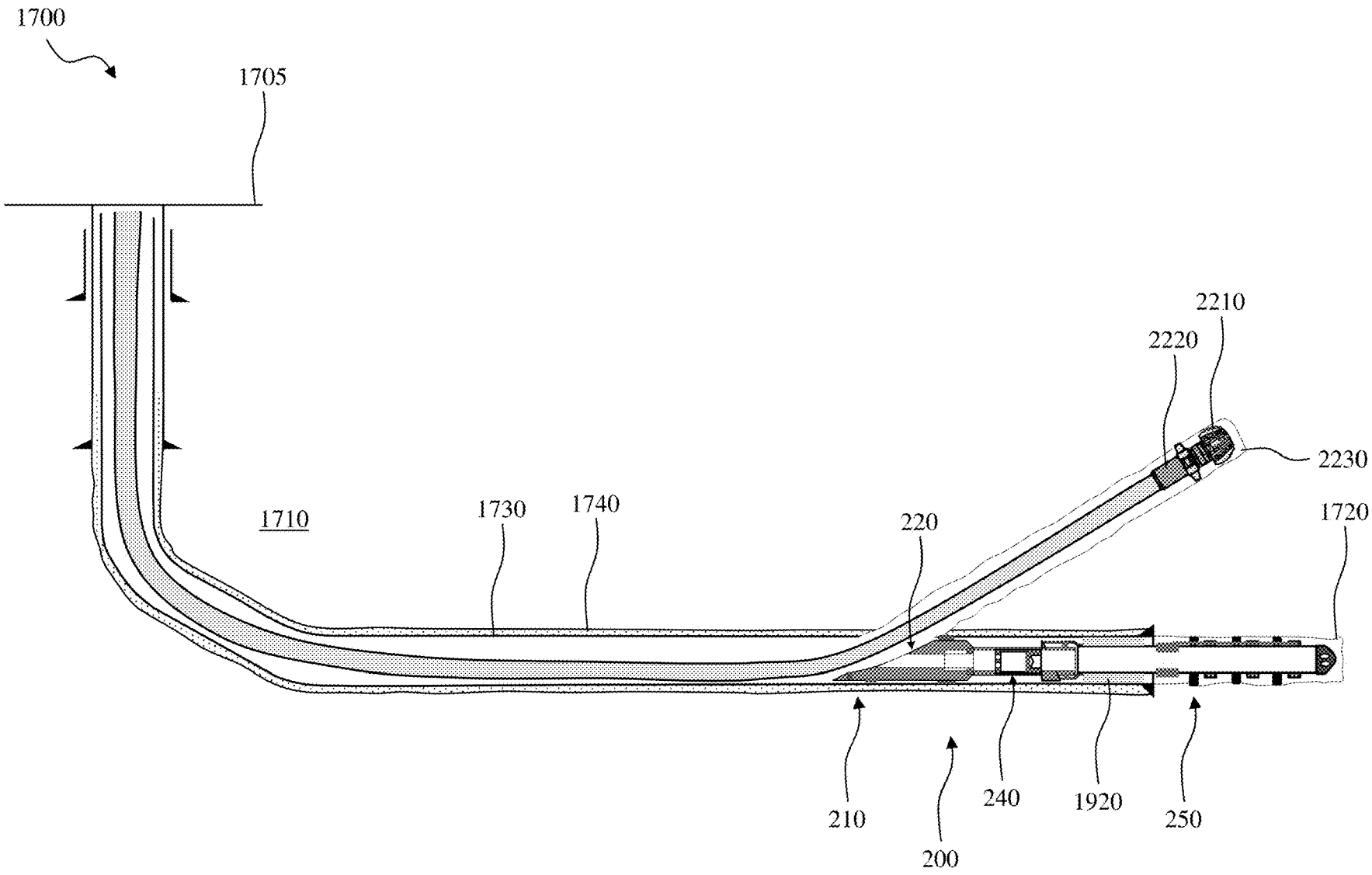

Turning to FIG. 22, illustrated is the well system 1700 of FIG. 21 after running in hole a drill string 2210, for example with a rotary steerable assembly 2220, and drilling the lateral wellbore 2230 to depth. In at least one embodiment, this could be considered the second multilateral trip downhole. Thereafter, the drill string 2210 and rotary steerable assembly 2220 may be pulled out of hole.

Figure 23:
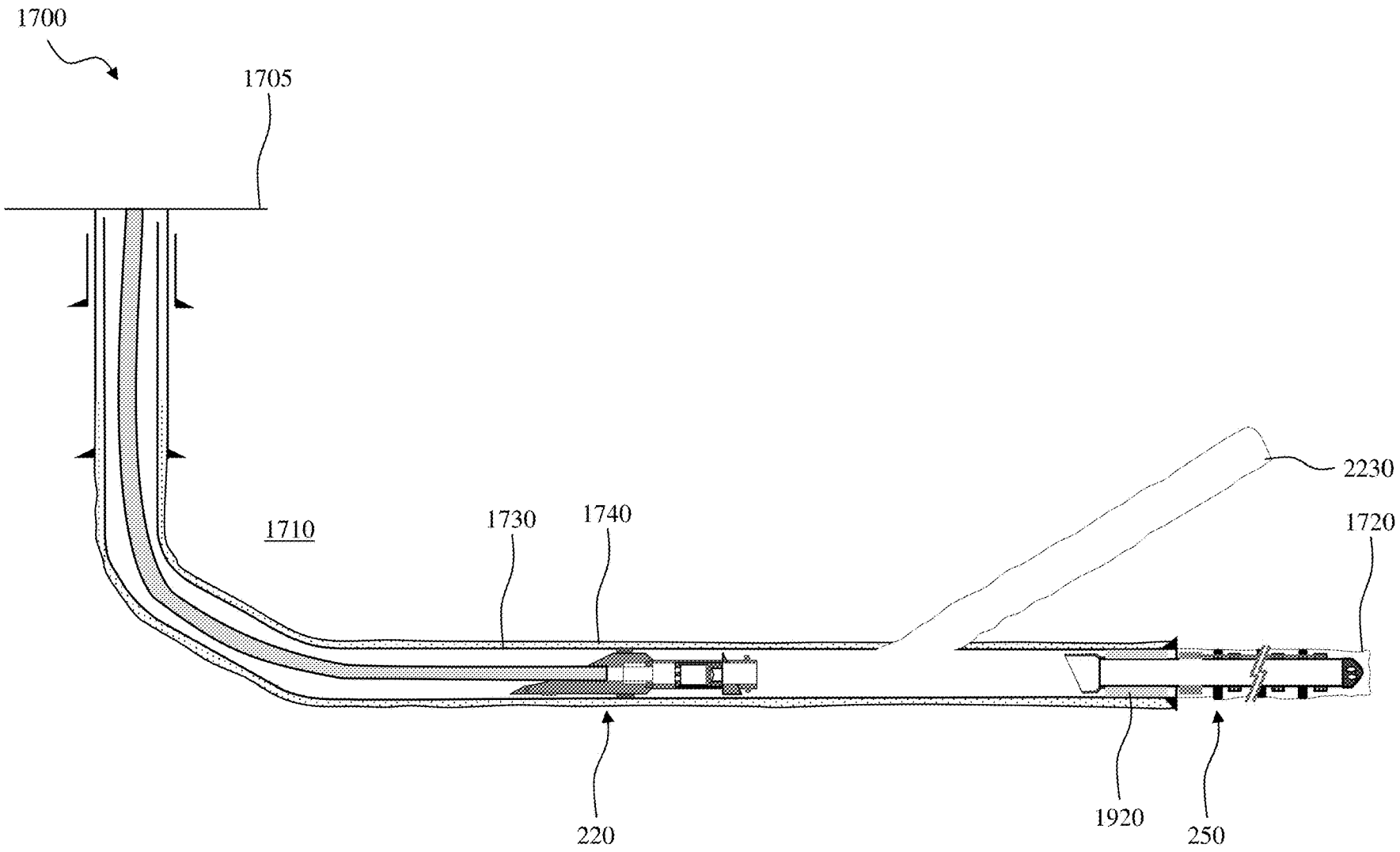

Turning to FIG. 23, illustrated is the well system 1700 of FIG. 22 after starting to pull the multilateral whipstock assembly 220 out of hole. In at least one embodiment, a retrieving tool, spear, or hook, among other tools, may be used to pull the multilateral whipstock assembly 220 out of hole.

Figure 24:
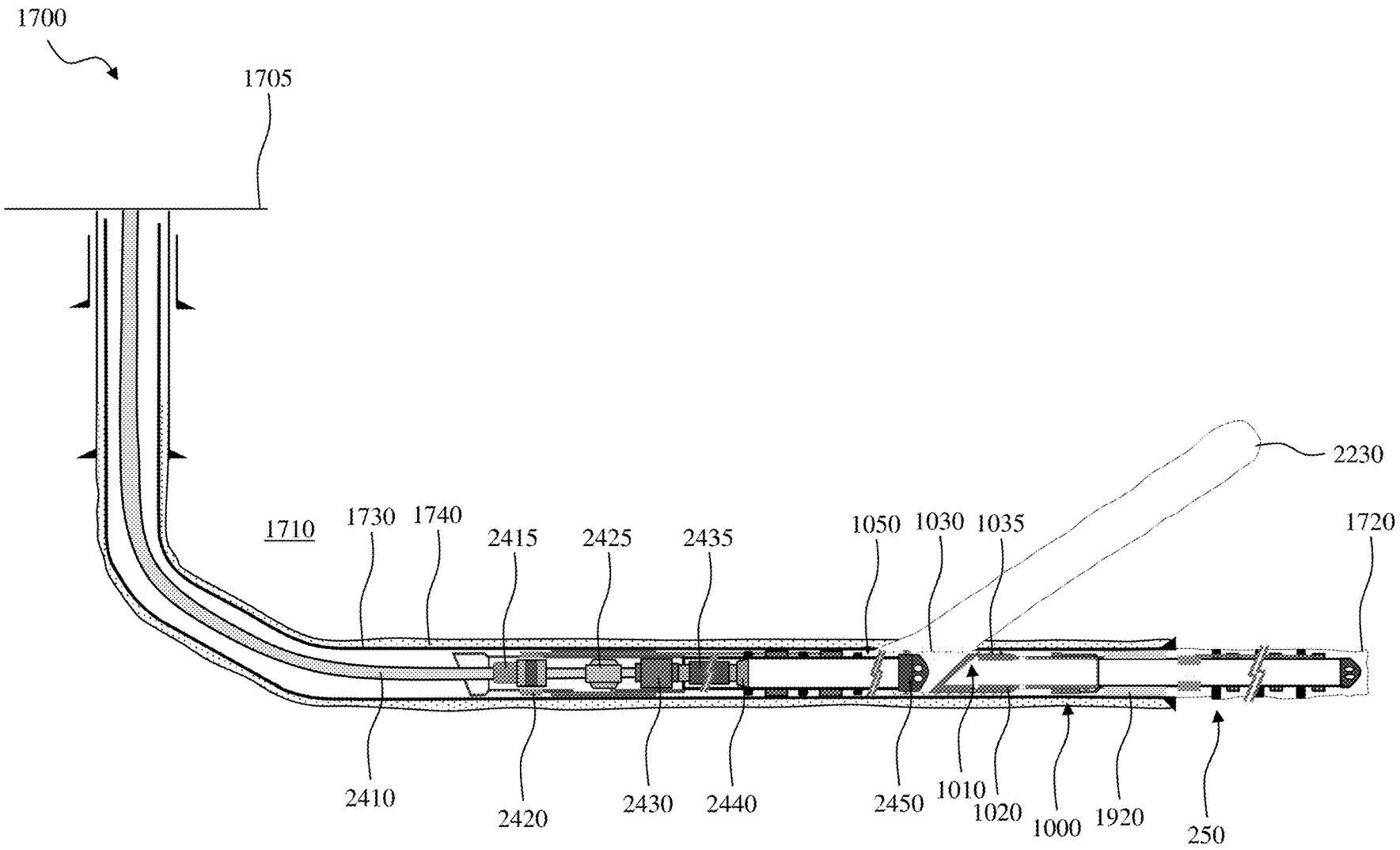

Turning to FIG. 24, illustrated is the well system 1700 of FIG. 23 after positioning a multilateral downhole assembly 1000 (e.g., as shown in FIG. 10A) within the main wellbore 1720 using a running tool 2410. In at least one embodiment, this could be considered the third multilateral trip downhole. The running tool 2410, in at least one embodiment, includes one or more of running tool downhole telemetry 2415, an inductive coupler or wet mate 2420 (e.g., to couple with control line coupler 1082), a workstring orientation tool 2425, a liner running tool 2430, a reactive catalyst 2435, and cup seals 2440. In the illustrated embodiment, the multilateral downhole assembly 1000 includes a multilateral deflector assembly 1010 coupled to a running tool, in this embodiment a multilateral junction assembly 1050.

In the illustrated embodiment, the running tool 2410 is coupled to the multilateral deflector assembly 1010 using a degradable material coupling mechanism 1030. In at least one embodiment, the degradable material coupling mechanism 1030 is configured to degrade over time and allow the running tool 2410 to release from the multilateral deflector assembly 1010.

The multilateral downhole assembly 1000 of FIG. 24 additionally includes an expandable metal anchor 1035 positioned on a radial exterior surface of the deflector body 1020. In one or more embodiments, the expandable metal anchor 1035 includes a metal configured to expand in response to hydrolysis to axially and rotationally fix the multilateral deflector assembly 1010 within a wellbore tubular.

In the embodiment of FIG. 24, with the multilateral deflector assembly 1010 engaged with the multilateral mainbore completion 250, the main wellbore 1720 is subject to reactive fluid. For example, in at least one embodiment, the operator could circulate reactive fluid down through the multilateral junction assembly 1050 through flow ports 1081 (FIG. 11C) and 1294 (FIG. 13) to initiate the chemical reaction process for each of the degradable material coupling mechanism 1030 and the expandable metal anchor 1035. In at least one embodiment, the circulation of reactive fluid may cease when the degradable material coupling mechanism 1030 and the expandable metal anchor 1035 are soaking in reactive fluid. Furthermore, it may be desirable to isolate the expandable metal anchor 1065 and the degradable material 1070 of the transition sleeve assembly 1055 from the reactive fluid so as to not activate those features as this time. Alternatively, the expandable metal anchor 1065 and the degradable material 1070 could include a delay coating, which would accomplish the same.

Figure 25:
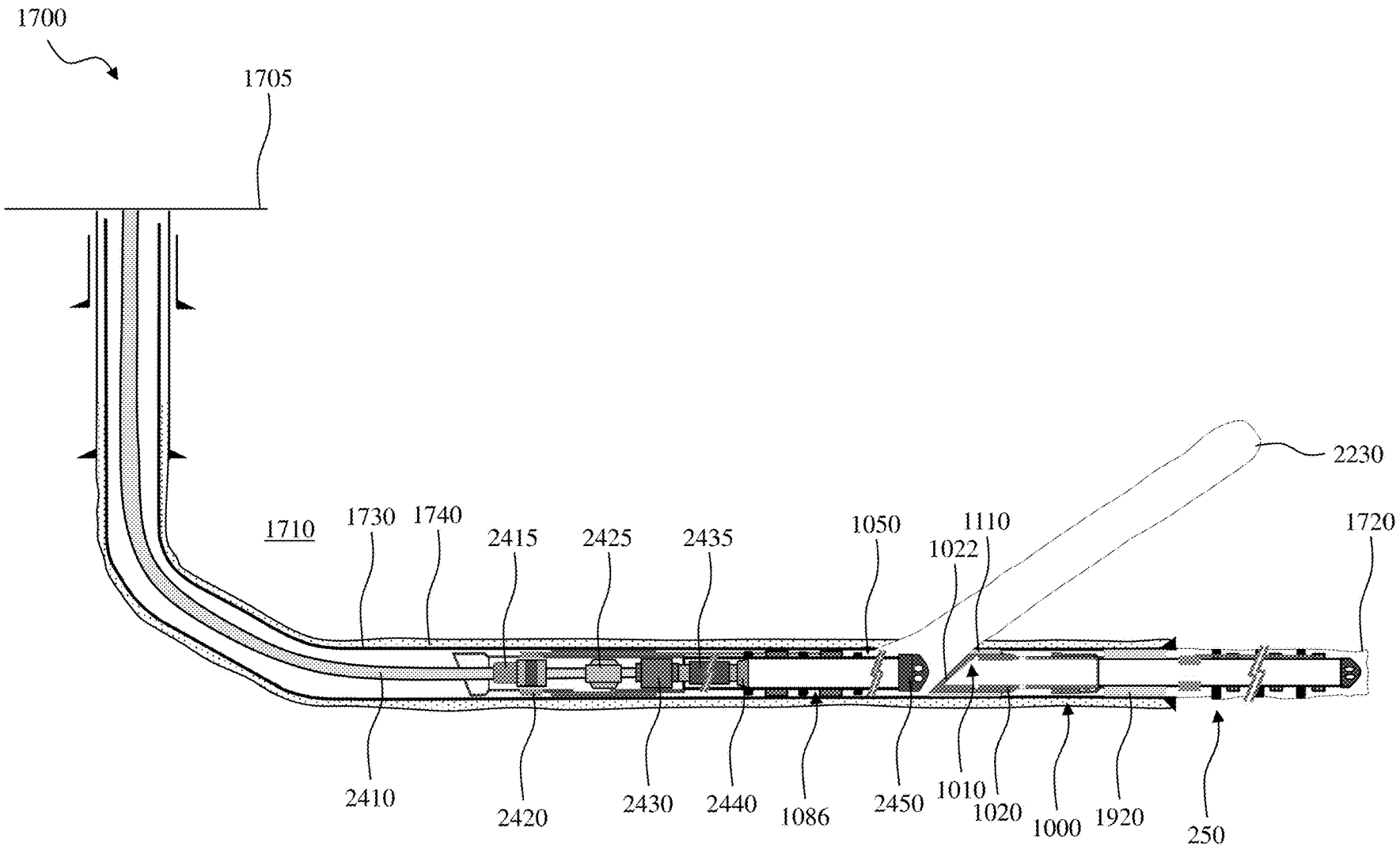

Turning to FIG. 25, illustrated is the well system 1700 of FIG. 24 after the degradable material coupling mechanism 1030 and the expandable metal anchor 1035 are subjected to the reactive fluid, and thereby forming an expanded metal anchor 1110. In the illustrated embodiment, the expanded metal anchor 1110 generally fills the space. Notwithstanding the foregoing, the expanded metal anchor 1110 may have a variety of different volumes and remain within the scope of the disclosure, and in one embodiment may not extend uphole of the deflector face 1022. Such volumes, as expected, are a function of the size of the space, the volume of the expandable metal anchor 1035, and the composition of the expandable metal anchor 1035, among other factors.

In the illustrated embodiment of FIG. 25, the degradable material coupling mechanism 1030 also comprises the material configured to expand in response to hydrolysis. However, given the limited volume of the degradable material coupling mechanism 1030 relative to the space surrounding it, the degradable material coupling mechanism 1030 degrades over time and allows the multilateral junction assembly 1050 to release from the multilateral deflector assembly 1010. Accordingly, a single unitary layer of expandable metal may both result in the expanded metal anchor 1110, as well as degrade to release the multilateral deflector assembly 1010.

In the embodiment of FIG. 25, the multilateral junction assembly 1050 is free from the multilateral downhole assembly 1000. Furthermore, a bullnose 2450 of the multilateral junction assembly 1050 is sized to deflect out into the lateral wellbore 2130.

Figure 26:
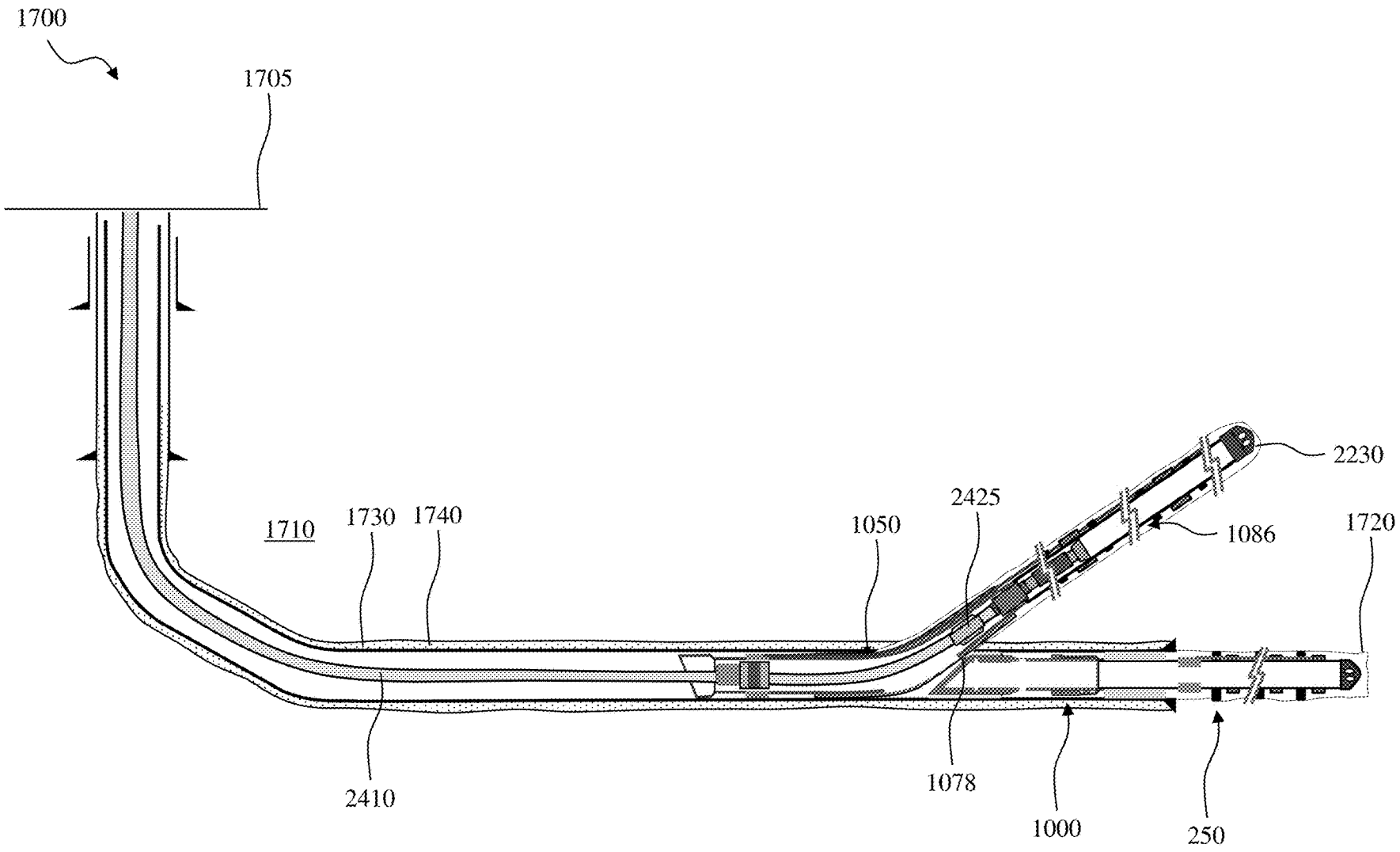

Turning to FIG. 26, illustrated is the well system 1700 of FIG. 25 after running the multilateral junction assembly 1050 to the target depth in the lateral wellbore 2130. In at least one embodiment, the workstring orientation tool 2425 is employed to get rough alignment near total depth. In at least one embodiment, at final total depth the orientation feature 1078 (e.g., collet finger no-go feature) provides for proper orientation and space out of the multilateral junction assembly 1050. In at least one embodiment, at this stage, health checks may be performed on the devices of the multilateral lateral bore completion 1086, for example using downhole telemetry. Furthermore, reactive fluid may be circulated downhole (e.g., through the one or more flow ports 1081), the circulation for example stopping when the transition sleeve assembly 1055 is soaking in reactive fluid.

Figure 27:
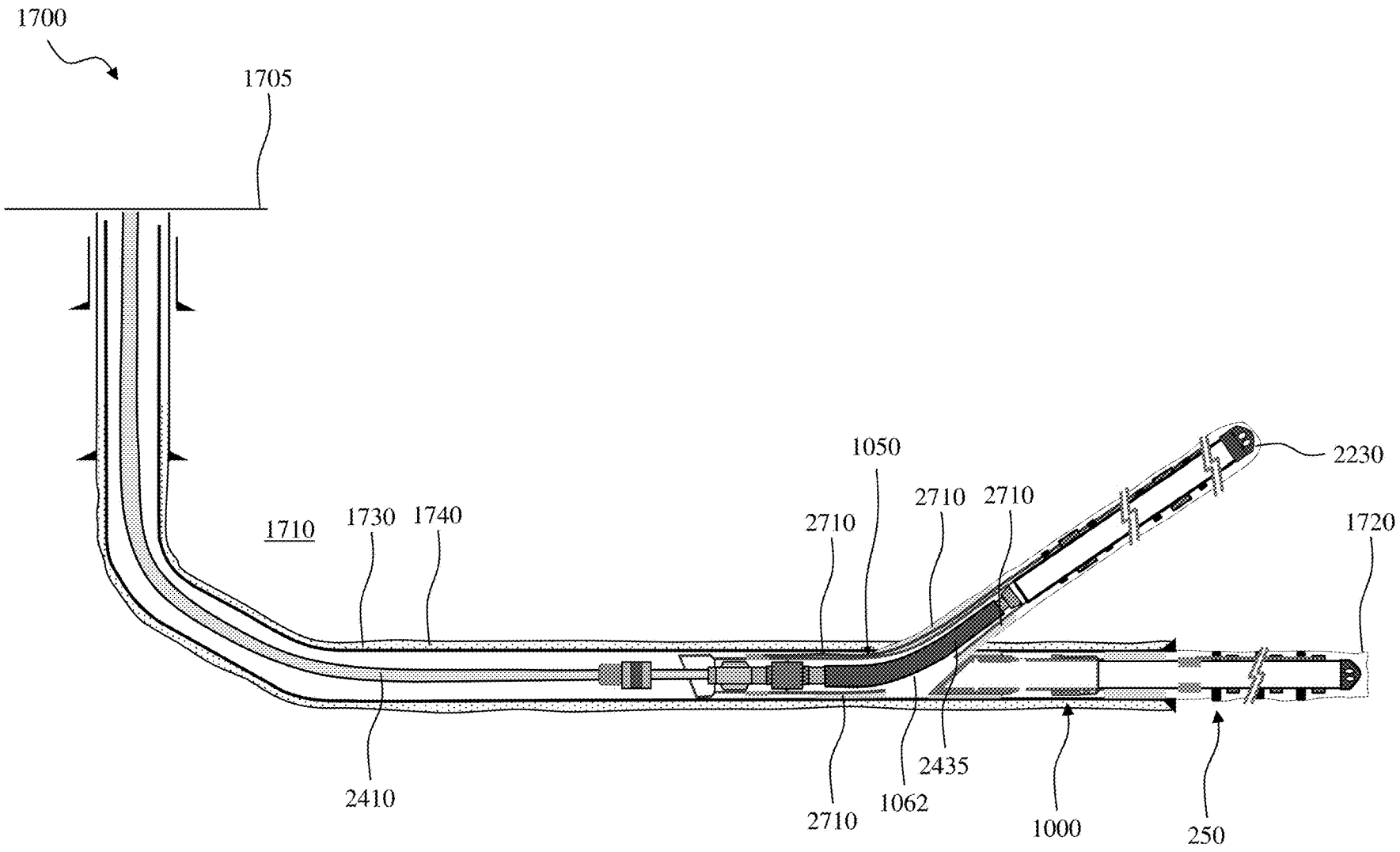

Turning to FIG. 27, illustrated is the well system 1700 of FIG. 26 after the expandable metal anchor 1065 has expanded into an expanded metal anchor 2710, and the degradable material 1070 has degraded or otherwise washed away, thereby uncovering the sidewall opening 1062, and thus opening a pathway to the multilateral downhole assembly 1000.

In at least one embodiment, the reactive catalyst 2435 is placed proximate to the expandable metal anchor 1065 and the degradable material 1070 to accelerate a chemical reaction of the expandable metal. For example, in at least one embodiment, the reactive catalyst 2435 is placed across the expandable metal anchor 1065 and the degradable material 1070 to accelerate a chemical reaction of the expandable metal.

Figure 28:
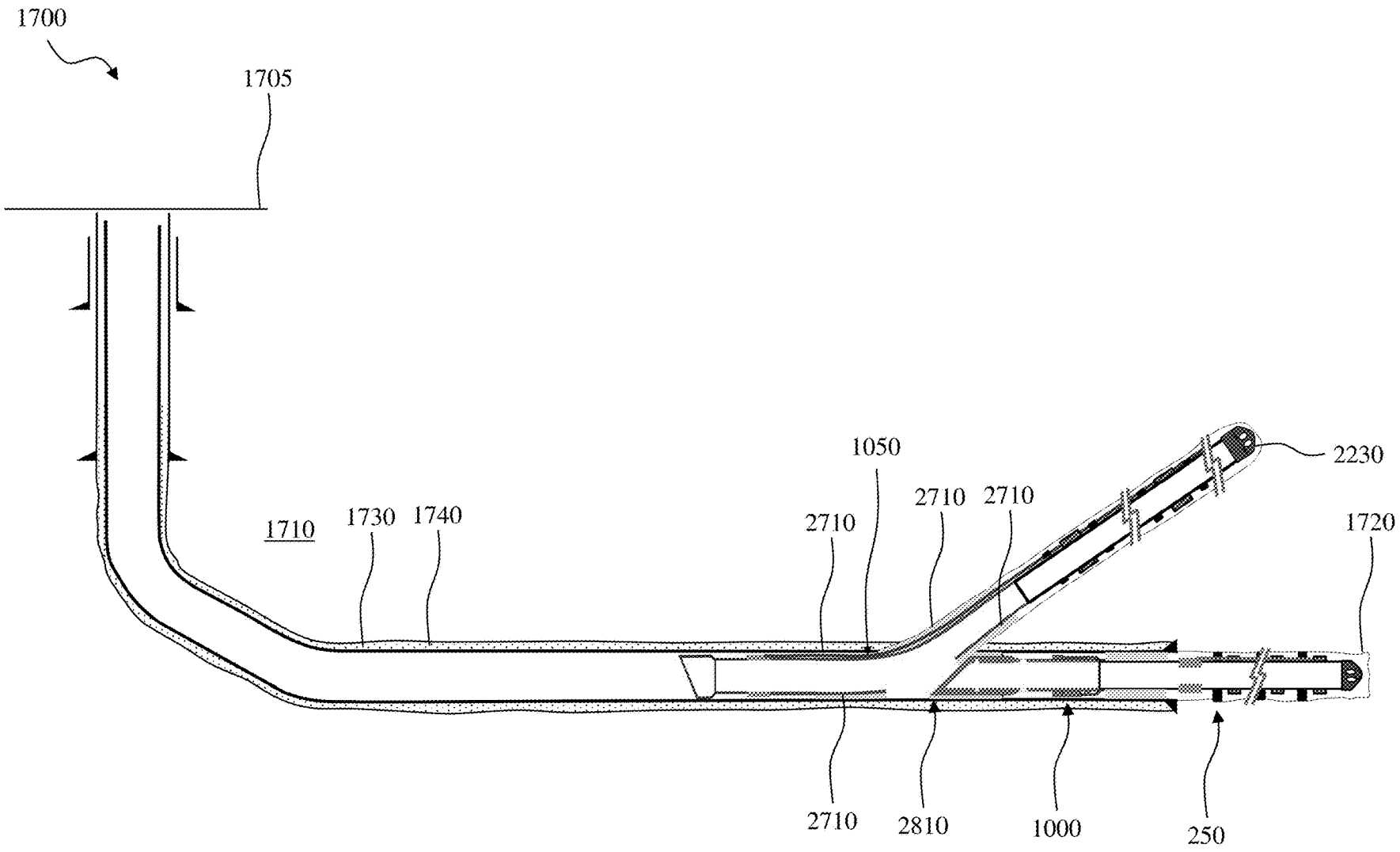

Turning to FIG. 28, illustrated is the well system 1700 of FIG. 27 after the running tool 2410 is pulled out of hole. What results, in at least one embodiment, is a Level-5 multilateral junction 2810. The Level-5 multilateral junction 2810 includes high pressure isolation and high mechanical strength. The Level-5 multilateral junction 2810 also has a larger ID and mechanical access to the main wellbore 1720 and lateral wellbore 2130.

Figure 29:
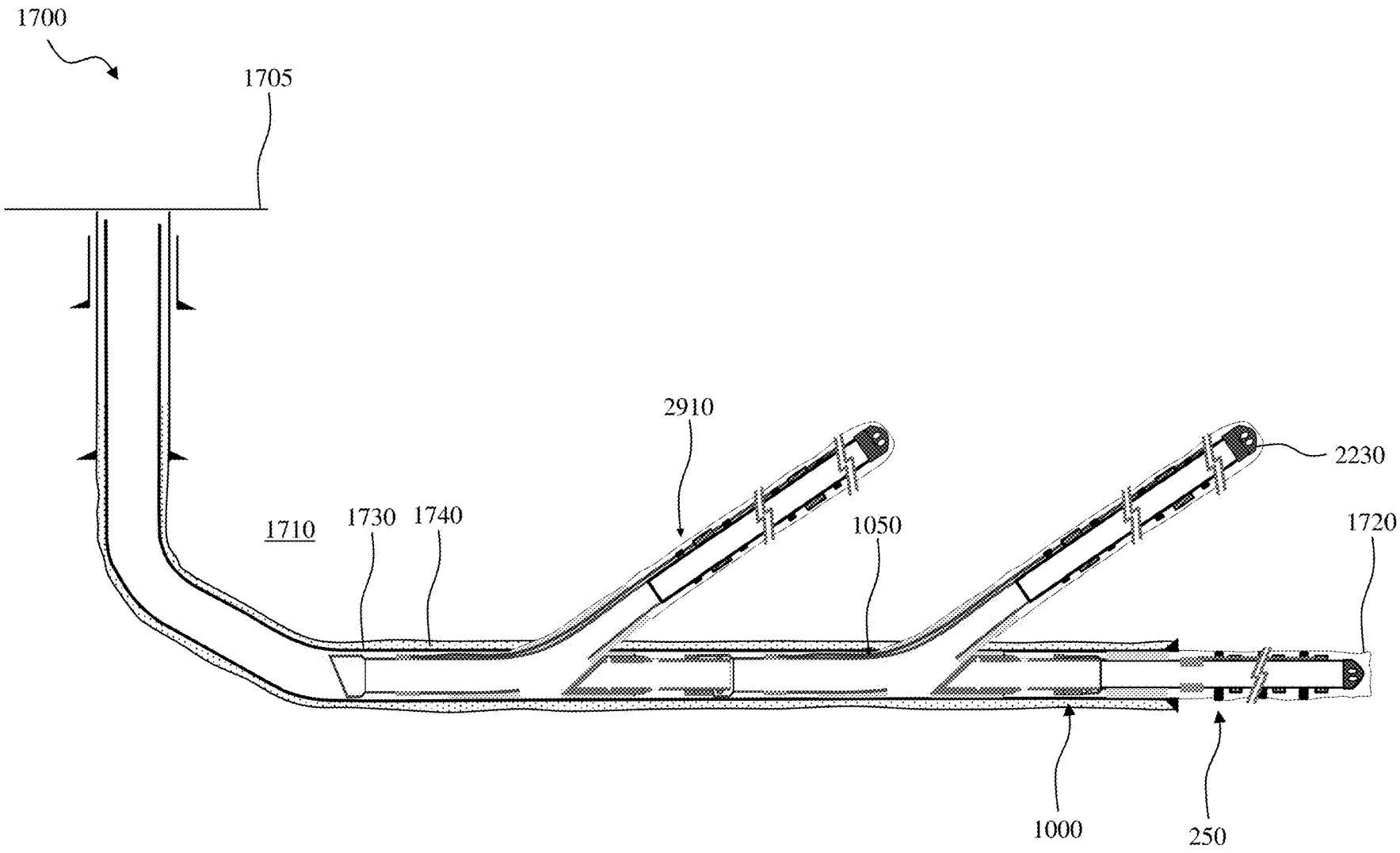

Turning to FIG. 29, illustrated is the well system 1700 of FIG. 28 after repeating the process described with regard to FIGS. 18 through 28 to create a trilateral wellbore 2910. In the embodiment of FIG. 29 only two lateral wellbores have been formed. It should be noted, however, that the details of the present disclosure may be used to form any number of lateral wellbores off of the main wellbore 1720 without departing from the scope of the disclosure.

Figure 30:
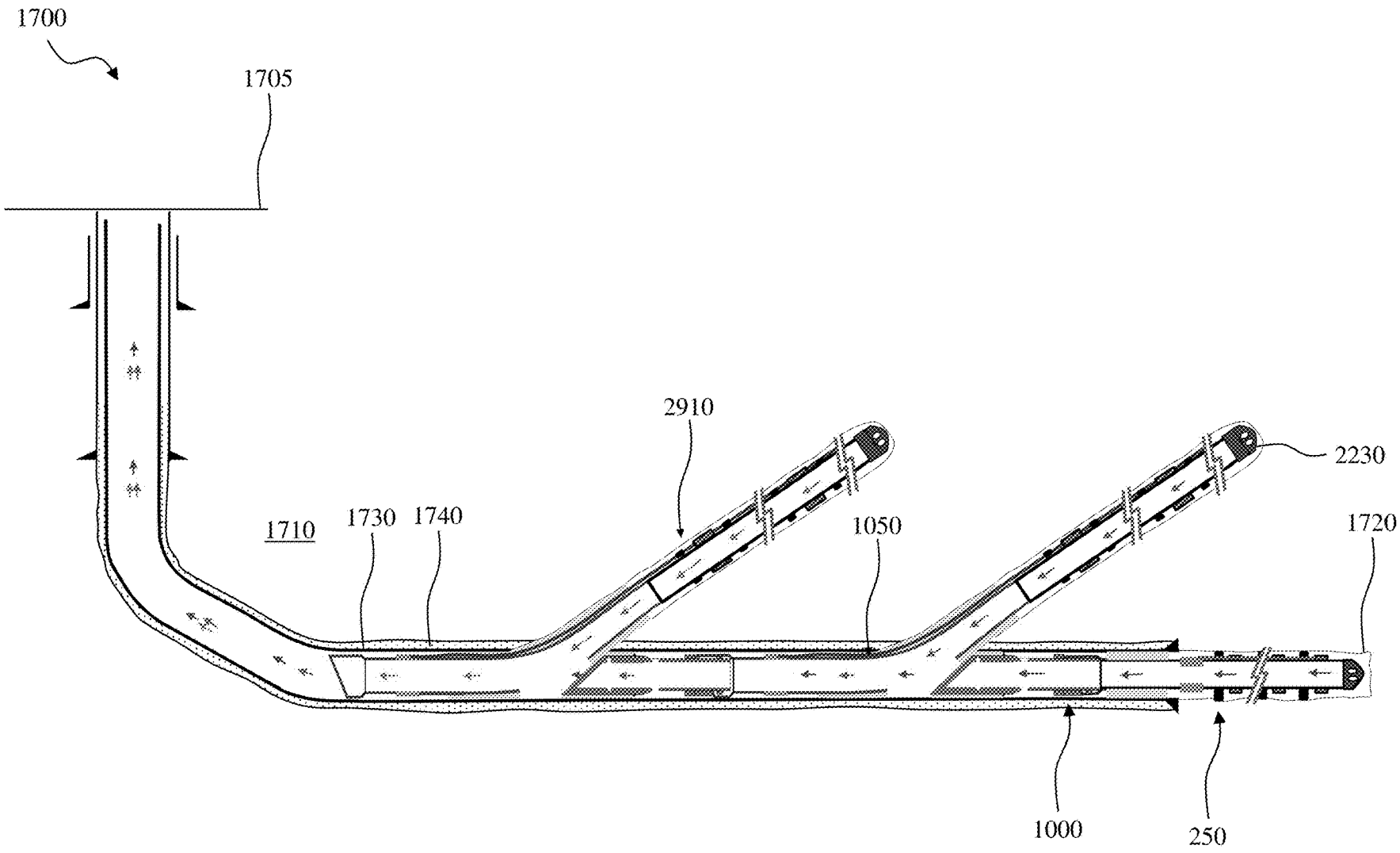

Turning to FIG. 30, illustrated is the well system 1700 of FIG. 29 after producing from the well system 1700.

Figure 31:
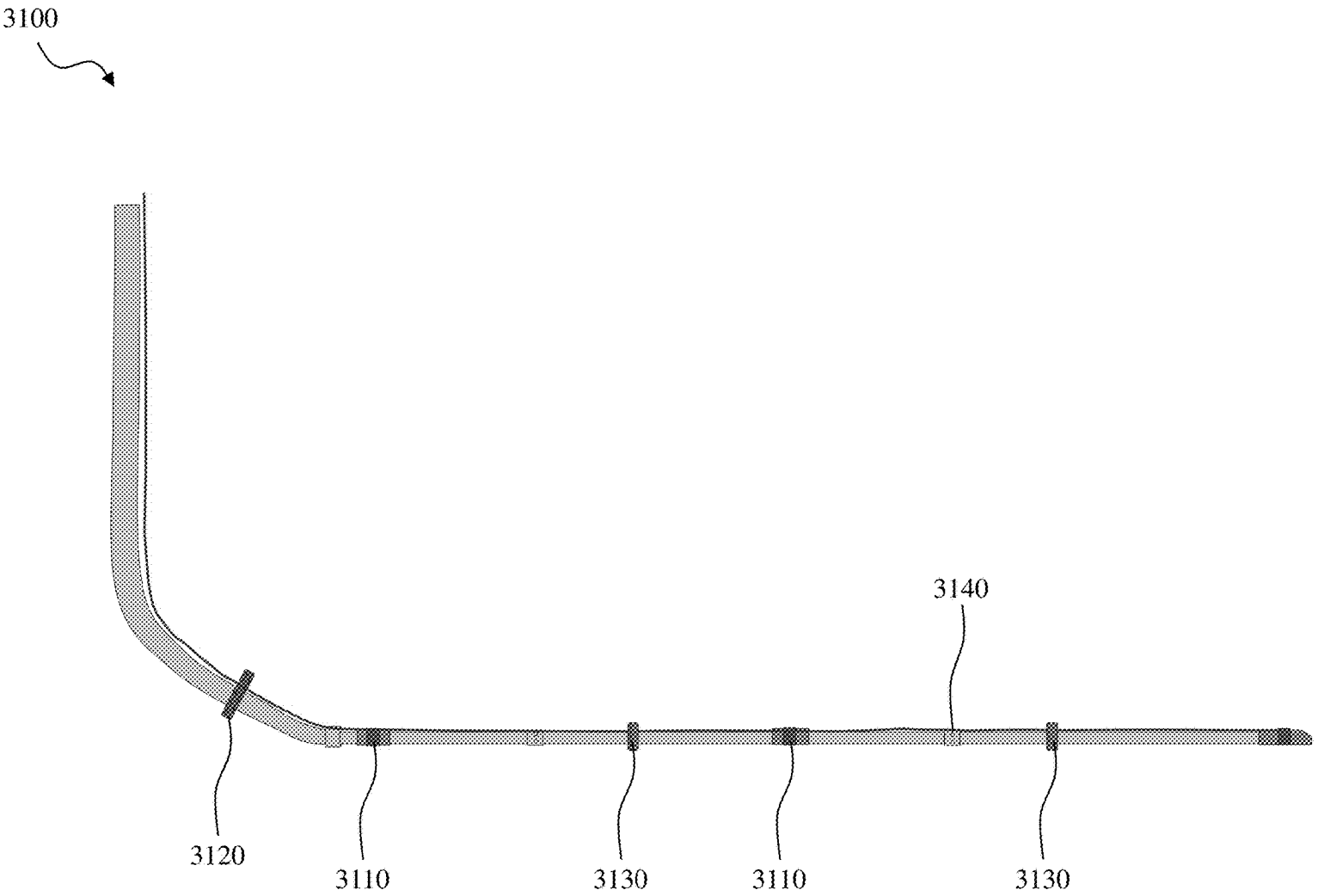

Turning to FIG. 31, illustrated is a final completion string 3100 that could be used with a well system, such as the well system 1700 of FIG. 30. For example, the final completion string 3100 could be used for wired lateral completion devices. In at least one embodiment, the final completion string 3100 includes one or more mating inductive couplers and/or wet mates 3110, as might couple with the control line couplers (e.g., control line coupler 1082) of the well system 1700. Accordingly, any lateral devices and/or sensors may be coupled to the terranean surface 1705. In the illustrated embodiment of FIG. 31, the final completion string 3100 additionally includes a production packer 3120, one or more feedthrough packers or swell packers 3130, and a perforated pup joint 3140.

Figure 32:
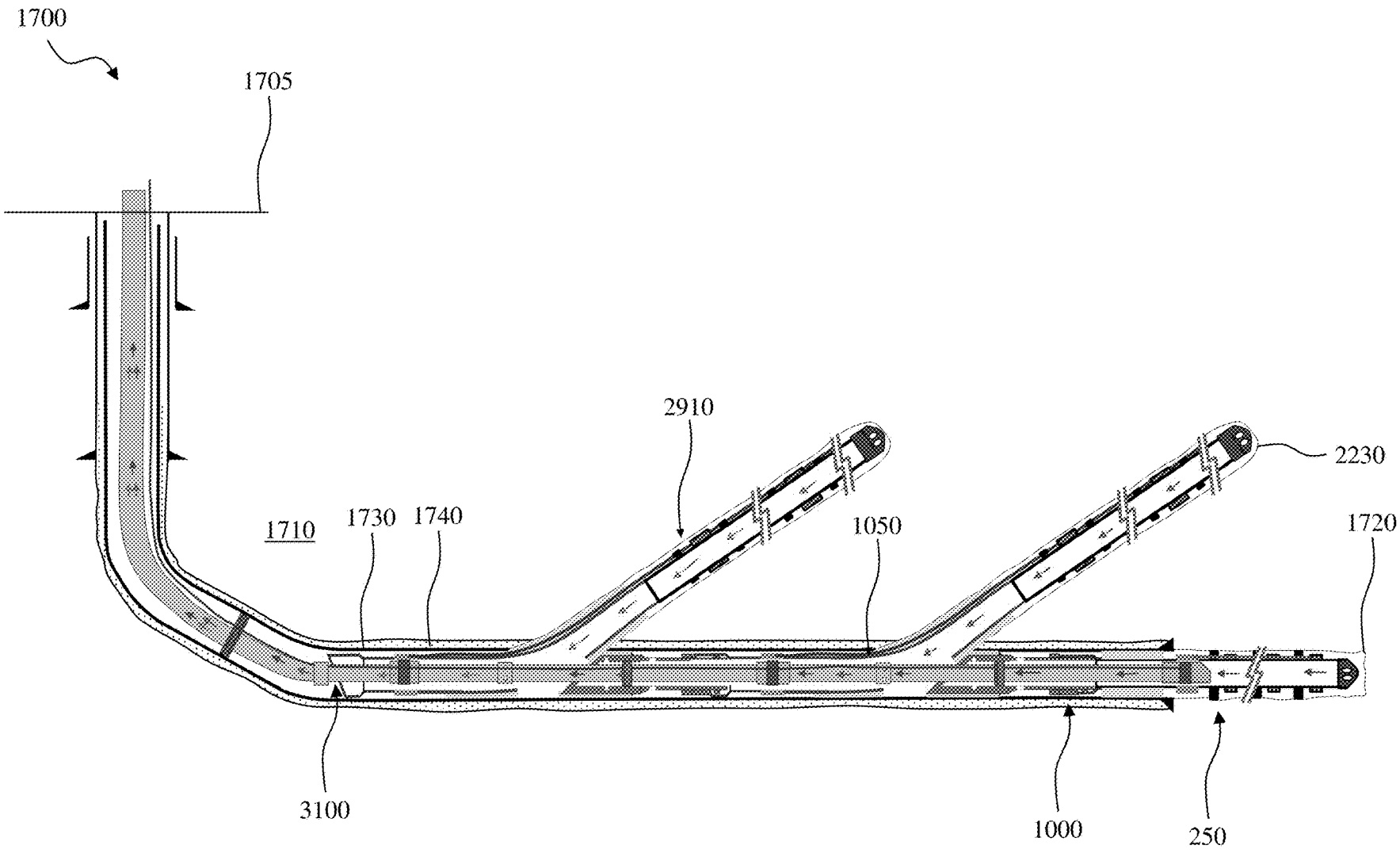

Turning to FIG. 32, illustrated is the well system 1700 of FIG. 29 after positioning the final completion string 3100 of FIG. 31 therein. In at least one embodiment, this could be considered the fourth (e.g., and final) multilateral trip downhole. With the final completion string 3100 in place, the interval control valves may be opened electrically, and the well system 1700 is ready to produce from, which may be achieved with only four multilateral trips downhole.

Figure 33:
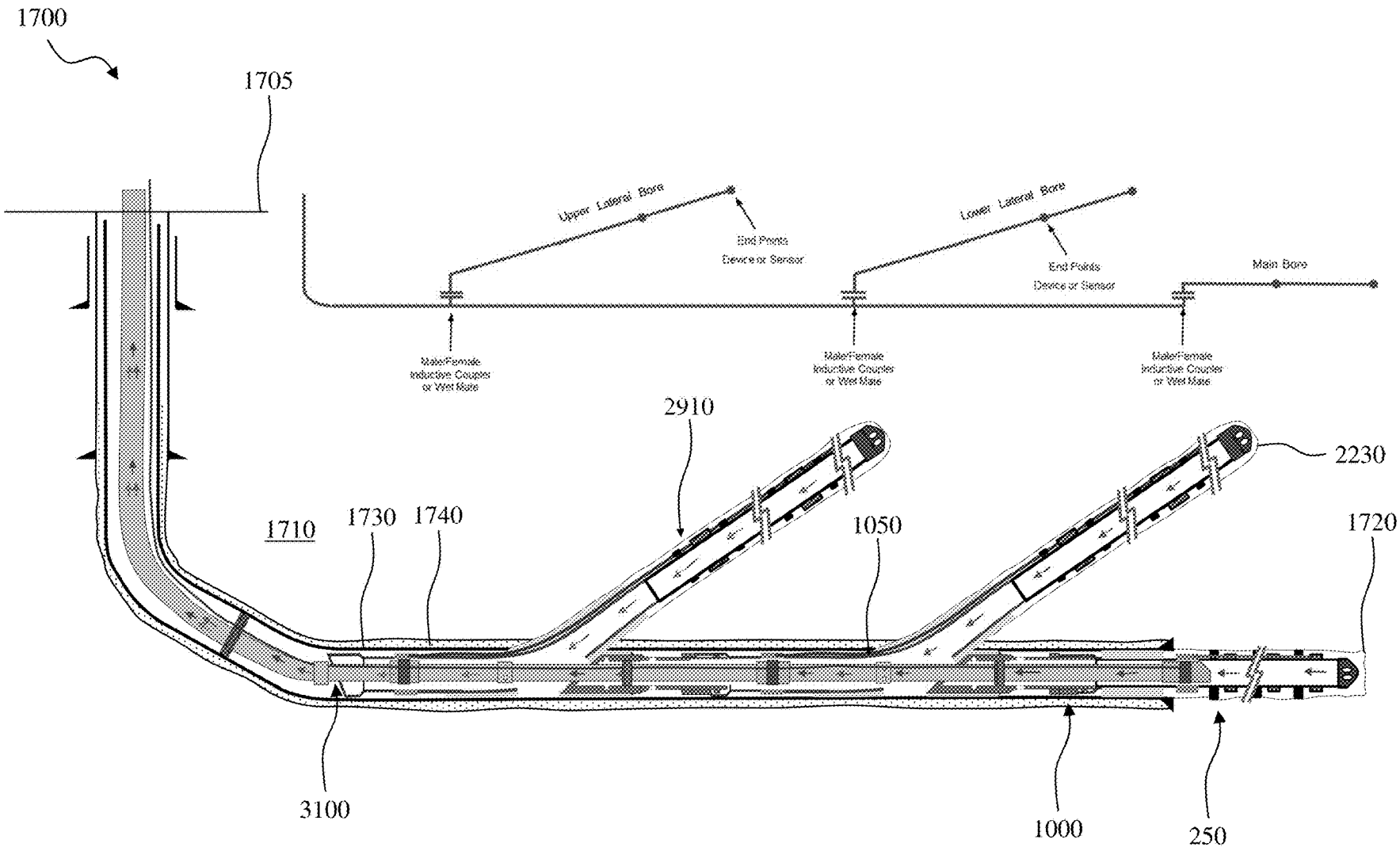

Turning to FIG. 33, illustrated is the well system 1700 of FIG. 32 illustrating that the lateral wellbores may be parallel connected. The parallel connected lateral wellbores provide fault tolerance and optimized signal transmission, among other benefits.

Turning to FIGS. 34 through 51, illustrated is a method for forming a well system 3400 at various different stages of manufacture, the well system 3400 employing one or more of the features disclosed above with respect to FIGS. 2 through 16F. As the embodiment of FIGS. 34 through 51 will employ one or more features disclosed with respect to FIGS. 2 through 16F above, like reference numbers may be used to indicate similar, if not identical, features. Furthermore, FIGS. 34 through 51 should be viewed in conjunction with FIGS. 2 through 16F.

Figure 34:
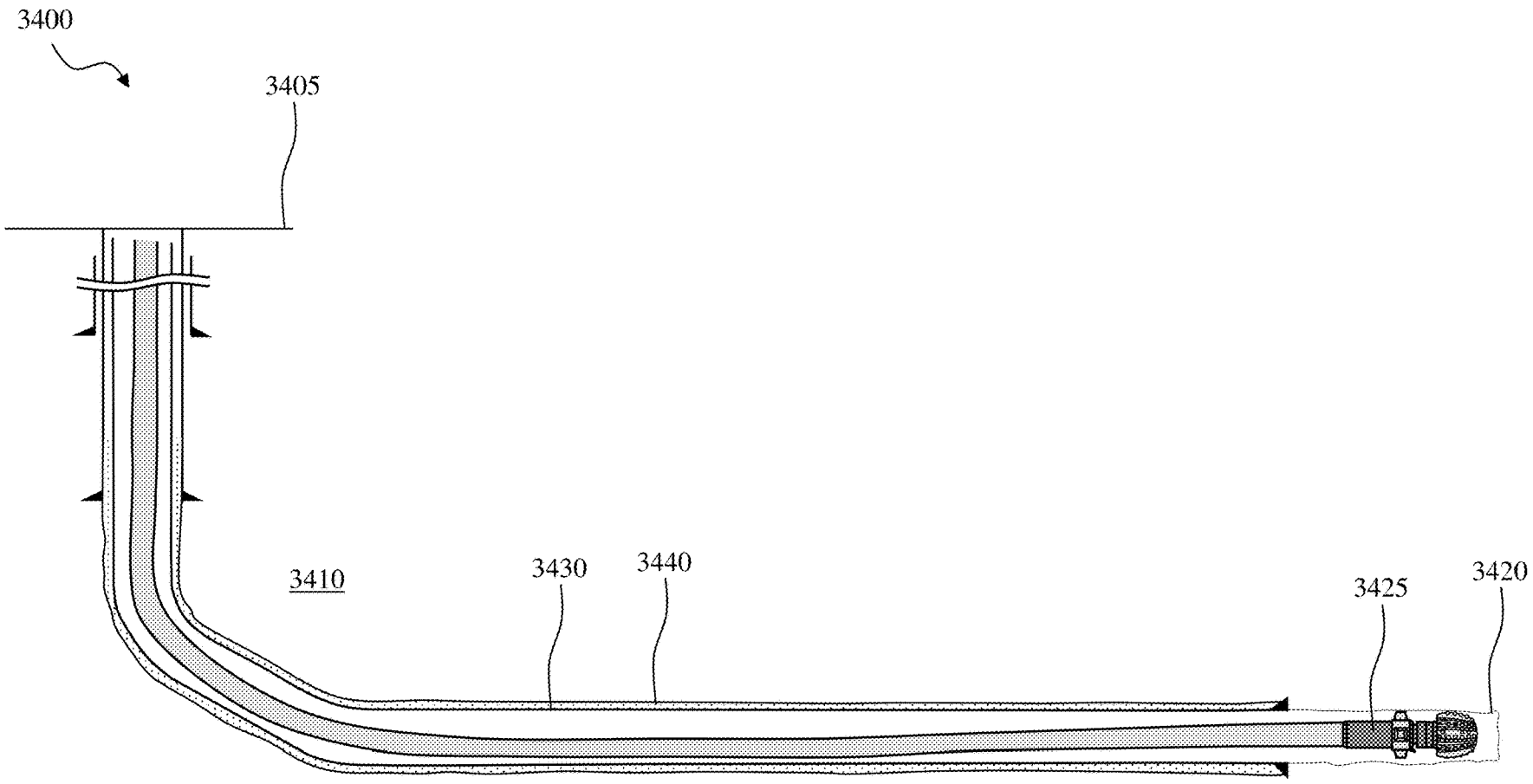

With initial reference to FIG. 34, a main wellbore 3420 has been drilled (e.g., using a drilling assembly 3425) from a terranean surface 3405 through one or more subterranean formations 3410. In the illustrated embodiment, the main wellbore 3420 includes a wellbore tubular 3430 (e.g., wellbore casing, wellbore liner, etc.), as well as cement 3440 positioned between the wellbore tubular 3430 and the main wellbore 3420.

Figure 35:
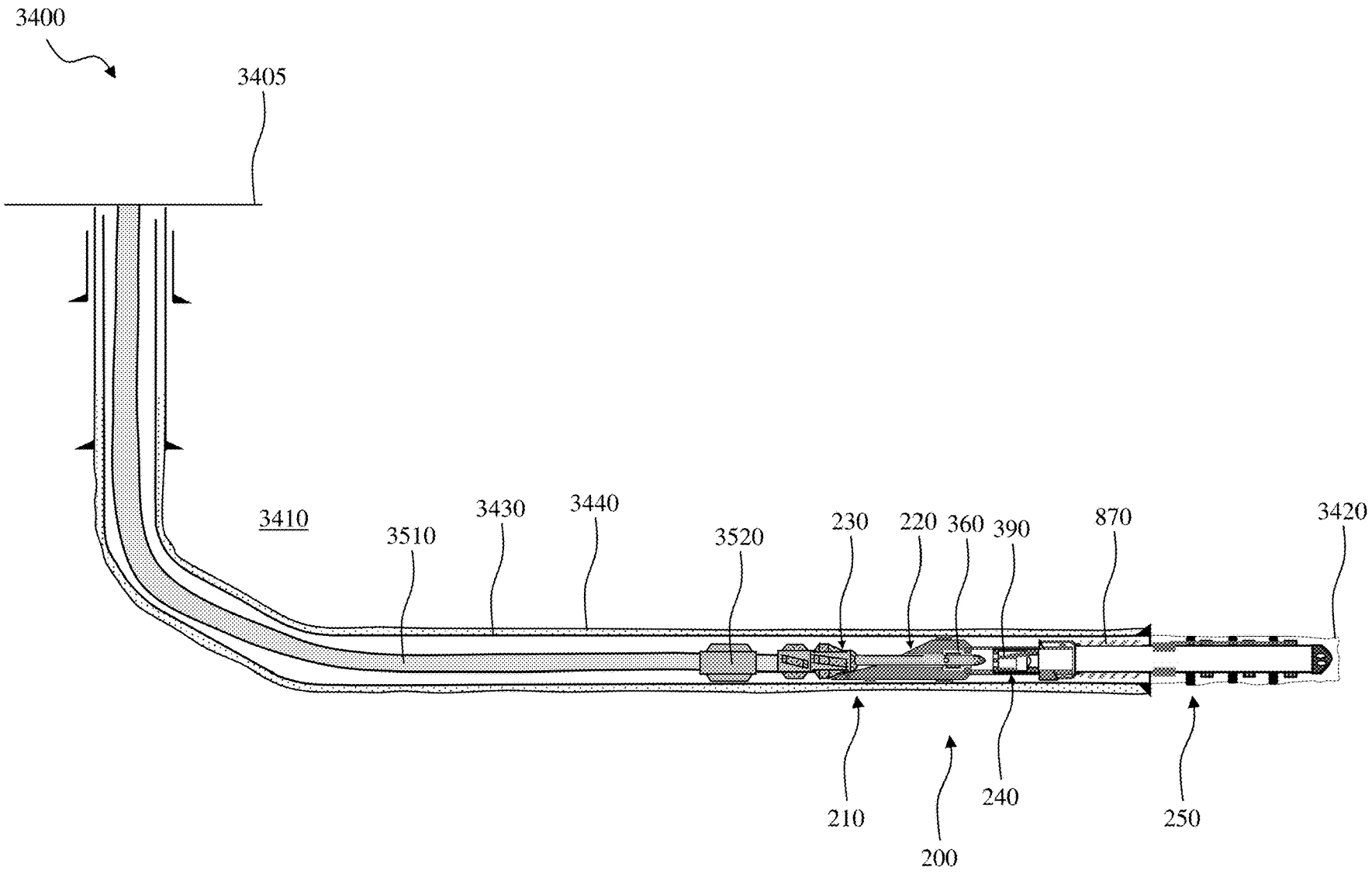

Turning to FIG. 35, illustrated is the well system 3400 of FIG. 34 after employing a running tool 3510 to position a multilateral downhole device 200 designed, manufactured and/or operated according to one or more embodiments of the disclosure within the main wellbore 3420. In at least one embodiment, this could be considered the first multilateral trip downhole. In the illustrated embodiment of FIG. 35, the multilateral downhole device 200 includes one or more of a multilateral milling assembly 210 (e.g., which in at least one embodiment includes a multilateral whipstock assembly 220, a two part milling and running tool 230, and a multilateral fluid loss device 240) and a multilateral mainbore completion 250, all of which may include various different versions and/or positioning of the expandable metal and/or degradable material designed, manufactured and/or operated according to one or more embodiments of the disclosure. In the illustrated embodiment of FIG. 35, the degradable material 360, 390 of the multilateral whipstock assembly 220 and multilateral fluid loss device 240, respectively, remain intact. Additionally, the expandable metal anchor 870 of the multilateral mainbore completion 250 is in the unexpanded state. In the illustrated embodiment of FIG. 35, the running tool 3510, along with a workstring orientation tool (WOT) 3520, have axially and rotationally positioned the multilateral whipstock assembly 220 at a location in the main wellbore 3420 wherein a lateral wellbore is to be formed. Those skilled in the art understand the process for accomplishing such.

Figure 36:
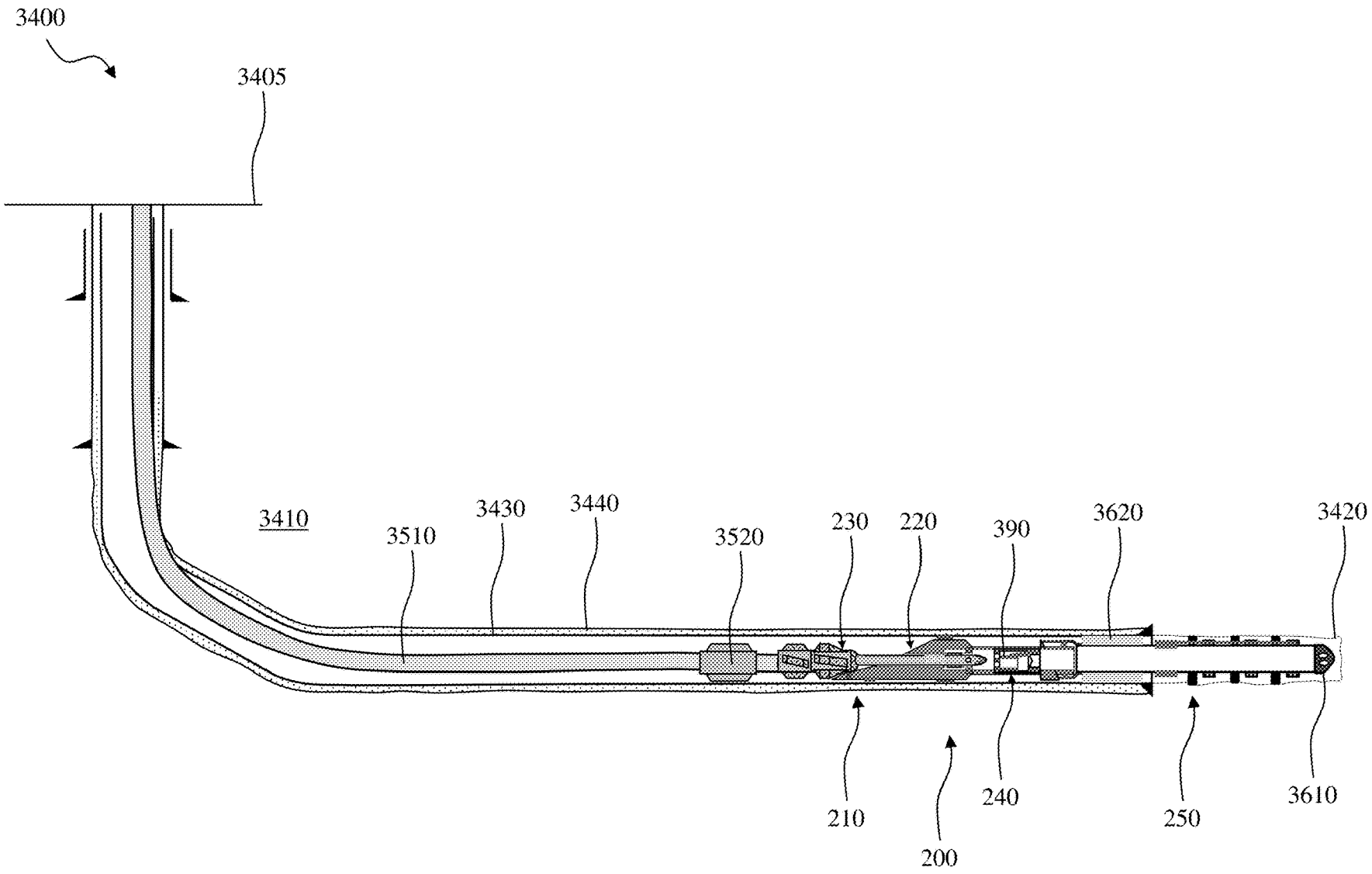

Turning to FIG. 36, illustrated is the well system 3400 of FIG. 35, after subjecting the multilateral downhole device 200 to reactive fluid (e.g., mud with water based completion fluid, brine, etc.). For example, in at least one embodiment, the operator could circulate reactive fluid down through a float shoe 3610 located at the end of the multilateral downhole device 200 to initiate the chemical reaction process for each of the degradable material 360, 390 and the expandable metal anchor 870. In at least one embodiment, the circulation of reactive fluid may cease when the expandable metal anchor 870, and the degradable materials 360, 390< are soaking in reactive fluid.

As shown in FIG. 36, the reactive fluid causes the expandable metal anchor 870 to turn to an expanded metal anchor 3620, as discussed above. Additionally, the reactive fluid causes the degradable material 360 to degrade or otherwise dissolve away, for example allowing the two part milling and running tool 230 the ability to decouple from the multilateral whipstock assembly 220. In at least this one embodiment, the degradable material 390 of the multilateral fluid loss device 240 includes a delay coating thereon, and thus the degradable material 390 remains in the multilateral fluid loss device 240 at this point in time. Nevertheless, it is also possible that the degradable material 390 was to degrade or otherwise dissolve away at this stage of the process.

Figure 37:
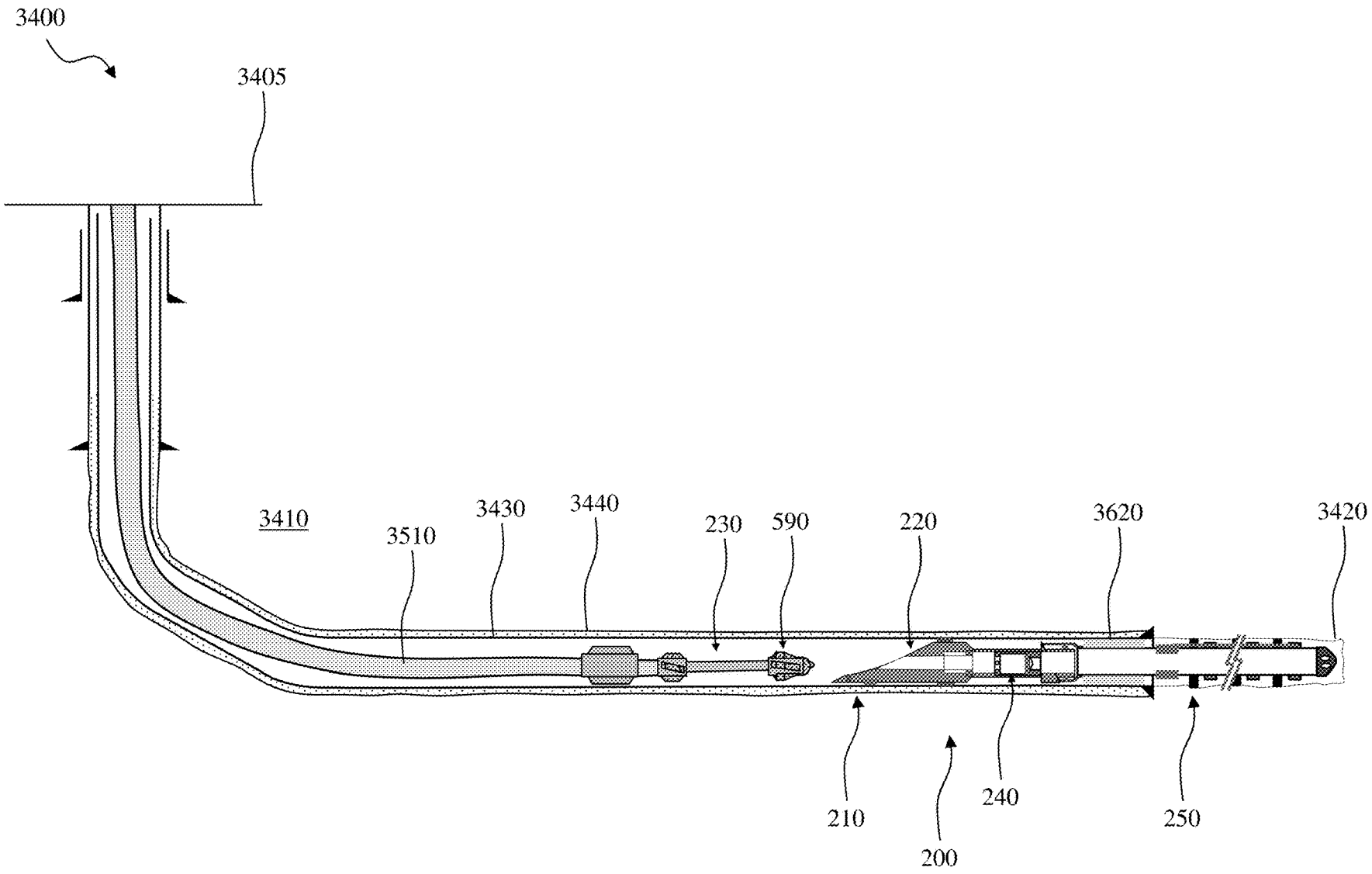

Turning to FIG. 37, illustrated is the well system of FIG. 36 after the degradable material 360 axially fixing the two part milling and running tool 230 to the multilateral whipstock assembly 220 has fully degraded, and thus the two part milling and running tool 230 is free to slide relative to the multilateral whipstock assembly 220. For example, the smaller assembly 330 could first slide relative to the larger bit assembly 340 to form the combined bit assembly 590 (e.g., in at least one embodiment, the body lock ring 530 of the larger bit assembly 340 would axially fix the smaller assembly 330 to the larger bit assembly 340). Thereafter, the combined bit assembly 590 would continue to be pulled uphole, thereby shearing the coupling mechanism 355 located between the larger bit assembly 340 and the multilateral downhole device 200, resulting in the two part milling and running tool 230 being in the position shown in FIG. 37.

Further to the embodiment of FIG. 37, the degradable material 390 within the multilateral fluid loss device 240 has now fully degraded or otherwise dissolved, thereby allowing the plug member 380 to move to the second position preventing fluid from traversing the fluid passageway 385 thereof.

Figure 38:
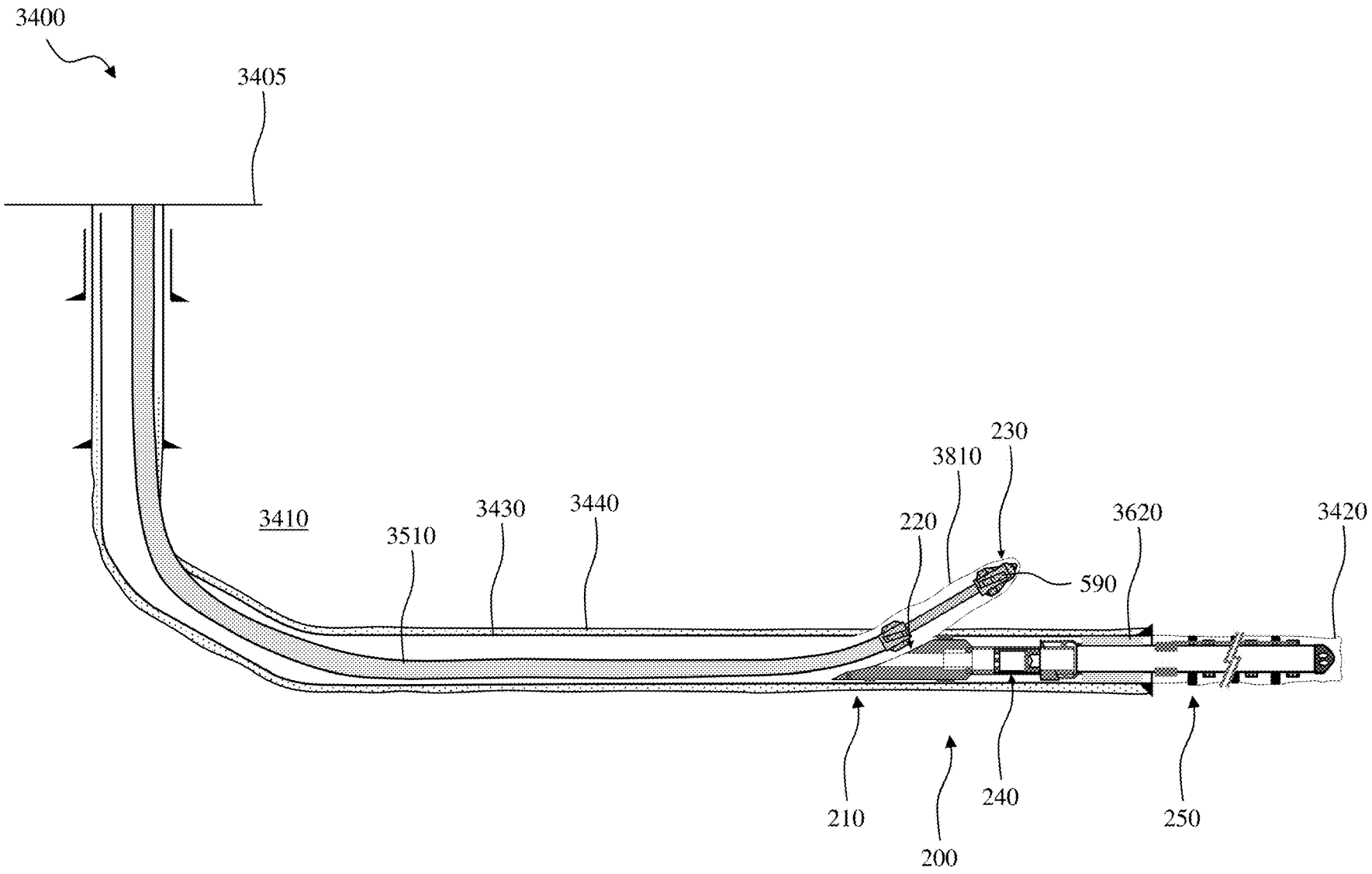

Turning to FIG. 38, illustrated is the well system 3400 of FIG. 37, after using the combined bit assembly 590 of the two part milling and running tool 230 to mill the wellbore tubular 3430 and drill a full window pocket 3810 in the subterranean formation 3410. In certain embodiments, the full window pocket 3810 is between 5 m and 15 m long, and in certain other embodiments about 13.5 m long. Thereafter, a circulate and clean process could occur, and then the two part milling and running tool 230 may be pulled out of hole.

Figure 39:
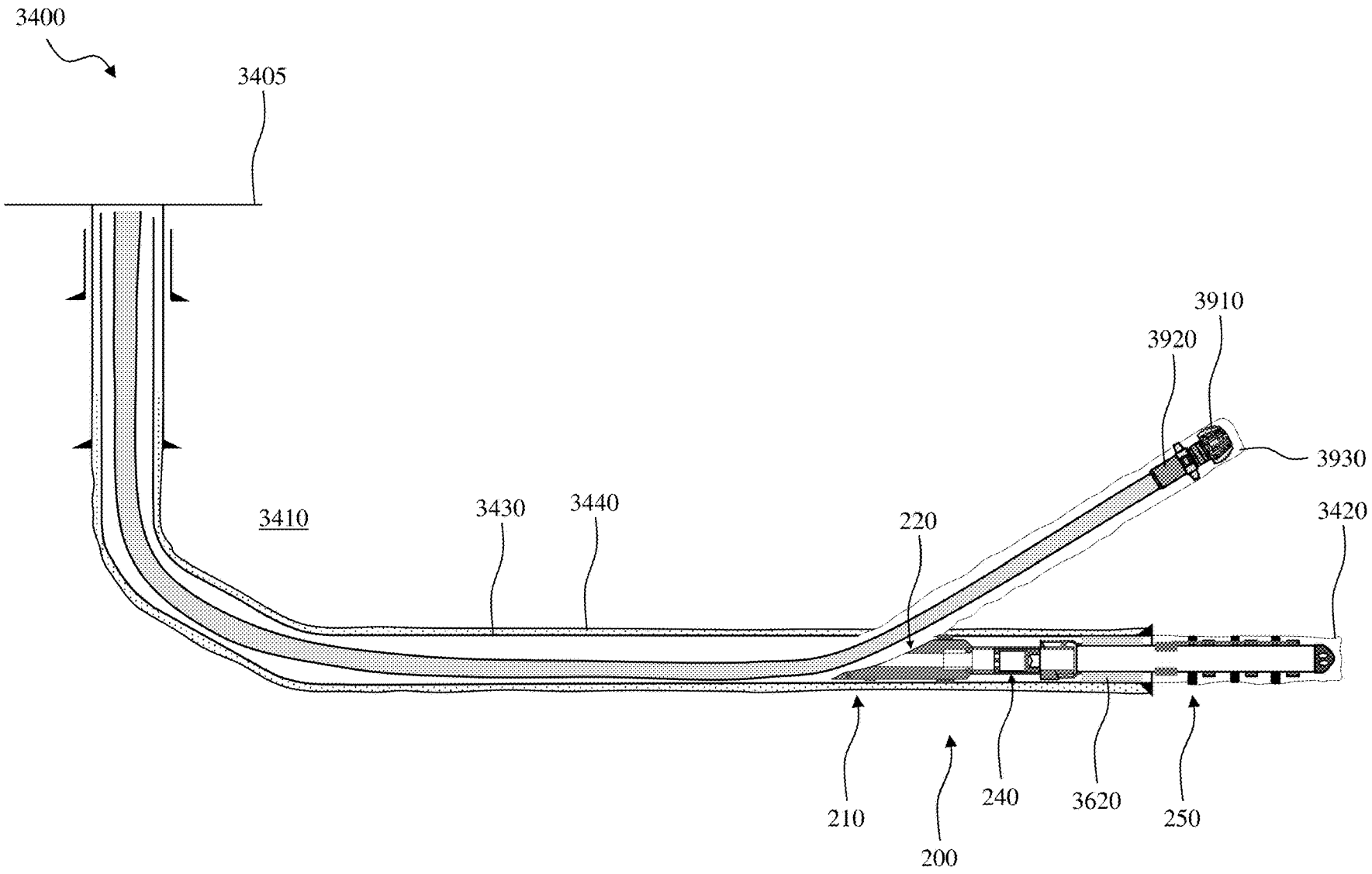

Turning to FIG. 39, illustrated is the well system 3400 of FIG. 38 after running in hole a drill string 3910, for example with a rotary steerable assembly 3920, and drilling the lateral wellbore 3930 to depth. In at least one embodiment, this could be considered the second multilateral trip downhole. Thereafter, the drill string 3910 and rotary steerable assembly 3920 may be pulled out of hole.

Figure 40:
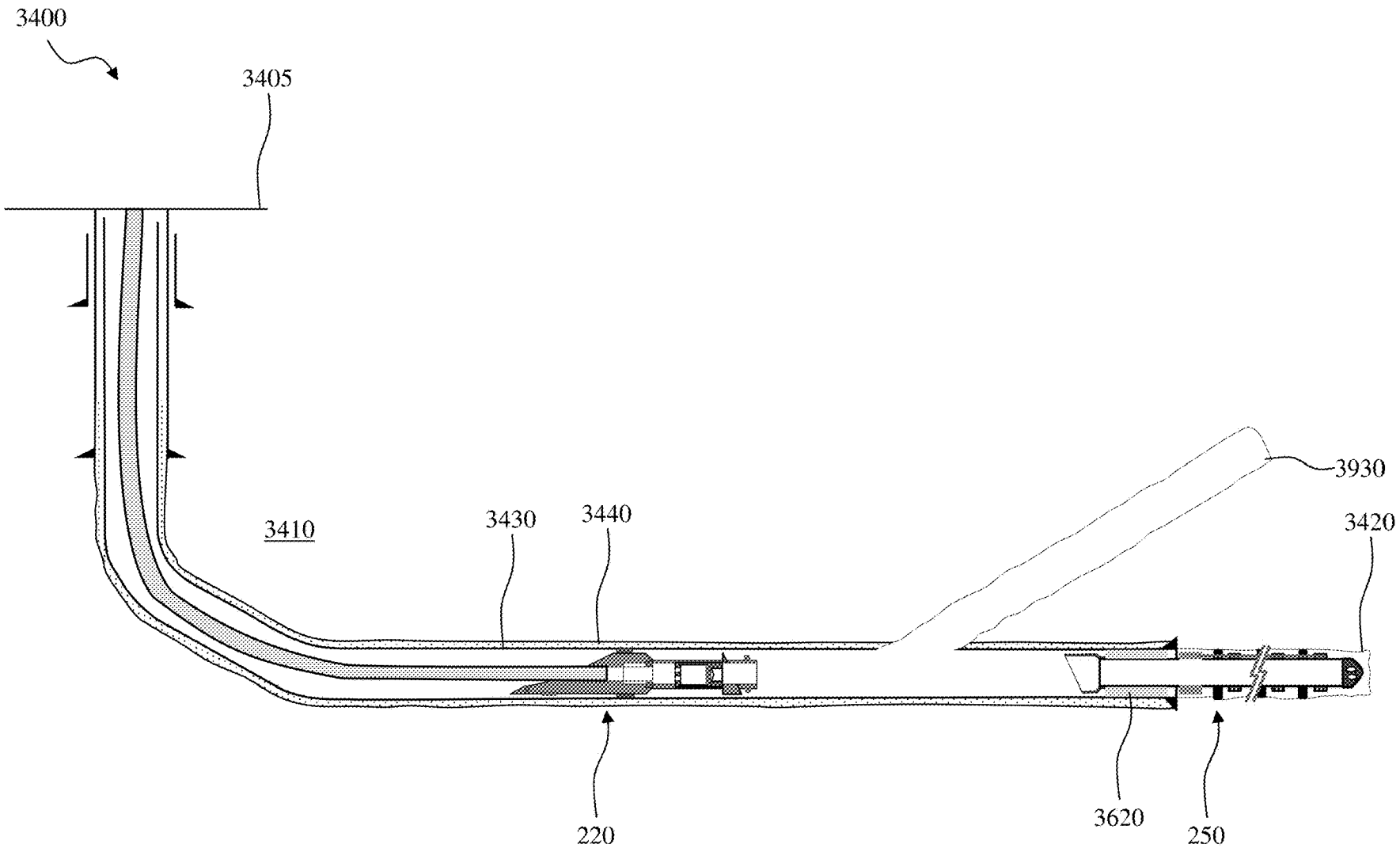

Turning to FIG. 40, illustrated is the well system 3400 of FIG. 39 after starting to pull the multilateral whipstock assembly 220 out of hole. In at least one embodiment, a retrieving tool, spear, or hook, among other tools, may be used to pull the multilateral whipstock assembly 220 out of hole.

Figure 41:
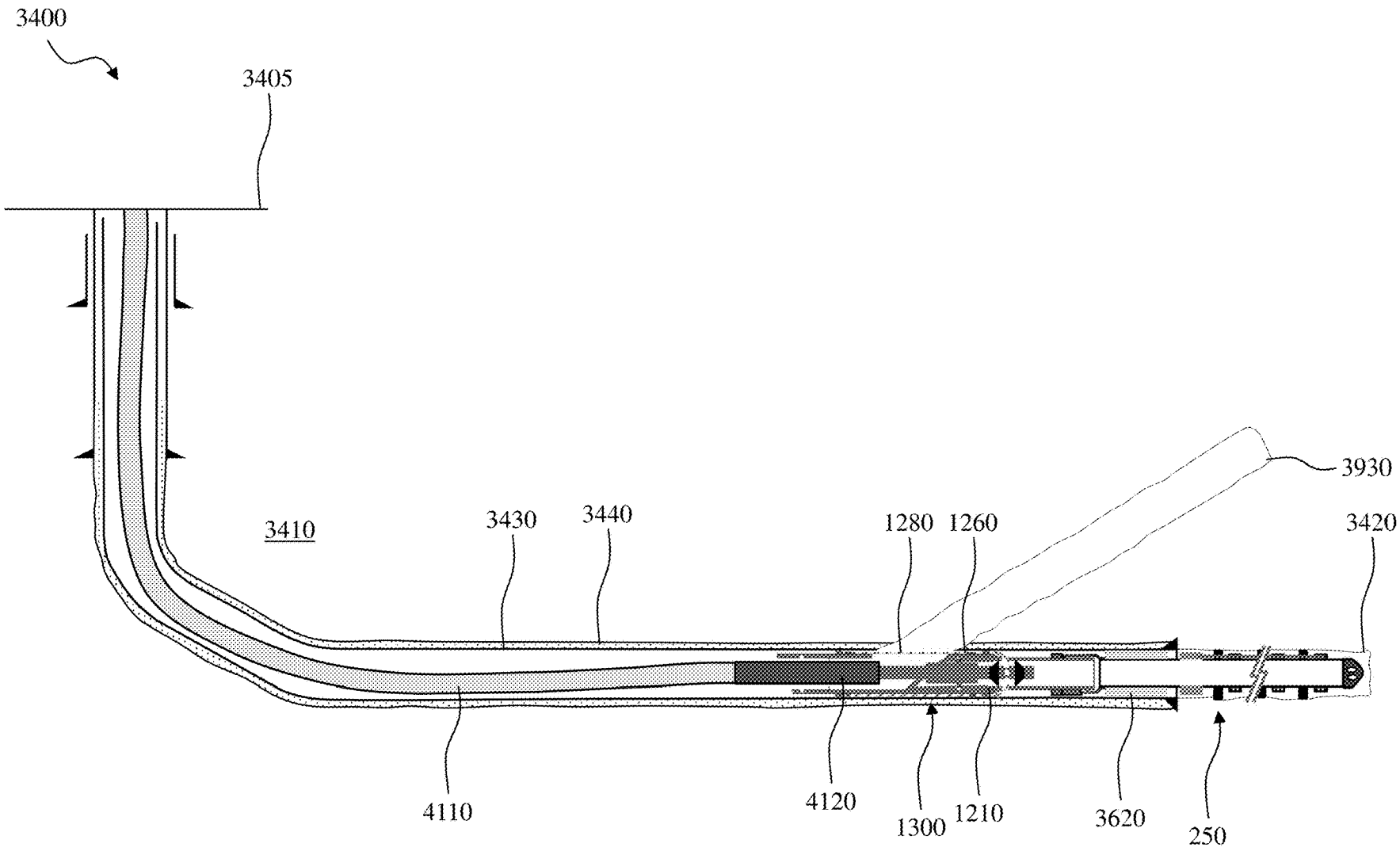

Turning to FIG. 41, illustrated is the well system 3400 of FIG. 40 after positioning a multilateral junction sleeve assembly 1300 (e.g., as shown in FIG. 13) within the main wellbore 3420 using a running tool 4110. In at least one embodiment, this could be considered the third multilateral trip downhole. In at least one embodiment, the multilateral junction sleeve assembly 1300 self-orients on the multilateral mainbore completion 250. The multilateral junction sleeve assembly 1300 (e.g., with reference to FIG. 13), in one or more embodiments, includes a multilateral deflector assembly 1210. In at least one embodiment, the multilateral deflector assembly 1210 includes a deflector body 1220 having a deflector face 1230 and an opening 1235 extending therethrough. The multilateral junction sleeve assembly 1300, in the illustrated embodiment, further includes a deflector assembly sleeve 1240 coupled to an uphole end of the deflector body 1220. In at least one embodiment, the deflector assembly sleeve 1240 has a sidewall opening 1250 in a sidewall thereof aligned with the deflector face 1230.

The multilateral junction sleeve assembly 1300, in the illustrated embodiment, further includes one or more of an expandable metal anchor 1260 positioned on a radial exterior surface of the deflector assembly sleeve 1240, and degradable material 1280 positioned on a radial exterior surface of the deflector assembly sleeve 1240 covering the sidewall opening 1250. In one or more embodiments, the expandable metal anchor 1260 includes a metal configured to expand in response to hydrolysis to axially and rotationally fix the multilateral deflector assembly 1210 within a wellbore tubular. In one or more embodiments, such as is illustrated in FIG. 41, the expandable metal anchor 1260 is positioned on the radial exterior surface of the deflector assembly sleeve 1240 uphole and downhole the sidewall opening 1250, the expandable metal anchor configured to fix the multilateral deflector assembly 1210 within the main wellbore 3420 uphole and downhole the sidewall opening 1250. The expandable metal anchor 1260 may comprise any of the expandable metals discussed above, so long as it expands into contact with a wellbore tubular and forms an expanded metal anchor.

In the illustrated embodiment of FIG. 41, the degradable material 1280 is a layer of degradable material 1285 positioned on the radial exterior surface of the deflector assembly sleeve 1240 covering the sidewall opening 1250. The layer of degradable material 1285 may comprise any material known to degrade over time, as well as any of the materials disclosed above. In one or more embodiments, however, the layer of degradable material 1285 is a layer of polymer based degradable material positioned between open ends of the expandable metal anchor 1260. In yet another embodiment, however, the layer of degradable material 1285 is a layer of metal based degradable material. For example, in at least one embodiment, the layer of metal based degradable material is a layer of expandable metal configured to expand in response to hydrolysis and then degrade to uncover the sidewall opening 1250. In this embodiment, the layer of expandable metal is configured to expand in response to hydrolysis and after the hydrolysis has completed then degrade to uncover the sidewall opening 1250.

In accordance with at least one embodiment, for example when the layer of degradable material 1285 comprises a layer of expandable metal configured to expand in response to hydrolysis, the layer of expandable metal and the expandable metal anchor 1260 are a single unitary layer of expandable metal 1310 including the metal configured to expand in response to hydrolysis. In at least one embodiment, the single unitary layer of expandable metal 1310 is configured to degrade around the sidewall opening 1250 but form an expanded metal anchor outside of the sidewall opening 1250. Accordingly, the single unitary layer of expandable metal 1310 has the dual purpose of degrading and forming the expanded metal anchor, and can be located axially and radially below the sidewall opening 1250. The embodiment of FIG. 41 has been depicted as using the multilateral junction sleeve assembly 1300 of FIG. 13, however, the multilateral junction sleeve assembly 1200 of FIG. 12 could also have been employed.

Figure 42:
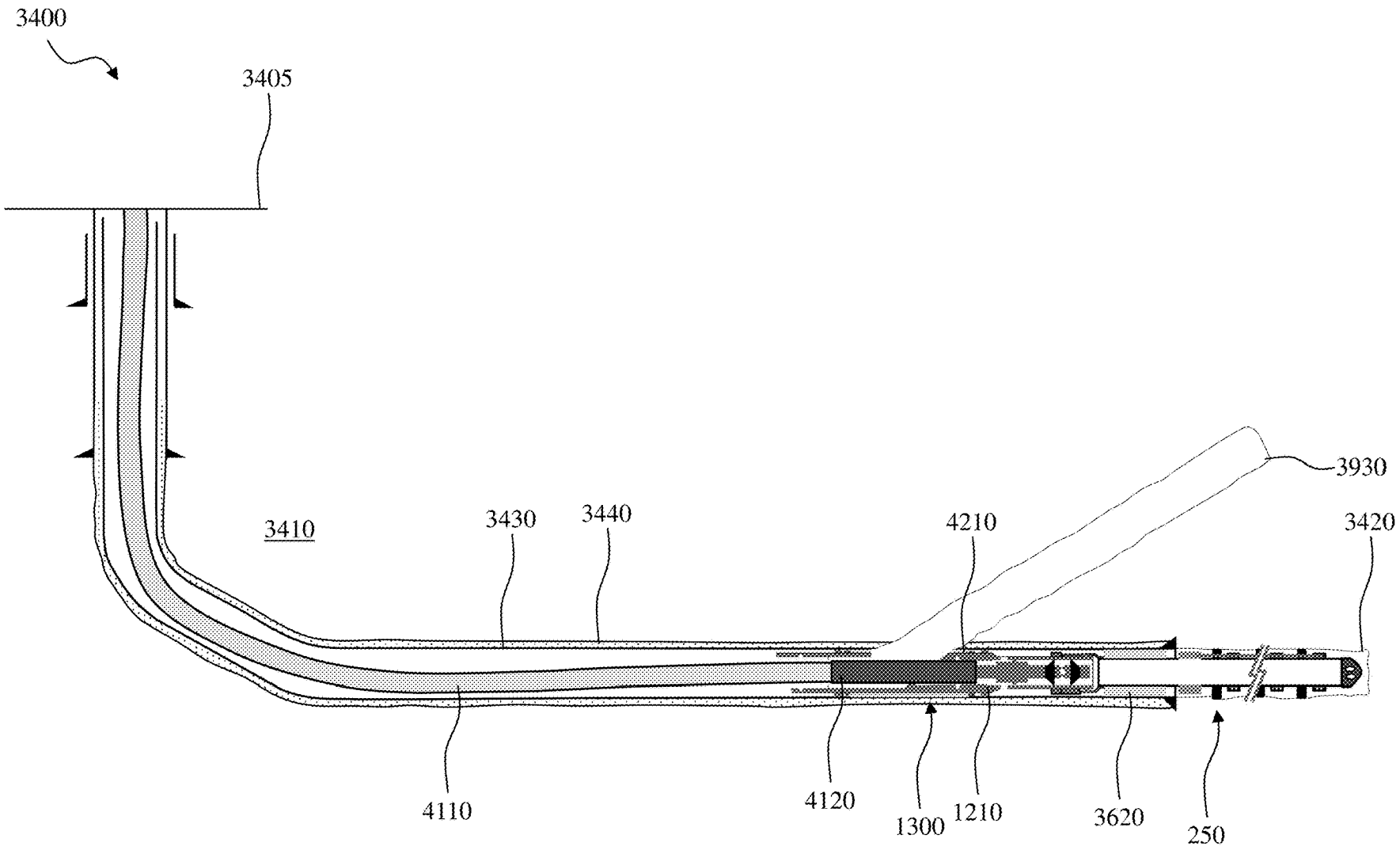

Turning to FIG. 42, illustrated is the well system 3400 of FIG. 41, after subjecting the multilateral junction sleeve assembly 1300 to reactive fluid (e.g., mud with water based completion fluid, brine, etc.). For example, in at least one embodiment, the operator could circulate reactive fluid down through a fluid port located at the end of the running tool 4110 to initiate the chemical reaction process for each of the degradable material 1280 and the expandable metal anchor 1260. In at least one embodiment, the circulation of reactive fluid may cease when the degradable material 1280 and the expandable metal anchor 1260 of the multilateral junction sleeve assembly 1300 are soaking in reactive fluid.

As shown in FIG. 42, the reactive fluid causes the expandable metal anchor 1260 to turn to an expanded metal anchor 4210, as discussed above with respect to and shown in FIG. 14B. Additionally, the reactive fluid causes the degradable material 1280 to degrade or otherwise dissolve away, for example uncovering the sidewall opening 1250, and thus providing access to the lateral wellbore 3930. In at least one embodiment, a reaction catalyst 4120 associated with the running tool 4110 may be employed to speed up the chemical reaction between the reactive fluid and the expandable metal anchor 1260 and/or degradable material 1280. This process may include moving the reaction catalyst 4120 to and/or from the expandable metal anchor 1260 and/or degradable material 1280, as well as the addition of a chemical catalyst, heat catalyst, voltage catalyst, etc.

Figure 43:
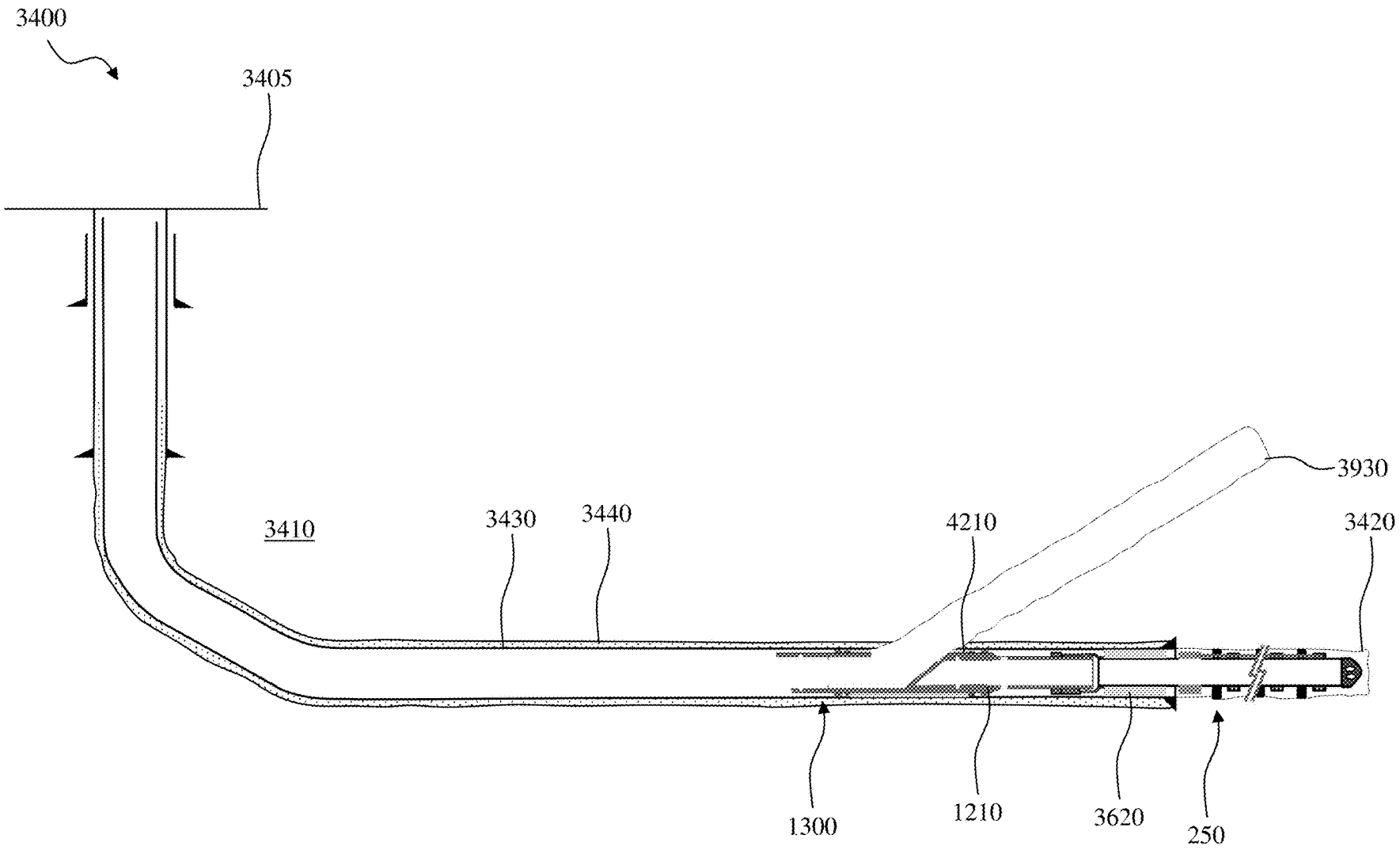

Turning to FIG. 43, illustrated is the well system 3400 of FIG. 42, after pulling the running tool 4110 out of hole.

Figure 44:
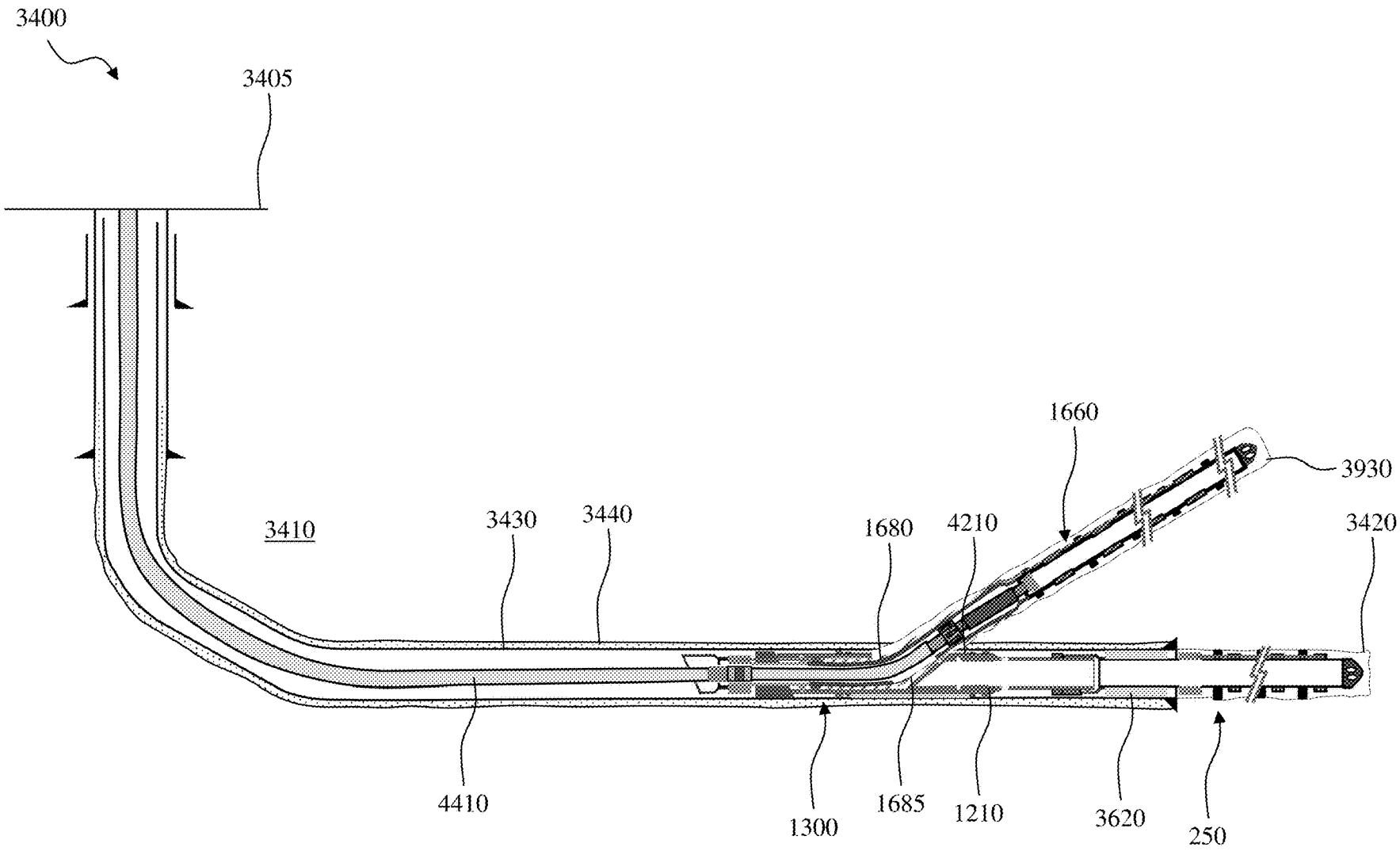

Turning to FIG. 44, illustrated is the well system 3400 of FIG. 43 after positioning a multilateral lateral bore completion 1660 (e.g., as shown in FIG. 16F) within the main wellbore 3420 and extending out into the lateral wellbore 3930, for example using a running tool 4410. In at least one embodiment, this could be considered the fourth multilateral trip downhole. In at least one embodiment, the multilateral lateral bore completion 1660 self-orients on the multilateral junction sleeve assembly 1300, and thus the multilateral mainbore completion 250.

As indicated above, the multilateral lateral bore completion 1660 includes a transition sleeve assembly 1665, for example including a transition sleeve 1670. The transition sleeve 1670, in one embodiment, includes a transition sleeve body 1672 having a sidewall opening 1674 in a sidewall thereof. In at least this one embodiment, the sidewall opening 1674 is configured to align with a main wellbore when the transition sleeve assembly 1665 is at least partially insert within the lateral wellbore 3930. For example, the sidewall opening 1674, in the illustrated embodiment of FIG. 44, aligns with the opening 1235 in the multilateral junction sleeve assembly 1300.

The transition sleeve 1670, in the illustrated embodiment, further includes an expandable metal anchor 1680 positioned on a radial exterior surface of the transition sleeve body 1672, and degradable material 1685 positioned on a radial exterior surface of the transition sleeve body 1672 covering the sidewall opening 1674 (e.g., and thus separating the transition sleeve 1670 from the opening 1235 in the multilateral junction sleeve assembly 1300). In one or more embodiments, the expandable metal anchor 1680 includes a metal configured to expand in response to hydrolysis to axially and rotationally fix the multilateral lateral bore completion 1660 within the main wellbore 3420 and the lateral wellbore 3930. In one or more embodiments, such as is illustrated in FIG. 44, the expandable metal anchor 1680 is positioned on the radial exterior surface of the transition sleeve body 1672 uphole and downhole the sidewall opening 1674, the expandable metal anchor 1680 configured to fix the multilateral lateral bore completion 1660 within the main wellbore 3420 and the lateral wellbore 3930 uphole and downhole the sidewall opening 1674. The expandable metal anchor 1680 may comprise any of the expandable metals discussed above, so long as it expands into contact with a wellbore tubular and forms an expanded metal anchor and/or seal.

In the illustrated embodiment of FIG. 44, the degradable material 1685 is a layer of degradable material positioned on the radial exterior surface of the transition sleeve body 1672 covering the sidewall opening 1674. The layer of degradable material may comprise any material known to degrade over time, as well as any of the materials disclosed above. In one or more embodiments, however, the layer of degradable material is a layer of polymer based degradable material positioned over the sidewall opening 1674. In yet another embodiment, however, the layer of degradable material is a layer of metal based degradable material. For example, in at least one embodiment, the layer of metal based degradable material is a layer of expandable metal configured to expand in response to hydrolysis and then degrade to uncover the sidewall opening 1674. In this embodiment, the layer of expandable metal is configured to expand in response to hydrolysis and after the hydrolysis has completed then degrade to uncover the sidewall opening 1674.

In accordance with at least one embodiment, for example when the layer of degradable material comprises a layer of expandable metal configured to expand in response to hydrolysis, the layer of expandable metal and the expandable metal anchor 1680 are a single unitary layer of expandable metal including the metal configured to expand in response to hydrolysis. In at least one embodiment, the single unitary layer of expandable metal is configured to degrade around the sidewall opening 1674 but form an expanded metal anchor outside of the sidewall opening 1674. Accordingly, the single unitary layer of expandable metal has the dual purpose of degrading and forming the expanded metal anchor. The embodiment of FIG. 44 employs the single unitary layer of expandable metal.

Figure 45:
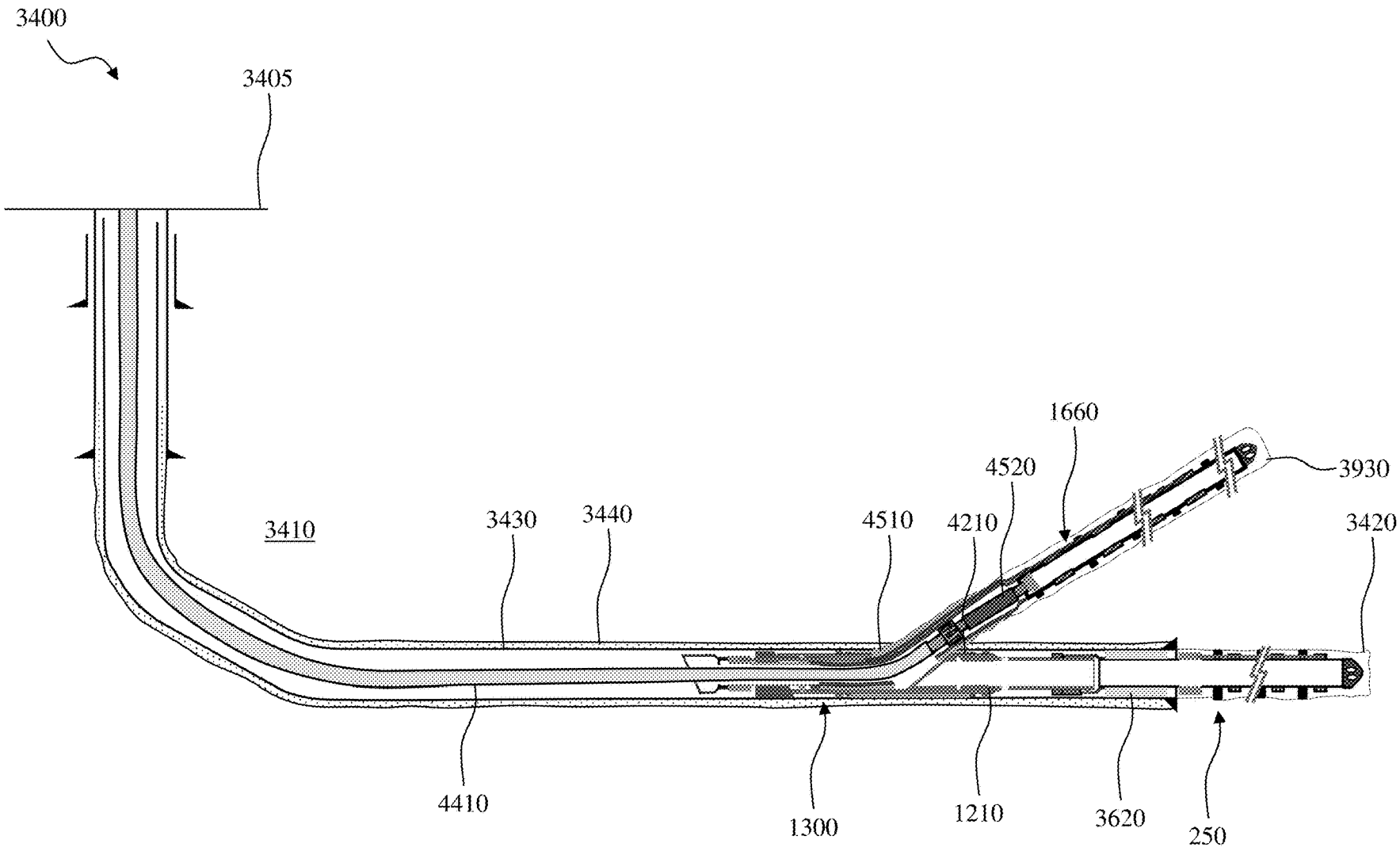

Turning to FIG. 45, illustrated is the well system 3400 of FIG. 44, after subjecting the multilateral lateral bore completion 1660 to reactive fluid (e.g., mud with water based completion fluid, brine, etc.). For example, in at least one embodiment, the operator could circulate reactive fluid down through a fluid port located at the end of the running tool 4410 to initiate the chemical reaction process for each of the expandable metal anchor 1680 and degradable material 1685. In at least one embodiment, the circulation of reactive fluid may cease when the expandable metal anchor 1680 and degradable material 1685 of the multilateral lateral bore completion 1660 are soaking in reactive fluid.

As shown in FIG. 45, the reactive fluid causes the expandable metal anchor 1680 to turn to an expanded metal anchor 4510, as discussed above. Additionally, the reactive fluid causes the degradable material 1685 to degrade or otherwise dissolve away, for example uncovering the sidewall opening 1674, and thus providing access to the main wellbore 3420 from the multilateral lateral bore completion 1660. In at least one embodiment, a reaction catalyst 4520 associated with the running tool 4410 may be employed to speed up the chemical reaction between the reactive fluid and the expandable metal anchor 1680 and/or degradable material 1685.

Figure 46:
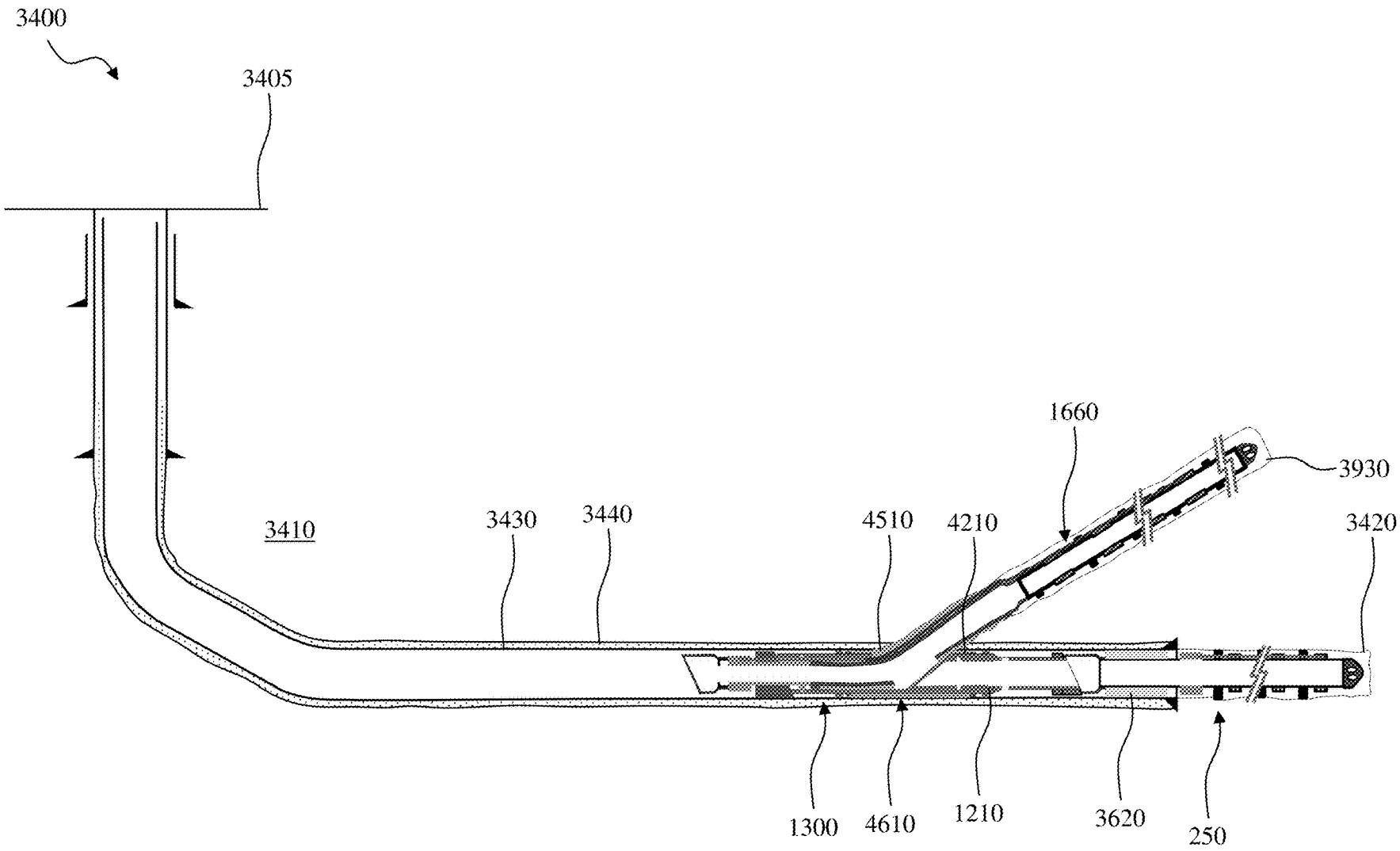

Turning to FIG. 46, illustrated is the well system 3400 of FIG. 45, after pulling the running tool 4410 out of hole. What ultimately results, for example between the expanded metal anchor 4210 and the expanded metal anchor 4510, is a Level-5 junction 4610. Additionally, in at least one embodiment, electrical conductivity is established from the control line coupler 1694 to one or more (e.g., if not all) devices and/or sensors within the lateral wellbore 3930. Furthermore, large ID and mechanical access to the main wellbore 3420 and lateral wellbore 3930 is achieved. For example, smaller intervention devices would be allowed to pass to the main wellbore 3420, whereas larger intervention devices would be redirected out into the lateral wellbore 3930.

Figure 47:
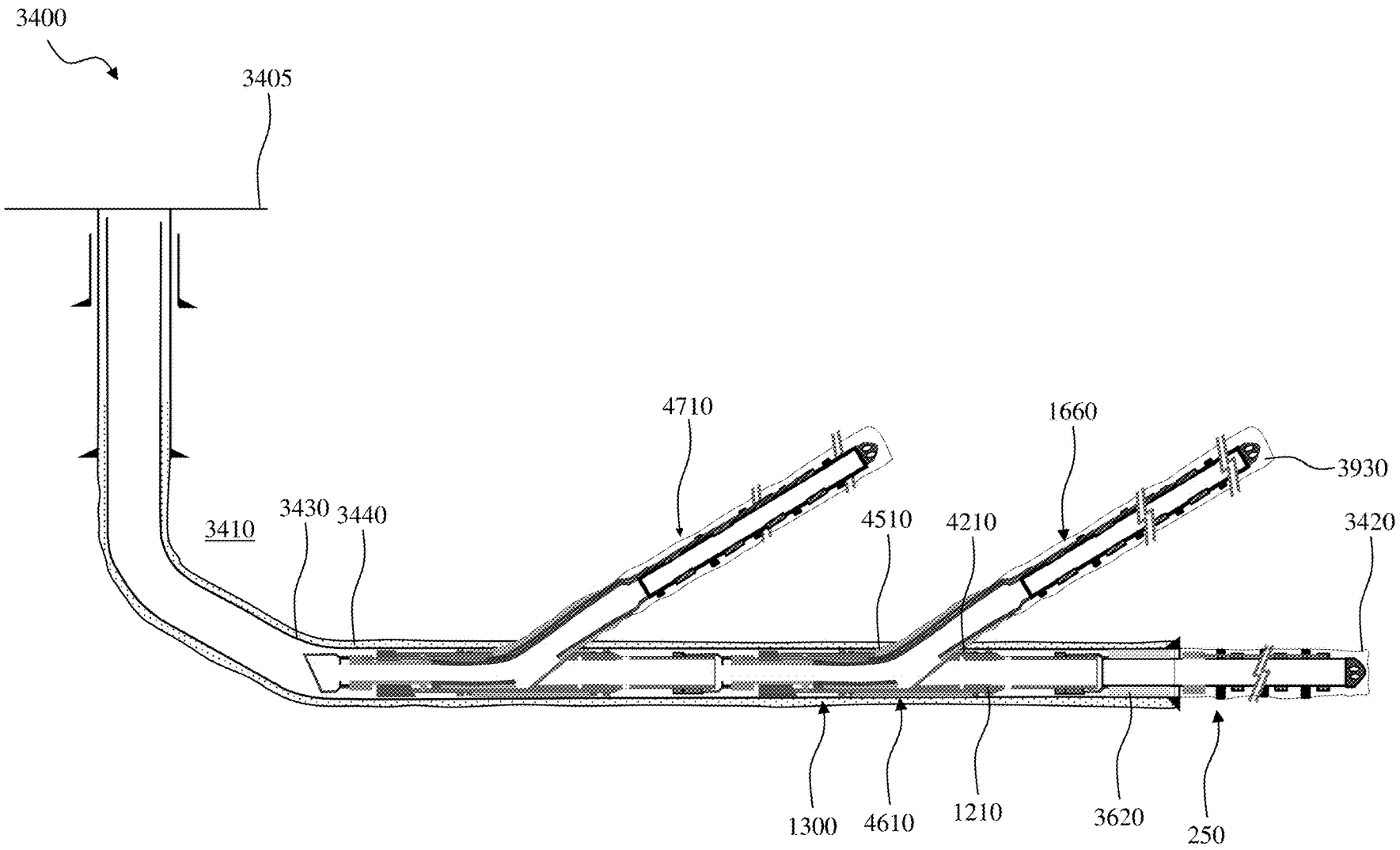

Turning to FIG. 47, illustrated is the well system 3400 of FIG. 46 after repeating the process described with regard to FIGS. 34 through 46 to create a trilateral wellbore 4710. In the embodiment of FIG. 47 only two lateral wellbores have been formed. It should be noted, however, that the details of the present disclosure may be used to form any number of lateral wellbores off of the main wellbore 3420 without departing from the scope of the disclosure.

Figure 48:
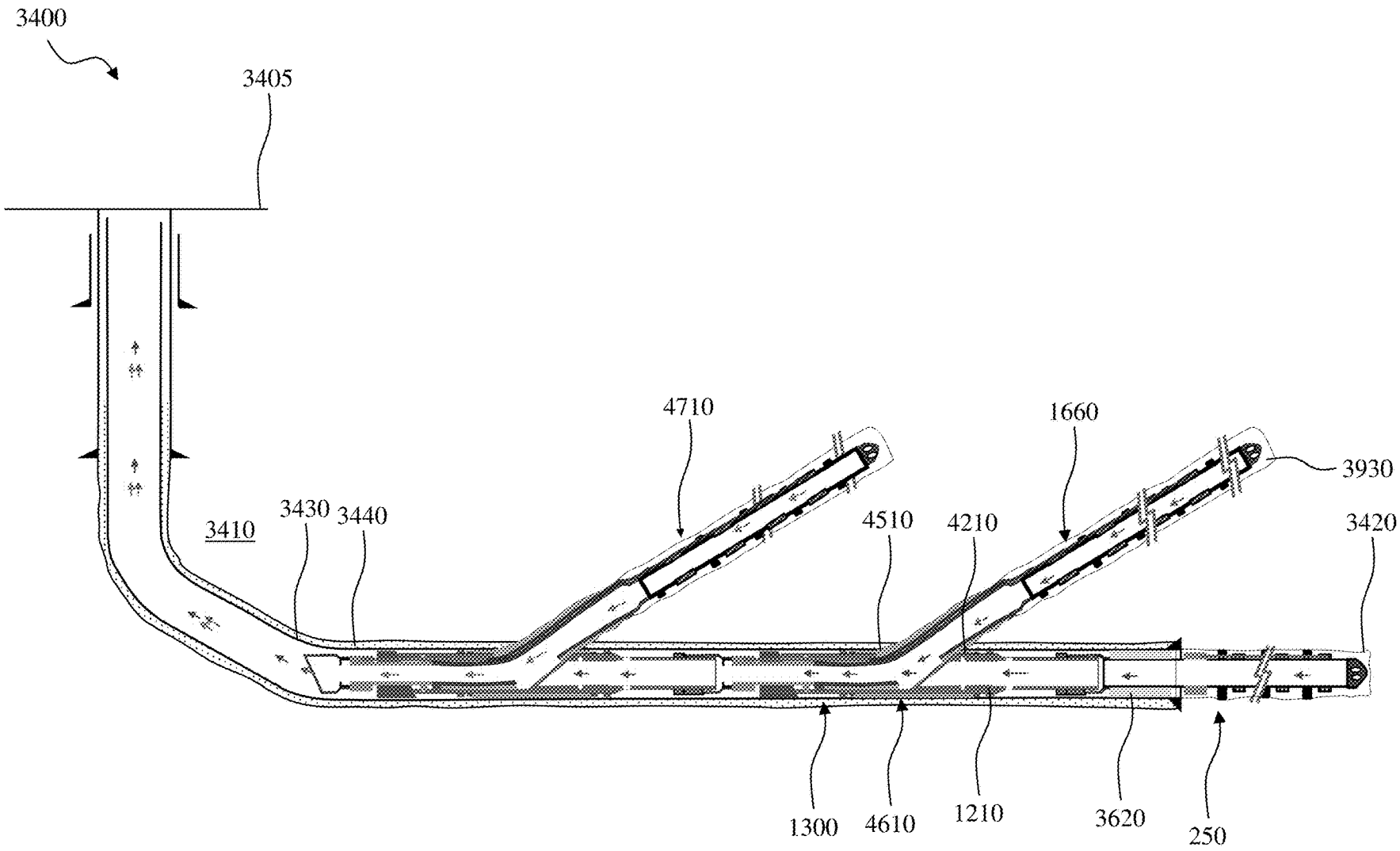

Turning to FIG. 48, illustrated is the well system 3400 of FIG. 47 after producing from the well system 3400.

Figure 49:
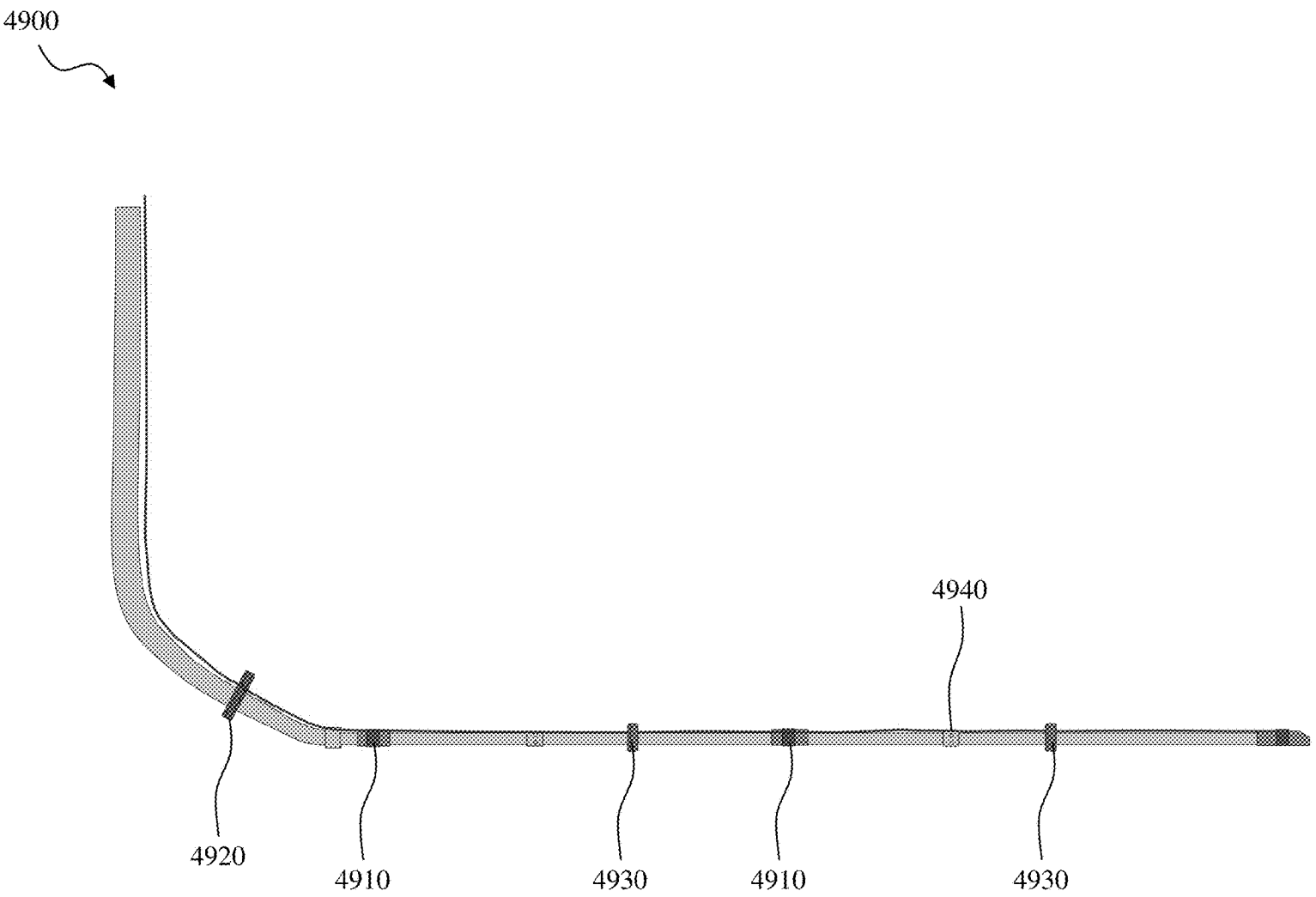

Turning to FIG. 49, illustrated is a final completion string 4900 that could be used with a well system, such as the well system 3400 of FIG. 48. For example, the final completion string 4900 could be used for wired lateral completion devices. In at least one embodiment, the final completion string 4900 includes one or more mating inductive couplers and/or wet mates 4910, as might couple with the control line couplers (e.g., control line coupler 1082) of the well system 3400. Accordingly, any lateral devices and/or sensors may be coupled to the terranean surface 3405. In the illustrated embodiment of FIG. 49, the final completion string 4900 additionally includes a production packer 4920, one or more feedthrough packers or swell packers 4930, and a perforated pup joint 4940.

Figure 50:
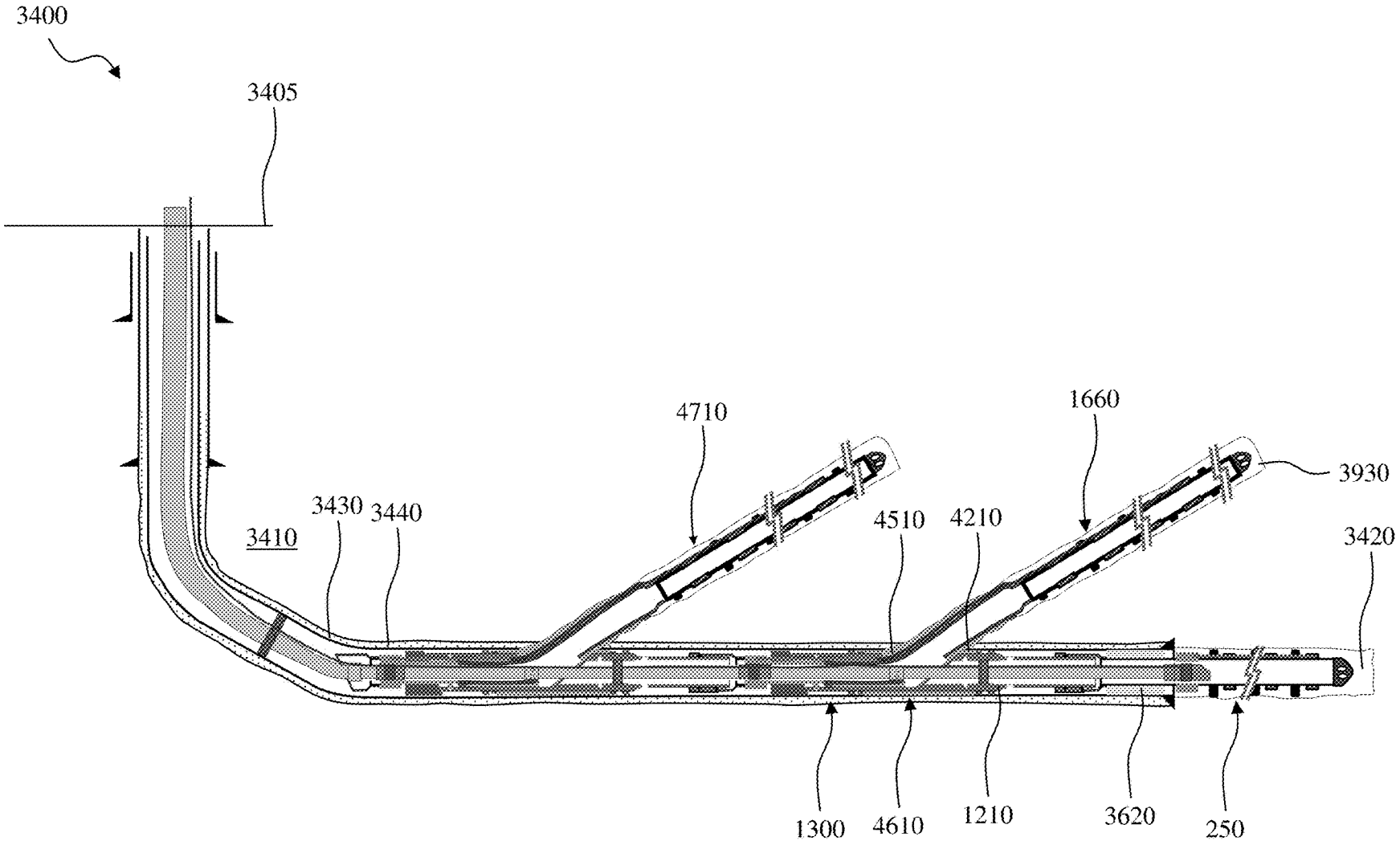

Turning to FIG. 50, illustrated is the well system 3400 of FIG. 48 after positioning the final completion string 4900 of FIG. 49 therein. In at least one embodiment, this could be considered the fifth multilateral trip downhole. With the final completion string 4900 in place, the interval control valves may be opened electrically, and the well system 3400 is ready to produce from, which may be achieved with only five multilateral trips downhole.

Figure 51:
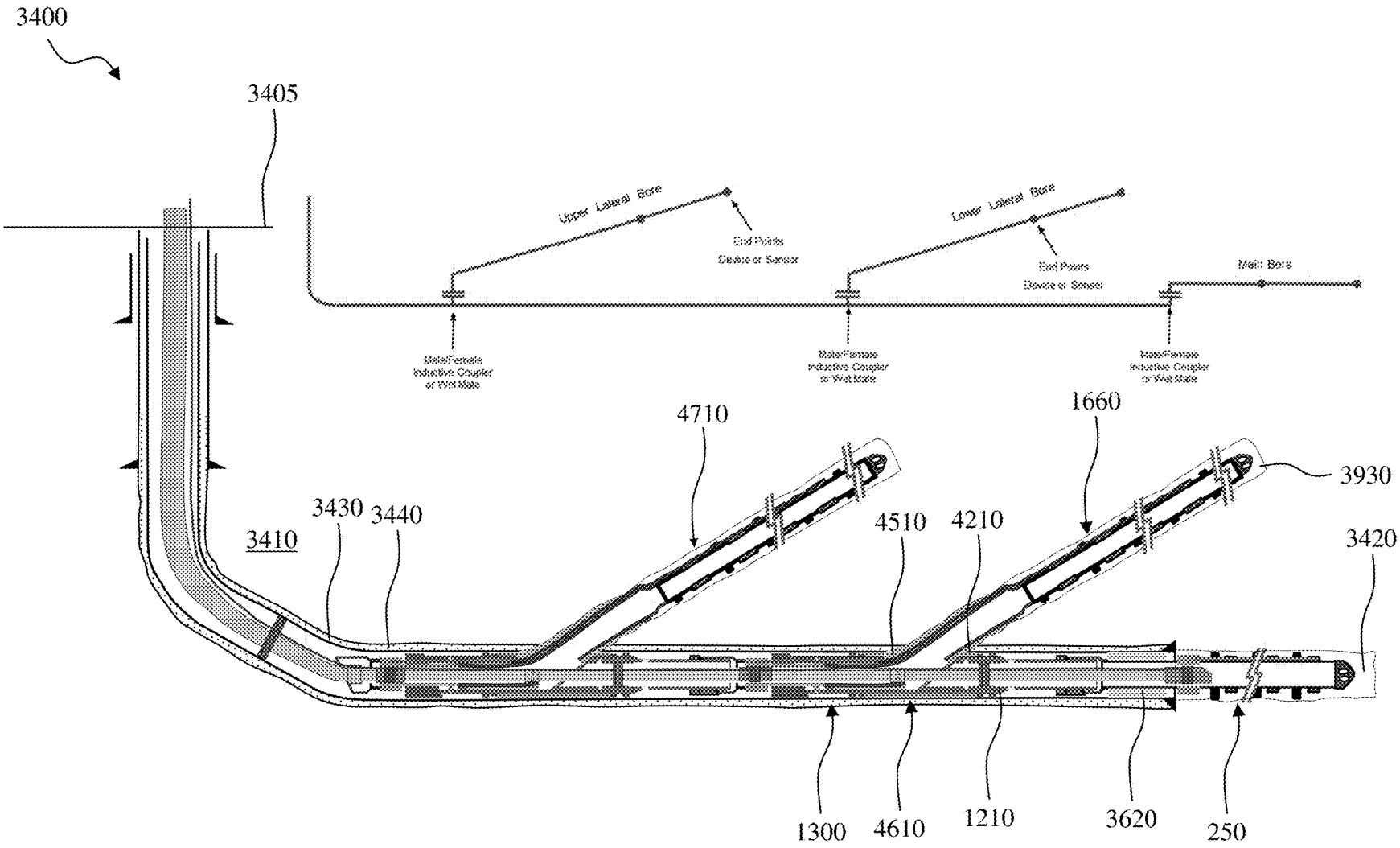

Turning to FIG. 51, illustrated is the well system 3400 of FIG. 50 illustrating that the lateral wellbores are parallel connected. The parallel connected lateral wellbores provide fault tolerance and optimized signal transmission, among other benefits.

Turning to FIGS. 52 through 71, illustrated is a method for forming a well system 5200 at various different stages of manufacture, the well system 5200 employing one or more of the features disclosed above with respect to FIGS. 2 through 16F. As the embodiment of FIGS. 52 through 71 will employ one or more features disclosed with respect to FIGS. 2 through 16F above, like reference numbers may be used to indicate similar, if not identical, features. Furthermore, FIGS. 52 through 71 should be viewed in conjunction with FIGS. 2 through 16F.

Figure 52:
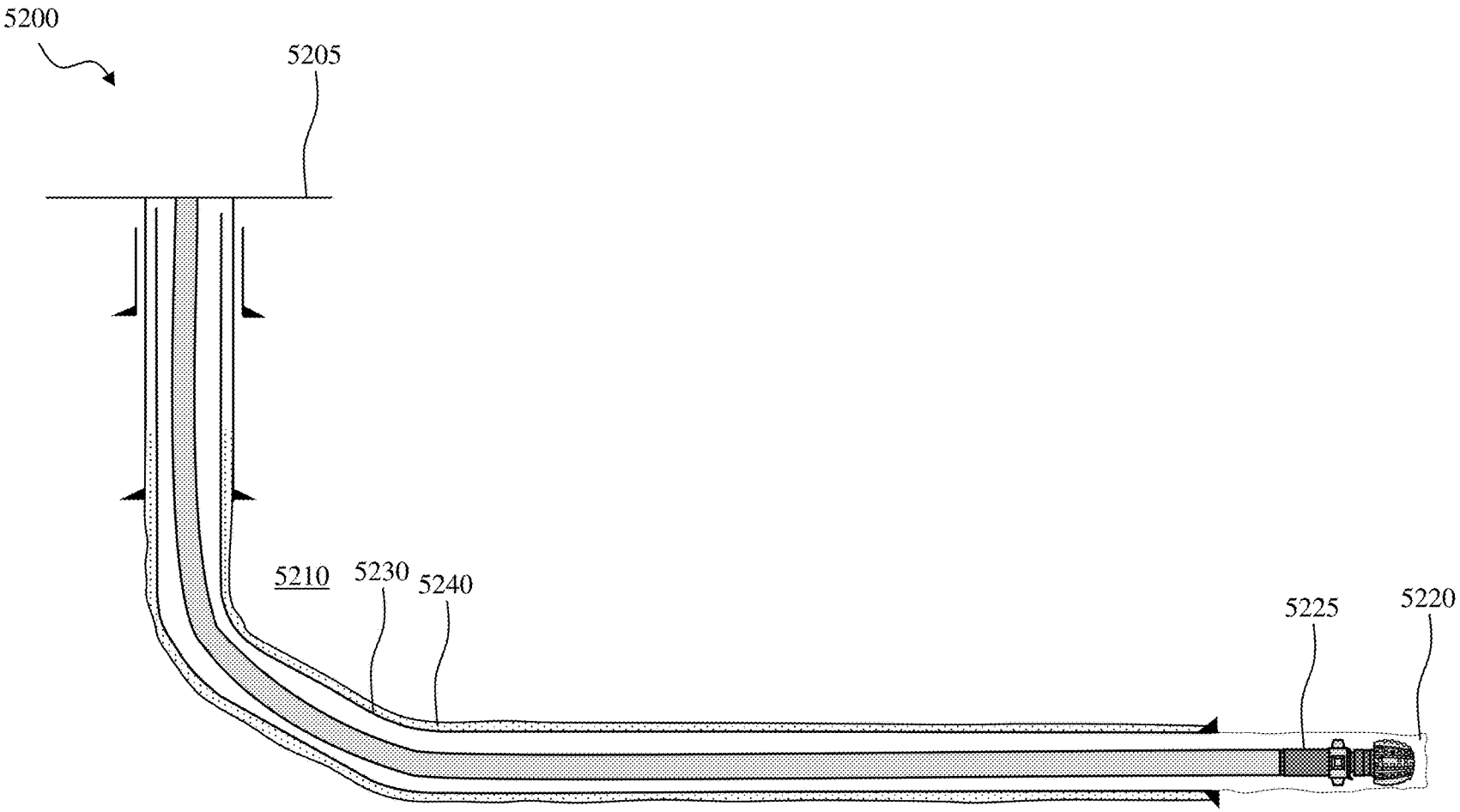

With initial reference to FIG. 52, a main wellbore 5220 has been drilled (e.g., using a drilling assembly 5225) from a terranean surface 5205 through one or more subterranean formations 5210. In the illustrated embodiment, the main wellbore 5220 includes a wellbore tubular 5230 (e.g., wellbore casing, wellbore liner, etc.), as well as cement 5240 positioned between the wellbore tubular 5230 and the main wellbore 5220.

Figure 53:
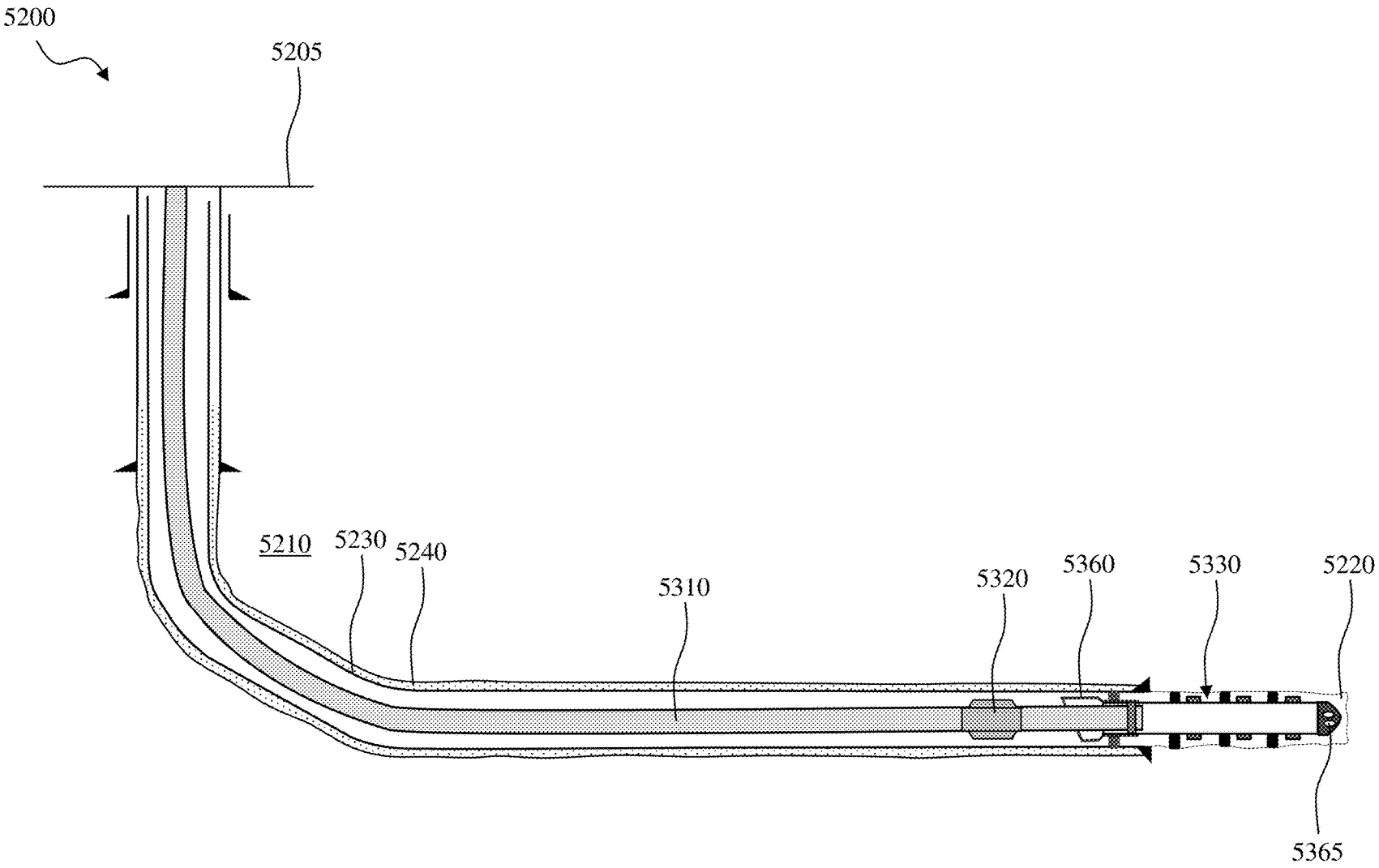

Turning to FIG. 53, illustrated is the well system 5200 of FIG. 52 after employing a running tool 5310 to position a multilateral mainbore completion 5330 designed, manufactured and/or operated according to one or more embodiments of the disclosure within the main wellbore 5220. In at least one embodiment, a workstring orientation tool (WOT) 5320 is employed to axially and rotationally position the multilateral mainbore completion 5330 within the main wellbore 5220.

In at least one embodiment, the multilateral mainbore completion 5330 may include many of the same features as the multilateral mainbore completion 800 of FIG. 8 disclosed above. Thus, for example, the multilateral mainbore completion 5330 may include an orientation device 5360 (e.g., anchor packer), which is configured to engage with a separate uphole device to rotationally orient the separate uphole device within the wellbore tubular. In at least one embodiment, any mud within the main wellbore 5220 may be displaced with wellbore fluid prior to setting the orientation device 5360. In certain embodiments, it is this process of supplying the wellbore fluid that sets the orientation device 5360 (e.g., expands the anchor packer). Further to this embodiment, a float shoe 5365 of the multilateral mainbore completion 5330 may be permanently locked in both directions once the mud is displaced with the completion fluids. Furthermore, the main wellbore 5220 may be isolated by closing interval control valves of the multilateral mainbore completion 5330.

Figure 54:
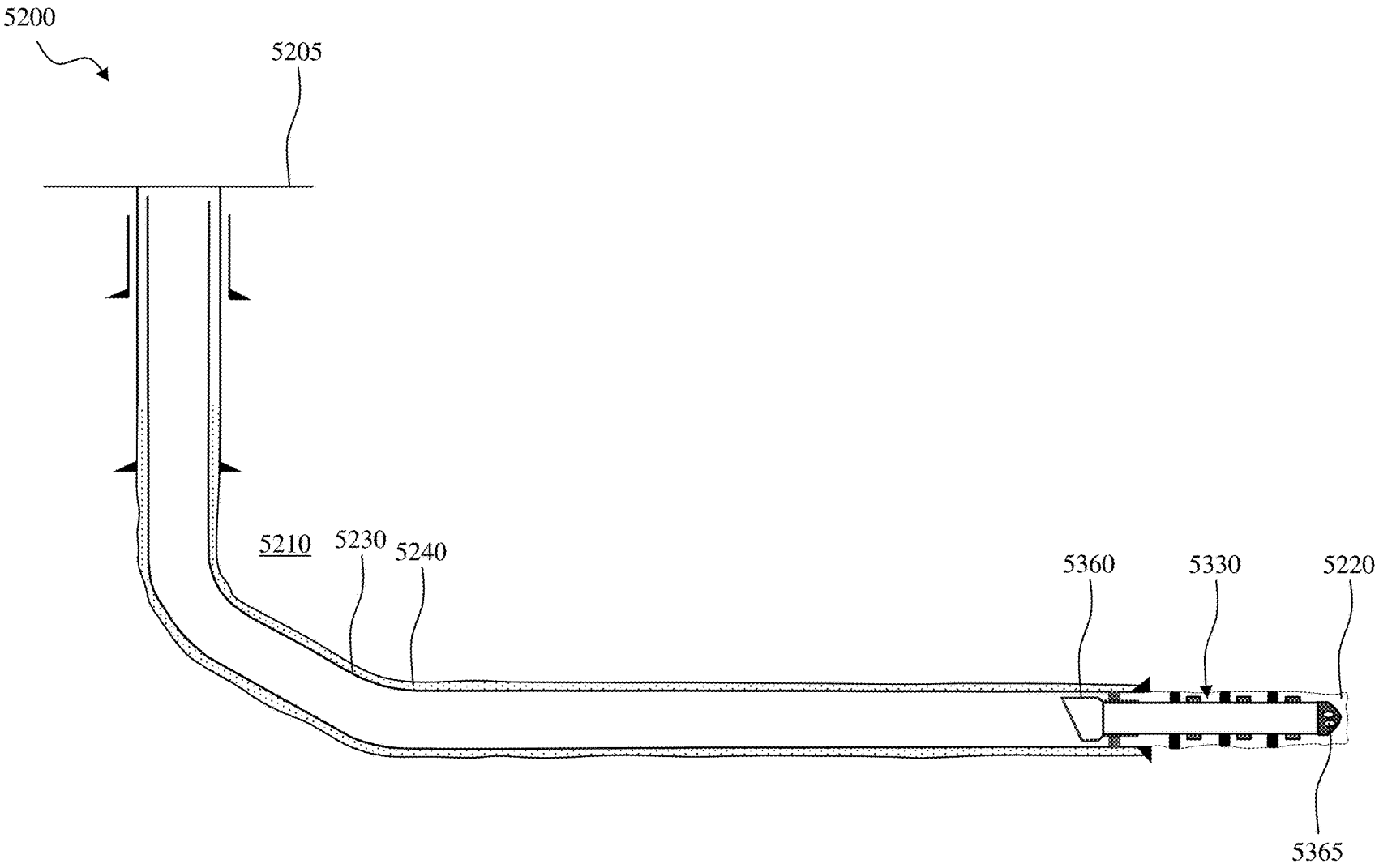

Turning to FIG. 54, illustrated is the well system 5200 of FIG. 53, after pulling the running tool 5310 out of hole.

Figure 55A:
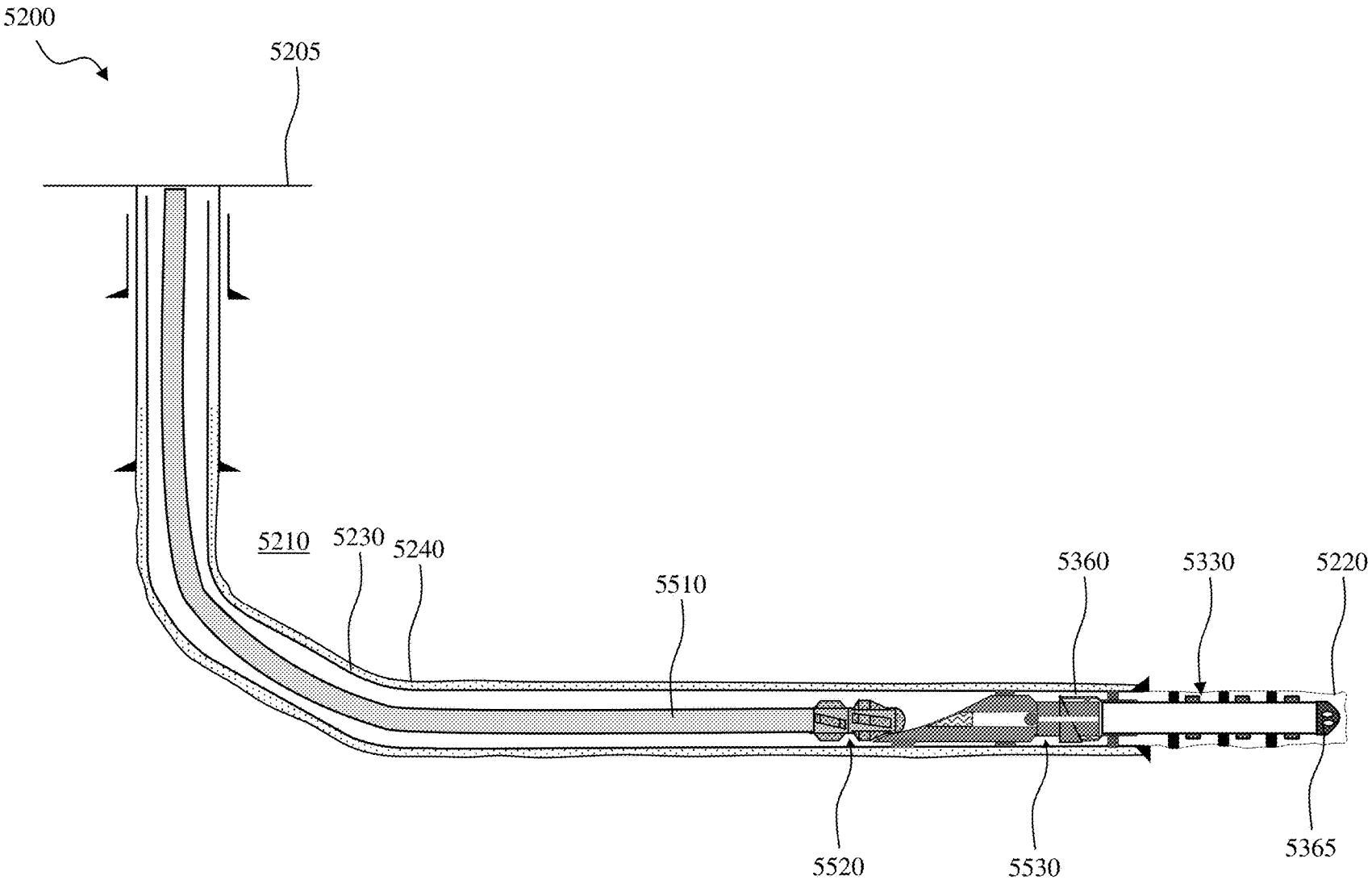

Turning to FIG. 55A, illustrated is the well system 5200 of FIG. 54, after running a multilateral whipstock assembly 5530 within the main wellbore 5220 using a running tool 5510. In the illustrated embodiment, the running tool 5510 includes a multilateral milling assembly 5520 coupled to a downhole end of the multilateral whipstock assembly 5530 using a coupling mechanism (e.g., shear feature). In the illustrated embodiment, the multilateral whipstock assembly 5530 is landed and oriented against the orientation device 5360 (e.g., anchor packer). Furthermore, a latching assembly of the multilateral whipstock assembly 5530 may lock the multilateral whipstock assembly 5530 in place.

Figure 55B:
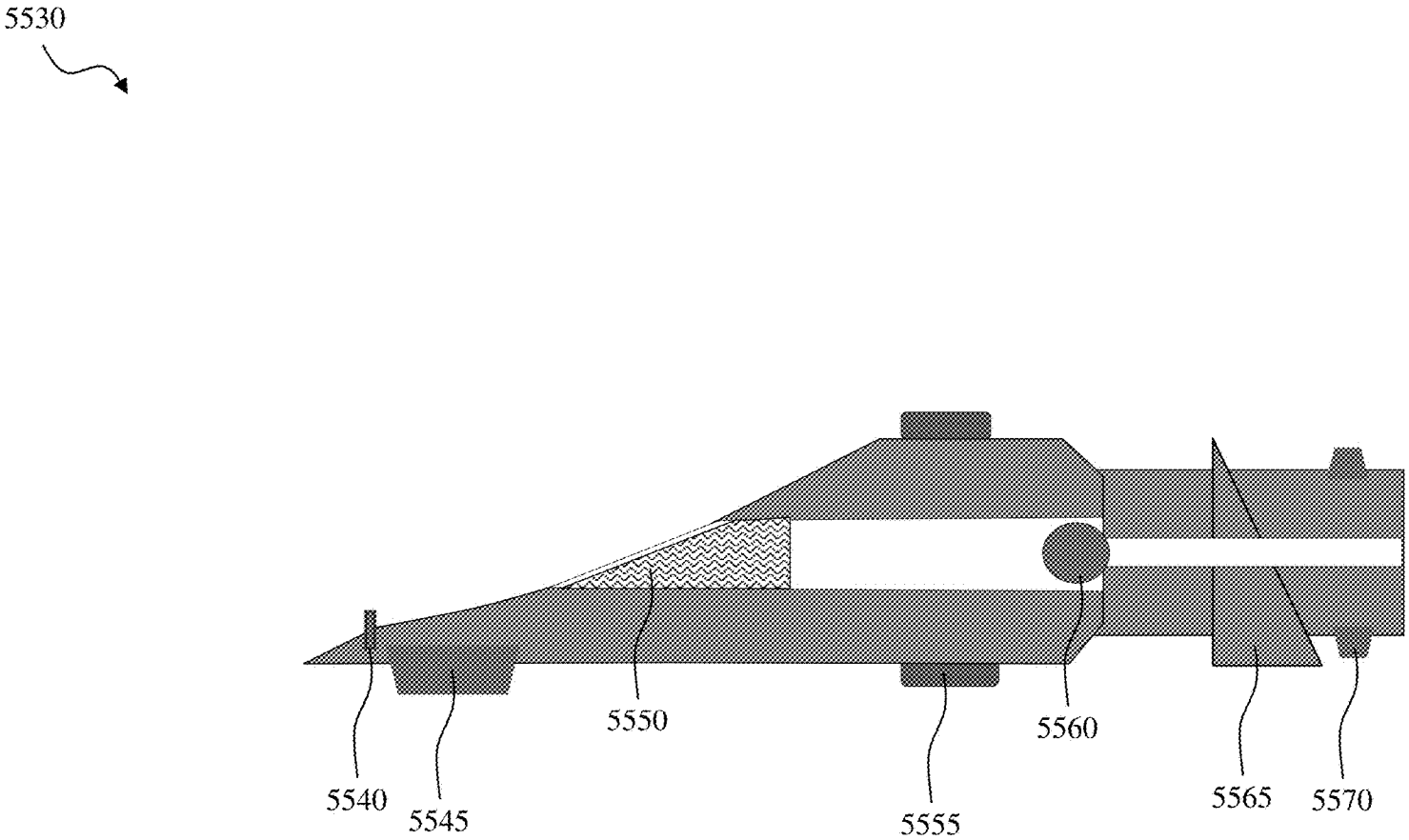

Turning briefly to FIG. 55B, illustrated is an enlarged view of the multilateral whipstock assembly 5530 illustrated in FIG. 55A. As can be seen in FIG. 55B, the multilateral whipstock assembly 5530 may include a coupling mechanism 5540 (e.g., to attach to the multilateral milling assembly 5520), a washover pad 5545, and a soft barrier 5550 (e.g., positioned inside of a whipface of the multilateral whipstock assembly 5530, which may be used for contingency spear retrieval, as well as hook retrieval in certain embodiments). The multilateral whipstock assembly 5530 may further include a debris seal 5555, a valve 5560 (e.g., a check valve, flapper valve, etc.), an orientating feature 5565, and the aforementioned latch 5570.

Figure 56:
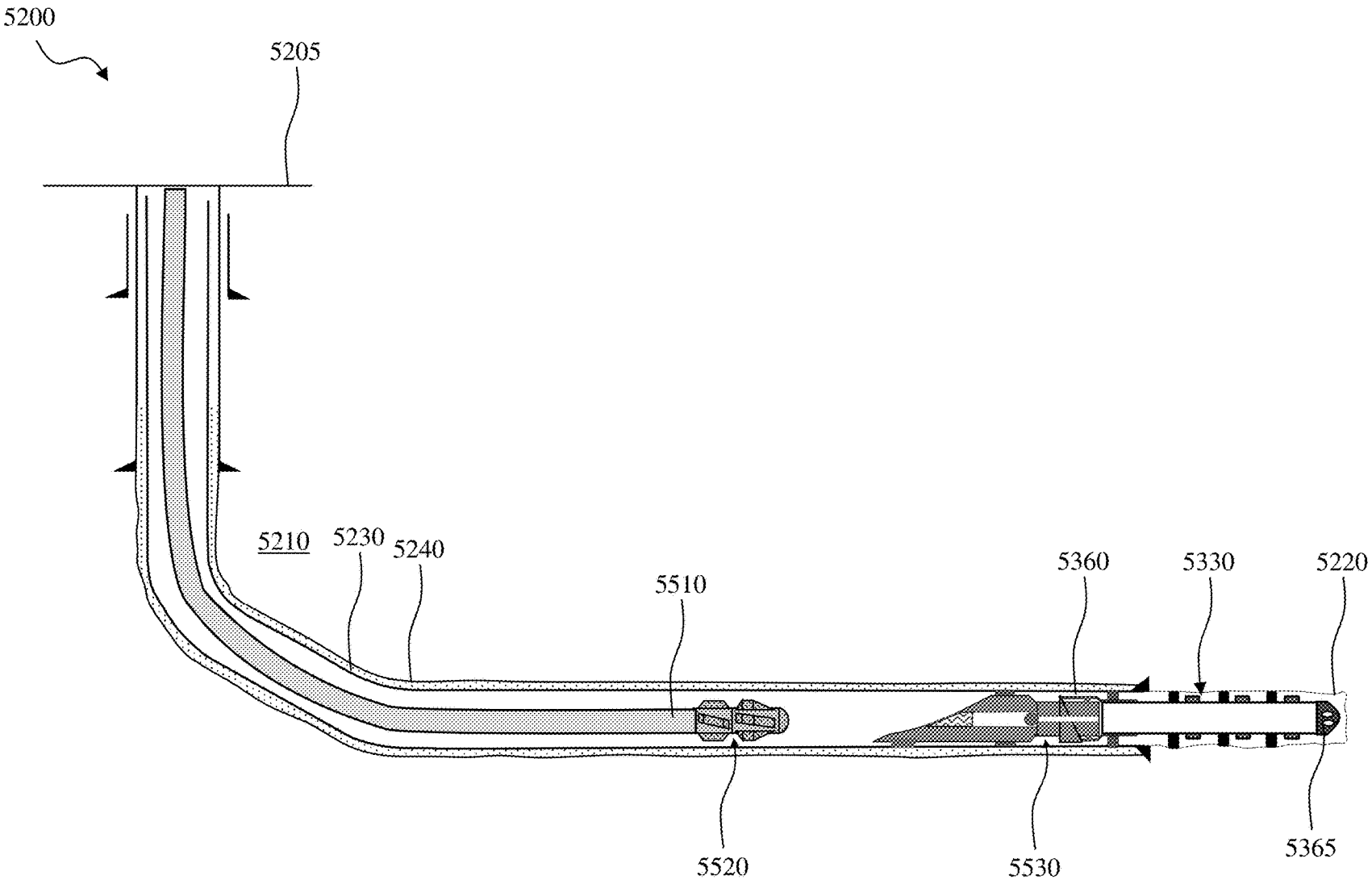

Turning to FIG. 56, illustrated is the well system 5200 of FIG. 55A, after picking up weight on the running tool 5510, and thus shearing the coupling mechanism 5540 such that the multilateral milling assembly 5520 separates from the multilateral whipstock assembly 5530.

Figure 57:
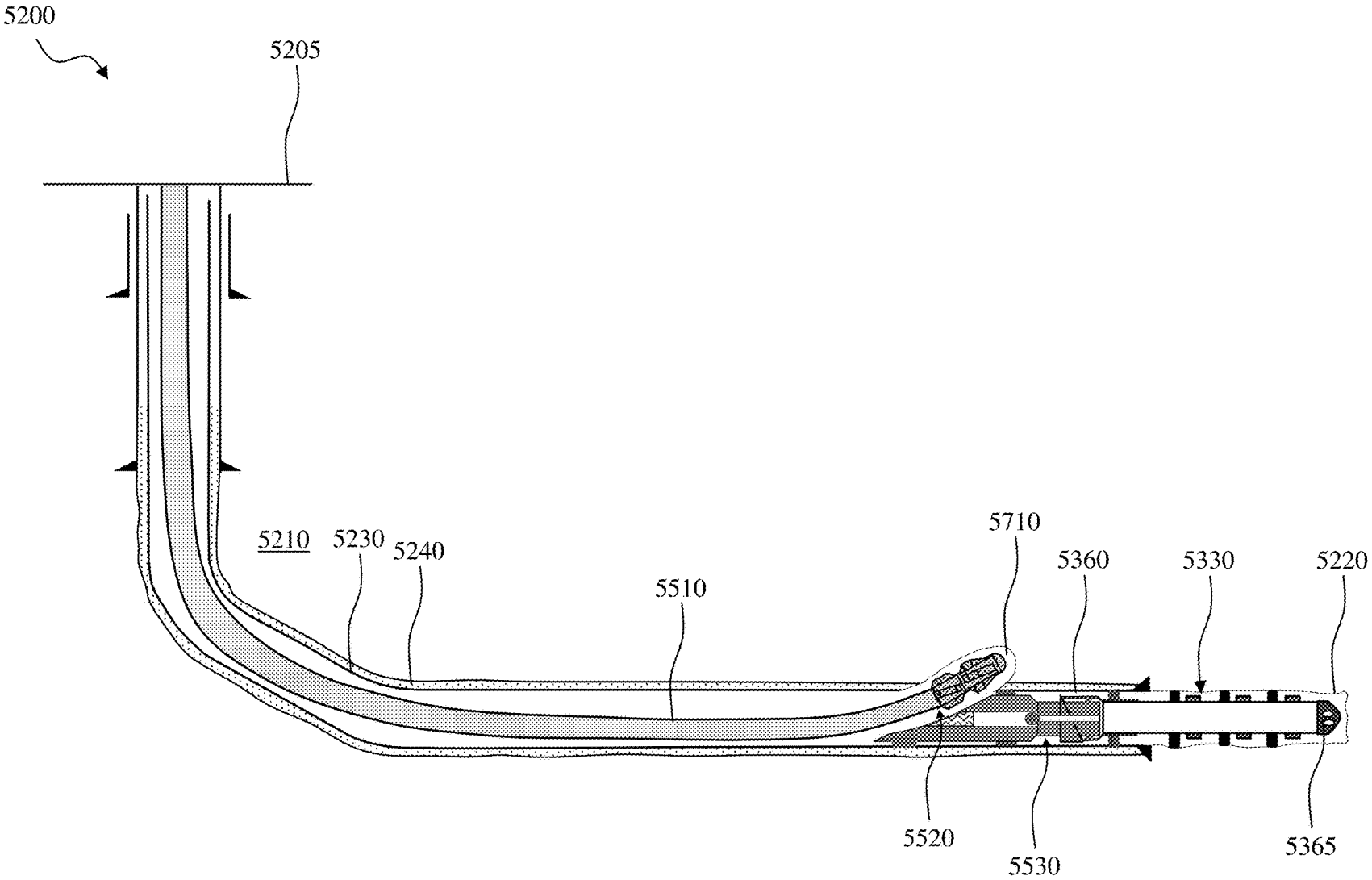

Turning to FIG. 57, illustrated is the well system 5200 of FIG. 56, after using the multilateral milling assembly 5520 and multilateral whipstock assembly 5530 to mill the wellbore tubular 5230 and drill a full window pocket 5710 in the subterranean formation 5210. In at least one embodiment, this could be considered the first multilateral trip downhole. In certain embodiments, the full window pocket 5710 is between 5 m and 15 m long, and in certain other embodiments about 13.5 m long. Thereafter, a circulate and clean process could occur, and then the two part milling and running tool 5510 and multilateral milling assembly 5520 may be pulled out of hole.

Figure 58:
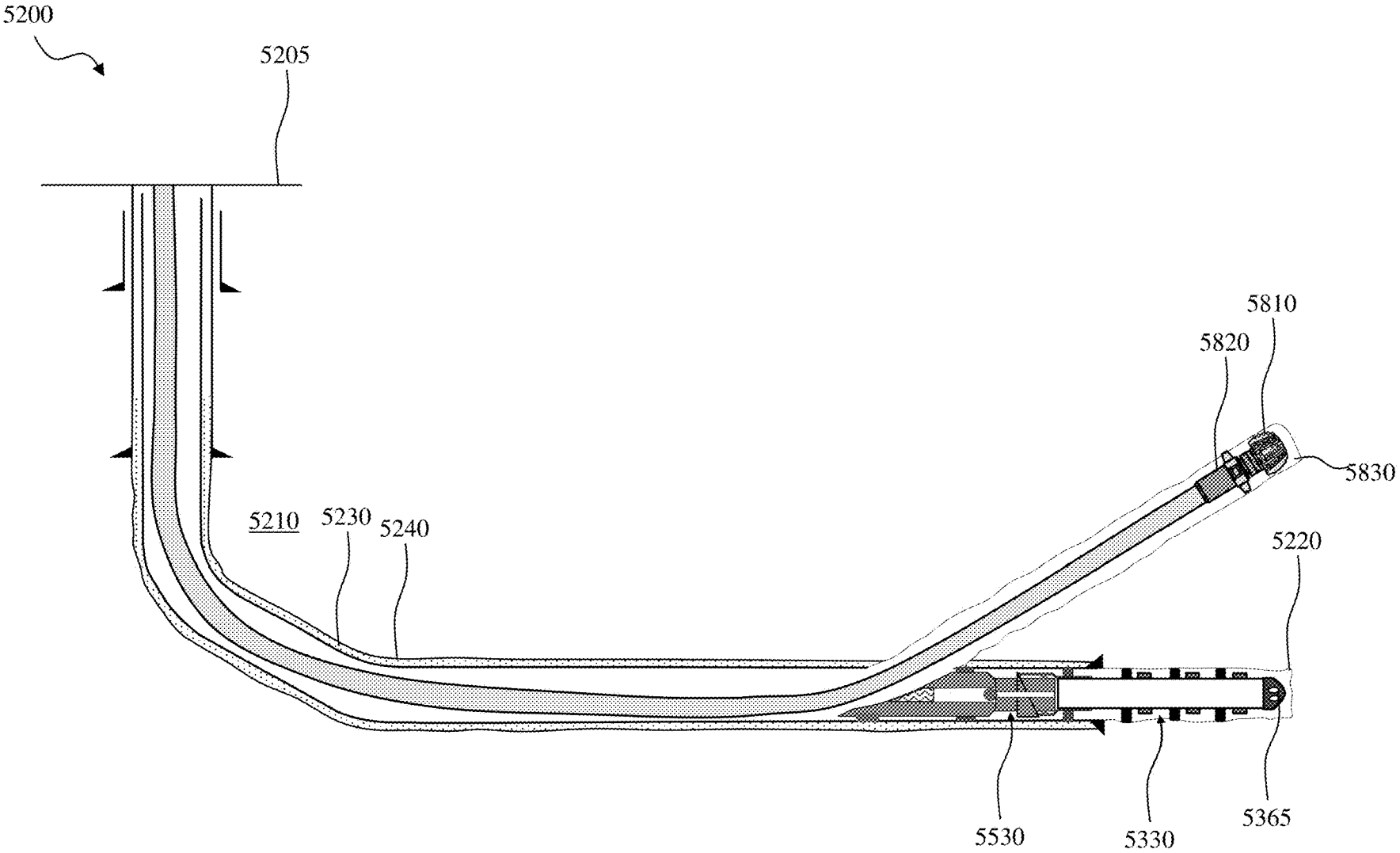

Turning to FIG. 58, illustrated is the well system 5200 of FIG. 57 after running in hole a drill string 5810, for example with a rotary steerable assembly 5820, and drilling the lateral wellbore 5830 to depth. In at least one embodiment, this could be considered the second multilateral trip downhole.

Figure 59:
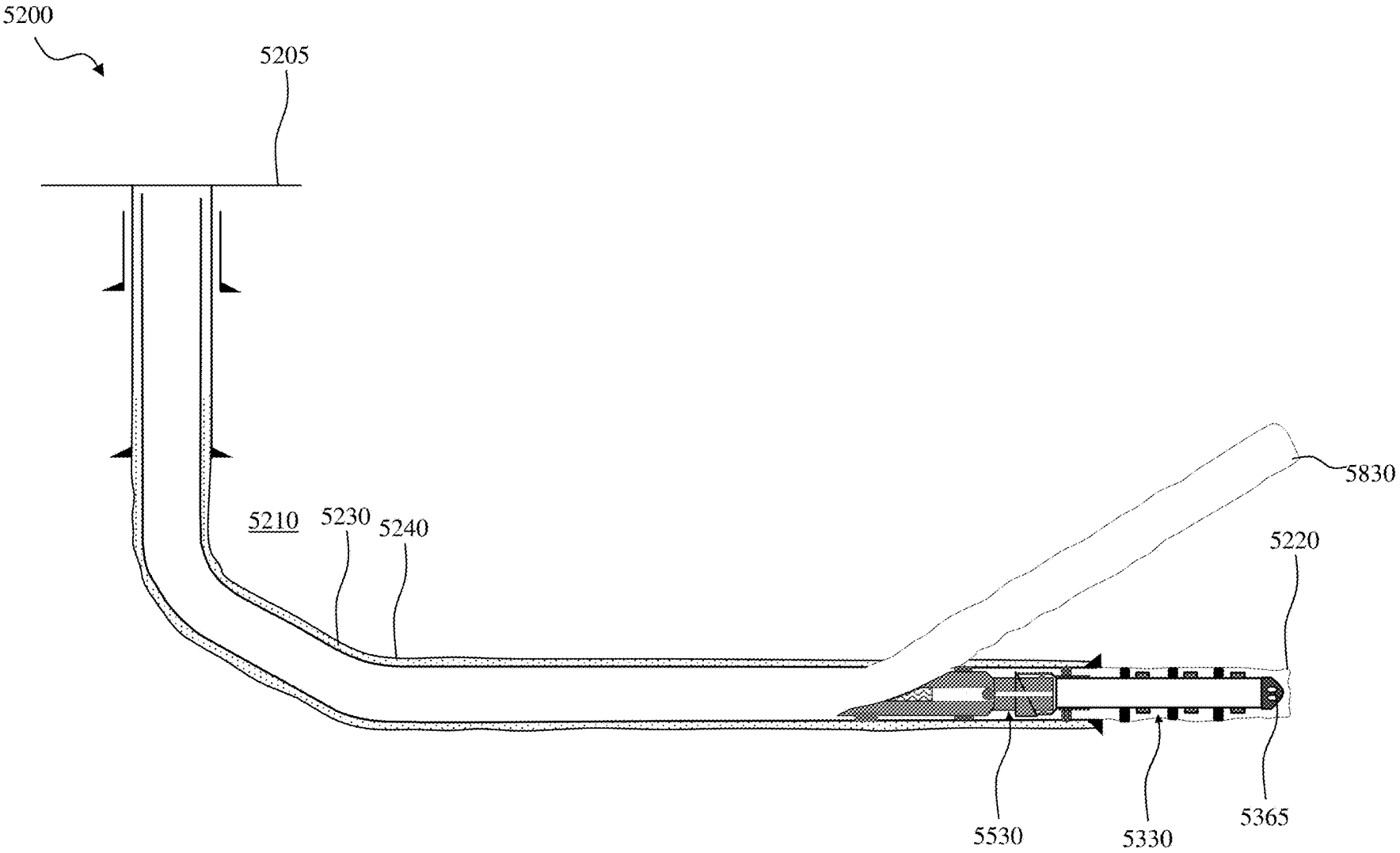

Turning to FIG. 59, illustrated is the well system 5200 of FIG. 58 after pulling the drill string 5810 and rotary steerable assembly 5820 out of hole.

Figure 60:
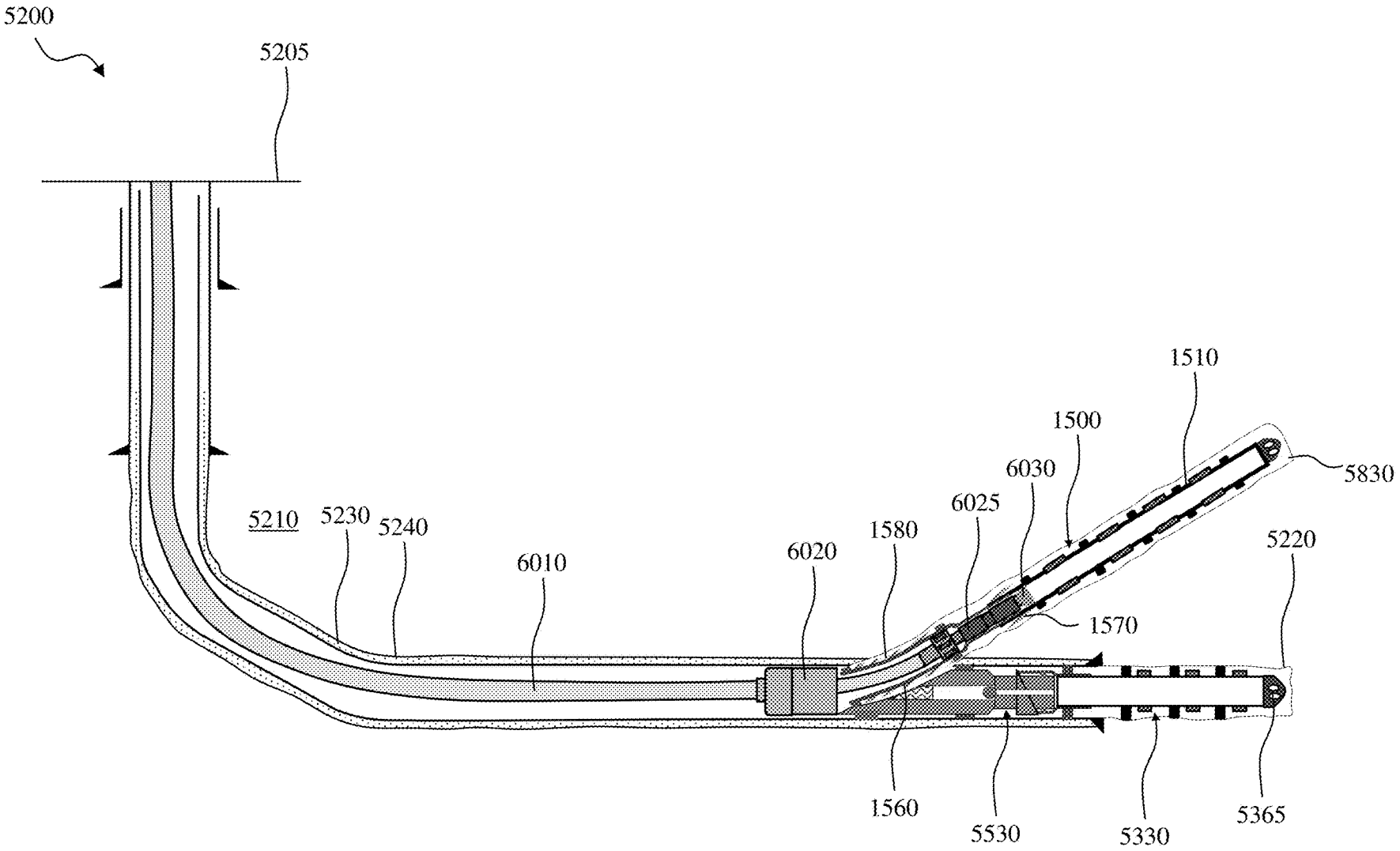

Turning to FIG. 60, illustrated is the well system 5200 of FIG. 59 after positioning a multilateral lateral bore completion 1500 (e.g., as shown in FIG. 15) designed, manufactured and/or operated according to one or more embodiments of the disclosure within the lateral wellbore 5830, for example using a running tool 6010. In at least one embodiment, this could be considered the third multilateral trip downhole. The running tool 6010, in at least one embodiment, includes one or more of an articulation joint 6020, a reaction catalyst 6025 (e.g., optional reaction catalyst), and one or more cup seals 6030. The articulation joint 6020, in one or more embodiments, is configured to accurately position the multilateral lateral bore completion 1500 within the lateral wellbore 5830.

The multilateral lateral bore completion 1500, in one or more embodiments, includes a tubular 1510 having a first end (e.g., uphole end) and a second end (e.g., downhole end). The multilateral lateral bore completion 1500, in one or more embodiments, further includes a transition joint 1560 coupled to the first end of the tubular 1510. In at least one embodiment, the transition joint 1560 includes an uphole end and a downhole end and is configured to extend partially into a main wellbore (e.g., from the lateral wellbore) and ultimately form a portion of the junction (e.g., Level-5 junction) between the lateral wellbore 5830 and the main wellbore 5220.

The multilateral lateral bore completion 1500, in one or more embodiments, further includes an expandable metal anchor 1570 positioned on the radial exterior surface of the tubular 1510. In at least one embodiment, the expandable metal anchor 1570 includes a metal configured to expand in response to hydrolysis to axially and rotationally fix the tubular 1510 with respect to the wellbore tubular (e.g., wellbore tubular of a lateral wellbore). For example, upon subjecting the expandable metal anchor 1570 to reactive fluid, the expandable metal goes from metal to micron-scale particles that are larger and lock together to form an expanded metal anchor that anchors and/or seals the multilateral lateral bore completion 1500 within the wellbore tubular. Those skilled in the art understand that for the expandable metal anchor 1570 to work as intended (e.g., turn into an expanded metal anchor), the volume of space that the expandable metal is located should be small enough such that the expandable metal expands into contact with the one or more surfaces upon undergoing hydrolysis, while volumetrically expanding no more than its total achievable volumetric expansion.

The multilateral lateral bore completion 1500, in one or more embodiments, further includes an expandable metal anchor 1580 positioned on the radial exterior surface of the transition joint 1560. In at least one embodiment, the expandable metal anchor 1580 includes a metal configured to expand in response to hydrolysis to axially and rotationally fix and seal the transition joint 1560 at a junction between the lateral wellbore 5830 and the main wellbore 5220. For example, upon subjecting the expandable metal anchor 1580 to reactive fluid, the expandable metal goes from metal to micron-scale particles that are larger and lock together to form an expanded metal anchor that anchors and/or seals the transition joint 1560. Those skilled in the art understand that for the expandable metal anchor 1580 to work as intended (e.g., turn into an expanded metal anchor), the volume of space that the expandable metal is located should be small enough such that the expandable metal expands into contact with the one or more surfaces upon undergoing hydrolysis, while volumetrically expanding no more than its total achievable volumetric expansion.

Figure 61:
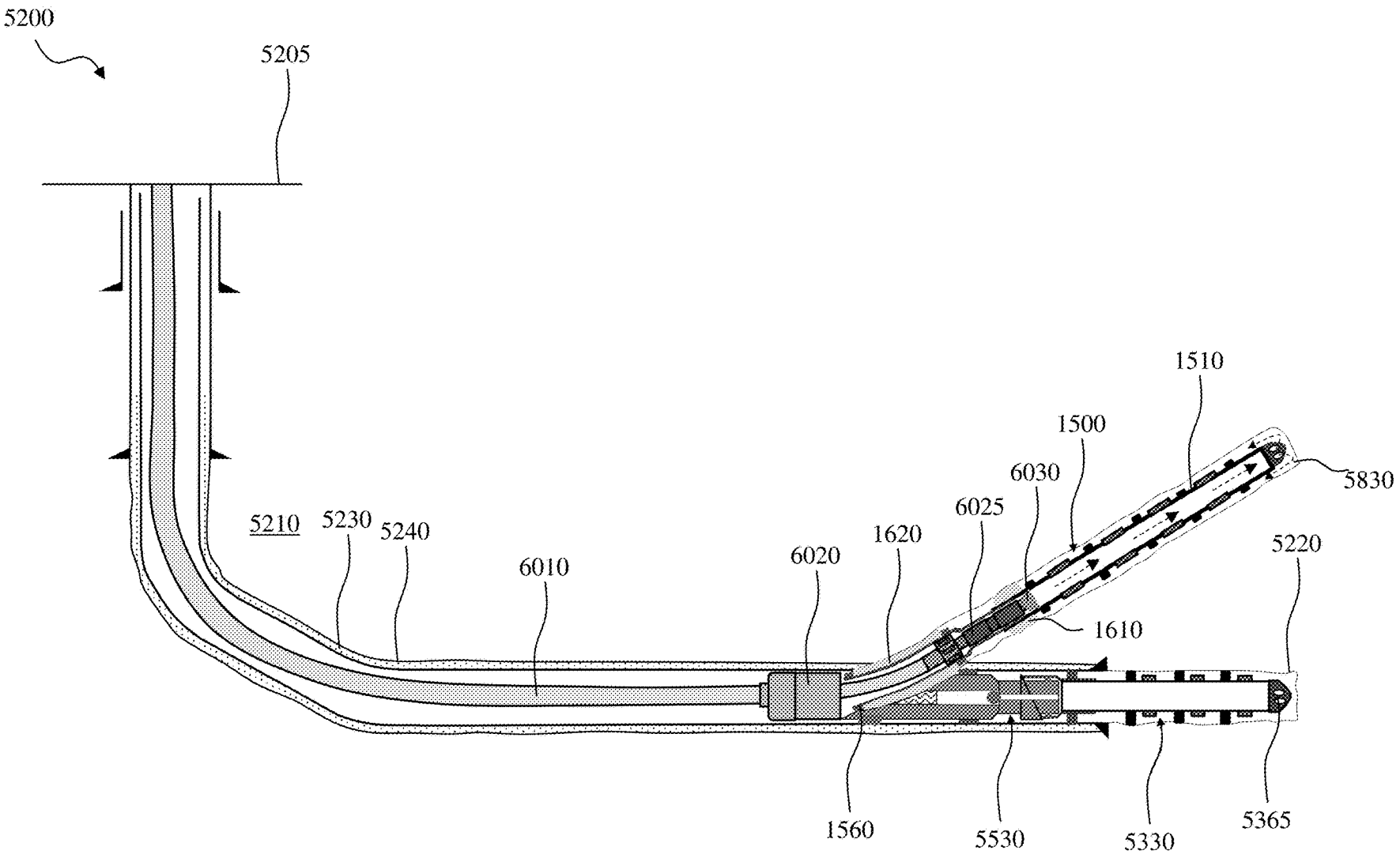

Turning to FIG. 61, illustrated is the well system 5200 of FIG. 60 after subjecting the expandable metal anchor 1570 and expandable metal anchor 1580 to reactive fluid (e.g., mud with water based completion fluid, brine, etc.). For example, in at least one embodiment, the operator could circulate reactive fluid down through the running tool 6010 and out the float shoe to initiate the chemical reaction process for each of the expandable metal anchor 1570 and expandable metal anchor 1580. In at least one embodiment, the circulation of reactive fluid may cease when the expandable metal anchor 1570 and expandable metal anchor 1580 are soaking in reactive fluid. What results are expanded metal anchors 1610, 1620. It should be noted that in certain embodiments, the expandable metal anchor 1570 is employed and the expandable metal anchor 1580 is not employed, and vice versa. Accordingly, in certain embodiments an expanded metal anchor 1610 will be used, and the expanded metal anchor 1620 will not be used, and vice versa.

Figure 62:
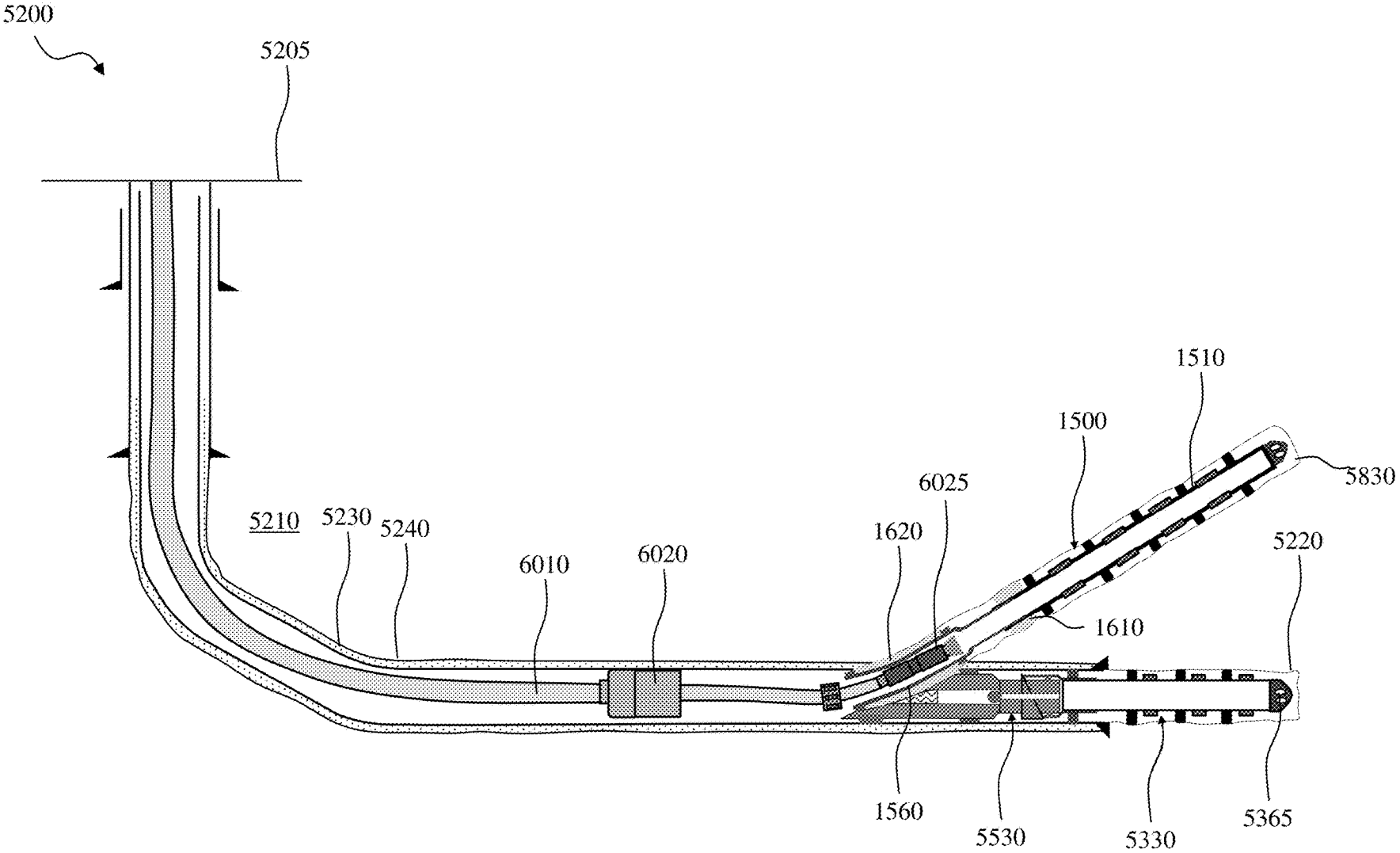

Turning to FIG. 62, illustrated is the well system 5200 of FIG. 61 after subjecting the one or more of the expanded metal anchors 1610, 1620 to the reaction catalyst 6025 to accelerate the chemical reaction and thus increase the rate of expansion of the expanded metal anchors 1610, 1620. In at least one embodiment, the reaction catalyst 6025 is moved within the transition joint 1560 to reach each of the expandable metal anchor 1570 and expandable metal anchor 1580.

Figure 63:
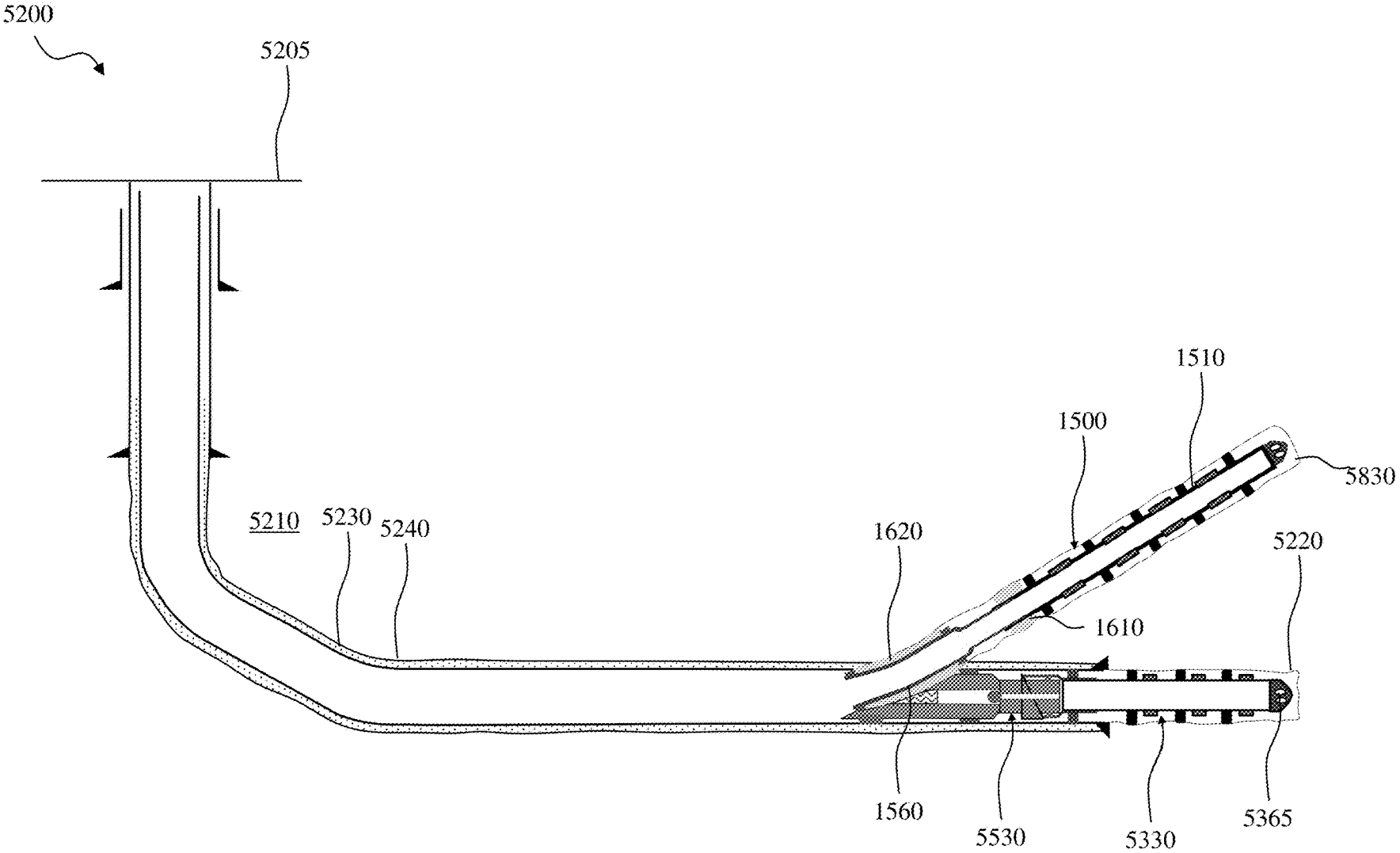

Turning to FIG. 63, illustrated is the well system 5200 of FIG. 62 after pulling the running tool 6010 out of hole. As is illustrated, the transition joint 1560 and the expanded metal anchor 1620 extend from the lateral wellbore 5830 into the main wellbore 5220.

Figure 64:
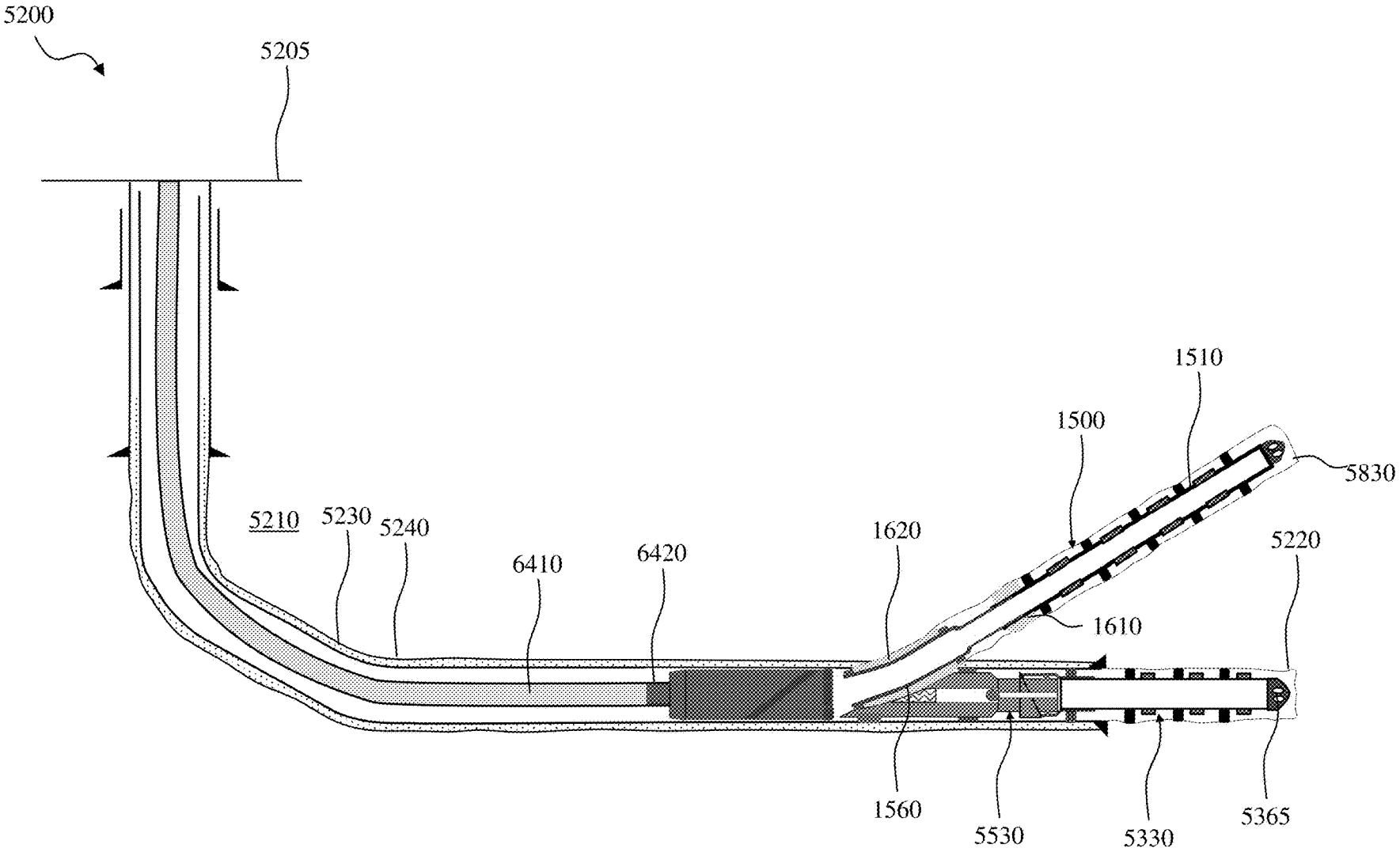

Turning to FIG. 64, illustrated is the well system 5200 of FIG. 63 after running a washover sleeve assembly 6420 downhole using a running tool 6410. In the illustrated embodiment of FIG. 64, the washover sleeve assembly 6420 is approaching the transition joint 1560. In at least one embodiment, this could be considered the third multilateral trip downhole.

Figure 65:
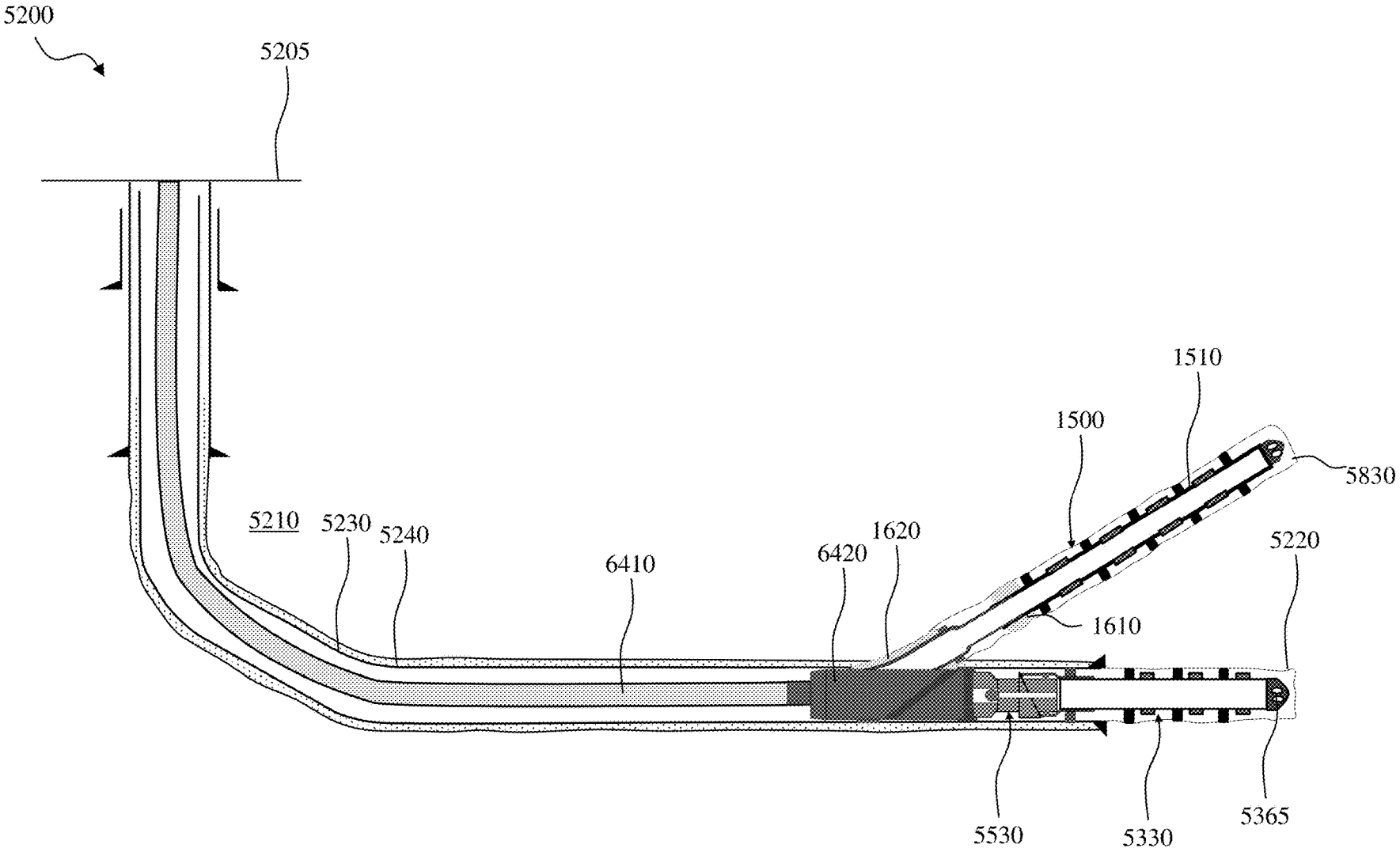

Turning to FIG. 65, illustrated is the well system 5200 of FIG. 64 after the washover sleeve assembly 6420 completes the washover process, which includes trimming those portions of the transition joint 1560 extending into the main wellbore 5220. Furthermore, the washover sleeve assembly 6420 swallows the multilateral whipstock assembly 5530, and at a certain point in time locks into the multilateral whipstock assembly 5530.

Figure 66:
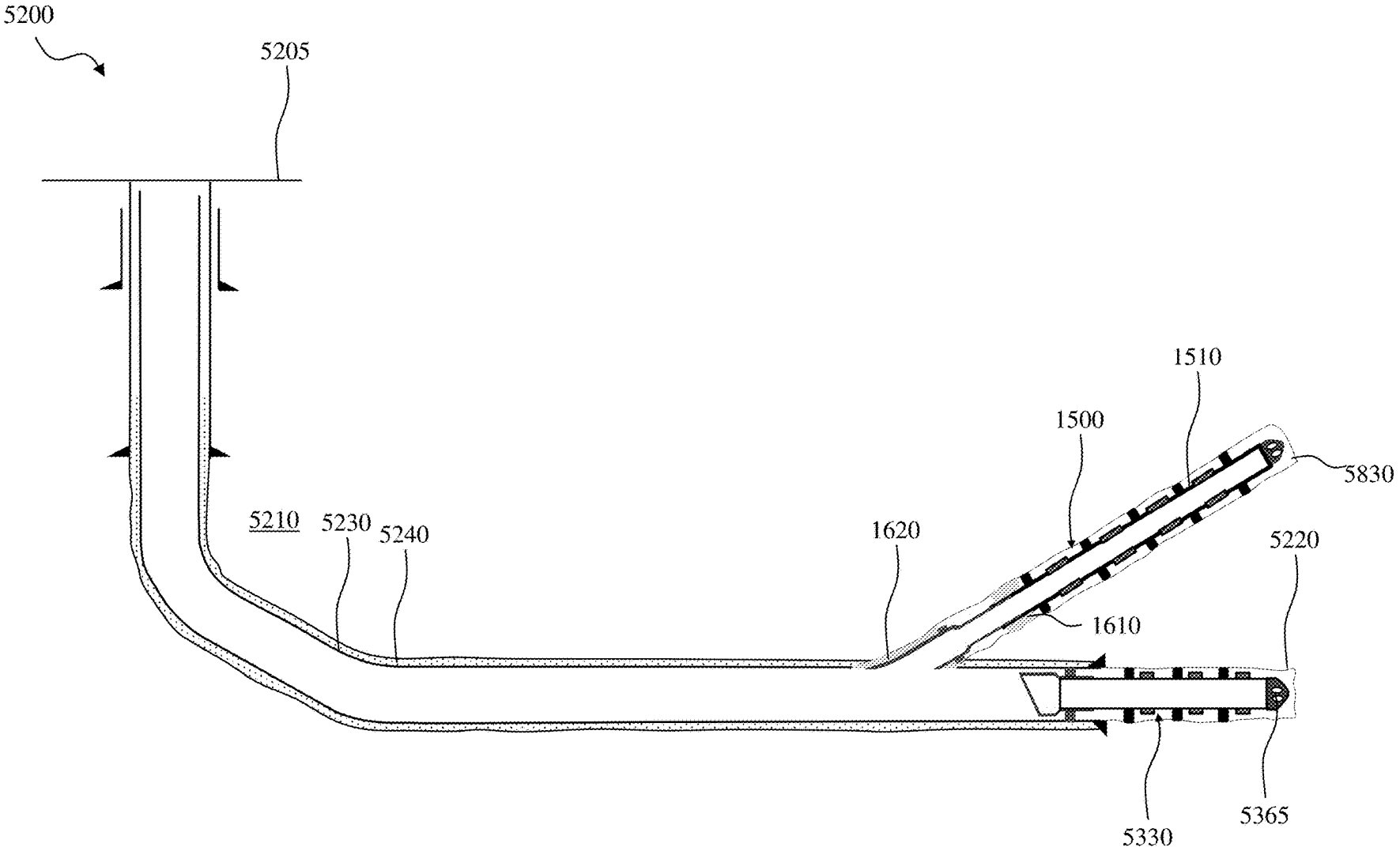

Turning to FIG. 66, illustrated is the well system 5200 of FIG. 65 after pulling the running tool 6410, washover sleeve assembly 6420, and attached multilateral whipstock assembly 5530 out of hole. As illustrated, the transition joint 1560 and expanded metal anchor 1620 are trimmed back to the main wellbore 5220.

Figure 67:
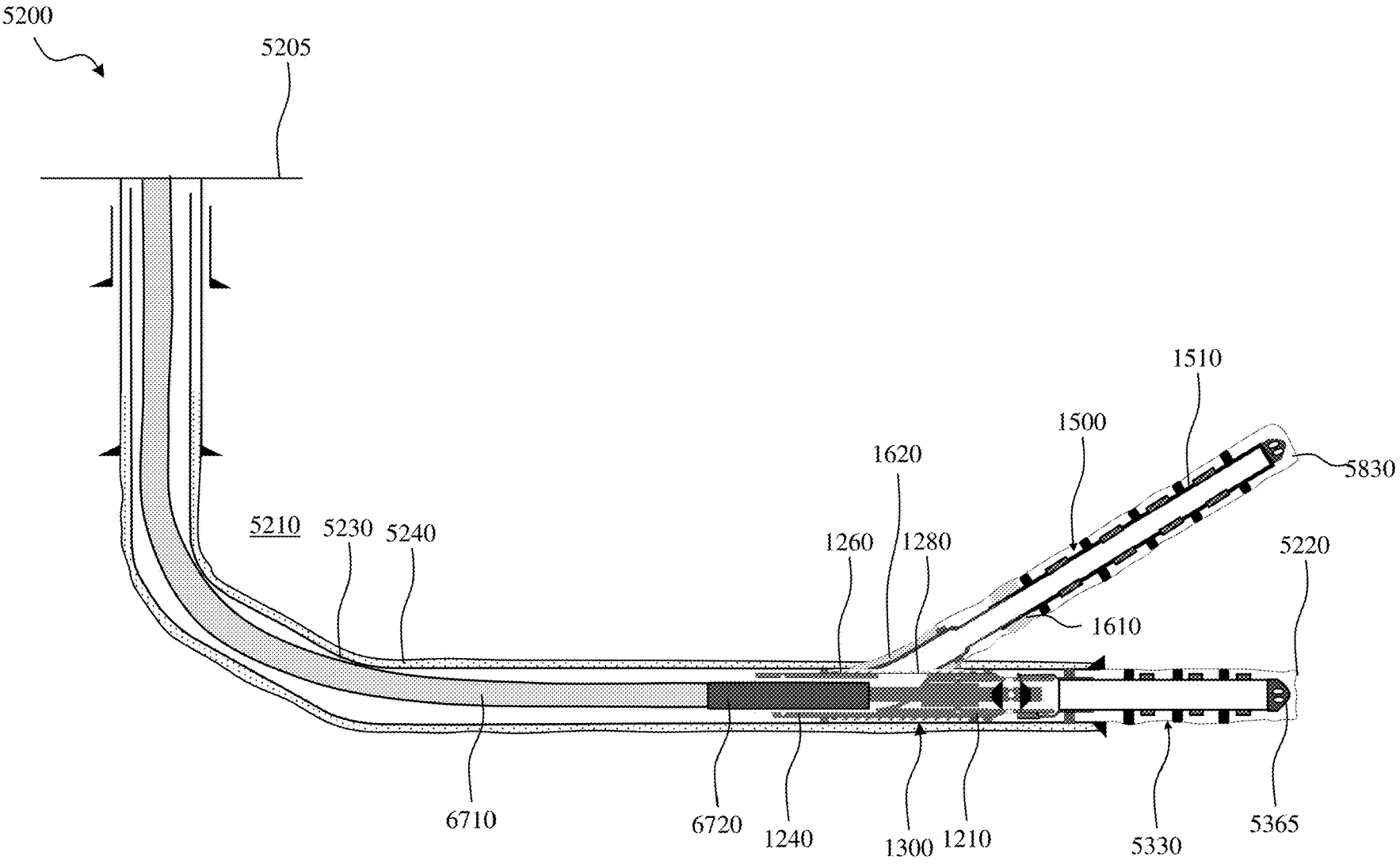

Turning to FIG. 67, illustrated is the well system 5200 of FIG. 66 after positioning a multilateral junction sleeve assembly 1300 (e.g., as shown in FIG. 13) within the main wellbore 5220 using a running tool 6710, for example including a reaction catalyst 6720. In at least one embodiment, this could be considered the fourth multilateral trip downhole. In at least one embodiment, the multilateral junction sleeve assembly 1300 self-orients on the multilateral mainbore completion 5350. The multilateral junction sleeve assembly 1300 (e.g., with reference to FIG. 13), in one or more embodiments, includes a multilateral deflector assembly 1210. In at least one embodiment, the multilateral deflector assembly 1210 includes a deflector body 1220 having a deflector face 1230 and an opening 1235 extending therethrough. The multilateral junction sleeve assembly 1300, in the illustrated embodiment, further includes a deflector assembly sleeve 1240 coupled to an uphole end of the deflector body 1220. In at least one embodiment, the deflector assembly sleeve 1240 has a sidewall opening 1250 in a sidewall thereof aligned with the deflector face 1230.

The multilateral junction sleeve assembly 1300, in the illustrated embodiment, further includes one or more of an expandable metal anchor 1260 positioned on a radial exterior surface of the deflector assembly sleeve 1240, and degradable material 1280 positioned on a radial exterior surface of the deflector assembly sleeve 1240 covering the sidewall opening 1250. In one or more embodiments, the expandable metal anchor 1260 includes a metal configured to expand in response to hydrolysis to axially and rotationally fix the multilateral deflector assembly 1210 within a wellbore tubular. In one or more embodiments, such as is illustrated in FIG. 67, the expandable metal anchor 1260 is positioned on the radial exterior surface of the deflector assembly sleeve 1240 uphole and downhole the sidewall opening 1250, the expandable metal anchor configured to fix the multilateral deflector assembly 1210 within the main wellbore 5220 uphole and downhole the sidewall opening 1250. The expandable metal anchor 1260 may comprise any of the expandable metals discussed above, so long as it expands into contact with a wellbore tubular and forms an expanded metal anchor.

In the illustrated embodiment of FIG. 67, the degradable material 1280 is a layer of degradable material 1285 positioned on the radial exterior surface of the deflector assembly sleeve 1240 covering the sidewall opening 1250. The layer of degradable material 1285 may comprise any material known to degrade over time, as well as any of the materials disclosed above. In one or more embodiments, however, the layer of degradable material 1285 is a layer of polymer based degradable material positioned between open ends of the expandable metal anchor 1260. In yet another embodiment, however, the layer of degradable material 1285 is a layer of metal based degradable material. For example, in at least one embodiment, the layer of metal based degradable material is a layer of expandable metal configured to expand in response to hydrolysis and then degrade to uncover the sidewall opening 1250. In this embodiment, the layer of expandable metal is configured to expand in response to hydrolysis and after the hydrolysis has completed then degrade to uncover the sidewall opening 1250.

In accordance with at least one embodiment, for example when the layer of degradable material 1285 comprises a layer of expandable metal configured to expand in response to hydrolysis, the layer of expandable metal and the expandable metal anchor 1260 are a single unitary layer of expandable metal 1310 including the metal configured to expand in response to hydrolysis. In at least one embodiment, the single unitary layer of expandable metal 1310 is configured to degrade around the sidewall opening 1250 but form an expanded metal anchor outside of the sidewall opening 1250. Accordingly, the single unitary layer of expandable metal 1310 has the dual purpose of degrading and forming the expanded metal anchor, and can be located axially and radially below the sidewall opening 1250. The embodiment of FIG. 67 has been depicted using the multilateral junction sleeve assembly 1300 of FIG. 13, however, the multilateral junction sleeve assembly 1200 of FIG. 12 could also have been employed.

Figure 68:
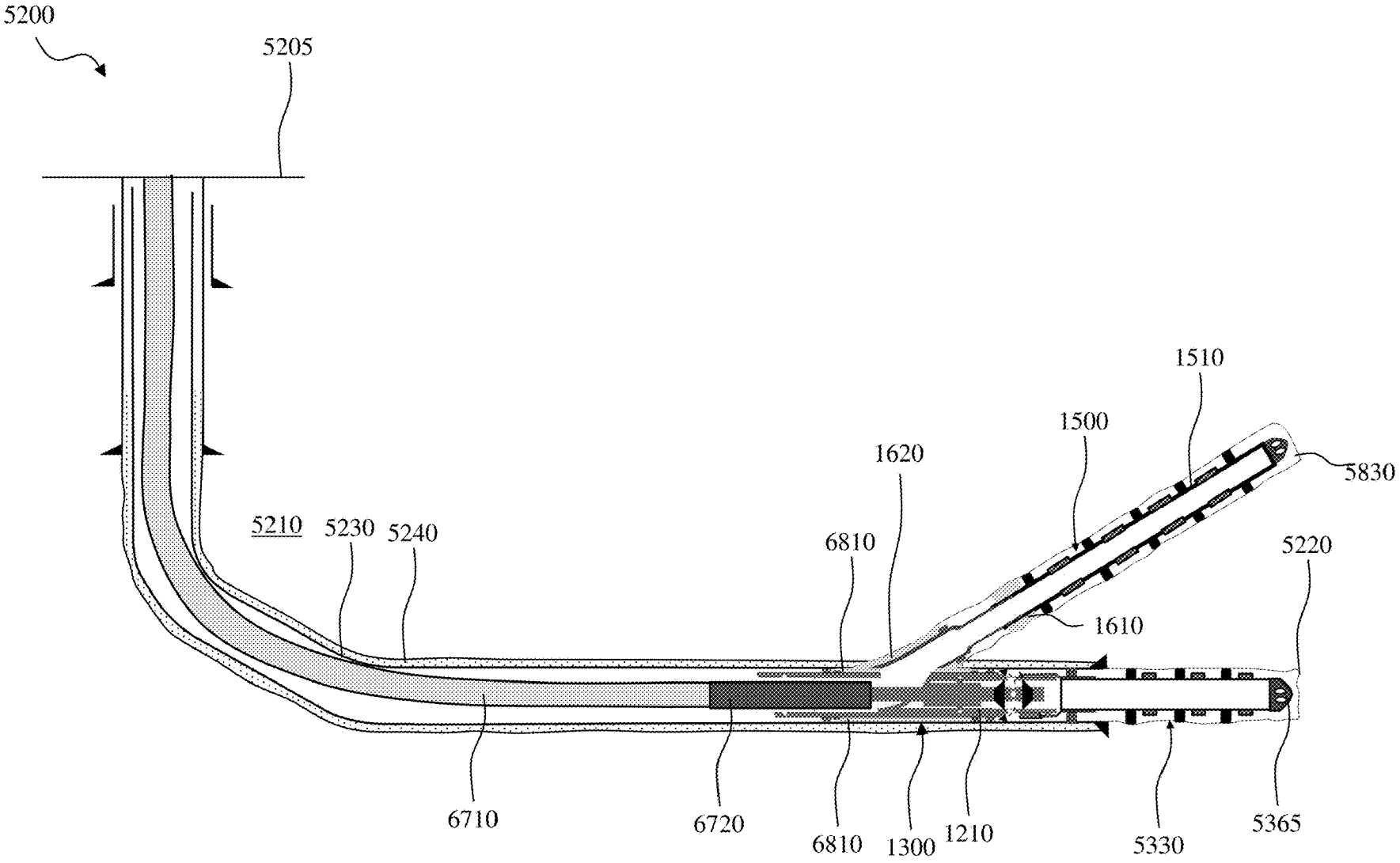

Turning to FIG. 68, illustrated is the well system 5200 of FIG. 67, after subjecting the multilateral junction sleeve assembly 1300 to reactive fluid (e.g., mud with water based completion fluid, brine, etc.). For example, in at least one embodiment, the operator could circulate reactive fluid down through a fluid port located at the end of the running tool 6710 to initiate the chemical reaction process for each of the degradable material 1280 and the expandable metal anchor 1260. In at least one embodiment, the circulation of reactive fluid may cease when the degradable material 1280 and the expandable metal anchor 1260 of the multilateral junction sleeve assembly 1300 are soaking in reactive fluid.

As shown in FIG. 68, the reactive fluid causes the expandable metal anchor 1260 to turn to an expanded metal anchor 6810, as discussed above. Additionally, the reactive fluid causes the degradable material 1280 to degrade or otherwise dissolve away, for example uncovering the sidewall opening 1250, and thus providing access to the lateral wellbore 5830. In at least one embodiment, the reaction catalyst 6720 associated with the running tool 6710 may be employed to speed up the chemical reaction between the reactive fluid and the expandable metal anchor 1260 and/or degradable material 1280.

Figure 69:
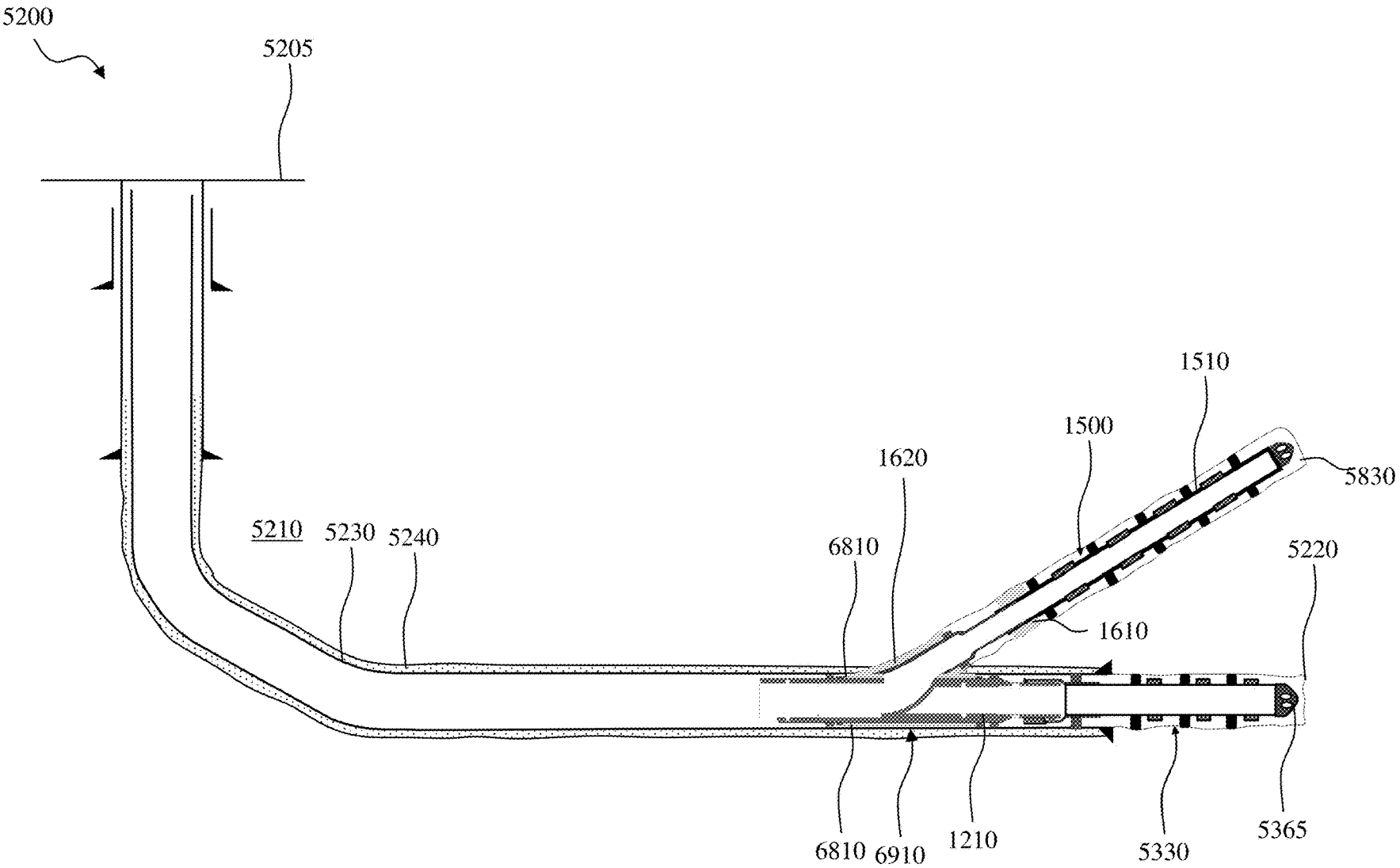

Turning to FIG. 69, illustrated is the well system 5200 of FIG. 68, after pulling the running tool 6710 out of hole. What ultimately results, for example between the expanded metal anchor 1620 and the expanded metal anchor 6810, is a Level-5 junction 6910. Additionally, large ID and mechanical access to the main wellbore 3420 and lateral wellbore 3930 is achieved. For example, smaller intervention devices would be allowed to pass to the main wellbore 5220, whereas larger intervention devices would be redirected out into the lateral wellbore 5830.

Figure 70:
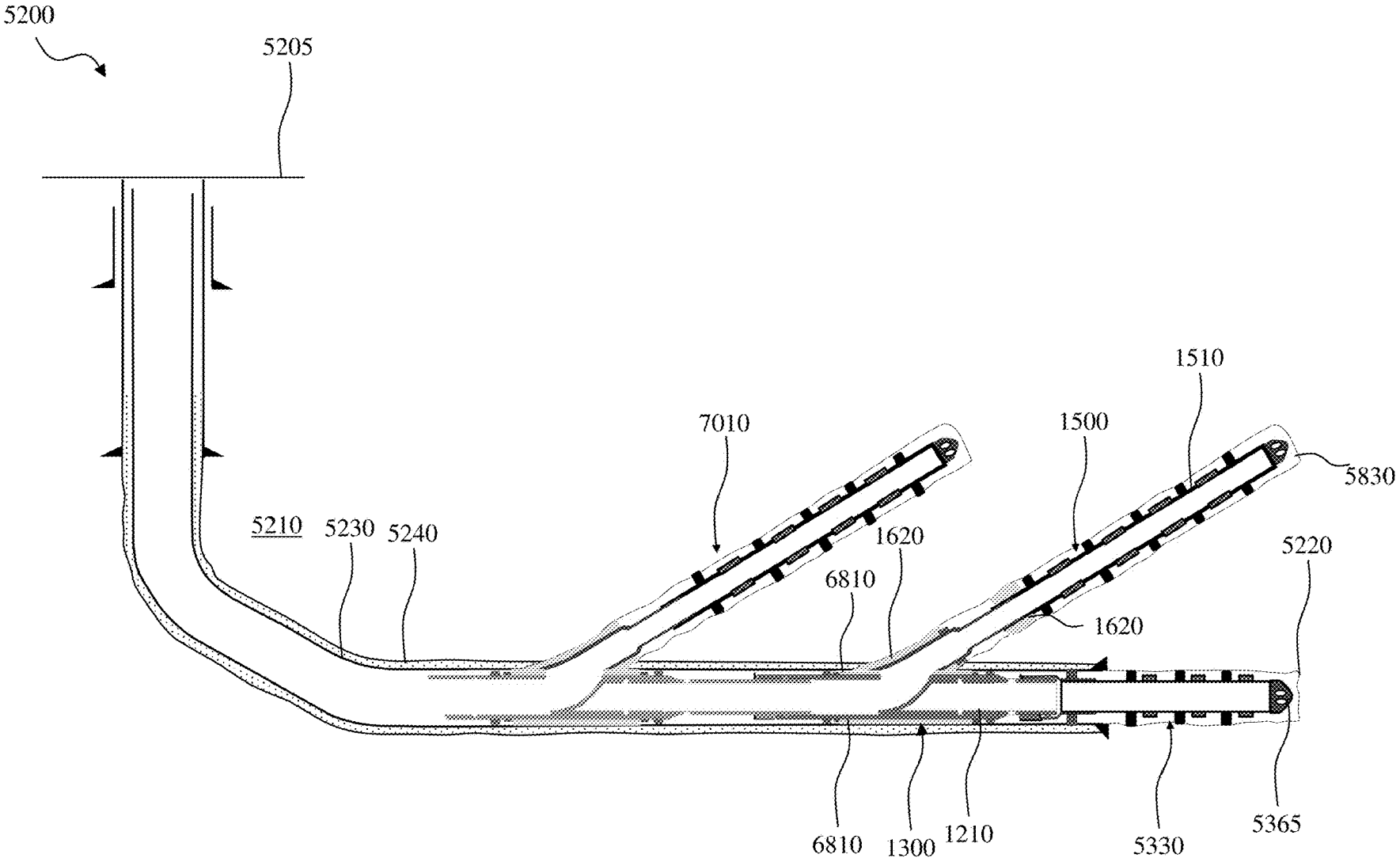

Turning to FIG. 70, illustrated is the well system 5200 of FIG. 69 after repeating the process described with regard to FIGS. 52 through 69 to create a trilateral wellbore 7010. In the embodiment of FIG. 70 only two lateral wellbores have been formed. It should be noted, however, that the details of the present disclosure may be used to form any number of lateral wellbores off of the main wellbore 5220 without departing from the scope of the disclosure.

Figure 71:
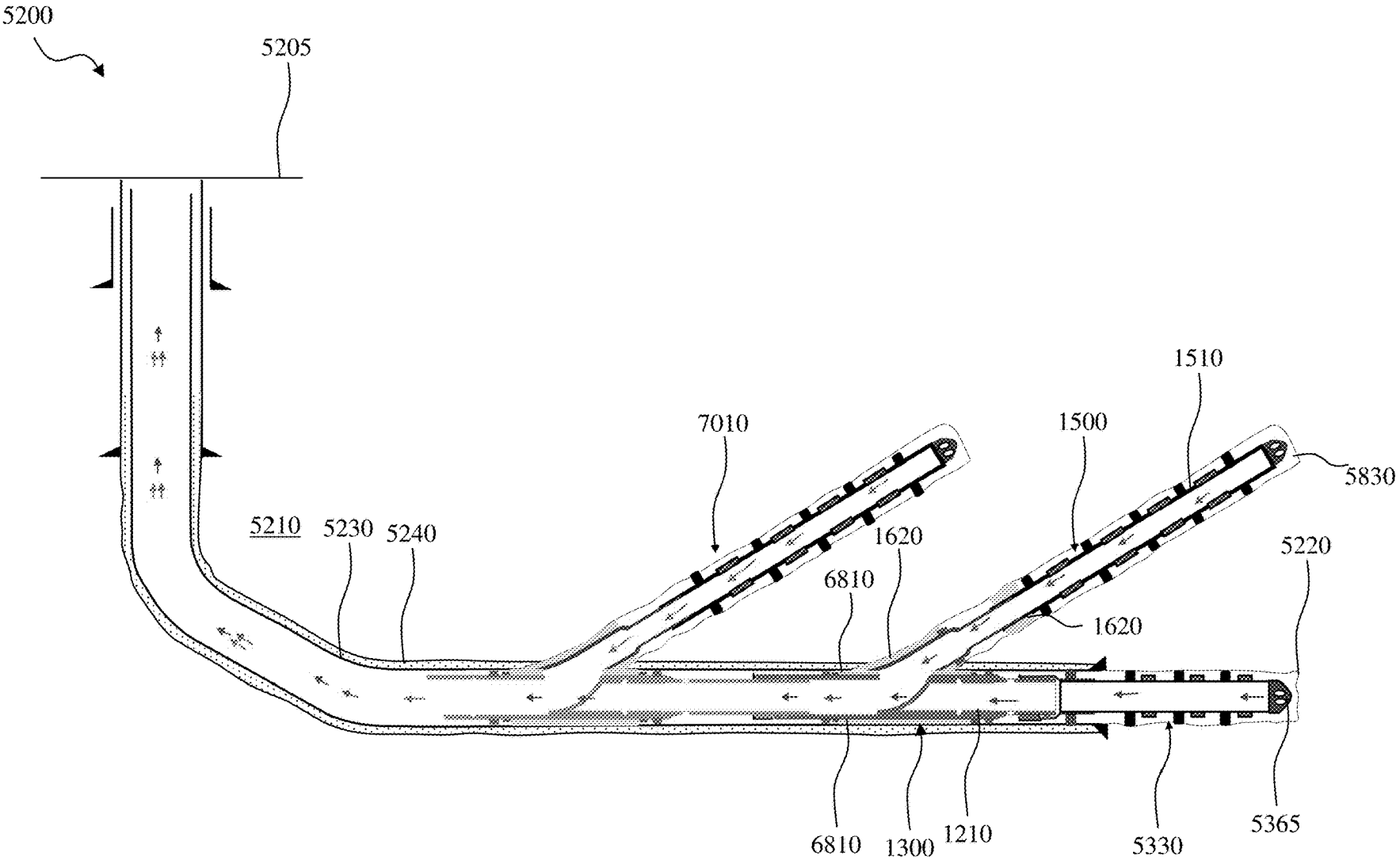

Turning to FIG. 71, illustrated is the well system 5200 of FIG. 70 after producing from the well system 5200. In at least one embodiment, the well system 5200 is ready to produce from, for example, employing only four multilateral trips downhole.

Aspects disclosed herein include:

A. A multilateral milling assembly, the multilateral milling assembly including: 1) a multilateral whipstock assembly, the multilateral whipstock assembly having a whipstock body with a whipface and an opening extending therethrough; 2) a two part milling and running tool coupled to the multilateral whipstock assembly, the two part milling and running tool including: a) a conveyance; b) a smaller assembly coupled to an end of the conveyance; and c) a larger bit assembly slidably coupled to the conveyance, the smaller assembly and larger bit assembly configured to slidingly engage one another downhole to form a combined bit assembly; and 3) degradable material axially fixing the smaller assembly relative to the whipstock body, the degradable material configured to degrade over time and allow the smaller assembly to release from the whipstock body and axially slide relative to the larger bit assembly to form the combined bit assembly.

B. A well system, the well system including: 1) a main wellbore located within a subterranean formation; and 2) a multilateral milling assembly located in the main wellbore proximate a junction between the main wellbore and where a lateral wellbore is to be formed, the multilateral milling assembly including: a) a multilateral whipstock assembly, the multilateral whipstock assembly having a whipstock body with a whipface and an opening extending therethrough; b) a two part milling and running tool coupled to the multilateral whipstock assembly, the two part milling and running tool including: i) a conveyance; ii) a smaller assembly coupled to an end of the conveyance; and iii) a larger bit assembly slidably coupled to the conveyance, the smaller assembly and larger bit assembly configured to slidingly engage one another downhole to form a combined bit assembly; and c) degradable material axially fixing the smaller assembly relative to the whipstock body, the degradable material configured to degrade over time and allow the smaller assembly to release from the whipstock body and axially slide relative to the larger bit assembly to form the combined bit assembly.

C. A method for forming a well system, the method including: 1) forming a main wellbore within a subterranean formation; and 2) positioning a multilateral milling assembly in the main wellbore proximate a junction between the main wellbore and where a lateral wellbore is to be formed, the multilateral milling assembly including: a) a multilateral whipstock assembly, the multilateral whipstock assembly having a whipstock body with a whipface and an opening extending therethrough; b) a two part milling and running tool coupled to the multilateral whipstock assembly, the two part milling and running tool including: i) a conveyance; ii) a smaller assembly coupled to an end of the conveyance; and iii) a larger bit assembly slidably coupled to the conveyance, the smaller assembly and larger bit assembly configured to slidingly engage one another downhole to form a combined bit assembly; and c) degradable material axially fixing the smaller assembly relative to the whipstock body, the degradable material configured to degrade over time and allow the smaller assembly to release from the whipstock body and axially slide relative to the larger bit assembly to form the combined bit assembly.

D. A multilateral whipstock assembly, the multilateral whipstock assembly including: 1) a whipstock body, the whipstock body having a whipface and an opening extending therethrough; and 2) degradable material located in the opening, the degradable material configured to axially fix a smaller assembly of a two part milling and running tool relative to the whipstock body, the degradable material configured to degrade over time and allow the smaller assembly to release from the whipstock body and axially slide relative to a larger bit assembly of the two part milling and running tool to form a combined bit assembly.

E. A well system, the well system including: 1) a main wellbore located within a subterranean formation; and 2) a multilateral whipstock assembly located in the main wellbore proximate a junction between the main wellbore and where a lateral wellbore is to be formed, the multilateral whipstock assembly including: a) a whipstock body, the whipstock body having a whipface and an opening extending therethrough; and b) degradable material located in the opening, the degradable material configured to axially fix a smaller assembly of a two part milling and running tool relative to the whipstock body, the degradable material configured to degrade over time and allow the smaller assembly to release from the whipstock body and axially slide relative to a larger bit assembly of the two part milling and running tool to form a combined bit assembly.

F. A method for forming a well system, the method including: 1) forming a main wellbore within a subterranean formation; and 2) positioning a multilateral whipstock assembly in the main wellbore proximate a junction between the main wellbore and where a lateral wellbore is to be formed, the multilateral whipstock assembly including: a) a whipstock body, the whipstock body having a whipface and an opening extending therethrough; and b) degradable material located in the opening, the degradable material configured to axially fix a smaller assembly of a two part milling and running tool relative to the whipstock body, the degradable material configured to degrade over time and allow the smaller assembly to release from the whipstock body and axially slide relative to a larger bit assembly of the two part milling and running tool to form a combined bit assembly.

G. A two part milling and running tool, the two part milling and running tool including: 1) a conveyance; 2) a smaller assembly coupled to an end of the conveyance; and 3) a larger bit assembly slidably coupled to the conveyance, the smaller assembly and larger bit assembly configured to slidingly engage one another downhole to form a combined bit assembly, the larger bit assembly having a body lock ring in an interior thereof, the body lock ring configured to allow the smaller assembly to slide toward the larger bit assembly but prevent the smaller assembly from sliding away from the larger bit assembly.

H. A well system, the well system including: 1) a main wellbore located within a subterranean formation; and 2) a multilateral milling assembly located in the main wellbore proximate a junction between the main wellbore and where a lateral wellbore is to be formed, the multilateral milling assembly including: a) a multilateral whipstock assembly, the multilateral whipstock assembly including a whipstock body with a whipface and an opening extending therethrough; and b) a two part milling and running tool coupled to the multilateral whipstock assembly, the two part milling and running tool including: i) a conveyance; ii) a smaller assembly coupled to an end of the conveyance; and iii) a larger bit assembly slidably coupled to the conveyance, the smaller assembly and larger bit assembly configured to slidingly engage one another downhole to form a combined bit assembly, the larger bit assembly having a body lock ring in an interior thereof, the body lock ring configured to allow the smaller assembly to slide toward the larger bit assembly but prevent the smaller assembly from sliding away from the larger bit assembly.

I. A method for forming a well system, the method including: 1) forming a main wellbore within a subterranean formation; and 2) positioning a multilateral milling assembly in the main wellbore proximate a junction between the main wellbore and where a lateral wellbore is to be formed, the multilateral milling assembly including: a) a multilateral whipstock assembly, the multilateral whipstock assembly including a whipstock body with a whipface and an opening extending therethrough; and b) a two part milling and running tool coupled to the multilateral whipstock assembly, the two part milling and running tool including: i) a conveyance; ii) a smaller assembly coupled to an end of the conveyance; and iii) a larger bit assembly slidably coupled to the conveyance, the smaller assembly and larger bit assembly configured to slidingly engage one another downhole to form a combined bit assembly, the larger bit assembly having a body lock ring in an interior thereof, the body lock ring configured to allow the smaller assembly to slide toward the larger bit assembly but prevent the smaller assembly from sliding away from the larger bit assembly.

J. A multilateral fluid loss device, the multilateral fluid loss device including: 1) a fluid loss device body, the fluid loss device body having a first end and a second end coupled together by a fluid passageway; 2) a plug member located in the fluid passageway, the plug member configured to move between a first position allowing fluid to traverse the fluid passageway as it travels from the first end to the second end and a second position preventing the fluid from traversing the fluid passageway as it travels from the first end to the second end; and 3) degradable material located within the fluid passageway and engaged with the plug member, the degradable material preventing the plug member from moving to the second position, the degradable material configured to degrade over time and allow the plug member to move from the first position to the second position to prevent the fluid from traversing the fluid passageway as it travels from the first end to the second end.

K. A well system, the well system including: 1) a wellbore located within a subterranean formation; and 2) a multilateral fluid loss device located in the wellbore, the multilateral fluid loss device including: a) a fluid loss device body, the fluid loss device body having a first end and a second end coupled together by a fluid passageway; b) a plug member located in the fluid passageway, the plug member configured to move between a first position allowing fluid to traverse the fluid passageway as it travels from the first end to the second end and a second position preventing the fluid from traversing the fluid passageway as it travels from the first end to the second end; and c) degradable material located within the fluid passageway and engaged with the plug member, the degradable material preventing the plug member from moving to the second position, the degradable material configured to degrade over time and allow the plug member to move from the first position to the second position to prevent the fluid from traversing the fluid passageway as it travels from the first end to the second end.

L. A method for forming a well system, the method including: 1) forming a wellbore within a subterranean formation; and 2) positioning a multilateral fluid loss device in the wellbore, the multilateral fluid loss device including: a) a fluid loss device body, the fluid loss device body having a first end and a second end coupled together by a fluid passageway; b) a plug member located in the fluid passageway, the plug member configured to move between a first position allowing fluid to traverse the fluid passageway as it travels from the first end to the second end and a second position preventing the fluid from traversing the fluid passageway as it travels from the first end to the second end; and c) degradable material located within the fluid passageway and engaged with the plug member, the degradable material preventing the plug member from moving to the second position, the degradable material configured to degrade over time and allow the plug member to move from the first position to the second position to prevent the fluid from traversing the fluid passageway as it travels from the first end to the second end.

M. A multilateral mainbore completion, the multilateral mainbore completion including: 1) a tubular having a first end and a second end; 2) first and second packers located on a radial exterior surface of the tubular, the first and second packers configured to move from a radially retracted state to a radially extended state to engage with a wellbore tubular and separate the wellbore tubular into first and second production zones; 3) a first interval control valve located in the tubular in the first production zone and a second interval control valve located in the tubular in the second production zone; and 4) an expandable metal anchor positioned on the radial exterior surface of the tubular, the expandable metal anchor including a metal configured to expand in response to hydrolysis to axially and rotationally fix the tubular with respect to the wellbore tubular.

N. A well system, the well system including: 1) a main wellbore located within a subterranean formation; and 2) a multilateral mainbore completion located in the main wellbore, the multilateral mainbore completion including: a) a tubular having a first end and a second end; b) first and second packers located on a radial exterior surface of the tubular, the first and second packers configured to move from a radially retracted state to a radially extended state to engage with a wellbore tubular and separate the wellbore tubular into first and second production zones; c) a first interval control valve located in the tubular in the first production zone and a second interval control valve located in the tubular in the second production zone; and d) an expandable metal anchor positioned on the radial exterior surface of the tubular, the expandable metal anchor including a metal configured to expand in response to hydrolysis to axially and rotationally fix the tubular with respect to the wellbore tubular.

O. A method for forming a well system, the method including: 1) forming a main wellbore within a subterranean formation; and 2) positioning a multilateral mainbore completion in the main wellbore, the multilateral mainbore completion including: a) a tubular having a first end and a second end; b) first and second packers located on a radial exterior surface of the tubular, the first and second packers configured to move from a radially retracted state to a radially extended state to engage with a wellbore tubular and separate the wellbore tubular into first and second production zones; c) a first interval control valve located in the tubular in the first production zone and a second interval control valve located in the tubular in the second production zone; and d) an expandable metal anchor positioned on the radial exterior surface of the tubular, the expandable metal anchor including a metal configured to expand in response to hydrolysis to axially and rotationally fix the tubular with respect to the wellbore tubular.

P. A multilateral downhole assembly, the multilateral downhole assembly including: 1) a multilateral deflector assembly, the multilateral deflector assembly including a deflector body having a deflector face and an opening extending therethrough; and 2) a running tool, the running tool coupled to the multilateral deflector assembly using a degradable material coupling mechanism, the degradable material coupling mechanism configured to degrade over time and allow the running tool to release from the multilateral deflector assembly.

Q. A well system, the well system including: 1) a main wellbore located within a subterranean formation; 2) a lateral wellbore extending from the main wellbore; and 3) a multilateral deflector assembly located in the main wellbore proximate a junction between the main wellbore and the lateral wellbore, the multilateral deflector assembly including: a) a deflector body having a deflector face and an opening extending therethrough; and b) a running tool, the running tool coupled to the multilateral deflector assembly using a degradable material coupling mechanism, the degradable material coupling mechanism configured to degrade over time and allow the running tool to release from the multilateral deflector assembly.

R. A method for forming a well system, the method including: 1) forming a main wellbore within a subterranean formation; 2) forming a lateral wellbore off of the main wellbore; and 3) positioning a multilateral deflector assembly in the main wellbore proximate a junction between the main wellbore and the lateral wellbore, the multilateral deflector assembly including: a) a deflector body having a deflector face and an opening extending therethrough; and b) a running tool, the running tool coupled to the multilateral deflector assembly using a degradable material coupling mechanism, the degradable material coupling mechanism configured to degrade over time and allow the running tool to release from the multilateral deflector assembly.

S. A multilateral junction sleeve assembly, the multilateral junction sleeve assembly including: 1) a multilateral deflector assembly, the multilateral deflector assembly including a deflector body having a deflector face and an opening extending therethrough; 2) a deflector assembly sleeve coupled to an uphole end of the deflector body, the deflector assembly sleeve having a sidewall opening in a sidewall thereof aligned with the deflector face; and 3) an expandable metal anchor positioned on a radial exterior surface of the deflector assembly sleeve, the expandable metal anchor including a metal configured to expand in response to hydrolysis to axially and rotationally fix the multilateral deflector assembly within a wellbore tubular.

T. A well system, the well system including: 1) a main wellbore located within a subterranean formation; 2) a lateral wellbore extending from the main wellbore; and 3) a multilateral junction sleeve assembly located in the main wellbore proximate a junction between the main wellbore and the lateral wellbore, the multilateral junction sleeve assembly including: a) a multilateral deflector assembly, the multilateral deflector assembly including a deflector body having a deflector face and an opening extending therethrough; b) a deflector assembly sleeve coupled to an uphole end of the deflector body, the deflector assembly sleeve having a sidewall opening in a sidewall thereof aligned with the deflector face; and c) an expandable metal anchor positioned on a radial exterior surface of the deflector assembly sleeve, the expandable metal anchor including a metal configured to expand in response to hydrolysis to axially and rotationally fix the multilateral deflector assembly within a wellbore tubular.

U. A method for forming a well system, the method including: 1) forming a main wellbore within a subterranean formation); forming a lateral wellbore off of the main wellbore; and 3) positioning a multilateral junction sleeve assembly in the main wellbore proximate a junction between the main wellbore and the lateral wellbore, the multilateral junction sleeve assembly including: a) a multilateral deflector assembly, the multilateral deflector assembly including a deflector body having a deflector face and an opening extending therethrough; b) a deflector assembly sleeve coupled to an uphole end of the deflector body, the deflector assembly sleeve having a sidewall opening in a sidewall thereof aligned with the deflector face; and c) an expandable metal anchor positioned on a radial exterior surface of the deflector assembly sleeve, the expandable metal anchor including a metal configured to expand in response to hydrolysis to axially and rotationally fix the multilateral deflector assembly within a wellbore tubular.

V. A multilateral junction sleeve assembly, the multilateral junction sleeve assembly including: 1) a multilateral deflector assembly, the multilateral deflector assembly including a deflector body having a deflector face and an opening extending therethrough; 2) a deflector assembly sleeve coupled to an uphole end of the deflector body, the deflector assembly sleeve having a sidewall opening in a sidewall thereof aligned with the deflector face; and 3) degradable material positioned on a radial exterior surface of the deflector assembly sleeve covering the sidewall opening, the degradable material configured to degrade over time and uncover the sidewall opening.

W. A well system, the well system including: 1) a main wellbore located within a subterranean formation; 2) a lateral wellbore extending from the main wellbore; and 3) a multilateral junction sleeve assembly located in the main wellbore proximate a junction between the main wellbore and the lateral wellbore, the multilateral junction sleeve assembly including: a) a multilateral deflector assembly, the multilateral deflector assembly including a deflector body having a deflector face and an opening extending therethrough; b) a deflector assembly sleeve coupled to an uphole end of the deflector body, the deflector assembly sleeve having a sidewall opening in a sidewall thereof aligned with the deflector face; and c) degradable material positioned on a radial exterior surface of the deflector assembly sleeve covering the sidewall opening, the degradable material configured to degrade over time and uncover the sidewall opening.

X. A method for forming a well system, the method including: 1) forming a main wellbore within a subterranean formation; 2) forming a lateral wellbore off of the main wellbore; and 3) positioning a multilateral junction sleeve assembly in the main wellbore proximate a junction between the main wellbore and the lateral wellbore, the multilateral junction sleeve assembly including: a) a multilateral deflector assembly, the multilateral deflector assembly including a deflector body having a deflector face and an opening extending therethrough; b) a deflector assembly sleeve coupled to an uphole end of the deflector body, the deflector assembly sleeve having a sidewall opening in a sidewall thereof aligned with the deflector face; and c) degradable material positioned on a radial exterior surface of the deflector assembly sleeve covering the sidewall opening, the degradable material configured to degrade over time and uncover the sidewall opening.

Y. A multilateral lateral bore completion, the multilateral lateral bore completion including: 1) a tubular having a first end and a second end; 2) first and second packers located on a radial exterior surface of the tubular, the first and second packers configured to move from a radially retracted state to a radially extended state to engage with a wellbore tubular and separate the tubular into first and second production zones; 3) a first interval control valve located in the tubular in the first production zone and a second interval control valve located in the tubular in the second production zone; and 4) an expandable metal anchor positioned on the radial exterior surface of the tubular, the expandable metal anchor including a metal configured to expand in response to hydrolysis to axially and rotationally fix the tubular with respect to the wellbore tubular.

Z. A well system, the well system including: 1) a main wellbore located within a subterranean formation; 2) a lateral wellbore extending from the main wellbore; and 3) a multilateral lateral bore completion located in the lateral wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; and d) an expandable metal anchor positioned on the radial exterior surface of the tubular, the expandable metal anchor including a metal configured to expand in response to hydrolysis to axially and rotationally fix the tubular with respect to the wellbore tubular.

AA. A method for forming a well system, the method including: 1) forming a main wellbore within a subterranean formation; 2) forming a lateral wellbore off of the main wellbore; and 3) positioning a multilateral lateral bore completion in the main wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; and d) an expandable metal anchor positioned on the radial exterior surface of the tubular, the expandable metal anchor including a metal configured to expand in response to hydrolysis to axially and rotationally fix the tubular with respect to the wellbore tubular.

BB. A multilateral lateral bore completion, the multilateral lateral bore completion including: 1) a tubular having a first end and a second end; 2) first and second packers located on a radial exterior surface of the tubular, the first and second packers configured to move from a radially retracted state to a radially extended state to engage with a wellbore tubular and separate the tubular into first and second production zones; 3) a first interval control valve located in the tubular in the first production zone and a second interval control valve located in the tubular in the second production zone; 4) a transition joint coupled to the first end of the tubular, the transition joint configured to extend out into a main wellbore; and 5) an expandable metal anchor positioned on the radial exterior surface of the transition joint, the expandable metal anchor including a metal configured to expand in response to hydrolysis to axially and rotationally fix the transition joint with respect to the wellbore tubular.

CC. A well system, the well system including: 1) a main wellbore located within a subterranean formation; 2) a lateral wellbore extending from the main wellbore; and 3) a multilateral lateral bore completion located in the lateral wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; d) a transition joint coupled to the first end of the tubular, the transition joint configured to extend out into a main wellbore; and e) an expandable metal anchor positioned on the radial exterior surface of the transition joint, the expandable metal anchor including a metal configured to expand in response to hydrolysis to axially and rotationally fix the transition joint with respect to the wellbore tubular.

DD. A method for forming a well system, the method including: 1) forming a main wellbore within a subterranean formation; 2) forming a lateral wellbore off of the main wellbore; and 3) positioning a multilateral lateral bore completion in the main wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; d) a transition joint coupled to the first end of the tubular, the transition joint configured to extend out into a main wellbore; and c) an expandable metal anchor positioned on the radial exterior surface of the transition joint, the expandable metal anchor including a metal configured to expand in response to hydrolysis to axially and rotationally fix the transition joint with respect to the wellbore tubular.

EE. A multilateral lateral bore completion, the multilateral lateral bore completion including: 1) a tubular having a first end and a second end; 2) first and second packers located on a radial exterior surface of the tubular, the first and second packers configured to move from a radially retracted state to a radially extended state to engage with a wellbore tubular and separate the tubular into first and second production zones; 3) a first interval control valve located in the tubular in the first production zone and a second interval control valve located in the tubular in the second production zone; 4) a transition sleeve assembly coupled to the first end of the tubular, the transition sleeve assembly including a transition sleeve including a transition sleeve body having sidewall opening in a sidewall thereof, the sidewall opening configured to align with a deflector face of a multilateral deflector assembly as a portion of the transition sleeve extends out into a lateral wellbore; and 5) degradable material positioned on a radial exterior surface of the transition sleeve body covering the sidewall opening, the degradable material configured to degrade over time and uncover the sidewall opening.

FF. A well system, the well system including: 1) a main wellbore located within a subterranean formation; 2) a lateral wellbore extending from the main wellbore; and 3) a multilateral lateral bore completion located in the lateral wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; d) a transition sleeve assembly coupled to the first end of the tubular, the transition sleeve assembly including a transition sleeve including a transition sleeve body having sidewall opening in a sidewall thereof, the sidewall opening configured to align with a deflector face of a multilateral deflector assembly as a portion of the transition sleeve extends out into a lateral wellbore; and c) degradable material positioned on a radial exterior surface of the transition sleeve body covering the sidewall opening, the degradable material configured to degrade over time and uncover the sidewall opening.

GG. A method for forming a well system, the method including: 1) forming a main wellbore within a subterranean formation; 2) forming a lateral wellbore off of the main wellbore; and 3) positioning a multilateral lateral bore completion in the main wellbore, the multilateral lateral bore completion including: a) a tubular having a first end and a second end; b) first and second packers located on a radial exterior surface of the tubular, the first and second packers configured to move from a radially retracted state to a radially extended state to engage with a wellbore tubular and separate the tubular into first and second production zones; c) a first interval control valve located in the tubular in the first production zone and a second interval control valve located in the tubular in the second production zone; d) a transition sleeve assembly coupled to the first end of the tubular, the transition sleeve assembly including a transition sleeve including a transition sleeve body having sidewall opening in a sidewall thereof, the sidewall opening configured to align with a deflector face of a multilateral deflector assembly as a portion of the transition sleeve extends out into a lateral wellbore; and e) degradable material positioned on a radial exterior surface of the transition sleeve body covering the sidewall opening, the degradable material configured to degrade over time and uncover the sidewall opening.

HH. A multilateral junction assembly, the multilateral junction assembly including: 1) a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and 2) degradable material positioned on a radial surface of the transition sleeve body covering the sidewall opening, the degradable material configured to degrade over time and uncover the sidewall opening.

II. A well system, well system: 1) a main wellbore located within a subterranean formation; 2) a lateral wellbore extending from the main wellbore; and 3) a multilateral junction assembly located at a junction between the main wellbore and lateral wellbore, the multilateral junction assembly at least partially insert within the lateral wellbore, the multilateral junction assembly including: a) a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and b) degradable material positioned on a radial surface of the transition sleeve body covering the sidewall opening, the degradable material configured to degrade over time and uncover the sidewall opening.

JJ. A method for forming a well system, the method including: 1) forming a main wellbore within a subterranean formation; 2) forming a lateral wellbore off of the main wellbore; and 3) positioning a multilateral junction assembly at a junction between the main wellbore and lateral wellbore, the multilateral junction assembly at least partially insert within the lateral wellbore, the multilateral junction assembly including: a) a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and b) degradable material positioned on a radial surface of the transition sleeve body covering the sidewall opening, the degradable material configured to degrade over time and uncover the sidewall opening.

Aspects A through JJ may have one or more of the following additional elements in combination: Element 1: wherein the opening includes a first smaller width opening and a second larger width opening, and further wherein the degradable material is located in the second larger width opening to fix the smaller assembly relative to the whipstock body. Element 2: wherein the smaller assembly includes a main portion and a smaller assembly clutch ring portion, the smaller assembly clutch ring portion located in the second larger width opening and surrounded by the degradable material to axially and rotationally fix the smaller assembly relative to the degradable material. Element 3: wherein the degradable material includes one or more degradable material outer diameter clutch ring portions, the one or more degradable material outer diameter clutch ring portions configured to engage with one or more slots in the second larger opening to rotationally couple the degradable material to the whipstock body. Element 4: wherein the degradable material has one or more circulation flutes extending along a length thereof, the one or more circulation flutes configured to permit reactive fluid to circulate past the degradable material to permit the degradable material to degrade over time and allow the smaller assembly to release from the whipstock body. Element 5: wherein the degradable material is a metal based degradable material. Element 6: wherein the metal based degradable material is an expandable metal configured to expand in response to hydrolysis and then degrade to allow the smaller assembly to release from the whipstock body. Element 7: wherein the expandable metal is configured to expand in response to hydrolysis and after the hydrolysis has completed then degrade to allow the smaller assembly to release from the whipstock body. Element 8: wherein the degradable material is a polymer based degradable material. Element 9: wherein the smaller assembly includes one or more flow ports therein, and further wherein a coupling mechanism removably couples the larger bit assembly to the whipface of the whipstock body. Element 11: further including circulating reactive fluid about the degradable material to permit the degradable material to degrade and allow the smaller assembly to release from the whipstock body. Element 12: wherein a coupling mechanism removably couples the larger bit assembly to the whipface of the whipstock body, and further including sliding the smaller assembly relative to the larger bit assembly to form the combined bit assembly after the smaller assembly has released from the whipstock body, and then applying force to the combined bit assembly to shear the coupling mechanism and release the two part milling and running tool from the multilateral whipstock assembly. Element 13: further including milling casing located within the main wellbore using the combined bit assembly after shearing the coupling mechanism. Element 14: further including drilling a lateral wellbore off of the main wellbore using the combined bit assembly after shearing the coupling mechanism. Element 15: wherein the opening includes a first smaller width opening and a second larger width opening, and further wherein the degradable material is located in the second larger width opening. Element 16: further including a lock ring retaining the degradable material within the second larger width opening. Element 17: wherein the degradable material includes one or more degradable material outer diameter clutch ring portions, the one or more degradable material outer diameter clutch ring portions configured to engage with one or more slots in the second larger opening to rotationally couple the degradable material to the whipstock body. Element 18: wherein the degradable material includes one or more degradable material inner diameter slots, the one or more degradable material inner diameter slots configured to engage with one or more smaller assembly clutch ring portions of the smaller assembly to rotationally fix the smaller assembly relative to the degradable material. Element 19: wherein the degradable material has one or more circulation flutes extending along a length thereof, the one or more circulation flutes configured to permit reactive fluid to circulate past the degradable material to permit the degradable material to degrade over time and allow the smaller assembly to release from the whipstock body. Element 20: wherein the degradable material is a metal based degradable material. Element 21: wherein the metal based degradable material is an expandable metal configured to expand in response to hydrolysis and then degrade to allow the smaller assembly to release from the whipstock body. Element 22: wherein the expandable metal is configured to expand in response to hydrolysis and after the hydrolysis has completed then degrade to allow the smaller assembly to release from the whipstock body. Element 23: wherein the degradable material is a polymer based degradable material. Element 24: further including circulating reactive fluid about the degradable material to permit the degradable material to degrade. Element 25: wherein a two part milling and running tool is coupled to the multilateral whipstock assembly, the two part milling and running tool including: a conveyance; a smaller assembly coupled to an end of the conveyance; and a larger bit assembly slidably coupled to the conveyance, the smaller assembly and larger bit assembly configured to slidingly engage one another downhole to form a combined bit assembly and allow the smaller assembly to release from the whipstock body, the degradable material axially fixing the smaller assembly relative to the whipstock body, wherein the circulating permits the degradable material to degrade and allow the smaller assembly to release from the whipstock body. Element 26: wherein a coupling mechanism removably couples the larger bit assembly to the whipface of the whipstock body, and further including sliding the smaller assembly relative to the larger bit assembly to form the combined bit assembly after the smaller assembly has released from the whipstock body, and then applying force to the combined bit assembly to shear the coupling mechanism and release the two part milling and running tool from the multilateral whipstock assembly. Element 27: further including milling casing located within the main wellbore using the combined bit assembly after shearing the coupling mechanism. Element 28: further including drilling a lateral wellbore off of the main wellbore using the combined bit assembly after shearing the coupling mechanism. Element 29: wherein a coupling mechanism removably couples the larger bit assembly to the whipface of the whipstock body, and further including sliding the smaller assembly relative to the larger bit assembly to form the combined bit assembly, and then applying force to the combined bit assembly to shear the coupling mechanism and release the two part milling and running tool from the multilateral whipstock assembly. Element 30: further including milling casing located within the main wellbore using the combined bit assembly after shearing the coupling mechanism. Element 31: further including drilling a lateral wellbore off of the main wellbore using the combined bit assembly after shearing the coupling mechanism. Element 32: wherein the plug member is a flapper valve, the flapper valve configured to move to the second position and engage with a flapper valve seat after the degradable material had degraded to prevent the fluid from traversing the fluid passageway as it travels from the first end to the second end. Element 33: wherein the plug member is a ball, the ball configured to move to the second position and engage with a ball seat after the degradable material had degraded to prevent the fluid from traversing the fluid passageway as it travels from the first end to the second end. Element 34: wherein the degradable material has one or more openings located therein, the one or more openings allowing fluid to pass through the degradable material as the degradable material prevents the plug member from moving to the second position. Element 35: further including a delay coating surrounding the degradable material, the delay coating configured to increase a time needed for the degradable material to degrade. Element 36: wherein the degradable material is a metal based degradable material. Element 37: wherein the metal based degradable material is an expandable metal configured to expand in response to hydrolysis and then degrade to allow the plug member to move from the first position to the second position. Element 38: wherein the expandable metal is configured to expand in response to hydrolysis and after the hydrolysis has completed then degrade to allow the plug member to move from the first position to the second position. Element 39: wherein the degradable material is a polymer based degradable material. Element 40: wherein the fluid passageway has uphole and downhole diameter portions separated by a larger middle diameter portion, and further wherein the plug member is located in the larger middle diameter portion. Element 41: further including circulating reactive fluid about the degradable material to allow the plug member to move from the first position to the second position to prevent the fluid from traversing the fluid passageway as it travels from the first end to the second end. Element 42: wherein the wellbore is a main wellbore, and further including a multilateral whipstock assembly located in the main wellbore proximate a junction between the main wellbore and where a lateral wellbore is to be formed, wherein the multilateral fluid loss device is located within the multilateral whipstock assembly. Element 43: further including an orientation device coupled to the first end of the tubular, the orientation device configured to engage with a separate uphole device to rotationally orient the separate uphole device within the wellbore tubular. Element 44: wherein the expandable metal anchor is positioned between the first packer and the orientation device. Element 45: further including a control line coupler located on the tubular between the first packer and the expandable metal anchor. Element 46: wherein the control line coupler is an inductive coupler. Element 47: wherein the control line coupler is a wet mate coupler. Element 48: wherein the first packer is a first feed through packer, and further wherein a control line extends from the control line coupler through the first feed through packer to the first interval control valve. Element 49: wherein the second packer is a second feedthrough packer, and further wherein the control line extends from the control line coupler through the first feed through packer and the second feed through packer to the second interval control valve. Element 50: further including a float shoe located at the second end. Element 51: wherein the expandable metal anchor is configured to go from metal to micron-scale particles that are larger and lock together. Element 52: further including subjecting the expandable metal anchor to reactive fluid, the reactive fluid causing the metal of the expandable metal anchor to expand in response to hydrolysis to form an expanded metal anchor fixing the multilateral mainbore completion in the main wellbore. Element 53: further including an expandable metal anchor positioned on a radial exterior surface of the deflector body, the expandable metal anchor including a metal configured to expand in response to hydrolysis to axially and rotationally fix the multilateral deflector assembly within a wellbore tubular. Element 54: wherein the degradable material coupling mechanism is a metal based degradable material coupling mechanism. Element 55: wherein the metal based degradable material coupling mechanism is an expandable metal coupling mechanism configured to expand in response to hydrolysis and then degrade to allow the running tool to release from the multilateral deflector assembly. Element 56: wherein the expandable metal coupling mechanism is configured to expand in response to hydrolysis and after the hydrolysis has completed then degrade to allow the running tool to release from the multilateral deflector assembly. Element 57: wherein the expandable metal coupling mechanism and the expandable metal anchor are a single unitary layer of expandable metal including the metal configured to expand in response to hydrolysis, the single unitary layer of expandable metal configured to degrade to allow the running tool to release from the multilateral deflector assembly while forming an expanded metal anchor to axially and rotationally fix the multilateral deflector assembly within a wellbore tubular. Element 58: wherein the expanded metal anchor is configured to not extend uphole of the deflector face. Element 59: wherein the degradable material coupling mechanism is a polymer based degradable material coupling mechanism. Element 60: wherein the degradable material coupling mechanism includes a first sleeve portion coupled to the multilateral deflector assembly and a second post portion coupling the running tool with the first sleeve portion. Element 61: wherein the running tool includes one or more flow ports configured to provide reactive fluid to the degradable material coupling mechanism. Element 62: further including an expandable metal anchor positioned on a radial exterior surface of the deflector body, the expandable metal anchor including a metal configured to expand in response to hydrolysis to axially and rotationally fix the multilateral deflector assembly within a wellbore tubular, wherein the degradable material coupling mechanism is an expandable metal coupling mechanism configured to expand in response to hydrolysis and then degrade to allow the running tool to release from the multilateral deflector assembly, and further wherein the expandable metal coupling mechanism and the expandable metal anchor are a single unitary layer of expandable metal including the metal configured to expand in response to hydrolysis, the single unitary layer of expandable metal configured to degrade to allow the running tool to release from the multilateral deflector assembly while forming an expanded metal anchor to axially and rotationally fix the multilateral deflector assembly within a wellbore tubular. Element 63: further including subjecting the single unitary layer of expandable metal to reactive fluid, the reactive fluid causing the single unitary layer of expandable metal to degrade to allow the running tool to release from the multilateral deflector assembly while forming an expanded metal anchor to axially and rotationally fix the multilateral deflector assembly within a wellbore tubular. Element 64: wherein the expandable metal anchor is positioned on the radial exterior surface of the deflector assembly sleeve uphole and downhole the sidewall opening, the expandable metal anchor configured to fix the multilateral deflector assembly within a wellbore tubular uphole and downhole the sidewall opening. Element 65: further including a layer of degradable material positioned on the radial exterior surface of the deflector assembly sleeve covering the sidewall opening. Element 66: wherein the layer of degradable material is a layer of polymer based degradable material. Element 67: wherein the layer of degradable material is a layer of metal based degradable material. Element 68: wherein the layer of metal based degradable material is a layer of expandable metal configured to expand in response to hydrolysis and then degrade to uncover the sidewall opening. Element 69: wherein the layer of expandable metal is configured to expand in response to hydrolysis and after the hydrolysis has completed then degrade to uncover the sidewall opening. Element 70:

wherein the layer of expandable metal and the expandable metal anchor are a single unitary layer of expandable metal including the metal configured to expand in response to hydrolysis, the single unitary layer of expandable metal configured to degrade around the sidewall opening and form an expanded metal anchor outside of the sidewall opening. Element 71: further including an uphole orientation feature coupled to an uphole end of the deflector assembly sleeve and a downhole orientation feature coupled to a downhole end of the multilateral deflector assembly. Element 72: wherein the multilateral deflector assembly includes one or more flow ports located therein between the deflector face and the downhole orientation feature. Element 73: wherein the expandable metal anchor is positioned on the radial exterior surface of the deflector assembly sleeve uphole and downhole the sidewall opening, and further wherein a layer of degradable material is positioned on the radial exterior surface of the deflector assembly sleeve covering the sidewall opening, the layer of degradable material being a layer of expandable metal configured to expand in response to hydrolysis and then degrade to uncover the sidewall opening, and further wherein the layer of expandable metal and the expandable metal anchor are a single unitary layer of expandable metal including the metal configured to expand in response to hydrolysis, the single unitary layer of expandable metal configured to degrade around the sidewall opening and form an expanded metal anchor outside of the sidewall opening. Element 74: further including subjecting the single unitary layer of expandable metal to reactive fluid, the reactive fluid causing the single unitary layer of expandable metal to degrade around the sidewall opening and form an expanded metal anchor outside of the sidewall opening. Element 75: further including an expandable metal anchor positioned on a radial exterior surface of the deflector body, the expandable metal anchor including a metal configured to expand in response to hydrolysis to axially and rotationally fix the multilateral deflector assembly within a wellbore tubular. Element 76: wherein the expandable metal anchor is a layer of expandable metal positioned on a radial exterior surface of the deflector body and a radial exterior surface of the deflector assembly sleeve uphole and downhole of the sidewall opening. Element 77: wherein the degradable material is a metal based degradable material. Element 78: wherein the metal based degradable material is expandable metal configured to expand in response to hydrolysis and then degrade to uncover the sidewall opening. Element 79: wherein the expandable metal is configured to expand in response to hydrolysis and after the hydrolysis has completed then degrade to uncover the sidewall opening. Element 80: wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening. Element 81: wherein the single unitary layer of expandable metal is located axially and radially below the sidewall opening. Element 82: wherein the degradable material is a polymer based degradable material. Element 83: further including an expandable metal anchor positioned on a radial exterior surface of the deflector body, the expandable metal anchor including a metal configured to expand in response to hydrolysis to axially and rotationally fix the multilateral deflector assembly within a wellbore tubular. Element 84: further including a layer of expandable metal positioned on a radial exterior surface of the deflector body and a radial exterior surface of the deflector assembly sleeve uphole and downhole the sidewall opening, the layer of expandable metal including a metal configured to expand in response to hydrolysis, wherein the degradable material is expandable metal configured to expand in response to hydrolysis and then degrade to uncover the sidewall opening, wherein the layer of expandable metal and the expandable metal are a single unitary layer of expandable metal including the metal configured to expand in response to hydrolysis, the single unitary layer of expandable metal configured to degrade around the sidewall opening and form an expanded metal anchor outside of the sidewall opening. Element 85: further including subjecting the single unitary layer of expandable metal to reactive fluid, the reactive fluid causing the single unitary layer of expandable metal to degrade around the sidewall opening and form an expanded metal anchor outside of the sidewall opening. Element 88: further including a transition joint coupled to the first end of the tubular, the transition joint configured to extend out into a main wellbore. Element 87: wherein the expandable metal anchor is positioned between the first packer and the transition joint. Element 88: wherein the expandable metal anchor is positioned on the radial exterior surface of the transition joint. Element 89: further including a control line coupler located on the tubular between the first packer and the expandable metal anchor. Element 90: wherein the control line coupler is an inductive coupler. Element 91: wherein the control line coupler is a wet mate coupler. Element 91: wherein the first packer is a first feedthrough packer, and further wherein a control line extends from the control line coupler through the first feedthrough packer to the first interval control valve. Element 92: wherein the second packer is a second feedthrough packer, and further wherein the control line extends from the control line coupler through the first feedthrough packer and the second feedthrough packer to the second interval control valve. Element 93: wherein the expandable metal anchor is configured to go from metal to micron-scale particles that are larger and lock together. Element 94: further including subjecting the expandable metal anchor to reactive fluid, the reactive fluid causing the metal of the expandable metal anchor to expand in response to hydrolysis to form an expanded metal anchor fixing the multilateral lateral bore completion in the lateral wellbore. Element 95: wherein the expandable metal anchor is a first expandable metal anchor, and further including a second expandable metal anchor positioned on a radial exterior surface of the tubular. Element 96: further including a control line coupler located on the tubular between the first packer and the expandable metal anchor. Element 97: wherein the control line coupler is an inductive coupler. Element 98: wherein the control line coupler is a wet mate coupler. Element 99: wherein the first packer is a first feedthrough packer, and further wherein a control line extends from the control line coupler through the first feedthrough packer to the first interval control valve. Element 100: wherein the second packer is a second feedthrough packer, and further wherein the control line extends from the control line coupler through the first feedthrough packer and the second feedthrough packer to the second interval control valve. Element 101: wherein the transition joint has a transition joint diameter and the tubular has a tubular diameter, and further wherein the transition joint diameter is greater than the tubular diameter. Element 102: further including first and second end rings on opposing ends of the expandable metal anchor. Element 103: wherein the expandable metal anchor is configured to go from metal to micron-scale particles that are larger and lock together. Element 104: further including subjecting the expandable metal anchor to reactive fluid, the reactive fluid causing the metal of the expandable metal anchor to expand in response to hydrolysis to form an expanded metal anchor fixing the transition joint in the lateral wellbore. Element 105: further including an expandable metal anchor positioned on a radial exterior surface of the transition sleeve body, the expandable metal anchor including a metal configured to expand in response to hydrolysis to axially and rotationally fix the multilateral lateral bore completion within a wellbore tubular. Element 106: wherein the expandable metal anchor is a layer of expandable metal positioned on a radial exterior surface of the transition sleeve body uphole and downhole of the sidewall opening. Element 107: wherein the degradable material is a polymer based degradable material. Element 108: wherein the degradable material is a metal based degradable material. Element 109: wherein the metal based degradable material is expandable metal configured to expand in response to hydrolysis and then degrade to uncover the sidewall opening. Element 110: wherein the expandable metal is configured to expand in response to hydrolysis and after the hydrolysis has completed then degrade to uncover the sidewall opening. Element 111: wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening. Element 112: wherein the single unitary layer of expandable metal is located axially and radially below the sidewall opening. Element 113: further including: an orientation feature coupled to the transition sleeve body uphole or downhole of the sidewall opening; an orientation device coupled to an uphole end of the transition sleeve body, the orientation device configured to engage with a separate uphole device to rotationally orient the separate uphole device within the wellbore tubular; and a control line coupler located on the transition sleeve body between the orientation device and the sidewall opening. Element 114: further including a layer of expandable metal positioned on a radial exterior surface of the transition sleeve body uphole and downhole the sidewall opening, the layer of expandable metal including a metal configured to expand in response to hydrolysis, wherein the degradable material is expandable metal configured to expand in response to hydrolysis and then degrade to uncover the sidewall opening, wherein the layer of expandable metal and the expandable metal are a single unitary layer of expandable metal including the metal configured to expand in response to hydrolysis, the single unitary layer of expandable metal configured to degrade around the sidewall opening and form an expanded metal anchor outside of the sidewall opening. Element 115: further including subjecting the single unitary layer of expandable metal to reactive fluid, the reactive fluid causing the single unitary layer of expandable metal to degrade around the sidewall opening and form an expanded metal anchor outside of the sidewall opening. Element 116: further including an expandable metal anchor positioned on a radial exterior surface of the transition sleeve body, the expandable metal anchor including a metal configured to expand in response to hydrolysis to axially and rotationally fix the transition sleeve assembly within the lateral wellbore. Element 117: wherein the expandable metal anchor is a layer of expandable metal positioned on a radial exterior surface of the transition sleeve uphole and downhole of the sidewall opening. Element 118: wherein the expandable metal anchor is configured to engage with the lateral wellbore and the main wellbore to form at least a part of a Level-5 junction. Element 119: wherein the degradable material is a polymer based degradable material. Element 120: wherein the degradable material is a metal based degradable material. Element 121: wherein the metal based degradable material is expandable metal configured to expand in response to hydrolysis and then degrade to uncover the sidewall opening. Element 122: wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening. Element 123: further including first and second end rings on opposing ends of the single unitary layer of expandable metal. Element 124: further including a multilateral lateral bore completion coupled to a downhole end of the transition sleeve assembly, the multilateral lateral bore completion including: a tubular having a first end and a second end; first and second packers located on a radial exterior surface of the tubular, the first and second packers configured to move from a radially retracted state to a radially extended state to engage with a wellbore tubular and separate the tubular into first and second production zones; and a first interval control valve located in the tubular in the first production zone and a second interval control valve located in the tubular in the second production zone. Element 125: further including an orientation feature coupled to the transition sleeve body within 5 m uphole or downhole of the sidewall opening, the orientation feature configured to provide proper orientation and space out of the transition sleeve assembly. Element 126: wherein the orientation feature is a collet finger. Element 127: further including an orientation device coupled to an uphole end of the transition sleeve body, the orientation device configured to engage with a separate uphole device to rotationally orient the separate uphole device within the main wellbore. Element 128: further including a control line coupler located on the transition sleeve body between the orientation device and the sidewall opening. Element 129: wherein the control line coupler is an inductive coupler. Element 130: wherein the control line coupler is a wet mate coupler.

Those skilled in the art to which this application relates will appreciate that other and further additions, deletions, substitutions and modifications may be made to the described embodiments.

What is claimed is:

1. A multilateral junction assembly, comprising:

a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and a metal based degradable material positioned on a radial surface of the transition sleeve body covering the sidewall opening, the degradable material configured to degrade over time and uncover the sidewall opening, further including an expandable metal anchor positioned on a radial exterior surface of the transition sleeve uphole and downhole of the sidewall opening, the expandable metal anchor including a metal configured to expand in response to hydrolysis to axially and rotationally fix the transition sleeve assembly within the lateral wellbore, wherein the metal based degradable material is expandable metal configured to expand in response to hydrolysis and then degrade to uncover the sidewall opening, and further wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening.

2. The multilateral junction assembly as recited in claim 1, wherein the expandable metal anchor is configured to engage with the lateral wellbore and the main wellbore to form at least a part of a Level-5 junction.

3. The multilateral junction assembly as recited in claim 1, further including first and second end rings on opposing ends of the single unitary layer of expandable metal.

4. The multilateral junction assembly as recited in claim 1, further including a multilateral lateral bore completion coupled to a downhole end of the transition sleeve assembly, the multilateral lateral bore completion including:

a tubular having a first end and a second end;

first and second packers located on a radial exterior surface of the tubular, the first and second packers configured to move from a radially retracted state to a radially extended state to engage with a wellbore tubular and separate the tubular into first and second production zones; and a first interval control valve located in the tubular in the first production zone and a second interval control valve located in the tubular in the second production zone.

5. The multilateral junction assembly as recited in claim 4, further including an orientation feature coupled to the transition sleeve body within 5 m uphole or downhole of the sidewall opening, the orientation feature configured to provide proper orientation and space out of the transition sleeve assembly.

6. The multilateral junction assembly as recited in claim 5, wherein the orientation feature is a collet finger.

7. The multilateral junction assembly as recited in claim 6, further including an orientation device coupled to an uphole end of the transition sleeve body, the orientation device configured to engage with a separate uphole device to rotationally orient the separate uphole device within the main wellbore.

8. The multilateral junction assembly as recited in claim 7, further including a control line coupler located on the transition sleeve body between the orientation device and the sidewall opening.

9. The multilateral junction assembly as recited in claim 8, wherein the control line coupler is an inductive coupler.

10. The multilateral junction assembly as recited in claim 8, wherein the control line coupler is a wet mate coupler.

11. A well system, comprising:

a main wellbore located within a subterranean formation;

a lateral wellbore extending from the main wellbore; and a multilateral junction assembly located at a junction between the main wellbore and lateral wellbore, the multilateral junction assembly at least partially insert within the lateral wellbore, the multilateral junction assembly including:

a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and a metal based degradable material positioned on a radial surface of the transition sleeve body covering the sidewall opening, the degradable material configured to degrade over time and uncover the sidewall opening, further including an expandable metal anchor positioned on a radial exterior surface of the transition sleeve uphole and downhole of the sidewall opening, the expandable metal anchor including a metal configured to expand in response to hydrolysis to axially and rotationally fix the transition sleeve assembly within the lateral wellbore, wherein the metal based degradable material is expandable metal configured to expand in response to hydrolysis and then degrade to uncover the sidewall opening, and further wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening.

12. The well system as recited in claim 11, wherein the expandable metal anchor is configured to engage with the lateral wellbore and the main wellbore to form at least a part of a Level-5 junction.

13. The well system as recited in claim 11, further including first and second end rings on opposing ends of the single unitary layer of expandable metal.

14. The well system as recited in claim 11, further including a multilateral lateral bore completion coupled to a downhole end of the transition sleeve assembly, the multilateral lateral bore completion including:

a tubular having a first end and a second end;

first and second packers located on a radial exterior surface of the tubular, the first and second packers configured to move from a radially retracted state to a radially extended state to engage with a wellbore tubular and separate the tubular into first and second production zones; and a first interval control valve located in the tubular in the first production zone and a second interval control valve located in the tubular in the second production zone.

15. The well system as recited in claim 14, further including an orientation feature coupled to the transition sleeve body within 5 m uphole or downhole of the sidewall opening, the orientation feature configured to provide proper orientation and space out of the transition sleeve assembly.

16. The well system as recited in claim 15, wherein the orientation feature is a collet finger.

17. The well system as recited in claim 16, further including an orientation device coupled to an uphole end of the transition sleeve body, the orientation device configured to engage with a separate uphole device to rotationally orient the separate uphole device within the main wellbore.

18. The well system as recited in claim 17, further including a control line coupler located on the transition sleeve body between the orientation device and the sidewall opening.

19. The well system as recited in claim 18, wherein the control line coupler is an inductive coupler.

20. The well system as recited in claim 18, wherein the control line coupler is a wet mate coupler.

21. A method for forming a well system, comprising:

forming a main wellbore within a subterranean formation;

forming a lateral wellbore off of the main wellbore; and positioning a multilateral junction assembly at a junction between the main wellbore and lateral wellbore, the multilateral junction assembly at least partially insert within the lateral wellbore, the multilateral junction assembly including:

a transition sleeve assembly, the transition sleeve assembly including a transition sleeve body having a sidewall opening in a sidewall thereof, the sidewall opening configured to align with a main wellbore when the transition sleeve assembly is at least partially insert within a lateral wellbore; and a metal based degradable material positioned on a radial surface of the transition sleeve body covering the sidewall opening, the degradable material configured to degrade over time and uncover the sidewall opening further including an expandable metal anchor positioned on a radial exterior surface of the transition sleeve uphole and downhole of the sidewall opening, the expandable metal anchor including a metal configured to expand in response to hydrolysis to axially and rotationally fix the transition sleeve assembly within the lateral wellbore, wherein the metal based degradable material is expandable metal configured to expand in response to hydrolysis and then degrade to uncover the sidewall opening, and further wherein the layer of expandable metal and the metal based degradable material are a single unitary layer of expandable metal including the metal configured to expand in response to hydrolysis, the single unitary layer of expandable metal configured to degrade around the sidewall opening and form an expanded metal anchor outside of the sidewall opening.

* * * * *